US005328818A

United States Patent [19]

Fukuzawa et al.

[11] Patent Number: 5,328,818

[45] Date of Patent: Jul. 12, 1994

[54] SILVER HALIDE COLOR PHOTOGRAPHIC LIGHT-SENSITIVE MATERIAL

[75] Inventors: Hiroshi Fukuzawa; Kohzaburoh Yamada; Keiji Mihayashi; Koji Tamoto; Shigeru Shibayama; Minoru Sato; Kiyoshi Nakazyo, all of Minami-ashigara, Japan

[73] Assignee: Fuji Photo Film Co., Ltd., Kanagawa, Japan

[21] Appl. No.: 945,933

[22] Filed: Sep. 17, 1992

[30] Foreign Application Priority Data

Sep. 18, 1991 [JP] Japan ..... 3-265534
Apr. 20, 1992 [JP] Japan ..... 4-125388

[51] Int. Cl.[5] ..... G03C 1/46

[52] U.S. Cl. ..... 430/505; 430/507; 430/517; 430/522; 430/557

[58] Field of Search ..... 430/517, 522, 507, 505, 430/557, 957, 592, 594

[56] References Cited

U.S. PATENT DOCUMENTS 5,098,818 3/1992 Ito et al. ..... 430/517
5,147,769 9/1992 Toya et al. ..... 430/502
5,208,137 5/1993 Usagawa et al. ..... 430/522
5,212,052 5/1993 Sakanoe et al. ..... 430/557

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material includes red-, green- and blue-sensitive silver halide emulsion layers, and a non-light-sensitive layer, and contains a dye of the following formula (I). The emulsion layer or the non-light-sensitive layer contains a yellow coupler of the following formula (1) or (2), or an acylacetamide type yellow coupler having an acyl group of the following formula (Y):

Formula (I)

where X and Y represent an electron attractive group, or when coupled with each other, XY represents an acidic nucleus, Ar represents a phenyl group or a heterocyclic group, and $L^1$, $L^2$ and $L^3$ represent a methine group, Formula (1)

Formula (2)

where $X_1$ and $X_2$ represent an alkyl group, an aryl group, or a heterocyclic group, $X_3$ represents an organic group which forms a nitrogen-containing heterocyclic group together with >N—, Y represents an aryl group or a heterocyclic group, and Z represents a split-off group, Formula (Y)

where $D^1$ represents a monovalent group, and Q represents a non-metallic atomic group required to form, together with the C, a 3- to 5-membered hydrocarbon ring or a 3- to 5-membered heterocyclic ring.

11 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material having improved photographic performances, storage stability, fastness of a color image obtained, and image quality.

2. Description of the Related Art

In manufacturing silver halide color photographic light-sensitive materials, it is well-known to employ a technique of providing a light-absorption layer, such as a light-absorbing filter, which absorbs light of a particular wavelength for the purpose of preventing halations or adjusting the sensitivity. At present, most generally used are a technique of cutting off the intrinsic sensitivities of green- and red-sensitive emulsions by providing an yellow filter layer at a position closer to the support than the blue-sensitive layer and further from the support than the other color-sensitive layers, and a technique of providing an anti-halation layer on the side closer to the support than the light-sensitive emulsion layers for prevention of unnecessary light scattering. In these light absorption layers, colloidal fine silver grains are usually used from a practical point of view. The colloidal silver grains, however, have side effects such as creating fog harmful to the adjacent emulsion layer, increasing the amount of fog during the storage of the light sensitive material, and decreasing the desilverization speed, as known. It is conventionally necessary for prevention of the fog to add an anti-foggant as disclosed in JP-A-62-32460 or JP-A-1-219743, or to introduce an interlayer mainly consisting of gelatine between the yellow filter layer and emulsion layer. Addition of an anti-foggant also creates the problem of decreasing the sensitivity, and introduction of the interlayer increases the thickness of the emulsion layer, lowering the sharpness and increasing the number of layers applied to raise a production cost.

In order to solve the above-mentioned problems, it has been attempted to use an organic dye in place of colloidal silver for the filter layer, and such a technique is described in patents as will be described later. Harmful fog can be removed by using the dye; however, again, use of the dye entails side effects such as increment of $D_{min}$ due to a poor discoloring from the light-sensitive material, leaving unnecessary absorption after processing, and as variance of the photographic properties caused by diffusion of the dye into other layers during storage due to insufficient fixation of the dye to a particular layer to which the dye was added. Therefore, many efforts have been made to obtain a material which satisfies both performances, namely, discoloring property of dye, and fixation thereof to a particular layer.

For example, U.S. Pat. Nos. 2,548,564; 4,124,386 and 3,625,694 disclose techniques wherein a hydrophilic polymer having a charge opposite to dissociated anionic dye is provided, as a mordant, to co-exist with the dye in one layer, and the dye is localized in the layer by interaction of the polymer with the dye molecule.

Techniques for coloring a particular layer by use of a solid dye material insoluble in water, are disclosed in, for example, JP-A-56-12639, JP-A-55-155350, JP-A-55-155351, JP-A-63-27838, JP-A-63-197943, European Patents 15,601; 274,723; 276,566 and 299,435, and International Patent 88/04794. With the dye used in each of these patents, the desilverization speed can be increased without degrading the photographic properties; however, the desilverization speed achieved is still at an insufficient level, and there have been needs of the technique for further shortening the desilverization time.

Dye materials similar to that used in the present invention are disclosed in, for example, JP-A-63-64044, JP-A-1-196040, and JP-A-3-167546.

The dye materials disclosed in the above Patent Applications are not inactive in terms of photographic chemistry, and have been found to increase an amount of fog, and accordingly deteriorate the sensitivity when the light-sensitive material is stored for a long time. Further, these materials are not good in decoloring, and create color residue, or degrade the color-image fastness.

On the other hand, recently, the color-image fastness of silver halide color photographic light-sensitive materials have remarkably improved. Generally used is a silver halide color photographic light-sensitive material containing three types of color couplers which form yellow, magenta, and cyan dyes when coupled with an oxidized form of an aromatic primary amine color developing agent.

Of those mentioned above, benzoyl-type and pivaloylacetoanilide-type yellow couplers are known as yellow couplers. A great attention have been paid to the malondianilide-type yellow coupler disclosed in European Patent 447,920A, and the cycloalkanecarbonyl-type yellow coupler disclosed in European Patent 447,969A, in particular, since the formed dye of each of these couplers has a high molar extinction coefficient, and the color image thereof is fast with respect to humidity and heat.

However, it was found that introduction of the malondianilide-type yellow coupler and the cycloalkanecarbonyl-type yellow coupler increases the amount of fog more than that with a benzoyl- or pivaloyl-type yellow coupler, over a long period of time of storage. After many studies, it was further found that such an increase in the amount of fog is particularly remarkable in the case where the colloidal silver is used as a light absorption layer. The amount of fog can be decreased by adding a large amount of the anti-foggant mentioned above or the like, or by introducing an interlayer mainly consisting of gelatine; however this technique entails side effects such as variation of the sensitivity and degradation of the sharpness.

In connection with a malondianilide-type yellow coupler similar to that of the invention, French Patent 1,558,452, for example, discloses a so-called oxygen atom dissociation type coupler mainly consisting of a diffusion type, in which the coupling active site has a group which splits off via oxygen atom.

JP-A-1-250950 discloses a yellow coupler as a specific compound example.

Meanwhile, in connection with a malondianilide-type coupler similar to that of the invention, those which release development inhibiting compounds are disclosed as functional couplers in JP-A-52-696624, JP-A-52-82424, JP-A-57-151944, JP-A-2-250053, and the above-mentioned European Patent Application No. 447,920. However, neither of JP-A-52-82424 or JP-A-57-151944 disclose a specific compound, nor does JP-A-52-696624 states a specific advantage obtained by the coupler.

Although some of the couplers disclosed in these documents exhibit improved color-forming property, color image fastness, and color reproduction, a demand for further improvement is strong. Further, regarding the development inhibiting compound-releasing coupler, there is a demand for further enhancement of the image improvement effect.

SUMMARY OF THE INVENTION

Thus, a first object of the invention is to suppress generation of unnecessary fog and variation of the sensitivity, which occur when a light-sensitive material having a light absorption layer in which a dye is used in place of colloidal silver, is stored for a long time, by use of a malondianilide-type yellow coupler and/or a cycloalkanecarbonyl-type yellow coupler.

A second object of the invention is to provide a silver halide color photographic light-sensitive material having an improved storage stability and sharpness, which does not require an interlayer provided adjacent to the colloidal silver layer in the case where a malondianilide-type yellow coupler or a cycloalkanecarbonyl-type yellow coupler is used.

A third object of the invention is to provide a silver halide color photographic light-sensitive material exhibiting a high sensitivity and color-forming density, having less color residue, and improved color reproduction and color image fastness, in which a malondianilide-type yellow coupler and/or a cycloalkanecarbonyl-type yellow coupler is used.

To attain the above-described objects, the inventors of the present invention conducted intensive studies and found out that these objects can be achieved by a silver halide color photographic light-sensitive material comprising, on a support, at least one red-sensitive silver halide emulsion layer, at least one green-sensitive silver halide emulsion layer, at least one blue-sensitive silver halide emulsion layer, and at least one non-light-sensitive layer, said photographic light-sensitive material containing at least one dye represented by the following formula (I), and said color-sensitive silver halide emulsion layer or non-light-sensitive layer containing at least one of yellow couplers represented by the following formulas (1) and (2) and/or at least one acylacetamide-type yellow coupler having an acyl group represented by the following formula (Y):

Formula (I)

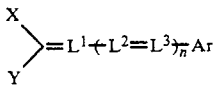

where X and Y each represents an electron attractive group, or when combined with each other, XY represents an acidic nucleus, Ar represents a phenyl group or a heterocyclic group, $L^1$, $L^2$, and $L^3$ each represents a methine group, and n is 0, 1, or 2;

Formula (1)

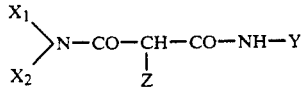

Formula (2)

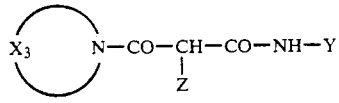

where $X_1$ and $X_2$ each represents an alkyl group, an aryl group, or a heterocyclic group, $X_3$ represents an organic group which forms a nitrogen-containing heterocyclic group together with >N—, Y represents an aryl group or a heterocyclic group, and Z represents a group which is split off when the coupler represented by said formulas reacts with an oxidized form of a developing agent;

Formula (Y)

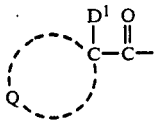

where $D^1$ represents a monovalent group, and Q represents a non-metallic atomic group required to form a 3- to 5-membered hydrocarbon ring or a 3- to 5-membered heterocyclic ring containing at least one heteroatom selected from the group consisting of N, S, O and P in its ring, together with the C, provided that $D^1$ is not a hydrogen atom, or does not form a ring bonded with Q.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

First, dyes represented by the formula (I) will be explained in detail below.

The electron attractive groups represented by X and Y include cyano group, nitro group, an alkoxycarbonyl group (for example, methoxycarbonyl, ethoxycarbonyl, hydroxyethoxycarbonyl, and t-amyloxycarbonyl), an aryloxycarbonyl (for example, phenoxycarbonyl, and 4-methoxyphenoxycarbonyl), an acyl group (for example, acetyl, pivaloyl, benzoyl, propionyl, 4-methinesulfonamidobenzoyl, 4-methoxy-3-methanesulfonamidobenzoyl, and 1-methylcyclopropylcarbonyl), a carbamoyl group (for example, N-ethylcarbamoyl, N,N-dimethylcarbamoyl, piperidine-1-carbonyl, and N-(3-methanesulfonamidophenyl)carbamoyl), and a sulfonyl group (for example, benzene sulfonyl, and p-toluenesulfonyl). Meanwhile, the acidic nucleus formed by X and Y bonded together should preferably be 5- or 6-membered cyclic groups. Preferable examples of the 5-membered cyclic groups are 2-pyrazolin-5-one, 2-isoxazolin-5-one, pyrazolin-3,5-dione, 2,5-dihydrofuran-2-one, and indan-1,3-dione, and those of the 6-membered cyclic groups are 1,2-dihydro-6-hydroxypyridin-2-one, barbituric acid, thiobarbituric acid, and coumarin.

The phenyl group represented by Ar is preferably a phenyl group substituted with an electron donative group. Preferable examples of the electron donative group are a dialkylamino group (for example, dimethylamino, di(ethoxycarbonylmethyl)amino, di(butoxycarbonylmethyl)amino, N-ethyl-N-ethoxycarbonylamino, di(cyanoethyl)amino, piperidinyl, pyrrolidinyl, morpholino, N-ethyl-N-β-methansulfonamidoethylamino, and N-ethyl-N-β-hydroxyethyl), hydroxy group, and alkoxy group (for example, methoxy, ethoxy, and ethoxycarbonylmethoxy).

The heterocyclic group represented by Ar is preferably a 5-membered one, and preferable examples thereof are pyrrol, indole, furan, and thiophene.

The methine group represented by $L^1$, $L^2$, or $L^3$ is preferably unsubstituted one, though they can have a substituent group.

The dye represented by the formula (I) of the invention is preferably oil-soluble. The term, oil-soluble, used herein means that the dye is substantially water-insoluble, and exhibits a solubility of 0.1 g or less in one liter of distilled water at 25° C.

In the present invention, the dye of formula (I) is preferably represented by the following formulas (II), (III), (IV), (V), or (VI):

Formula (II)

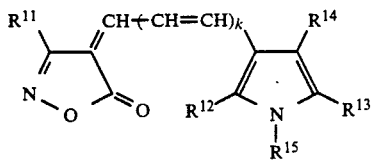

where $R^{11}$ represents a hydrogen atom, an alkyl group, an aryl group, —$COOR^{16}$, or —$CONR^{16}R^{17}$, each of $R^{12}$, $R^{13}$, and $R^{14}$ represents a hydrogen atom, an alkyl group, or an aryl group, and $R^{15}$ represents a hydrogen atom, an alkyl group, an aryl group or an amino group. $R^{13}$ and $R^{14}$ can combine with each other to form a 6-membered ring. $R^{16}$ and $R^{17}$ each represents a hydrogen atom, an alkyl group, or an aryl group. k is either 0 or 1.

Formula (III)

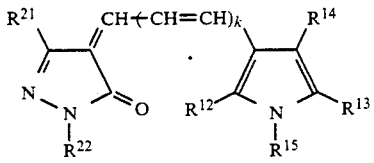

where $R^{21}$ represents a hydrogen atom, an alkyl group, an aryl group, —$COOR^{23}$, —$COR^{23}$, —$CONR^{23}R^{24}$, —CN, —$OR^{23}$, —$NR^{23}R^{24}$, or —$N(R^{23})COR^{24}$, $R^{22}$ represents a hydrogen atom, an alkyl group, an aryl group, or a heterocyclic group, each of $R^{12}$, $R^{13}$, $R^{14}$, and $R^{15}$ represents the same as defined above in the formula (II), and each of $R^{23}$ and $R^{24}$ represents a hydrogen atom, an alkyl group, or an aryl group. k is either 0 or 1.

Formula (IV)

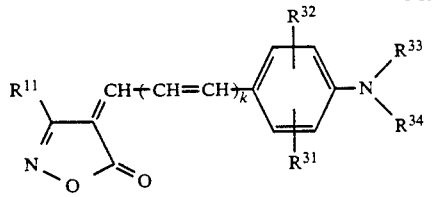

where $R^{11}$ represents the same defined as above in the formula (II), each of $R^{31}$ and $R^{32}$ represents a hydrogen atom, a halogen atom, an alkyl group, —$OR^{35}$, or —$COOR^{35}$, each of $R^{33}$ and $R^{34}$ represents a hydrogen atom, an alkyl group, or an aryl group. $R^{33}$ and $R^{34}$ may form a 5- or 6-membered ring. $R^{32}$ and $R^{33}$, and $R^{31}$ and $R^{34}$ respectively can combine with each other to form a 5- or 6-membered ring. $R^{35}$ represents a hydrogen atom, an alkyl group, or an aryl group. k is either 0 or 1.

Formula (V)

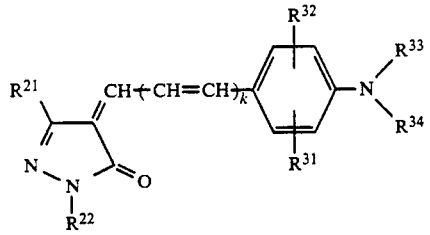

where $R^{21}$ and $R^{22}$ represent the same as defined in formula (III), and $R^{31}$, $R^{32}$, $R^{33}$ and $R^{34}$ represent the same as defined in formula (IV). k is either 0 or 1.

Formula (VI)

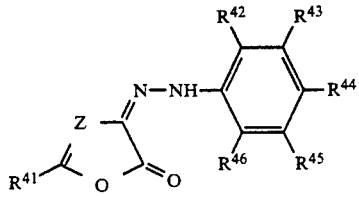

where Z represents a nitrogen atom or a methine group, $R^{41}$ represents a hydrogen atom, an alkyl group, an aryl group or a heterocyclic group, and $R^{42}$, $R^{43}$, $R^{44}$, $R^{45}$, and $R^{46}$ each represents a hydrogen atom, a halogen atom, an alkyl group, an aryl group, —$OR^{47}$, —$COOR^{47}$, —$COR^{47}$, —$CONR^{47}R^{48}$, —$SO_2NR^{47}R^{48}$, —$NR^{47}R^{48}$, —$SO_2NHCOR^{47}$, —$SO_2NHSO_2R^{47}$, —$CONHCOR^{47}$, —$CONHSO_2R^{47}$, —$N(R^{47})SO_2R^{48}$, or —$N(R^{47})COR^{48}$. $R^{47}$ and $R^{48}$ each represents a hydrogen atom, an alkyl group, an aryl group or a heterocyclic group.

The dyes represented by formulas (II), (III), (IV), (V), and (VI) will be described in detail below.

In the compounds represented by formulas (II), (III), (IV), (V), and (VI) of the invention, the alkyl group represented by each of $R^{11}$ and $R^{21}$ is preferably an alkyl group having 1 to 8 carbon atom, including, for example, methyl, ethyl, t-butyl, n-butyl, 1-methylcyclopropyl, chloromethyl, trifluoromethyl, and ethoxycarbonylmethyl. The aryl group represented by each of $R^{11}$ and $R^{21}$ is preferably an aryl group having 6 to 13 carbon atoms, including for example, phenyl, 4-methoxyphenyl, 4-acetylaminophenyl, 4-methanesulfonamidophenyl, and 4-benzenesulfonamidophenyl. The alkyl group represented by each of $R^{12}$, $R^{13}$ and $R^{14}$ is preferably be one having 1 to 6 carbon atoms, including, for example, methyl, ethyl, and propyl. The aryl group represented by each of $R^{12}$, $R^{13}$ and $R^{14}$ is preferably one having 6 to 13 carbon atoms, for example, phenyl.

The alkyl group represented by $R^{15}$ is preferably one having 1 to 18 carbon atoms, including, for example, methyl, ethyl, ethoxycarbomethyl, 1-ethoxycarbonylethyl, and 2-N,N-diethylamonoethyl. The aryl group represented by $R^{15}$ is preferably one having 6 to 22 carbon atoms, including, for example, phenyl, 2-methoxy-5-ethoxycarbonylphenyl, 4-{di(ethoxycarbonylmethyl) amino}carbonylphenyl, 4-n-octyloxycarbonylphenyl, 4-butanesulfonamidocarbonylphenyl-4-methanesulfonamidocarbonylphenyl, 4-sulfamoylphenyl, and 4-methansulfonamidophenyl.

The amino group represented by $R^{15}$ is preferably a dialkylamino group, including, for example, dimethylamino, diethylamino, N-methyl-N-ethoxycarbonylmethylamino, and di(propoxycarbonylmethylamino).

The 6-membered ring formed by $R^{13}$ and $R^{14}$ combined with each other is preferably a benzene ring.

The alkyl group represented by $R^{22}$ is preferably one having 1 to 18 carbon atoms, including, for example, methyl, ethyl, butyl, 2-cyanoethyl, 2-ethoxycarbonylethyl, 2-carbamoylethyl, and 2-octyloxyethyl.

The aryl group represented by $R^{22}$ is preferably one having 6 to 22 carbon atoms, including, for example, phenyl, 2-methoxy-5-ethoxycarbonylphenyl, 3,5-di(ethoxycarbonyl)phenyl, 4-{di(ethoxycarbonylamino)}carbonylphenyl, 4-n-octyloxycarbonylphenyl, 4-butanesulfonamidocarbonylphenyl, 4-methanesulfonamidocarbonylphenyl, 3-sulfamoylphenyl, 4-methansulfonamidophenyl, and 4-methanesulfonamidosulfonylphenyl.

The heterocyclic group represented by $R^{22}$ is, for example, pyridyl, pyrimidinyl, or sulfonyl.

The alkyl group represented by $R^{16}$, $R^{17}$, $R^{23}$, $R^{24}$, or $R^{35}$ is preferably an alkyl group having 1 to 12 carbon atoms, including for example, methyl, ethyl, dodecyl, cyclohexyl, ethoxycarbonylmethyl, hydroxyethyl, ethoxyethyl, 2-metanesulfonamidoethyl, cyanoethyl, 2,2,3,3-tetrafluoropropyl, chloroethyl, bromoethyl, acetoxyethyl, and dimethylaminomethyl.

The aryl group represented by each of $R^{16}$, $R^{17}$, $R^{23}$, $R^{24}$, and $R^{35}$ is preferably one having 1 to 12 carbon atoms, for example, phenyl, 4-methylphenyl, or 4-methoxyphenyl.

$R^{31}$ and $R^{32}$ each represents a hydrogen atom or a halogen atom (e.g., F, Cl, or Br). The alkyl group represented by each of $R^{31}$ and $R^{32}$ is preferably one having 1 to 6 carbon atoms, for example, methyl, ethyl, 2-chloroethyl, propyl, or n-hexyl.

$R^{33}$ and $R^{34}$ may be the same or different, and each represents a hydrogen atom, an alkyl group (which may be substituted; for example, methyl, ethyl, propyl, butyl, isobutyl, pentyl, hexyl, 2-ethylhexyl, octyl, dodecyl, hexadecyl, 2-chloroethyl, 3-chloropropyl, 2-bromoethyl, 2-hydroxyethyl, cyanomethyl, 2-cyanomethyl, 3-cyanopropyl, 2-methoxyethyl, 3-methoxypropyl, 2-ethoxyethyl, 2-octyloxyethyl, 3-ethoxypentyl, 2-isopropoxyethyl, acetylmethyl, 2-acetylethyl, benzoylmethyl, acetyloxymethyl, 2-(ethylcarbonyloxy)ethyl, 2-(heptanoyloxy)ethyl, 2-(isopropylcarbonyloxy)ethyl, benzoyloxyethyl, 4-chlorobenzoyloxymethyl, 4-nitrobenzoyloxyethyl, acetylaminoethyl, 2-(ethylcarbonylamino)ethyl, methylcarbamoylmethyl, 2-methylaminoethyl, 2-(ethylamino)ethyl, 2-(dimethylamino)ethyl, 2-(diethylamino)ethyl, 2-methylureidoethyl, carboxymethyl, 2-carboxyethyl, 3-carboxypropyl, 6-carboxyhexyl, methoxycarbonylmethyl, ethoxycarbonylmethyl, 2-(butoxycarbonyl)ethyl, 3-(octyloxycarbonyl)propyl, 2,2,2-trifluoethoxycarbonylmethyl, isopropyloxycarbonylmethyl, 3-(t-amyloxycarbonyl)propyl, (2-ethyl hexyl)oxycarbonylmethyl, 2-(ethoxycarbonyl)ethyl, ethylsulfonylmethyl, 2-(methylsulfonyl)ethyl, 2-(butylsulfonyl)ethyl, methylsulfonylaminomethyl, 2-(methylsulfonamino)ethyl, 2-(ethylsulfonamino)ethyl, 3-(ethylsulfonylamino)propyl, methylsulfamoylethyl, or phenylmethyl group), or an aryl group (which may be substituted; for example, phenyl, 4-chlorophenyl, 4-cyanophenyl, 4-hydroxyphenyl, 4-carboxyphenyl, 2-methoxyphenyl, 4-methoxyphenyl, 4-ethoxyphenyl, 4-octyloxyphenyl, 4-methylphenyl, or 4-nitrophenyl group). $R^{33}$ and $R^{34}$ may form a 5- or 6-membered heterocyclic ring (for example, pyridine ring, or morpholine ring).

$R^{32}$ and $R^{33}$, and $R^{31}$ and $R^{34}$ each respective combination may form a 5- or 6-membered heterocyclic ring.

Z represents a nitrogen atom or a methyne group, but it is preferably a nitrogen atom or —CH=. The alkyl group represented by $R^{41}$ is preferably an alkyl group having 1 to 7 carbon atoms, for example, methyl, ethyl, propyl, butyl, or cyclohexyl, and each may have a substituent group. The aryl group represented by $R^{41}$ is preferably one having 6 to 10 carbon atoms, for example, phenyl, or naphthyl, and each may have a substituent group. Preferable Examples of the substituent group are a halogen atom such as chlorine atom, an ester group such as acetoxy or ethoxycarbonyl, a carboxyl group, a sulfonamido group such as methanesulfonamido, ethanesulfonamido, or benzenesulfonamido, a sulfamoyl group, an acetylaminosulfonyl group, a methylsulfonylaminosulfonyl group, a methylsulfonylaminocarbonyl group, a hydroxy group, a dialkylamino group, and an alkyl group.

The halogen atom represented by each of $R^{42}$, $R^{43}$, $R^{44}$, $R^{45}$, and $R^{46}$ is preferably a chlorine atom.

The alkyl group represented by each of $R^{42}$, $R^{43}$, $R^{44}$, $R^{45}$, and $R^{46}$ is preferably an alkyl group having 1 to 6 carbon atoms, with methyl or ethyl being most preferred.

The aryl group represented by each of $R^{42}$, $R^{43}$, $R^{44}$, $R^{45}$, and $R^{46}$ is preferably an aryl group having 6 to 10 carbon atoms, with phenyl, p-tolyl, or p-methoxyphenyl being most preferred.

The alkyl group represented by each of $R^{47}$ and $R^{48}$ is preferably one having 1 to 12 carbon atoms, including, for example, a non-substituted alkyl group (for example, methyl, ethyl or propyl), or a substituted alkyl group (for example, an alkyl group having an ester group, such as ethoxycarbonylmethyl or 2-ethylhexyloxycarbonylethyl, an alkyl group having an amido group, such as N-propylcarbamoylmethyl or acetoamidoethyl, an alkyl group having a halogen atom, such as trifluoromethyl or 2,2,2-trichloroethyl, an alkyl group having a hydroxy group, such as 2-hydroxyethyl, an alkyl group having a sulfonamido group, such as 2-methansulfonamidoethyl or 3-sulfamoylpropyl, an alkyl group having a carboxyl group, such as carboxymethyl or 2-carboxy-2-propyl group).

The aryl group represented by each of $R^{47}$ and $R^{48}$ is preferably an aryl group having 6 to 10 carbon atoms, including, for example a non-substituted aryl group (such as phenyl), or a substituted aryl group (for example, an aryl group having a hydroxy group such as 4-hydroxyphenyl, an aryl group having a nitro group such as 4-nitrophenyl, a phenyl group having an amino group such as dimethylaminophenyl, or a phenyl group having a carboxy group such as 2-carboxyphenyl or 2-methoxy-5-carboxyphenyl).

The hetrocyclic group represented by each of $R^{47}$ and $R^{48}$ is preferably furyl, or pyridyl.

k is preferably 0.

The following are specific examples (II-1 to II-52, III-1 to III-39, Iv-1 to Iv-12, v-1 to v-6, VI-1 to VI-16, and D-1 to D-15) of the compounds represented by formulas (I)–(VI). It should be noted that the present invention is not limited to these examples.

II-1
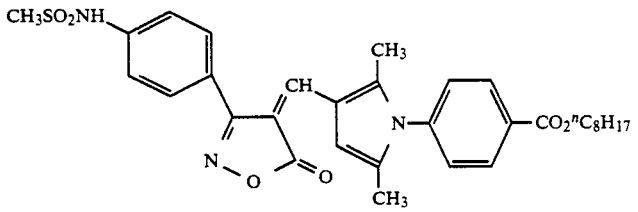
II-2
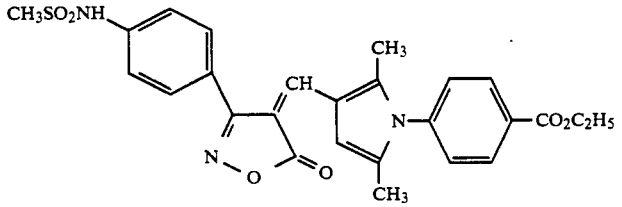
II-3
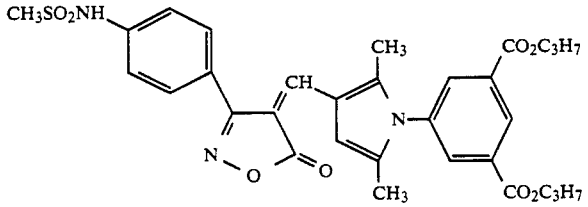
II-4
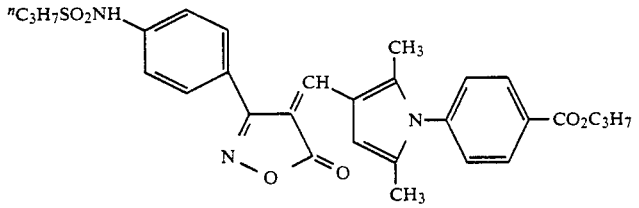
II-5
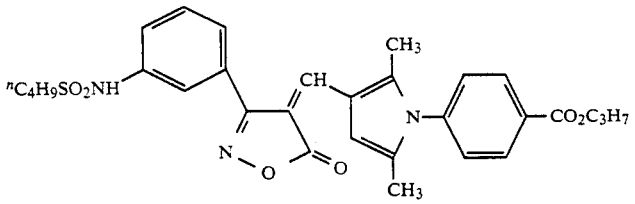
II-6
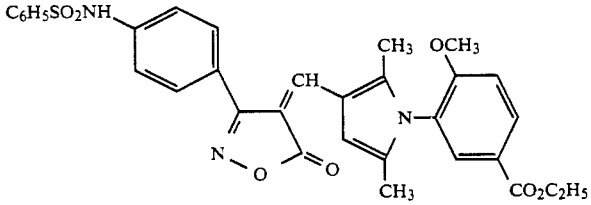
II-7
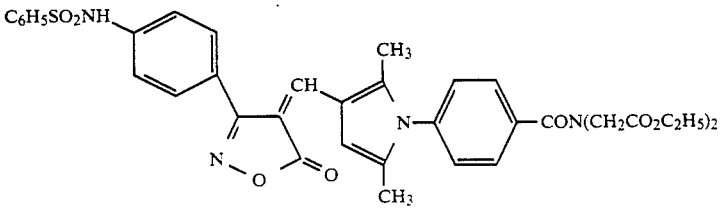

-continued
II-8
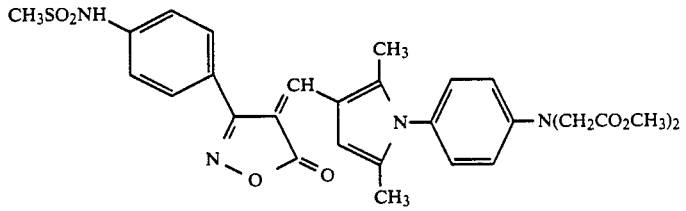
II-9
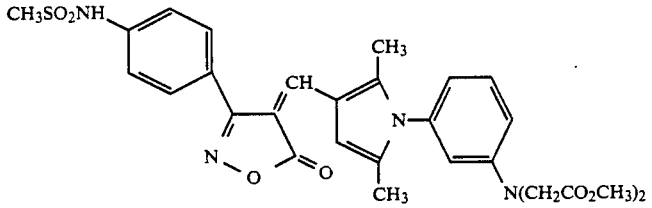
II-10
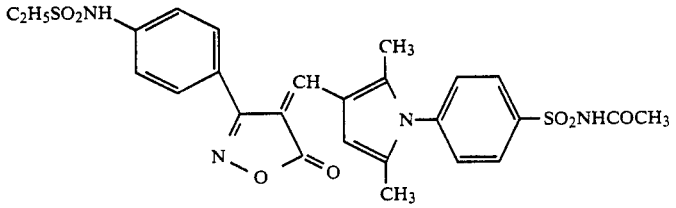
II-11
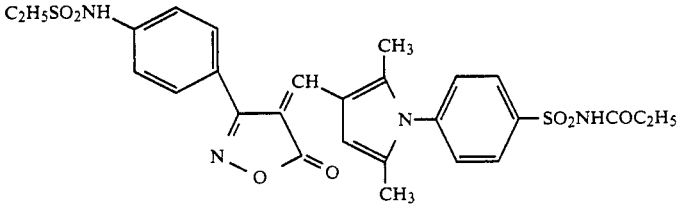
II-12
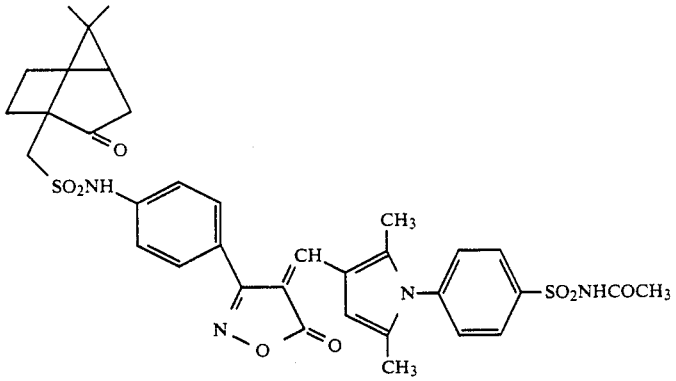
II-13
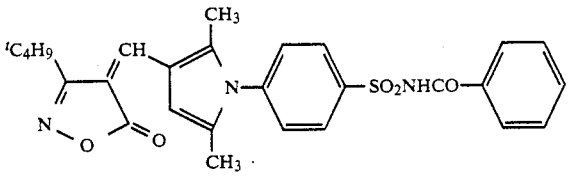
II-14
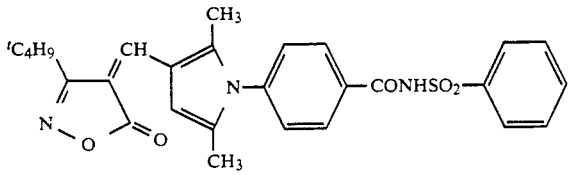

-continued
II-15
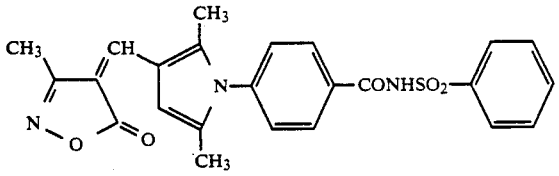
II-16
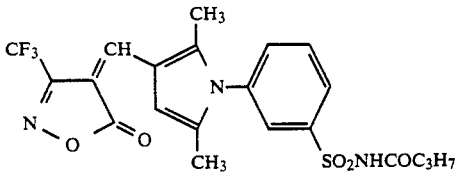
II-17
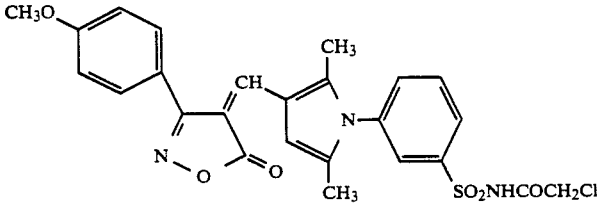
II-18
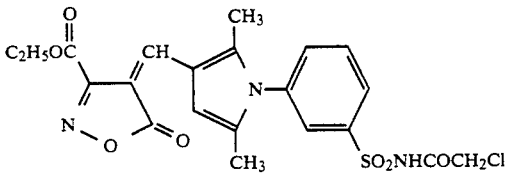
II-19
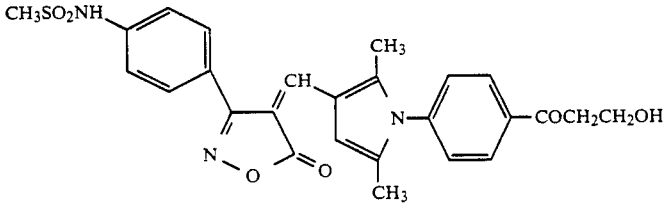
II-20
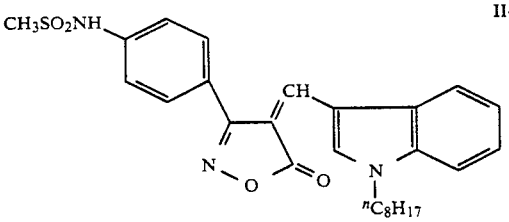
II-21
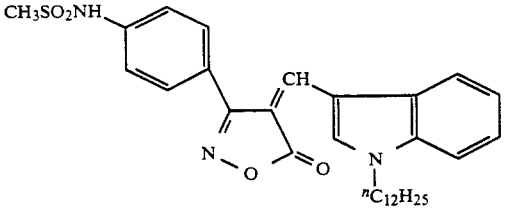
II-22
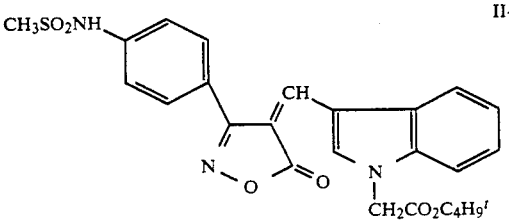
II-23
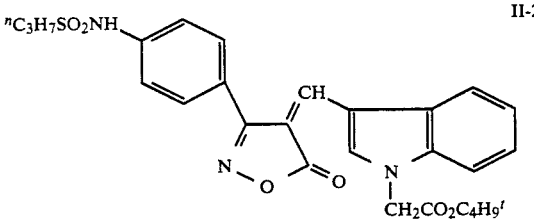
II-24
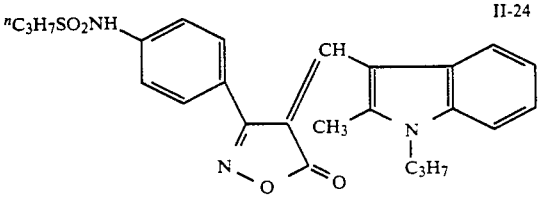
II-25
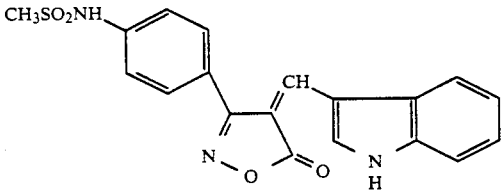

-continued
II-26
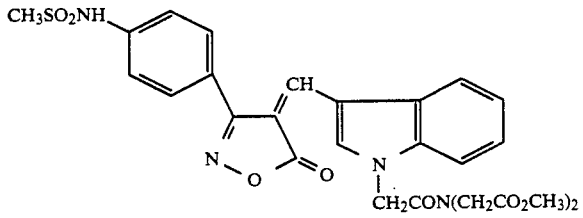
II-27
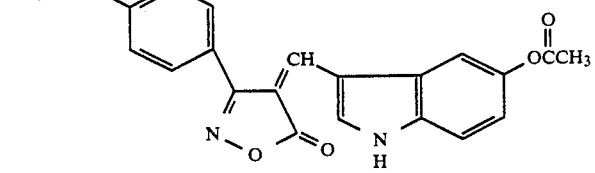
II-28
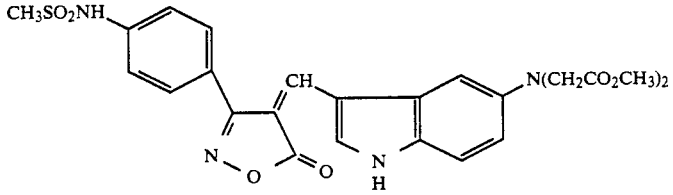
II-29
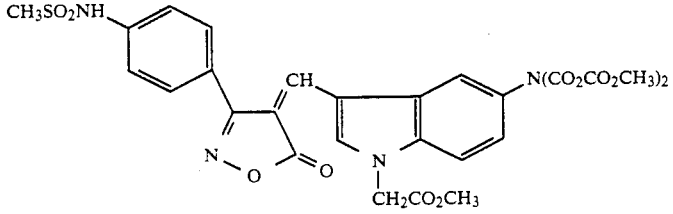
II-30
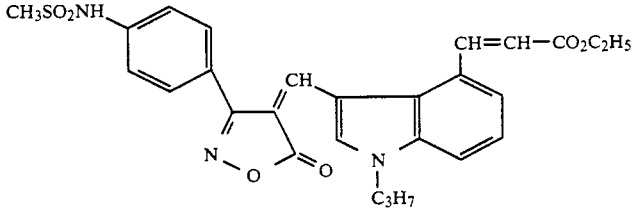
II-31
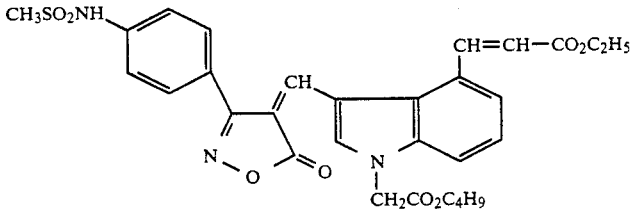
II-32
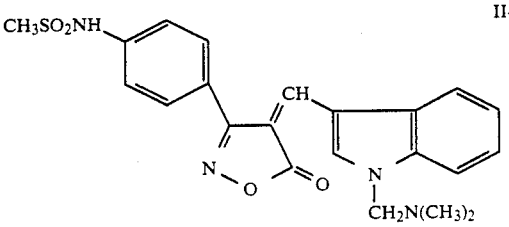
II-33
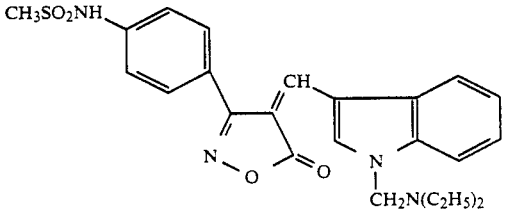

-continued
II-34
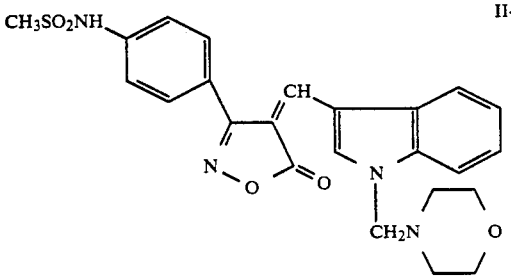
II-35
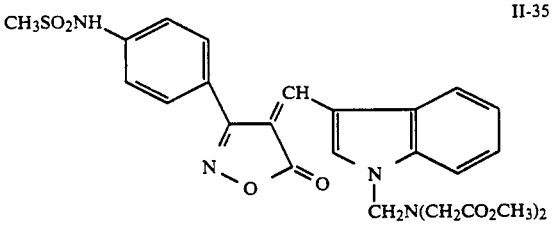
II-36
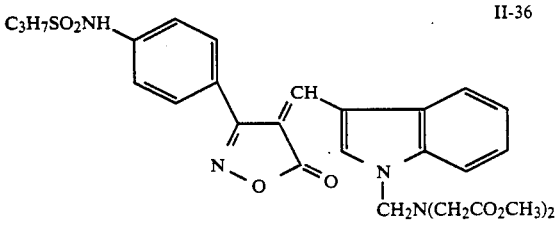
II-37
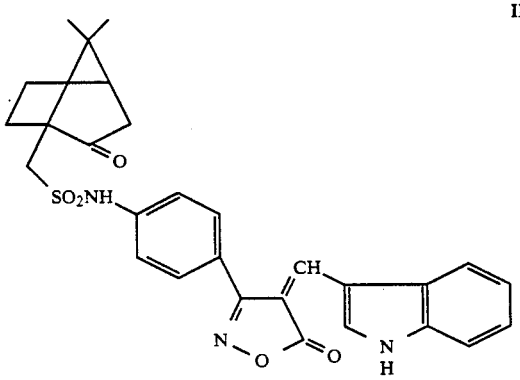
II-38
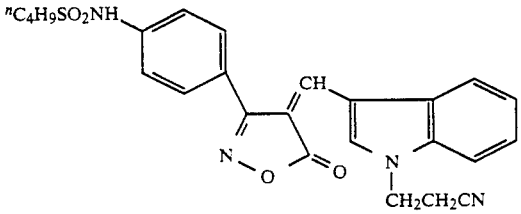
II-39
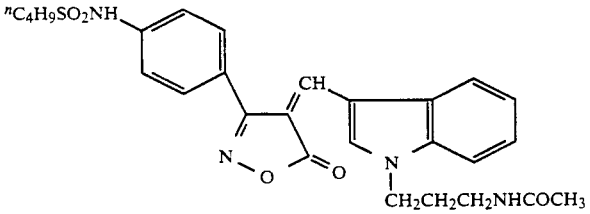
II-40
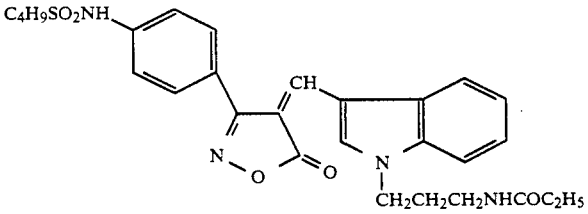
II-41
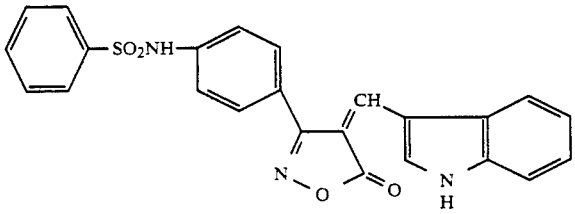

-continued
II-42
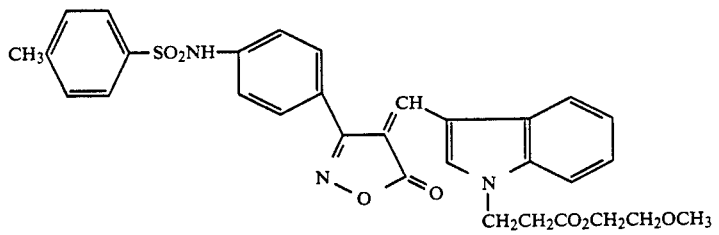
II-43
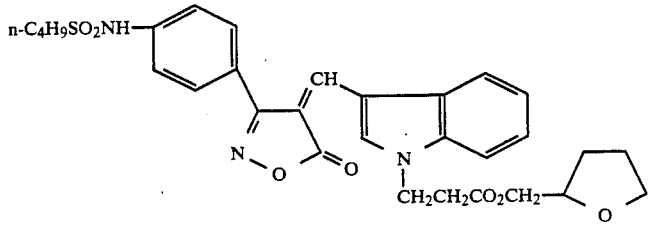
II-44
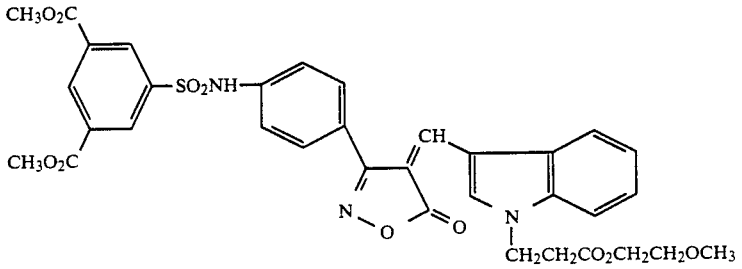
II-45
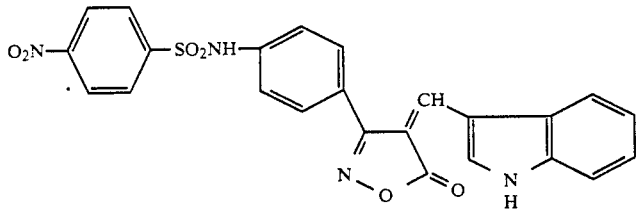
II-46
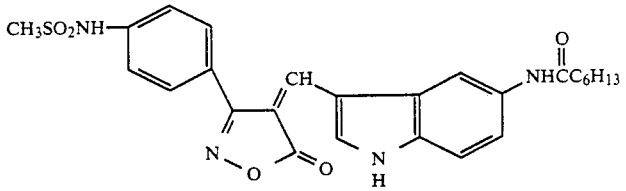
II-47
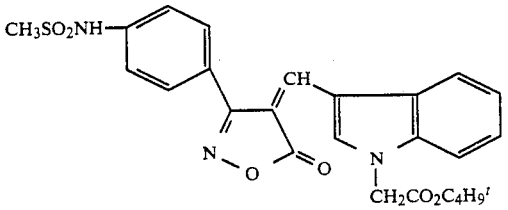
II-48
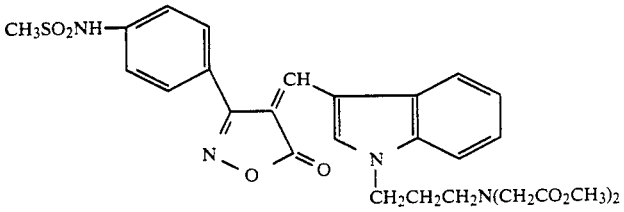

-continued
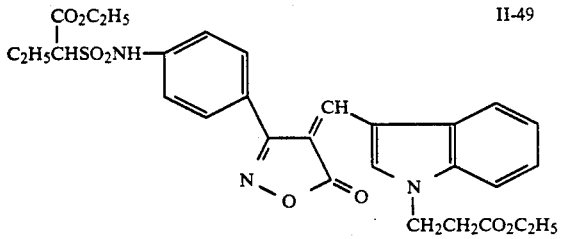
II-49
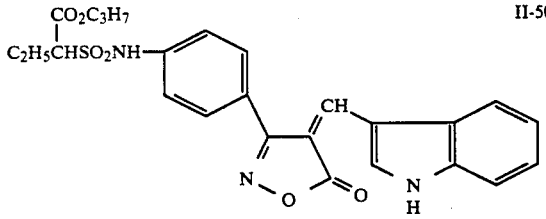
II-50
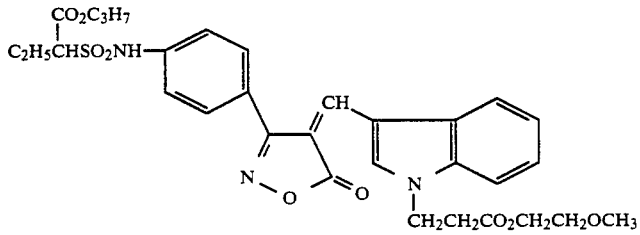
II-51
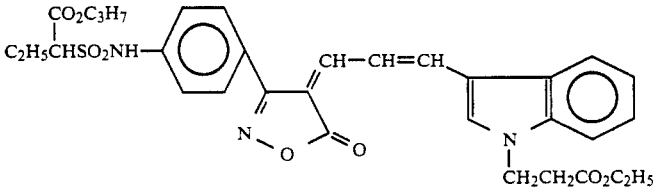
II-52
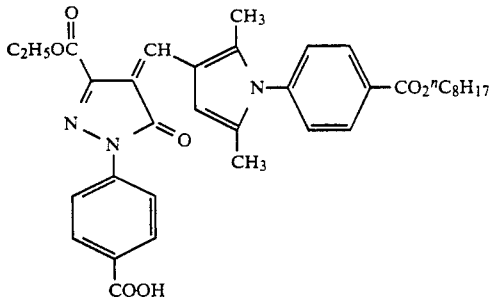
III-1
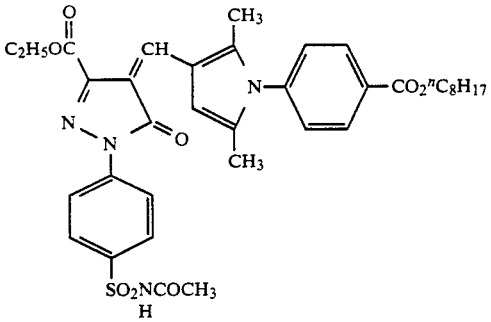
III-2
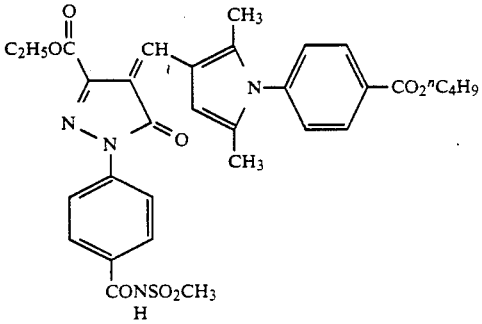
III-3
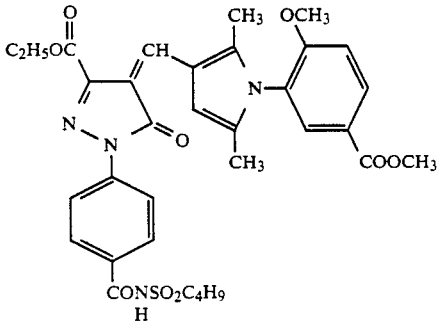
III-4

-continued
III-5
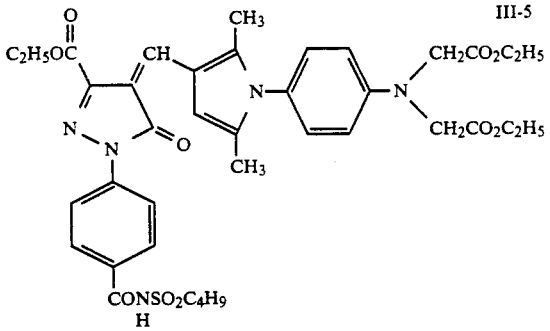
III-6
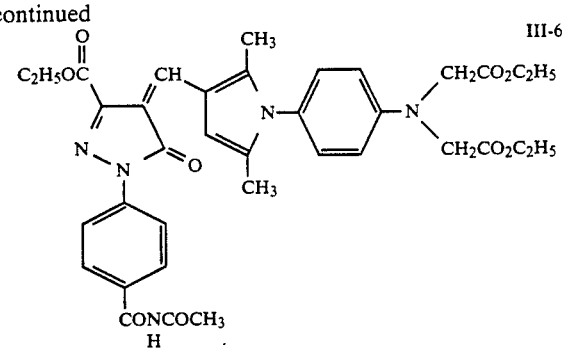
III-7
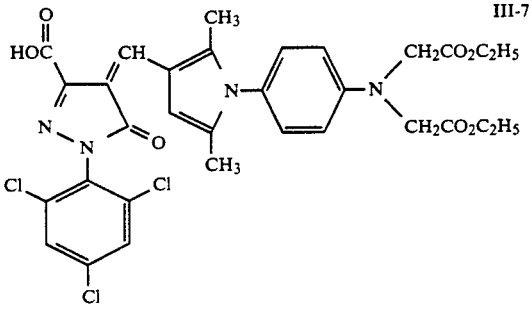
III-8
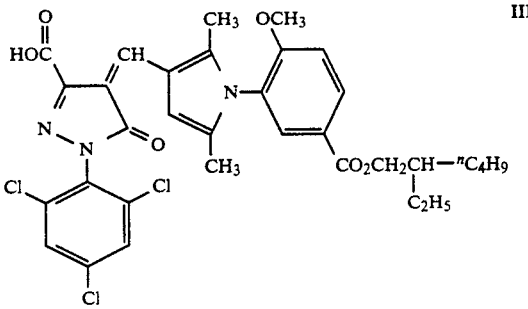
III-9
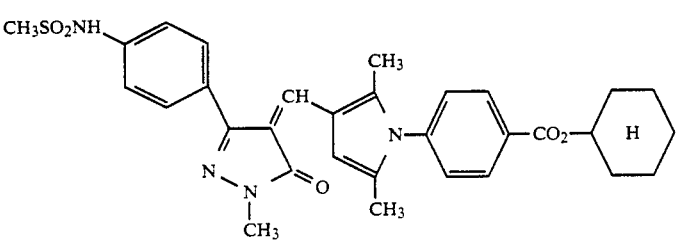
III-10
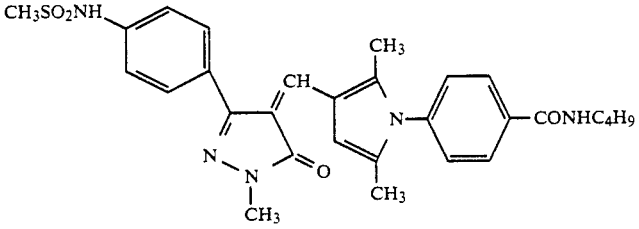
III-11
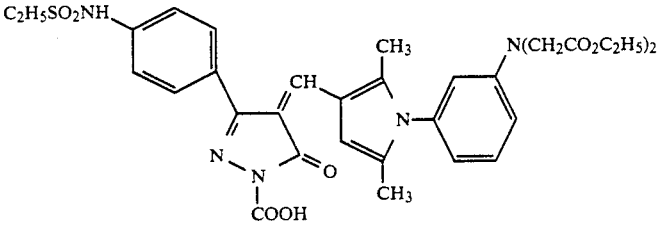
III-12
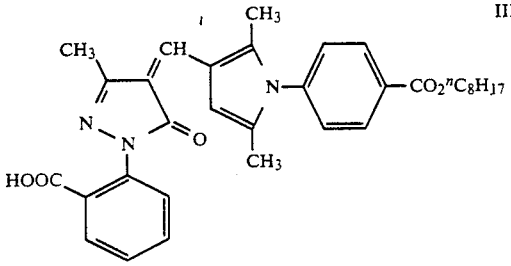
III-13
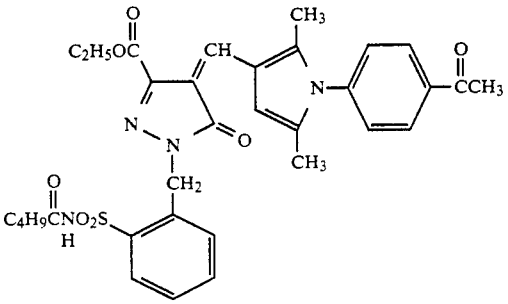

-continued
III-14
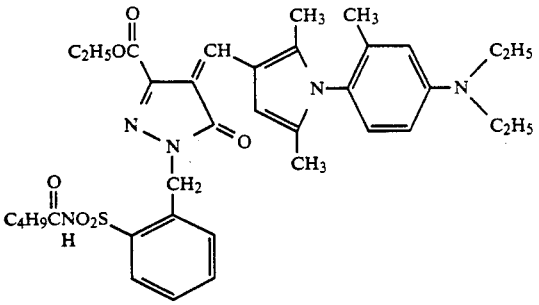
III-15
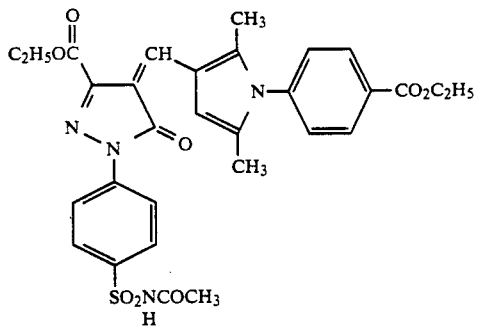
III-16
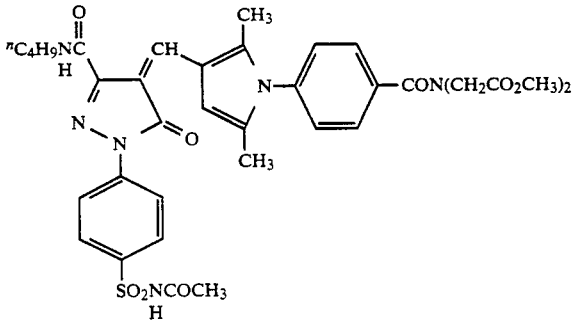
III-17
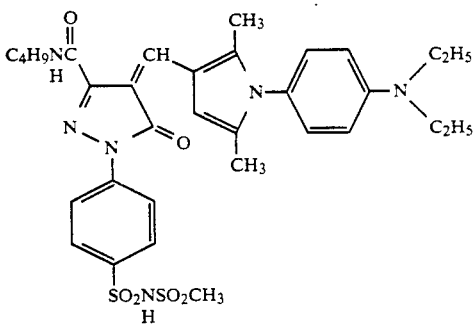
III-18
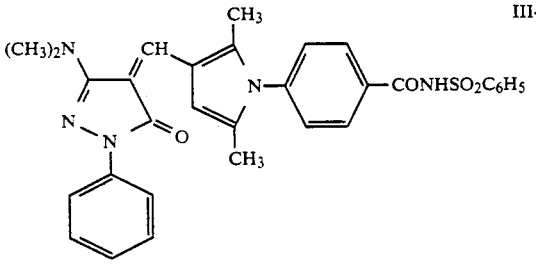
III-19
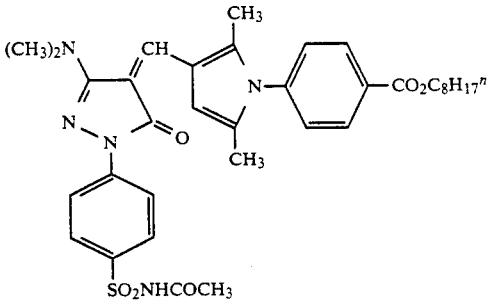
III-20
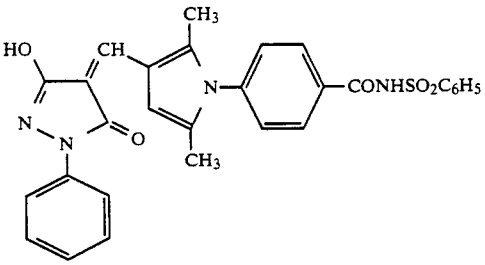
III-21
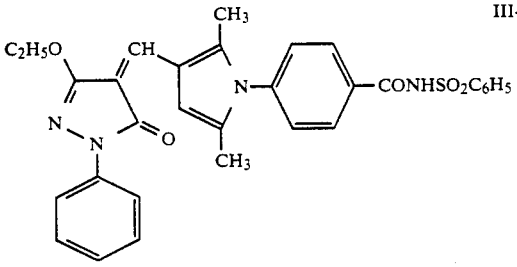
III-22
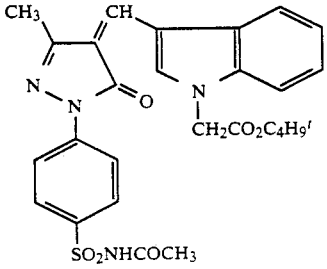

-continued
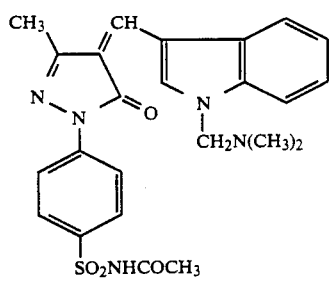
III-23
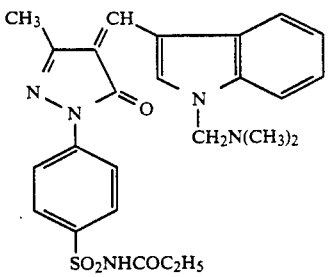
III-24
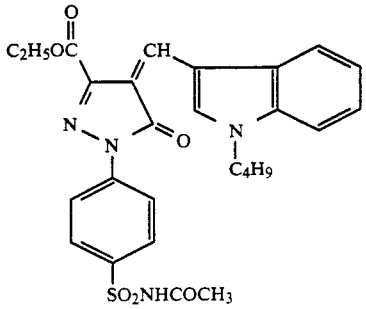
III-25
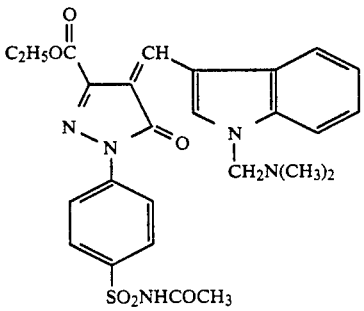
III-26
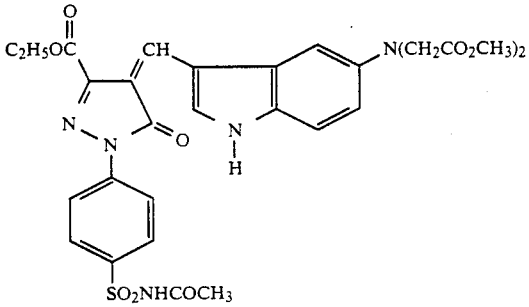
III-27
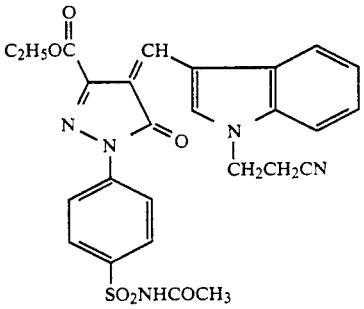
III-28
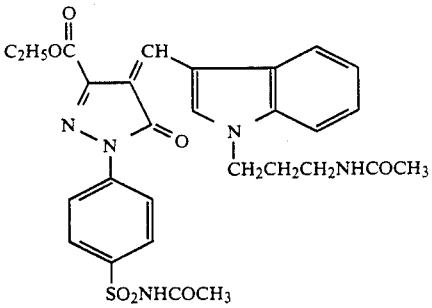
III-29
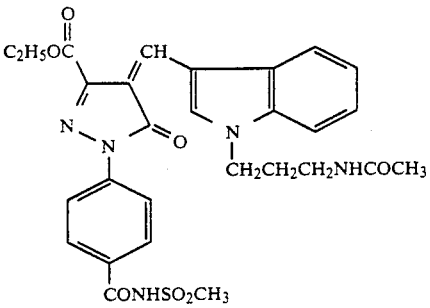
III-30
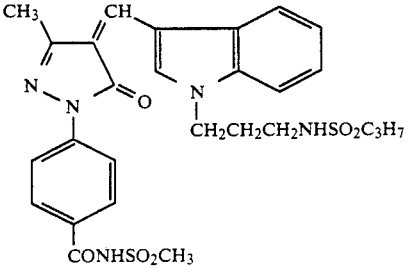
III-31
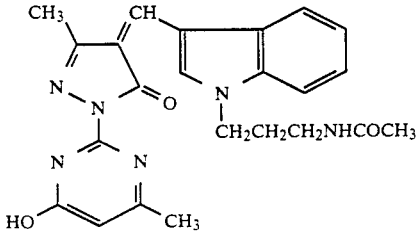
III-32

-continued
III-33
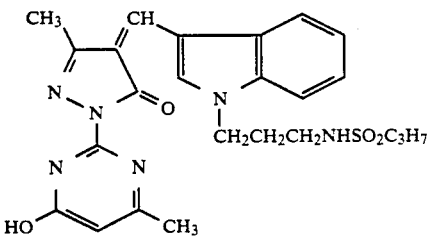
III-34
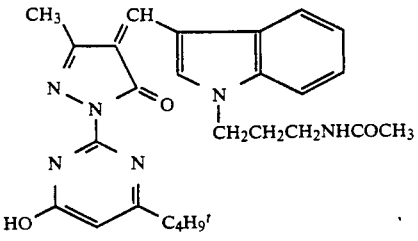
III-35
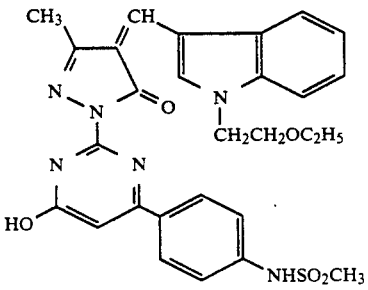
III-36
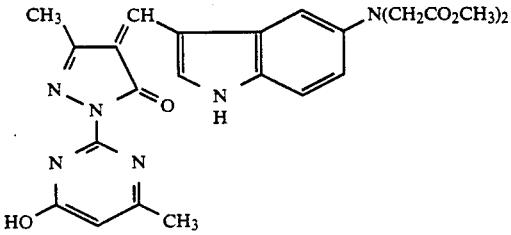
III-37
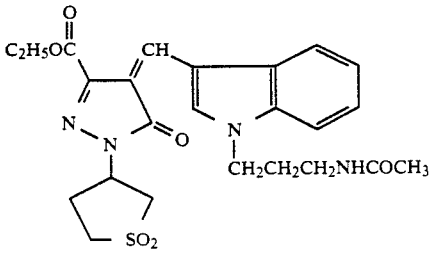
III-38
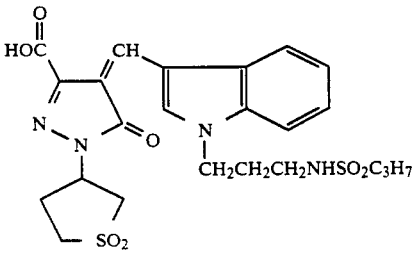
III-39
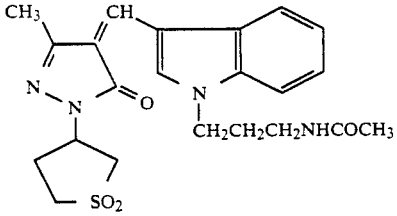
IV-1
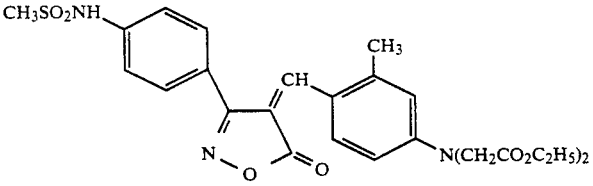
IV-2
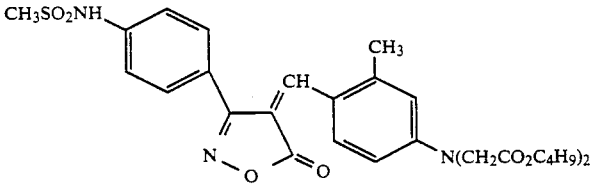
IV-3
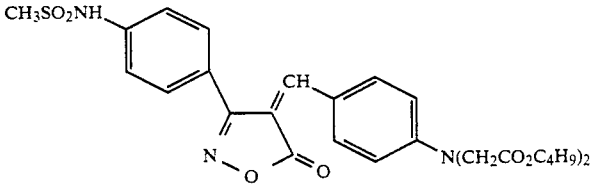

-continued
IV-4
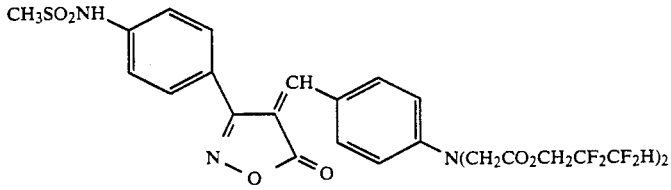
IV-5
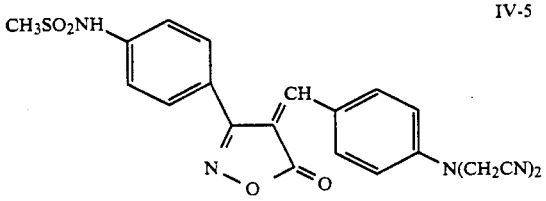
IV-6
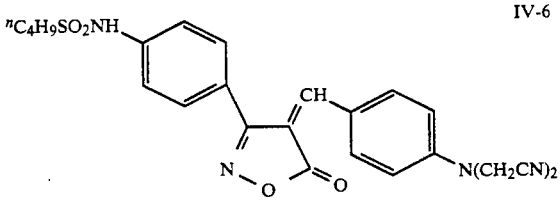
IV-7
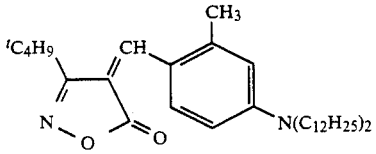
IV-8
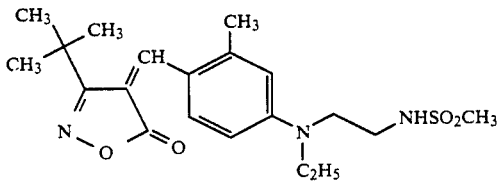
IV-9
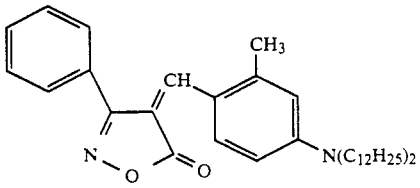
IV-10
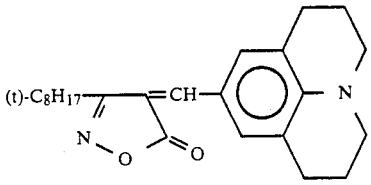
IV-11
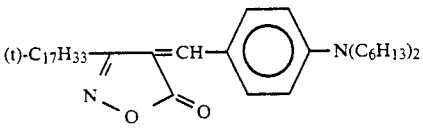
IV-12
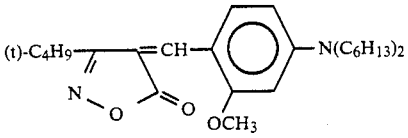
V-1
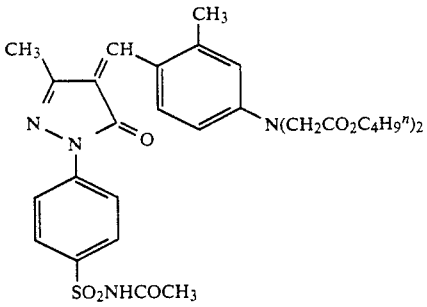
V-2
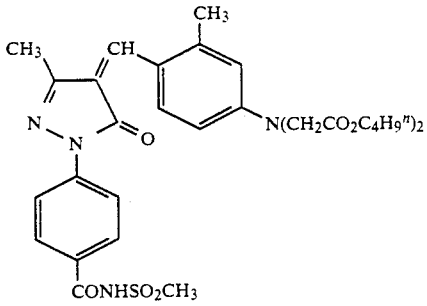
V-3
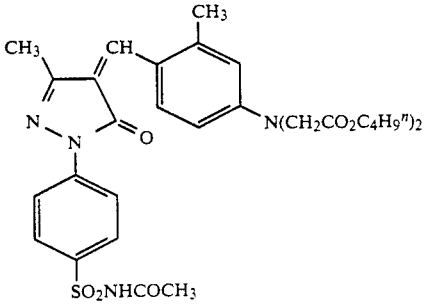

-continued
V-4
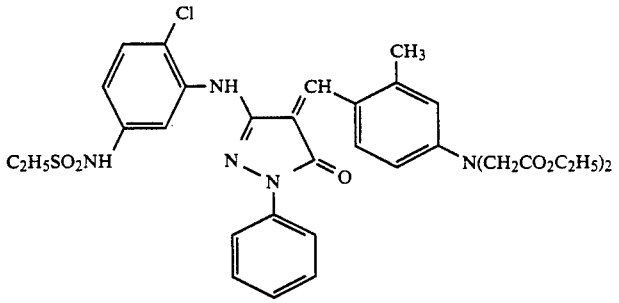
V-5
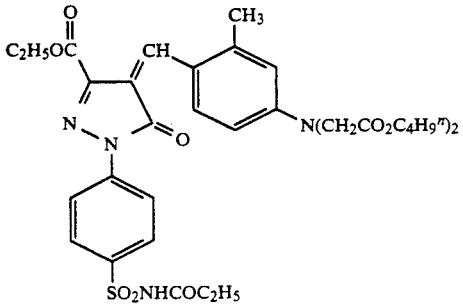
V-6
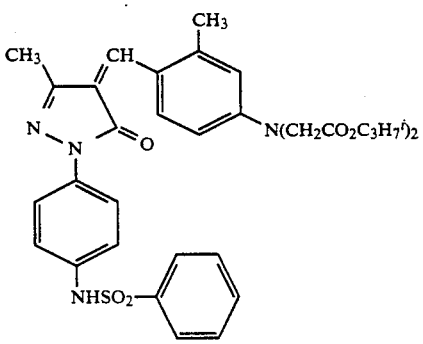
VI-1
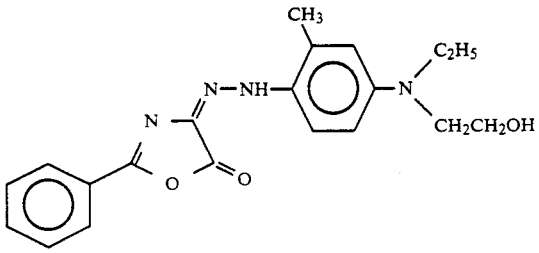
VI-2
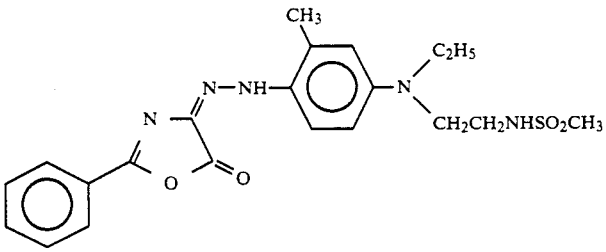
VI-3
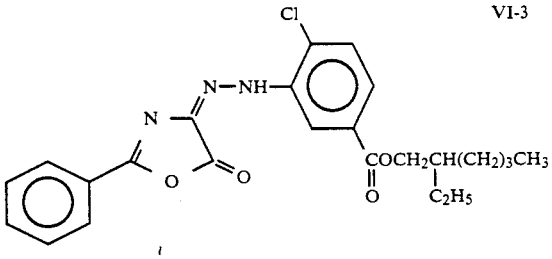
VI-4
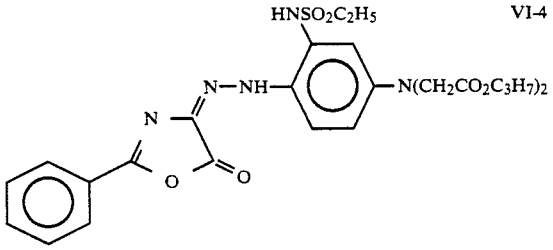
VI-5
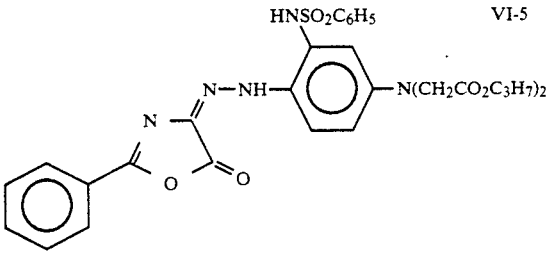
VI-6
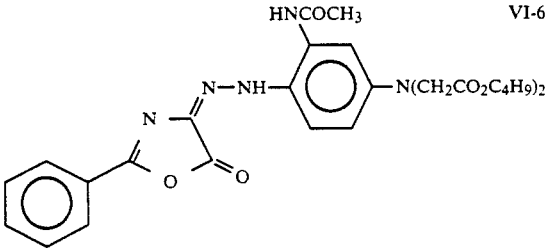

-continued
VI-7
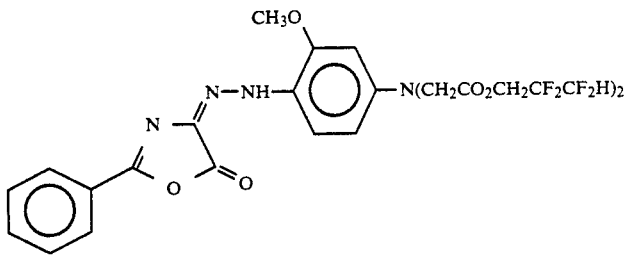
VI-8
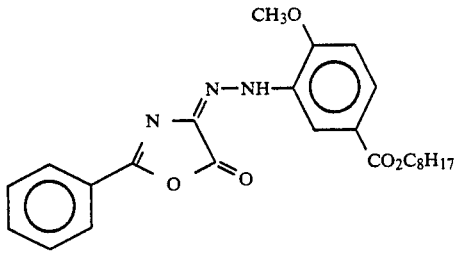
VI-9
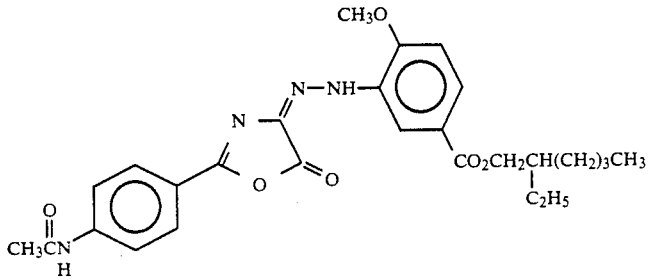
VI-10
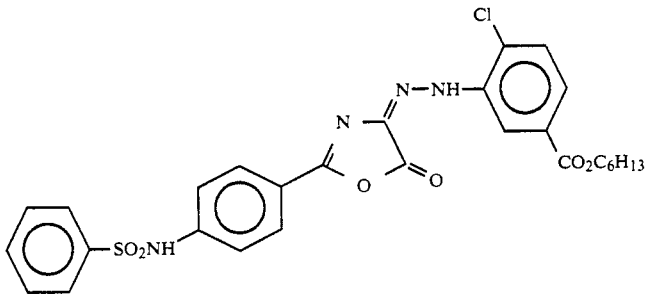
VI-11
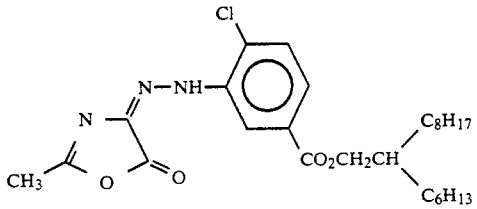
VI-12
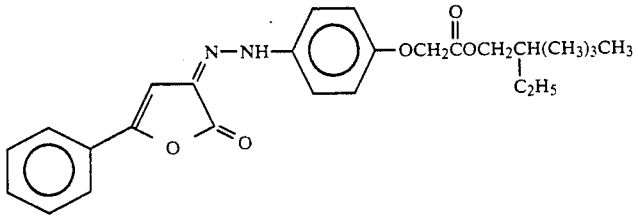

-continued
VI-13
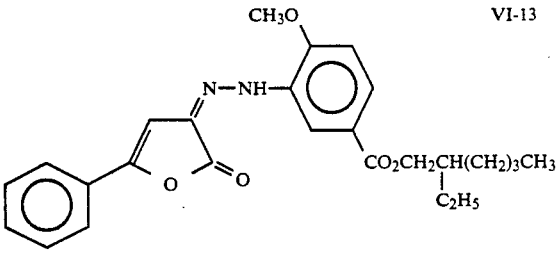
VI-14
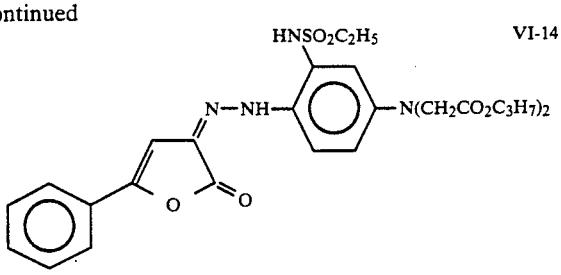
VI-15
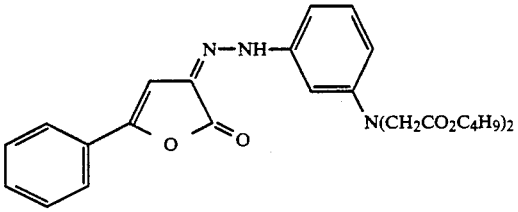
VI-16
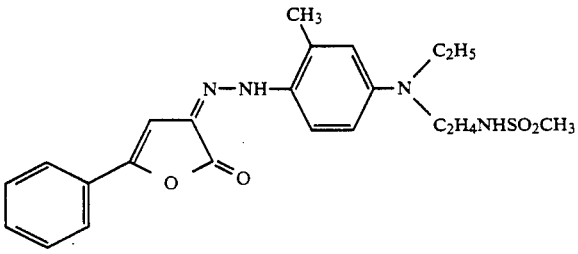
Other dyes represented by formula (I) are as follows:
D-1
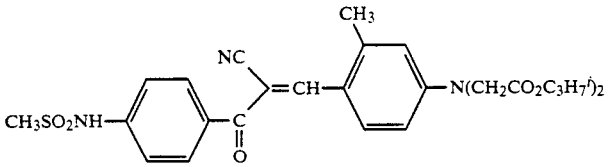
D-2
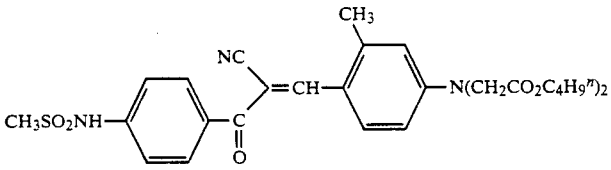
D-3
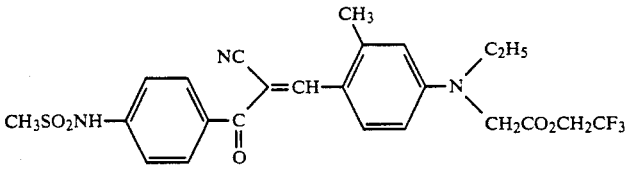
D-4
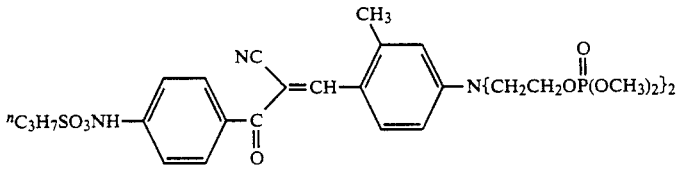

-continued
D-5
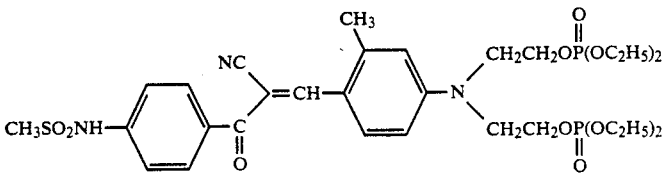
D-6
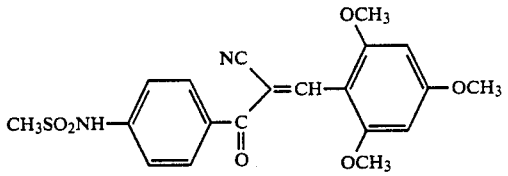
D-7
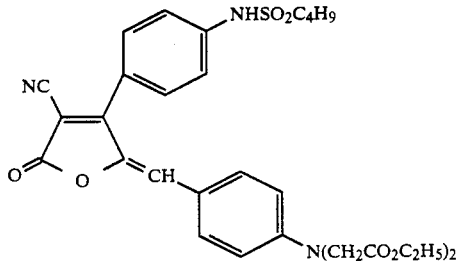
D-8
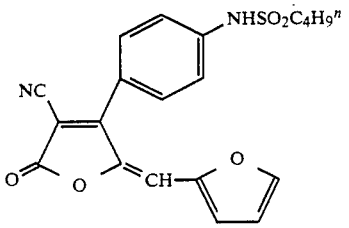
D-9
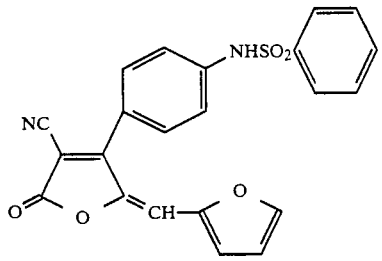
D-10
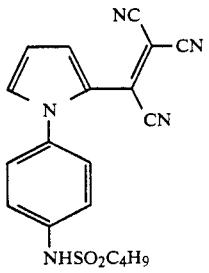
D-11
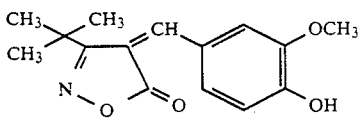

-continued

D-12

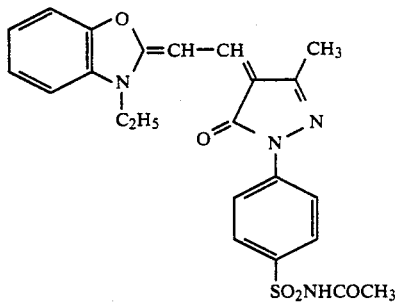

D-13

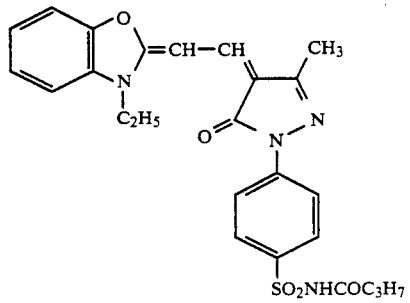

D-14

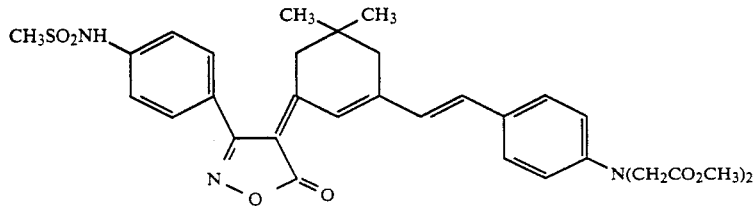

D-15

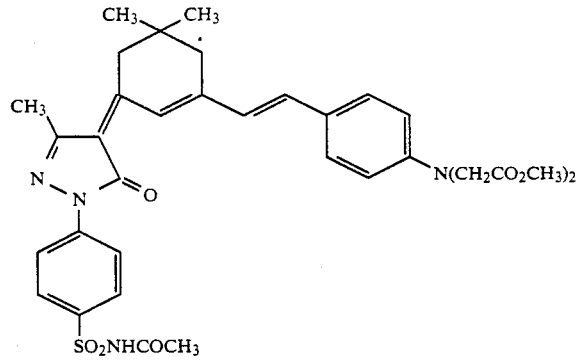

The compounds represented by formulas (II), (III), (IV), (V), and (VI) can be synthesized in the following manner. For example, iso-oxazolone is used as an acidic nucleus, and pyrrole-3-aldehyde as an aidehyde, and they are added to an organic solvent (e.g. methanol, ethanol, isopropanol, DMF, acetonitrile, acetic acid, or pyridine) in the presence of a catalyst (e.g. piperidine, glycine, β-alanine, p-toluenesulfonic acid, camphorsulfonic acid, or ammonium acetate). The mixture is reacted under reflux or at room temperature. Other examples are pyrazolone as the acidic nucleus, and indole-3-aldehyde, or benzaldehyde as the aidehyde.

.Some of the examples of the synethesizing method are described in, for example, JP-A-3-72340, JP-A-3-72342, and U.S. Pat. No. 3,627,532.

In particular, the compound represented by formula (VI) can be synthesized by the method disclosed in any of Journal of Chemical and Engineering Data, vol. 22, page 104, 1977, Journal of the Americal Chemical Society, vol. 79, page 1955, 1957, and Canadian Journal of Chemistry, vol. 41, page 1813, 1963.

Synthesis of Compound II-1

57.8 g of 4-octyloxycarbonylaniline, 27.4 g of acetonylacetone, and one drop of concentrated sulfuric acid were mixed together, and the mixture was heated at 150° C. for one hour. The reacted mixture was diluted with ethyl acetate, and washed with water. Then, the mixture was dried and concentrated, thus obtaining 1-(4-octyloxy-carbonylphenyl)-2,5-dimethylpyrrole.

100 ml of DMF and 33.7 g of phosphorus oxychloride were mixed to prepare a Viismeier reagent solution, and a solution of the pyrrole obtained above in 100 ml of DMF was added dropwise to the viismeier reagent solution under ice-cooling. After the mixture solution was stirred for 30 minutes at room temperature, it was added to a solution of 91.2 g of pottasium carbonate in 400 ml of water. The resultant mixture was extracted with ethyl acetate, and washed with salt water. This material was dried and concentrated. The resultant crude product was purified by column chromatography, thereby obtaining 1-(4-octyloxycarbonylphenyl)-2,5-dimethyl-3-formylpyrrole.

2.5 g of 3-(4-methanesulfonamidophenyl)-isooxazolin-5-one, 3.9 g of the formylpyrrole obtained above, 30 ml of acetonitrile, and one drop of piperidine were mixed together, and stirred for 2 hours while being heated.

Thus reacted solution was purified by column chromatography, thus obtaining 5.1 g of glassy compound II-1. λ max: 401 nm (AcOEt).

2.6 g of 3-(4-methanesulfonamidophenyl)-isooxazolin-5-one, 4.4 g of 1-dodecyl-3-formylindole, and 20 ml of ethanol were mixed together to prepare a solution, and the solution was refluxed for 1 hour while being heated. The reacted solution was purified by column chromatography, and recrystalized from isopropanol, thus obtaining 2.5 g of compound II-21. λ max: 428 nm (AcOEt).

Synthesis of Compound III-15

33.4 g of 3-ethoxycarbonyl-l-(4-sulfophenyl) pyrazolone sodium salt, 11.1 g of triethylamine, and 200 ml of DMF were mixed, and 15.5 g of benzoyl chloride was added dropwise to this mixture under ice-cooling. The resulting mixture was stirred for 2 hours at room temperature. Acetone was added, and the precipitated crystals were collected by filtering and dried, thereby obtaining 36.5 g of 5-benzoyloxy-3-ethoxycarbonyl-1-(4-sulfophenyl)pyrazole triethylamine salt.

To a mixture of 36.5 g of the pyrazolone protected above and 108 ml of acetonitrile, 22.1 g of phosphorus oxychloride was added under ice-cooling followed by 43 ml of N,N-dimethylacetoamide. The mixture was stirred at room temperature for 2 hours. The reaction mixture was poured into 300 g of ice-water, and the precipitated crystals were collected by filtering and dried, thereby obtaining 5-benzoyloxy-3-ethoxycarbonyl-1-(4-chlorosulfonylphenyl)pyrazole.

To a mixture of 0.6 g of sodium hydride (60%) and 5 ml of N,N-dimethylacetoamide, 0.4 g of acetoamide was slowly added under ice-cooling. To this mixture, 2.2 g of the sulfonyl chloride and 5 ml of N,N-dimethylacetoamide were added under ice-cooling, and the resulting mixture was stirred for 1 hour at room temperature. After 10 ml of ethanol was added thereto, the resultant mixture was refluxed for 2 hours while being heated, and poured into diluted hydrochloric acid. The mixture was extracted with ethyl acetate, and the extracted material was dried and concentrated, thereby obtaining 3-ethoxycarbonyl-l-(4-acetylaminosulfonylphenyl) pyrazolone.

A mixture consisting of the obtained pyrazolone, 4.1 g of 1-(4-ethoxycarbonylphenyl)-3-formyl-2,5-dimethylpyrrole and 30 ml of ethanol was stirred for 4 hours while being heated. The reaction mixture was diluted with ethyl acetate, washed with salt water, then dried and concentrated. The obtained crude product was purified by column chromatography, and the obtained material was recrystalized from isopropanol, thereby obtaining 0.6 g of compound III-15. λ max: 436 nm (AcOEt).

Synthesis of Compound IV-3

To a mixture 23.0 g of ethyl 4-methanesulfonamidobenzoylacetate, 5.8 g of hydroxylamine hydrochloride, and 35 ml of methanol, 8.2 g of pottasium acetate was added, and the mixture was refluxed for 30 minutes while being heated. The reaction mixture was poured into 210 ml of water, and the precipitated crystals were collected by filtering and dried, thereby obtaining 1.39 of 3-(4-methanesulfonamidophenyl)isoxazolin-5-one.

A mixture of 2.5 g of the obtained isoxazolone, 4.3 g of 4-di(n-butoxycarbonylmethyl)aminobezaldehyde, one drop of piperidine and 20 ml of acetonitrile was refluxed for 3 hours while being heated. The reaction mixture was diluted with ethyl acetate, washed with salt water, then dried and concentrated. The obtained material was recrystalized from isopropanol, thereby obtaining 3.3 g of compound IV-3. λ max: 442 nm (AcOEt).

Synthesis of Compound VI-16

A solution of 12.5 g of benzoylpropionic acid and 50 ml of acetic anhydrude was stirred for 1 hour at 100° C. The solvent was distilled off under a reduced pressure, and 15 ml of water and 45 ml of ethanol were added to the residue to crystalize it. The obtained crystals were collected by filtering, and then dried, thereby obtaining 7.2 g of γ-phenyl-Δ,β-butenolide.

4.4 g (10 mmol) of 4-(N-ethyl-N-β-methanesulfonamidoethyl)amino-2-methylaniline sulfate, 2.1 ml of concentrated hydrochloric acid, and 10 ml of water were mixed together to prepare a solution, and 0.78 g of sodium nitrite, and 2.0 ml of water were further added to the solution to prepare a diazonium salt solution.

A solution of 1.6 g of γ-phenyl-Δβ, γ-butenolide, 4.5 g of triethylamine and 10 ml of methanol was added to the diazonium salt solution, and the mixture was stirred for one hour at room temperature.

The reaction mixture was extracted with ethyl acetate and dried over magnesium sulfate, and the solvent was distilled off under a reduced pressure. Thus obtained material was purified by silica gel chromatography, thereby obtaining 0.1 g of orange crystals of compound VI-16. λ max: 505 nm; s:$3.16\times10^4$ (ethyl acetate).

In general, the dyes represented by general formulas (I)-(VI) are used in an amount of about 1-800 mg per $m^2$ of a light-sensitive material.

In the case where the dyes represented by formulas (I)-(VI) are used as a filter dye or an anti-halation dye, an amount used may be any effective amount. However, the dye is preferably used in such an amount that the optical density may fall within a range of 0.05 to 3.0. The dye can be added in any time before coating.

The dye according to the invention can be dispersed in an emulsion layer or the other hydrophilic colloid layer (for example, an interlayer, a protective layer, an anti-halation layer, a filter layer) by various known methods described below.

(i) A method of dissolving or dispersing the dye of the invention directly into an emulsion layer or a hydrophilic colloid layer, or a method of disolving or dispersing the dye into an aqueous solution, and then applying to the emulsion or hydrophilic colloid layer. The dye can be added to an emulsion, in the form of solution in an appropriate solvent such as methyl alcohol, ethyl alcohol, propyl alcohol, methylcellosolve, a halogenated alcohol disclosed in JP-A-48-9715 and U.S. Pat.

No. 3,756,830, acetone, water, pyridine, or a mixture of these.

(ii) A method of dispersing a solution prepared by dissolving the dye into a solvent substantially insoluble in water and having a high boiling point of about 160° C. or higher, and adding the solution to a hydrophilic colloid solution and dispersing the dye. Examples of the high boiling point solvent are, as listed in U.S. Pat. No. 2,322,027, for example, alkyl phthalates (e.g., dibutyl phthalate, and dioctyl phthalate), phosphoric acid esters (e.g. diphenylphosphate, triphenylphosphate, tricresyl phosphate, and dioctylbutylphosphate), citric acid esters (e.g. tributylacetylcitrate, benzoic acid esters (e.g. octyl benzoate), alkylamides (e.g. diethyllaurylamide), fatty acid esters (e.g. dibutoxyethylsuccinate and diethyl azelate), and trimesic acid esters (e.g. tributyl trimesate). Further, organic solvents having a boiling point of about 30° C. to 50° C., for example, lower alkyl acetates such as ethyl acetate and butyl acetate, ethyl propionate, secondary butyl alcohol, methylisobutylketone, β-ethoxyethylacetate, methylcellosolve acetate, or solvents readily soluble in water, e.g. alcohols such as methanol and ethanol can be used.

It should be noted here that a preferable ratio of amount used between the dye and a high-boiling point solvent is 10-1/10 (weight ratio).

(iii) A method of incorporating the dye of the invention and other additives into a photographic emulsion layer, and other hydrophlic colloid layer as a loading polymer latex composition.

The polymer latex includes a polyurethane polymer, and a polymer polymerized from a vinyl-monomer. Examples of the suitable vinyl monomer are acryl acid esters (e.g., methyl acrylate, ethyl acrylate, butyl acrylate, hexyl acrylate, octyl acrylate, dodecyl acrylate, and glycidyl acrylate), a-substituted acrylic acid esters (e.g., methyl methacrylate, butyl methacrylate, octyl methacrylate, and glycidyl methacryl), acrylamides (e.g., butylacrylamide, and hexylacrylamide), α-substituted acrylamides (e.g., methylmethacrylamide, and dibutylmethacrylamide), vinyl esters (e.g., vinyl acetate, and vinyl butyrate), vinyl halides (e.g., vinyl chloride), vinylidene halides (e.g., vinylidene chloride), vinyl ethers (e.g, vinylmethyl ether, and vinyloctyl ether), styrene, substituted styrenes (e.g., α-methylstyrene), nucleus-substituted styrenes (e.g., hydroxystyrene, chlorostyrene, and methylstyrene), ethylene, propylene, butylene, butadiene, acrylonitrile. These monomers can be used singly, or in combination of 2 or more, or in combination with other vinyl monomers as a minor component. Other vinyl monomers which can be employed includes itaconic acid, acrylic acid, methacrylic acid, hydroxyalkyl acrylate, hydroxyalkyl methacrylate, sulfoalkyl acrylate, sulfoalkyl methacrylate, and styrene sulfonic, acid.

These loading polymer latexes can be prepared by the methods disclosed in JP-B-51-39853, JP-A-51-59943, JP-A-53-137131, JP-A-54-32552, JP-A-54-107941, JP-A-55-133465, JP-A-56-19043, JP-A-56-19047, JP-A-56-126830, and JP-A-58-149038.

It should be noted here that a preferable ratio of amount used between the dye and a polymer latex is 10-1/10 (weight ratio).

(iv) A method of dissolving the dye by use of a surface active agent. Useful surface active agents may be an olygomer or a polymer.

JP-A-60-158437, the specification, pages 19–27 discusses such polymers in detail.

(v) A method of using a hydrophilic polymer in place of, or together with, the high-boiling point solvent described in above (ii). Such a method is disclosed in, for example, U.S. Pat. No. 3,619,195, or German Patent 1,957,467.

(vi) A microcapsulating method using polymers which have, e.g., carboxyl groups or sulfonic acid groups in their side chains, as disclosed in JP-A-59-113434.

To the dispersion of the hydrophilic colloid, the hydrosol of a lipophilic polymer such as disclosed in JP-B-51-39835 may be added.

In the invention, it is preferable to emply the method of adding a dispersion prepared by an oil-in-water dispersion method using a water-insoluble high boiling point solvent described in (ii) above, into an emulsion.

A typical example of the hydrophilic colloid is gelatine, but any type of hydrophilic colloid known as usable in photography can be used.

The dye of the invention can be dispersed into an emulsion layer or other hydrophilic colloidal layers, but is preferably dispersed into a layer on the further side from the support than the green-sensitive silver halide emulsion layer. In a light-sensitive material having a yellow filter layer, it is most preferably to disperse the dye into the yellow filter layer. This is because the dye has a sharper light absorptivity against a particular wavelength than yellow colloidal silver, and when the dye is used in a yellow filter layer, the sensitivity is significantly enhanced especially in the green-sensitive emulsion layer than when colloidal silver is used.

The couplers represented by formulas (1) and (2) will be explained in detail.

In formula (1), where $X_1$ and $X_2$ each represents an alkyl group, this alkyl group is a straight or branched chain or cyclic, saturated or unsaturated, substituted or unsubstituted alkyl group having 1 to 30 carbon atoms, preferably 1 to 20 carbon atoms. Examples of the alkyl group are methyl, ethyl, propyl, butyl, cyclopropyl, allyl, t-octyl, i-butyl, dodecyl, and 2-hexyldecyl.

When $X_1$ and $X_2$ each represents a heterocyclic group, this heterocyclic group is a 3- to 12-membered, preferably 5- or 6-membered, saturated or unsaturated, substituted or unsubstituted, single ring or fused ring heterocyclic group having 1 to 20 carbon atoms, preferably 1 to 10 carbon atoms and containing at least one hetero atom selected from, e.g., a nitrogen atom, an oxygen atom and a sulfur atom. Examples of the heterocyclic group are 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl, and pyranyl.

When $X_1$ and $X_2$ each represents an aryl group, this aryl group is a substituted or unsubstituted aryl group having 6 to 20 carbon atoms, preferably 6 to 10 carbon atoms. Typical examples of the aryl group are phenyl and naphthyl.

In formula (2), $X_3$ represents an organic group forming a nitrogen-containing heterocyclic group together with $>N-$. This heterocyclic group is a 3- to 12-membered, preferably 5- or 6-membered, substituted or unsubstituted, saturated or unsaturated, single ring or fused ring heterocylic group which has 1 to 20 carbon atoms, preferably 1 to 15 carbon atoms, and which may contain an oxygen atom or a sulfur atom in addition to the nitrogen atom. Examples of the heterocyclic group are pyrrolidino, piperidino, morpholino, 1-piperadinyl, 1-indolinyl, 1,2,3,4-tetrahydroquinolin-1-yl, 1-imidazolidinyl, 1-pyrazolyl, 1-pyrrolinyl, 1-pyrazolidinyl, 2,3-hydro-1-indazolyl, 2-isoindolynyl, 1-indolyl, 1-pyrrolyl, 4-thiazine—S,S-dioxo-4-yl, and benzoxadin-4-yl.

Meanwhile, when the above-mentioned $X_1$ and $X_2$ each represents an alkyl group, aryl group or heterocyclic group having a substituent group, and when the nitrogen-containing heterocyclic group formed by $X_3$ and >N— has a substituent group, examples of the substituent groups are: a halogen atom (e.g., fluorine, or chlorine), an alkoxycarbonyl group (having 2 to 30 carbon atoms, preferably 2 to 20 carbon atoms, e.g. methoxycarbonyl, dodecyloxycarbonyl, or hexadecyloxycarbonyl), an acylamino group (having 2 to 30 carbon atoms, preferably, 2 to 20 carbon atoms, e.g., acetamido, tetradecanamido, 2-(2,4-di-t-amylphenoxy)-butanamido, or benzamido), sulfonamido group (having 1 to 30 carbon atoms, preferably 1 to 20 carbon atoms, e.g., methanesulfonamido, dodecanesulfonamido, hexadecylsulfonamido, or benzenesulfonamido), a carbamoyl group (having 1 to 30 carbon atoms, preferably 1 to 20 carbon atoms, e.g., N-butylcarbamoyl, or N,N-diethylcarbamoyl), an N-sulfonylcarbamoyl group (having 1 to 30 carbon atoms, preferably 1 to 20 carbon atoms, e.g., N-mesylcarbamoyl, or N-dodecylsulfonylcarbamoyl), a sulfamoyl group (having 1 to 30 carbon atoms, preferably, 1 to 20 carbon atoms, e.g., N-butylsulfamoyl, N-dodecylsulfamoyl, N-hexadecylsulfamoyl, N-3-(2,4-di-t-amylphenoxy)butylsulfamoyl, or N,N-diethylsulfamoyl), an alkoxy group (having 1 to 30 carbon atoms, preferably 1 to 20 carbon atoms, e.g., methoxy, hexadecyloxy, or isopropoxy), an aryloxy group (having 6 to 30 carbon atoms, preferably 6 to 10 carbon atoms, e.g., phenoxy, 4-methoxyphenoxy, 3-t-butyl-4-hydroxyphenoxy, or naphthoxy), an aryloxycarbonyl group (having 7 to 21 carbon atoms, preferably 7 to 11 carbon atoms, e.g., phenoxycarbonyl), an N-acylsulfamoyl group (having 2 to 30 carbon atoms, preferably, 2 to 20 carbon atoms, e.g., N-propanoylsulfamoyl, or N-tetradecanoylsulfamoyl), a sulfonyl group (having 1 to 30 carbon atoms, preferably, 1 to 20 carbon atoms, e.g., methanesulfonyl, octanesulfonyl, 4-hydroxyphenylsulfonyl, or dodecansulfonyl), an alkoxycarbonylamino group (having 2 to 30 carbon atoms, preferably 2 to 20 carbon atoms, e.g., ethoxycarbonylamino), cyano group, nitro group, carboxyl group, hydroxy group, sulfo group, an alkylthio group (having 1 to 30 carbon atoms, preferably 1 to 20 carbon atoms, e.g., methylthio, dodecylthio, or dodecylcarbamoylmethylthio), a ureido group (having 1 to 30 carbon atoms, preferably 1 to 20 carbon atoms, e.g., N-phenylureido or N-hexadecylureido), an aryl group (having 6 to 30 carbon atoms, preferably, 6 to 10 carbon atoms, e.g., phenyl, naphthyl, or 4-methoxyphenyl), a heterocyclic group (having 1 to 20 carbon atoms, preferably 1 to 10 carbon atoms, which contains at least one of, for example, nitrogen, oxygen or sulfur, as hetero atoms, and is 3- to 12-membered, preferably 5- or 6-membered, single ring or fused ring one, e.g., 2-pyridyl, 3-pyrazolyl, 1-pyrrolyl, 2,4-dioxo-1,3-imidazolidine-yl, 2-benzoxyazolyl, morpholino, or imidolyl), an alkyl group (a straight, branced or cyclic, saturated or unsaturated alky group having 1 to 30 carbon atoms, preferably 1–20, e.g., methyl, ethyl, isopropyl, cyclopropyl, t-pentyl, t-octyl, cyclopentyl, t-butyl, sec-butyl, dodecyl, or 2-hexyldecyl), an acyl group (having 1 to 30 carbon atoms, preferably 1 to 20 carbon atoms, e.g., acetyl or benzoyl), an acyloxy group (having 1 to 30 carbon atoms, preferably 2 to 20 carbon atoms, e.g., propanoyloxy, or tetradecanoyloxy), an arylthio group (having 6 to 20 carbon atoms, preferably 6 to 10 carbon atoms, e.g., phenylthio, or naphthylthio), a sulfamoylamino group (having 0 to 30 carbon atoms, preferably 0 to 20 carbon atoms, e.g., N-butylsulfamoylamino, N-dodecylsulfamoylamino, or N-phenylsulfamoylamino), and an N-sulphonylsulfamoyl group (having 1 to 30 carbon atoms, preferably 1 to 20 carbon atoms, e.g., N-mesylsulfamoyl, N-ethanesulfonylsulfamoyl, N-dodecanesulfonylsulfamoyl, or N-hexadecanesulfonylsulfamoyl). These substituent groups each may further have a substituent group. Example of this substituent group are the same as those mentioned above.

Of the above-listed substituent groups, preferable are the alkoxy group, halogen atom, alkoxycarbonyl, acyloxy group, acylamino group, sulfonyl group, carbamoyl group, sulfamoyl group, sulfonamido group, nitro group, alkyl group and aryl group.

In formulas (1) and (2), when Y represents an aryl group, this aryl group is a substituted or unsubstituted aryl group having 6 to 20, preferably 6 to 10 carbon atoms. Typical examples are phenyl group and naphthyl group.

Meanwhile, when Y represents a heterocyclic group, Y has the same meaning as of the above-mentioned $X_1$ or $X_2$ when representing an heterocyclic group.

When Y represents a substituted aryl group or a substituted heterocyclic group, examples of the substituent are the same as the substituent groups listed as the examples of the case where $X_1$ has a substituent group. Preferable examples of the substituent group which Y has are those in which one of the substituent groups thereof is a halogen atom, an alkoxycarbonyl group, a sulfamoyl group, a carbamoyl, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Particularly preferable examples of Y are phenyl groups having at least one substituent group at its ortho position.

The group represented by Z in each of formulas (1) and (2) is any of the known coupling split-off groups. Preferable as z are a nitrogen-containing heterocyclic group which bonds to a coupling position through its nitrogen atom, an aryloxy group, an arylthio group, a heterocyclic oxy group, an acyloxy group, a carbamoyloxy group, an alkylthio group, and a halogen atom.

The split-off groups may be any of non-photographically useful groups, photographically useful groups, or precursers thereof (e.g., a development inhibitor, a development accelarator, a desilvering accelerator, a fogging agent, a dye, a hardening agent, a coupler, a scavenger for an oxidized form of a developing agent, a fluorescent dye, a developing agent, or an electron transferring agent).

When Z represents a photographically useful group, the known groups are useful. For example, U.S. Pat. Nos. 4,248,962; 4,409,323; 4,438,193; 4,421,845; 4,618,571; 4,652,516; 4,861,701; 4,782,012; 4,857,440; 4,847,185; 4,477,563; 4,438,193; 4,628,024; 4,618,571; and 4,741,994 and Laid-open European Patent 193,389A, 348,139A and 272,573A disclose the photographically useful groups, or split-off groups (e.g., a timing group) which releases the photographically useful groups.

When Z represents a nitrogen-containing heterocyclic group which bonds to a coupling position through its nitrogen atom, this nitrogen-containing heterocyclic group is preferably a 5- or 6-membered, substituted or unsubstituted, saturated or unsaturated, single ring or fused ring heterocyclic group having 1 to 15 carbon atoms, preferably 1 to 10 carbon atoms. This heterocyclic group may also contain an oxygen atom or sulfur atom in addition to the nitrogen atom, as its hetero atom. Preferable examples of the heterocyclic group are 1-pyrazolyl, 1-imidazolyl, pyrrolino, 1,2,4-triazol-2-yl, 1,2,3-triazol-1-yl, benzotriazolyl, benzimidazolyl, imidazolidin-2,4-dione-3-yl, oxazolidin-2,4-dione-3-yl, 1,2,4-triazolidin-3,5-dione-4-yl, imidazolidin-2,4,5-trione-3-yl, 2-imidazolinone-1-yl, 3,5-dioxomorpholino, and 1-indazolyl. In the case where these heterocyclic groups each contain a substituent group, examples thereof are the same as those listed as the substituent groups which may be included in the group represented by the above-mentioned $X_1$. Preferable examples of this substituent group are those in each of which one of the substituent groups is an alkyl group, an alkoxy group, a halogen atom, an alkoxycarbonyl group, an aryloxycarbonyl group, an alkylthio group, an acylamino group, a sulfonamido group, an aryl group, nitro, a carbamoyl group, cyano, or a sulfonyl group.

When Z represents an aromatic oxy group, this aromatic oxy group is preferably a substituted or unsubstituted atomatic oxy group having 6 to 10 carbon atoms, and more preferably it is a substituted or unsubstituted phenoxy group. When the aromatic oxy group has a substituent group, examples of this substituent group are those listed as the substituent group which may be included in the group represented by $X_1$. Preferable substituent groups are those in each of which at least one substituting group is an electron attractive group, for example, a sulfonyl group, an alkoxycarbonyl group, a sulfamoyl group, a halogen atom, a carbamoyl group, nitro, cyano, or an acyl group.

When Z represents an aromatic thio group, this aromatic thio group is a substituted or unsubstituted aromatic thio group having 6 to 10 carbon atoms, and more preferably it is a substituted or unsubstituted phenylthio group. When the aromatic thio group has a substituent group, examples of this substituent group are those listed as the substituting group which may be included in the group represented by $X_1$. Preferable substituting groups are those in each of which at least one substituent group is an alkyl group, an alkoxy group, a sulfonyl group, an alkoxycarbonyl group, a sulfamoyl group, a halogen atom, a carbamoyl group, or nitro.

When Z represents a heterocyclic oxy group, the heterocyclic moiety thereof is a 3- to 12-memered, preferably 5- or 6-membered, saturated or unsaturated, substituted or unsubstituted, single ring or fused ring heterocyclic group having 1 to 20 carbon atoms, preferably 1 to 10 carbon atoms, and containing at least one heteroatom selected from, e.g., a nitrogen atom, an oxygen atom and a sulfur atom. Examples of the heterocyclic oxy group are a pyridyloxy group, pyrazolyloxy group, and furyloxy group. When the heterocyclic oxy group has a substituent group, examples of this substituent group are those listed as the substituent group which may be included in the group represented by $X_1$. Preferable substituent groups are those in each of which at least one substituent group is an alkyl group, an aryl group, carboxyl group, an alkoxy group, a halogen atom, an alkoxycarbonyl group, an aryloxycarbonyl group, an alkylthio group, an acylamino group, a sulfonamido group, nitro, a carbamoyl group, or a sulfonyl group.

When Z represents a heterocyclic thio group, the heterocyclic moiety thereof is a 3- to 12-memered, preferably 5- or 6-membered, saturated or unsaturated, substituted or unsubstituted, single ring or fused ring heterocyclic group having 1 to 20 carbon atoms, preferably 1 to 10 carbon atoms, and containing at least one heteroatom selected form, e.g., a nitrogen atom, an oxygen atom and a sulfur atom. Examples of the heterocyclic thio group are a tetrazolylthio group, 1,3,4-thiadiazolylthio group, 1,3,4-oxadiazolylthio group, 1,3,4-triazolylthio group, benzoimidazolylthio group, benzothiazolythio group, and 2-pyridylthio group. When the heterocyclic thio group has a substituent group, examples of this substituent group are those listed as the substituent group which may be included in the group represented by $X_1$. Preferable substituent groups are those in each of which at least one substituent group is an alkyl group, an aryl group, carboxyl group, an alkoxy group, a halogen atom, an alkoxycarbonyl group, an aryloxycarbonyl group, an alkylthio group, an acylamino group, a sulfonamido group, nitro, a carbamoyl group, a heterocyclic group, or a sulfonyl group.

When Z represents an acyloxy group, this acyloxy group is preferably a substituted or unsubstituted, single ring or fused ring aromatic acyloxy group having 6 to 10 carbon atoms, or a substituted or unsubstituted aliphatic acyloxy group having 2 to 30 carbon atoms, preferably 2 to 20 carbon atoms. When the acyloxy group has a substituent group, examples of this substituent group are those listed as the substituent group which may be included in the group represented by $X_1$.

When Z represents a carbamoyloxy group, this carbamoyloxy group is a substituted or unsubstituted, aliphatic, aromatic or heterocyclic carbamoyloxy group having 1 to 30 carbon atoms, preferably 1 to 20 carbon atoms. Examples of the carbamoyloxy group are N,N-diethylcarbamoyloxy, N-phenylcarbamoyloxy, 1-imidazolylcarbonyloxy, and 1-pyrrolocarbonyloxy. When the carbamoyloxy group has a substituent group, examples of this substituent group are those listed as the substituent group which may be included in the group represented by $X_1$.

when Z represents an alkylthio group, this alkylthio group is a straight, branced or cyclic, saturated or unsaturated, substituted or unsubstituted alkylthio group having 1 to 30 carbon atoms, preferably 1 to 20 carbon atoms. In the case where the alkylthio group has a substituting group, examples of this substituent group are those listed as the substituent group which may be included in the group represented by $X_1$.

Next, preferable ranges for the couplers represented by formulas (1) and (2) will be described.

In the formula (1), the group represented by $X_1$ is preferably an alkyl group. Particularly preferable is an alky group having 1 to 10 carbon atoms.

The group represented by Y in each of formulas (1) and (2) is preferably an aromatic group. Particularly preferable is a phenyl group having at least one substituent group at the ortho position. Examples of the substituent group are the same as those listed above with reference to the case where Y represents an aromatic group. Preferable examples of the substituent group are also the same as those listed.

The group represented by Z in each of formulas (1) and (2) is preferably a 5- or 6-membered nitrogen-containing heterocyclic group which bonds to the coupling position through its nitrogen atom, an aromatic oxy group, a 5- or 6-membered heterocyclic oxy group, or a 5- or 6-membered heterocyclic thio group.

Of the couplers represented by formula (1) or (2), preferable are those represented by the following formula (3), (4), or (5).

Formula (3)

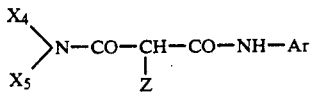

Formula (4)

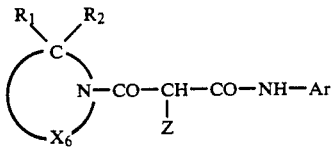

Formula (5)

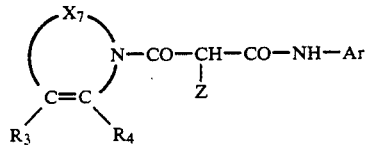

In these formulas, Z has the same meaning as in the formula (1), $X_4$ represents an alkyl group, $X_5$ represents an alkyl group, or an aromatic group, Ar represents a phenyl group having at least one substituent group at the ortho position, $X_6$ represents an organic group which forms a nitrogen-containing heterocyclic group (single ring or fused ring) together with $-C(R_1R_2)-N<$, $X_7$ represents an organic group which forms a nitrogen-containing heterocyclic group (single ring or fused ring) together with $-C(R_3)=C(R_4)-N<$, and $R_1$, $R_2$, $R_3$ and $R_4$ each represents a hydrogen atom or a substituent group.

Regarding the groups represented by $X_4$–$X_7$, Ar, and Z in formulas (3)–(5), the explanations and preferable ranges are the same as those stated in connection with formulas (1) and (2). When $R_1$–$R_4$ each represents a substituent group, examples of this substituent group are the same as the examples of those which may be included in $X_1$.

Particularly preferable couplers in the above the formulas are those represented by formula (4) or (5).

The couplers represented by formulas (1)–(5) may combine with each other via groups having a valence of 2 or more, at the group represented by $X_1$–$X_7$, Y, Ar, $R_1$–$R_4$, and/or Z to form a dimer or higher ones (e.g. telomer, or polymer). In this case, the carbon number may be out of the range specified for each of the above-described substituent groups.

The couplers represented by formulas (1)–(5) should preferably be of a nondiffusing type. The nondiffusing coupler is defined as one having a group (nondiffusing group) which increases the molecular weight to a sufficient level to immobilize the molecules in the layer to which the coupler is added. In general, alkyl groups having a total carbon number of 8–30, preferably, 10–20, or aryl groups having a substituent group of a total carbon number of 4–20 are used as the nondiffusing group. The nondiffusing group may have a substituent group at any of the molecule, and may have a plurality of substituent groups.

Specific examples (YA-1 to YA-67) of the yellow couplers represented by formulas (1)–(5) will be listed below; however, the invention is not limited to these examples.

YA-1

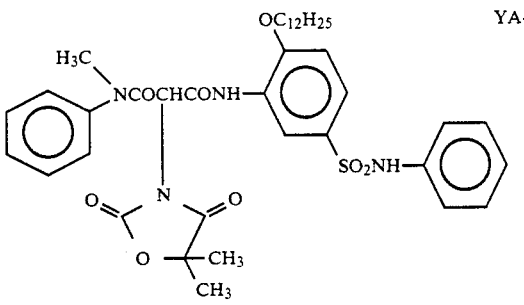

YA-2

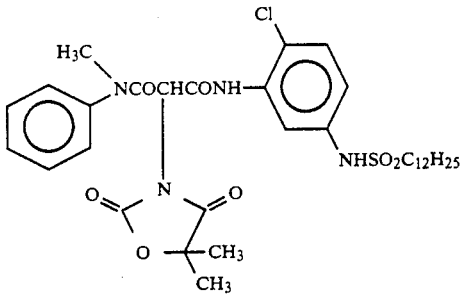

YA-3

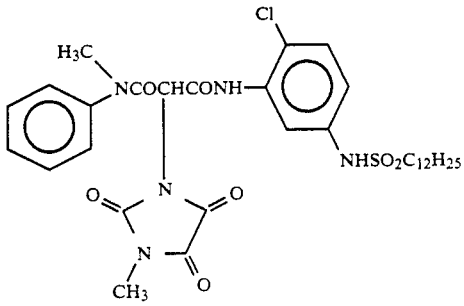

YA-4

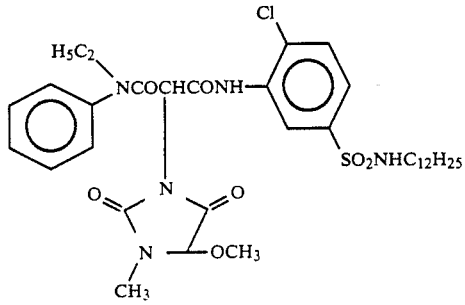

-continued
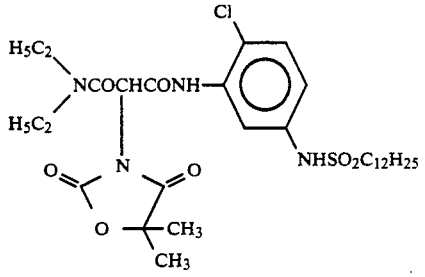
YA-5
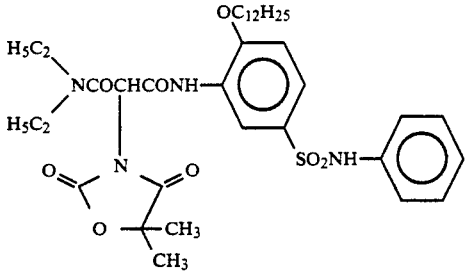
YA-6
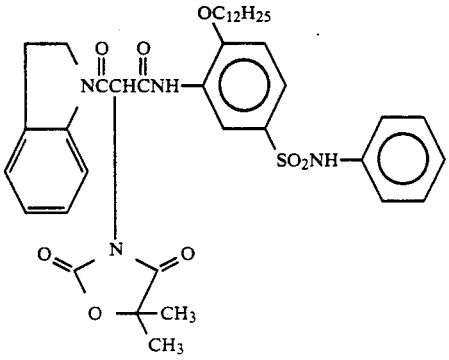
YA-7
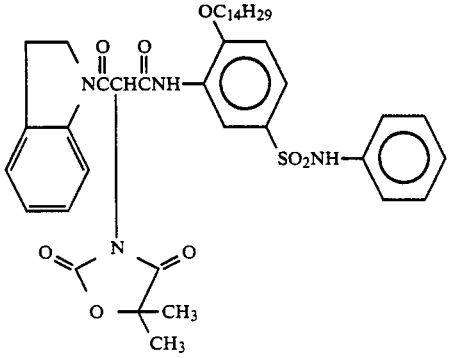
YA-8
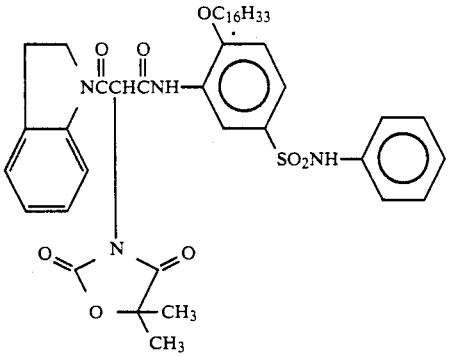
YA-9
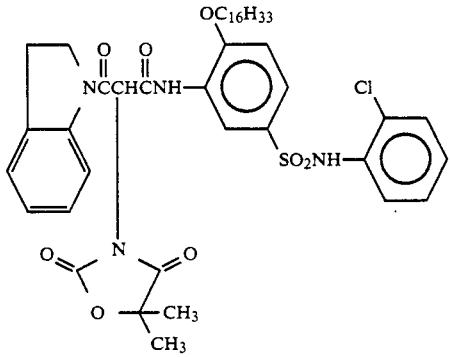
YA-10
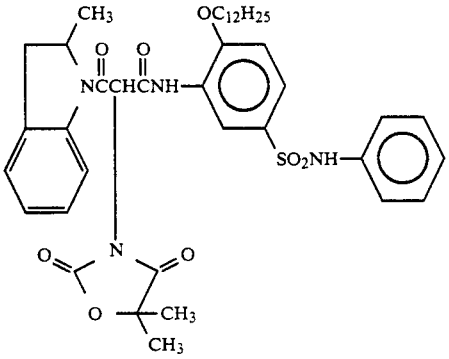
YA-11
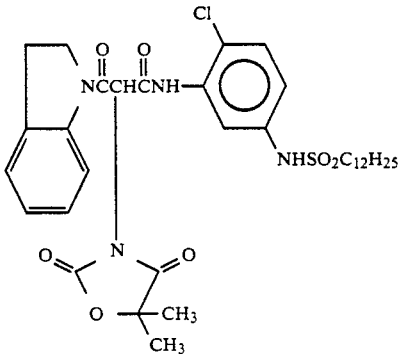
YA-12

-continued
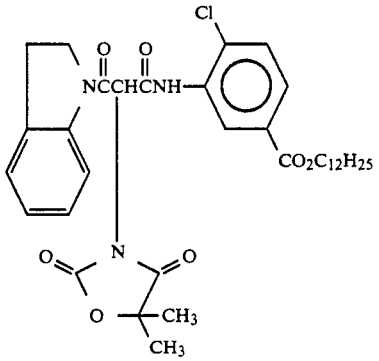
YA-13
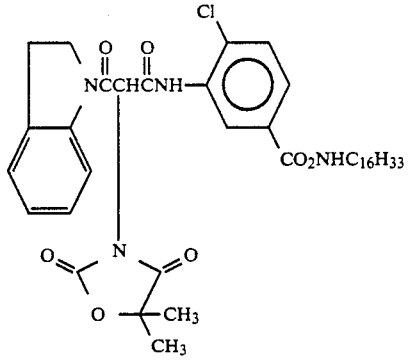
YA-14
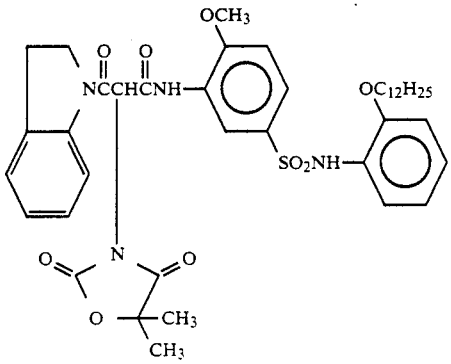
YA-15
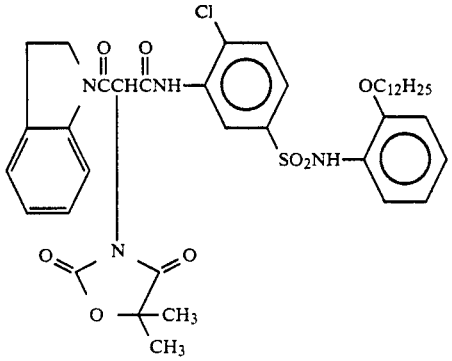
YA-16
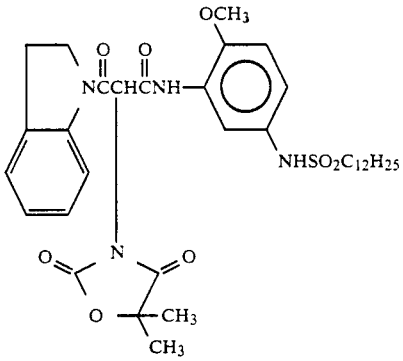
YA-17
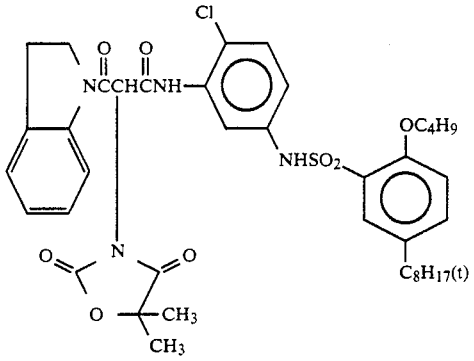
YA-18
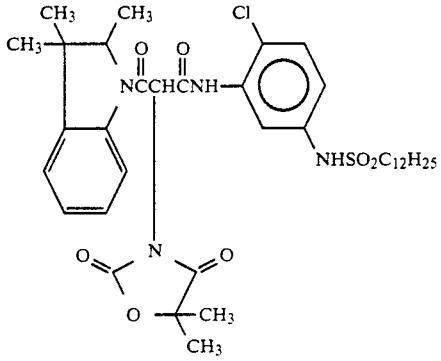
YA-19
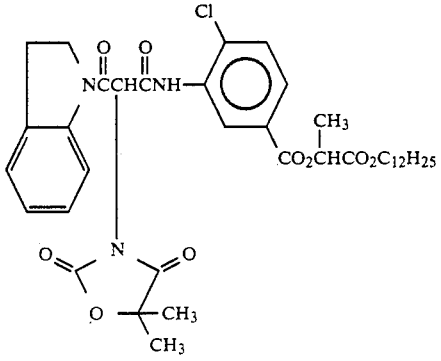
YA-20

-continued
YA-21
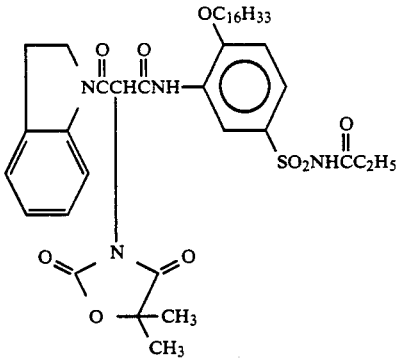
YA-22
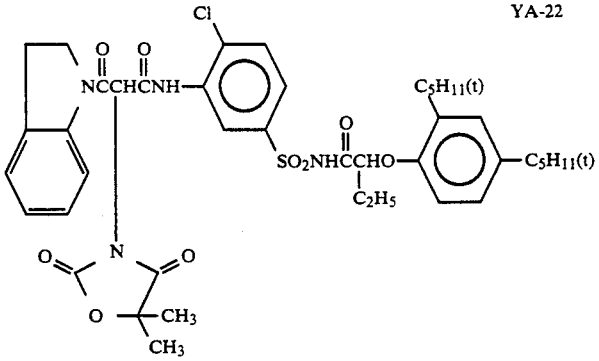
YA-23
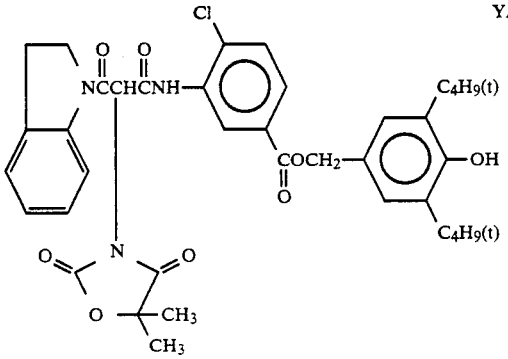
YA-24
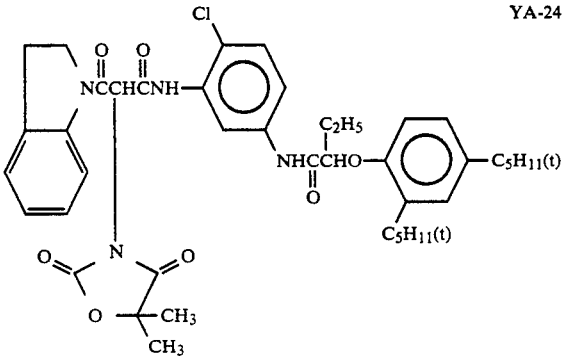
YA-25
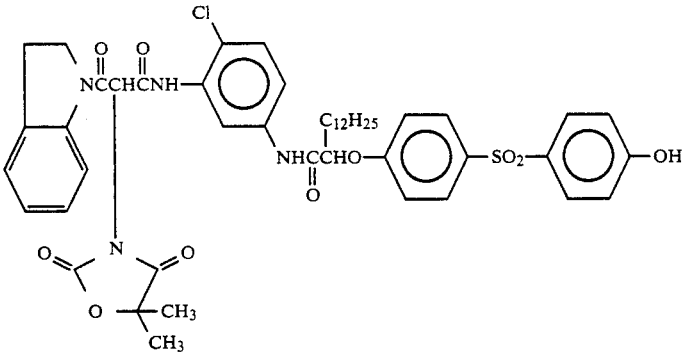
YA-26
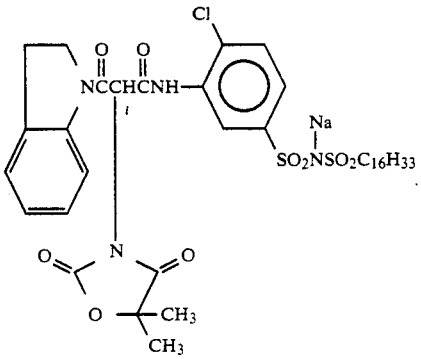
YA-27
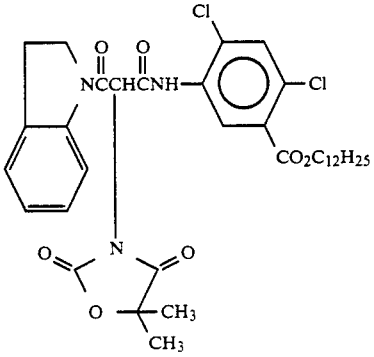

-continued
YA-28
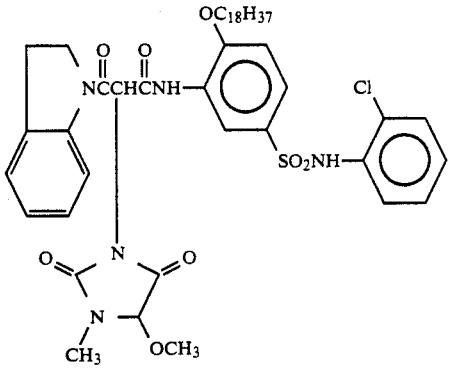
YA-29
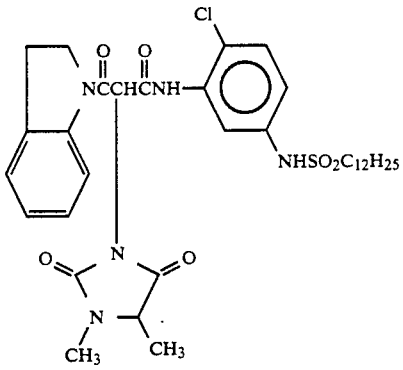
YA-30
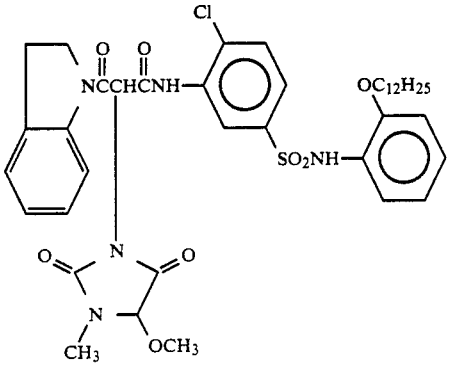
YA-31
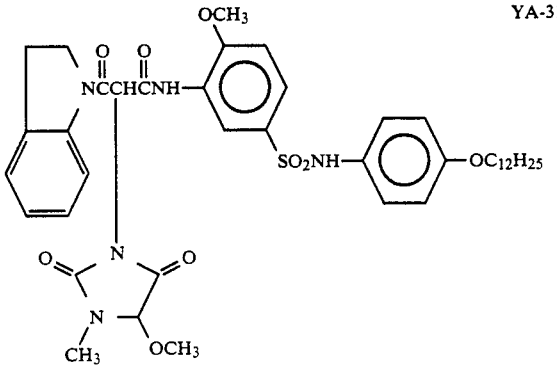
YA-32
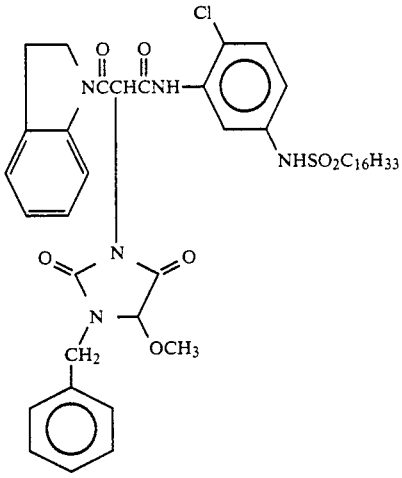
YA-33
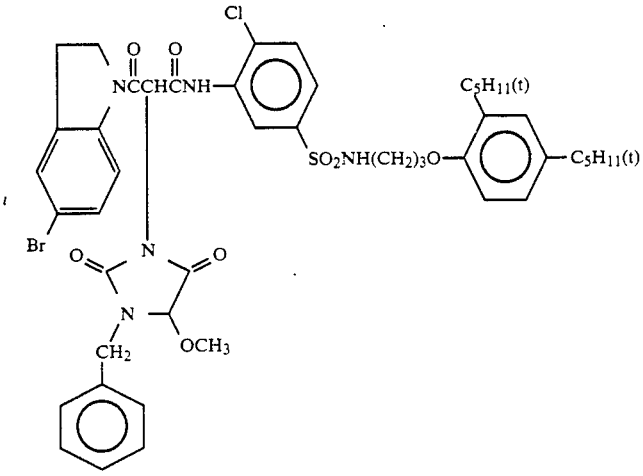

-continued
YA-34
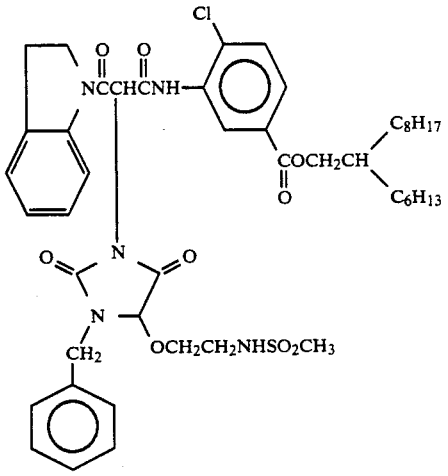
YA-35
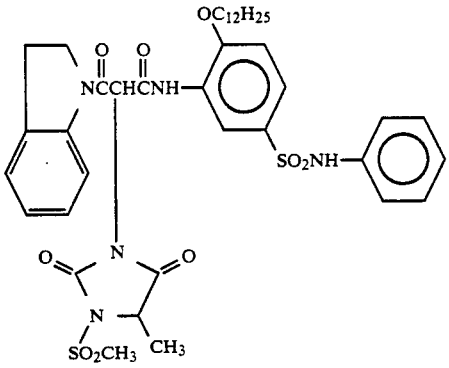
YA-36
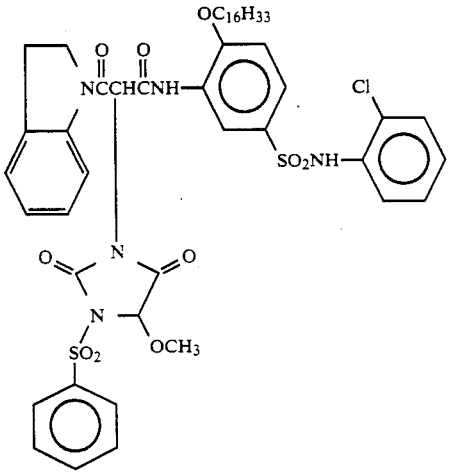
YA-37
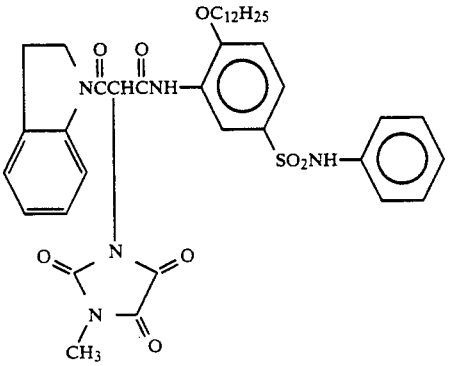
YA-38
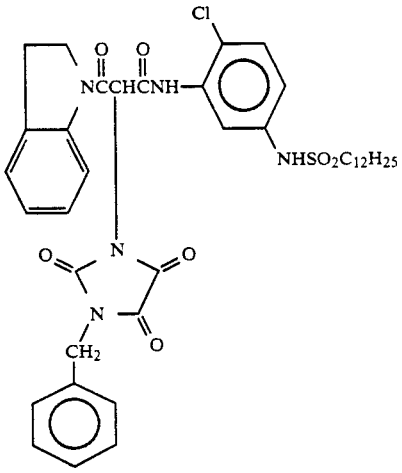
YA-39
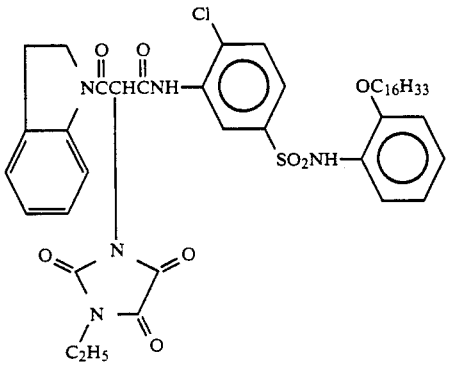

-continued
YA-40
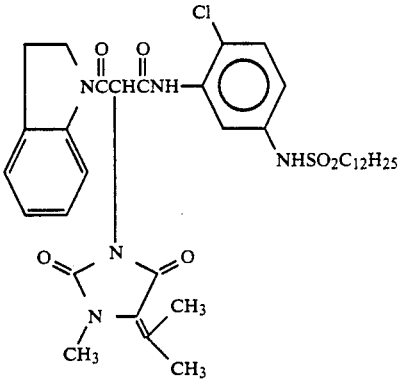
YA-41
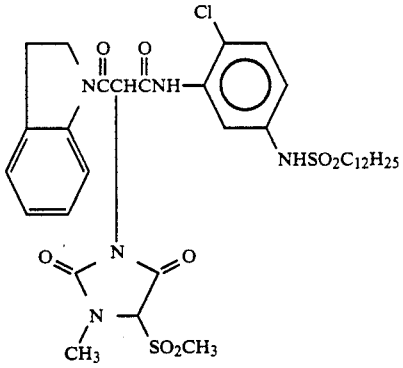
YA-42
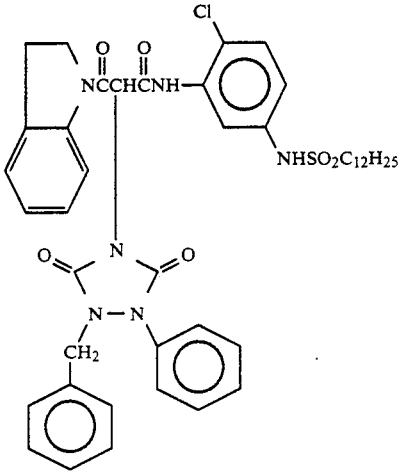
YA-43
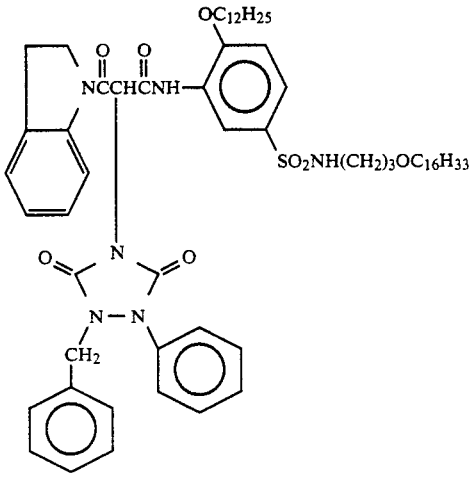
YA-44
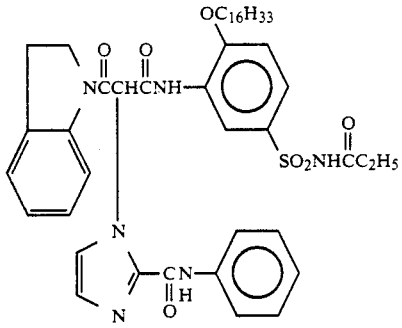
YA-45
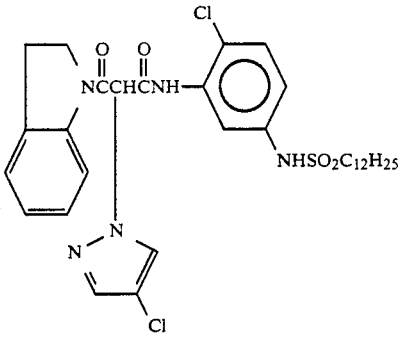
YA-46
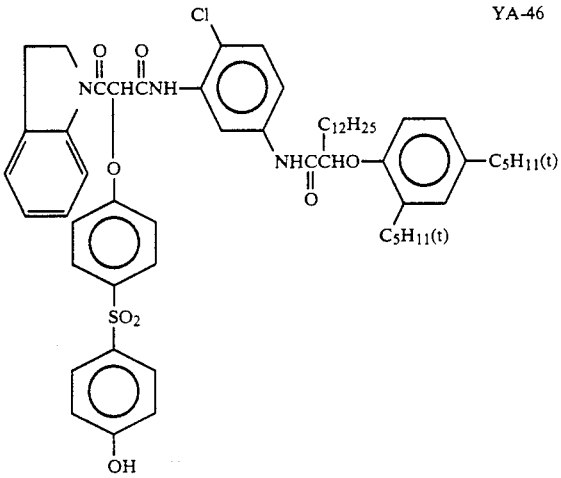
YA-47
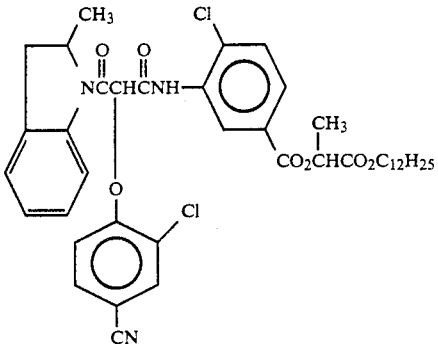

-continued
YA-48
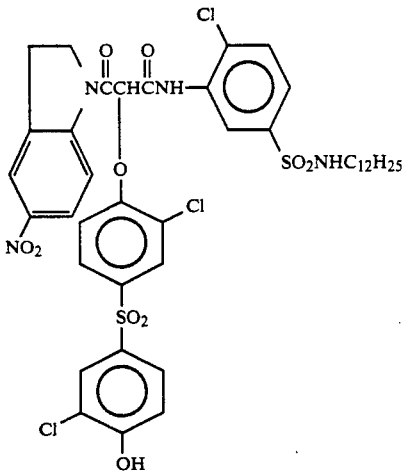
YA-49
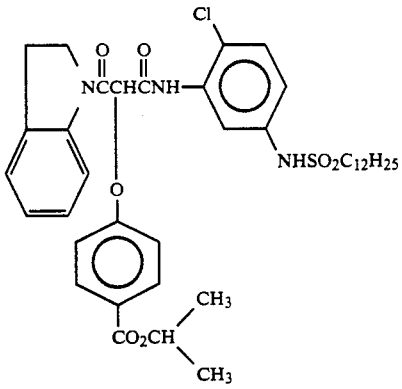
YA-50
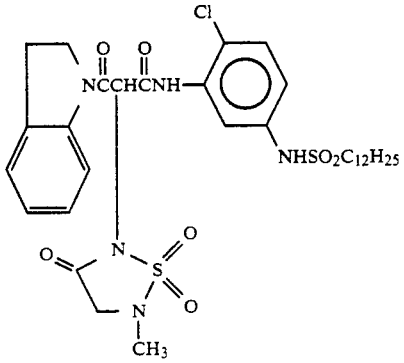
YA-51
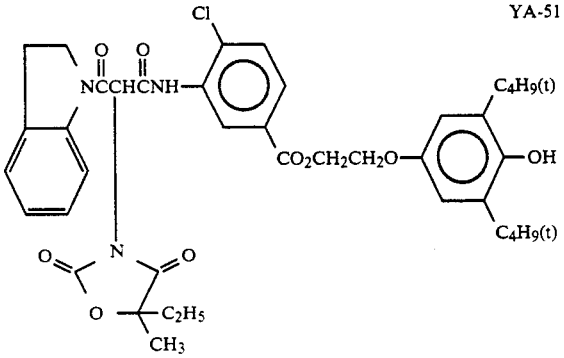
YA-52
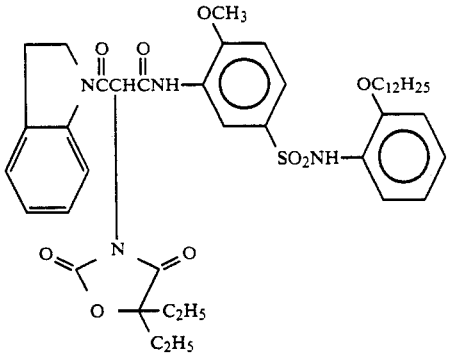
YA-53
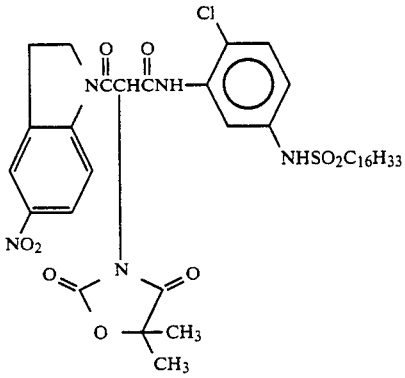
YA-54
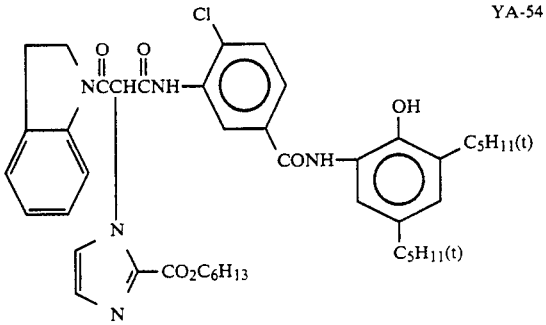
YA-55
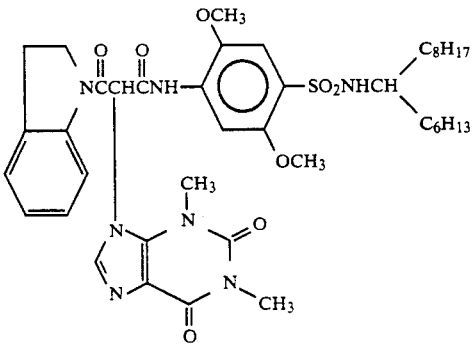

-continued
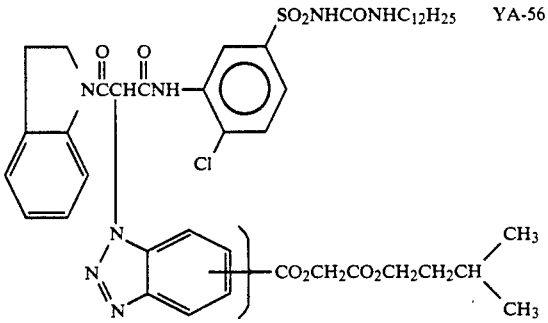
YA-56
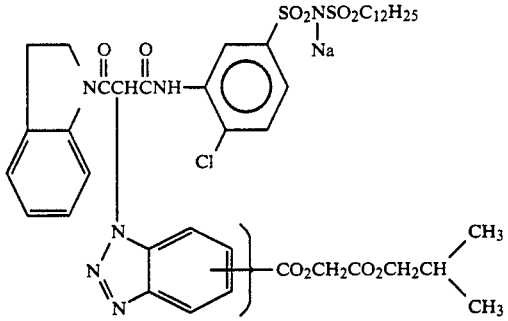
YA-57
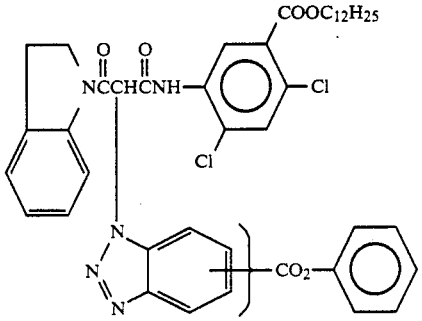
YA-58
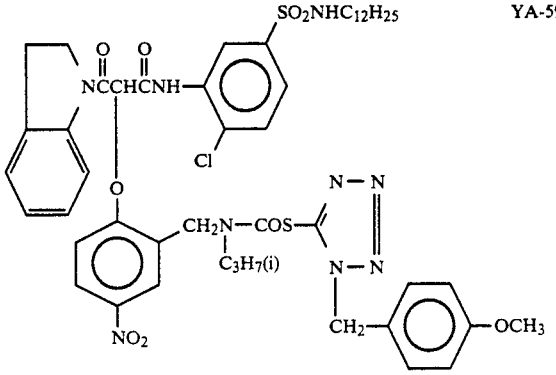
YA-59
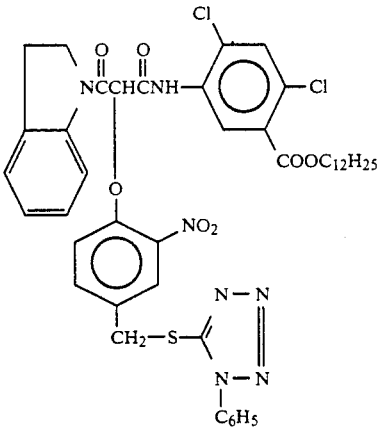
YA-60
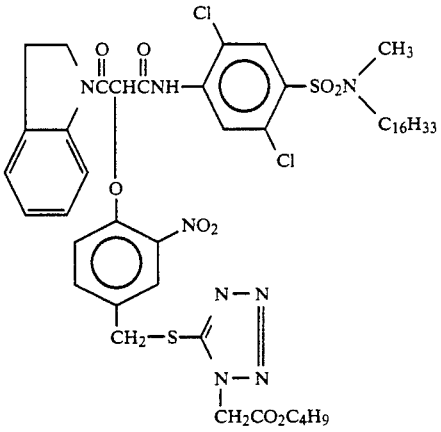
YA-61
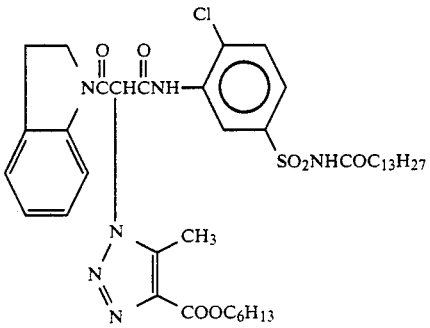
YA-62
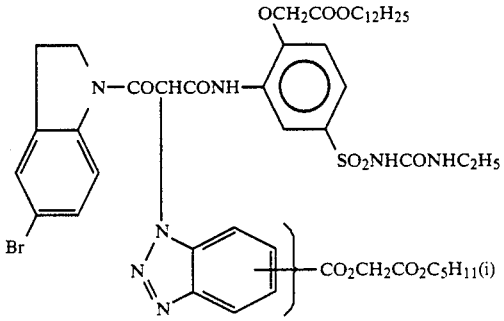
YA-63

-continued
YA-64
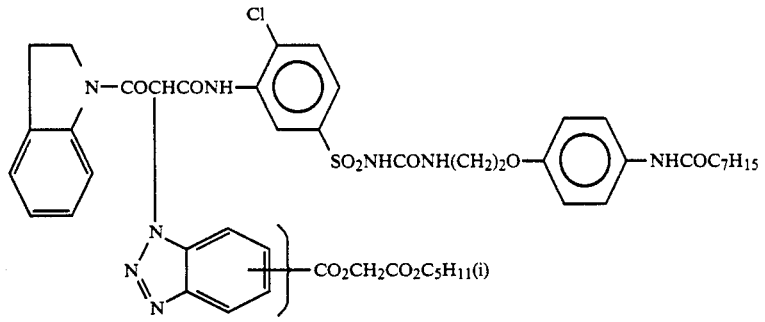
YA-65
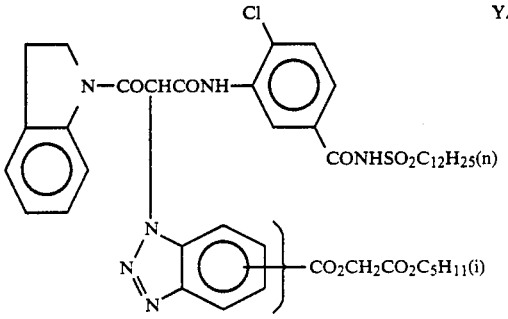
YA-66
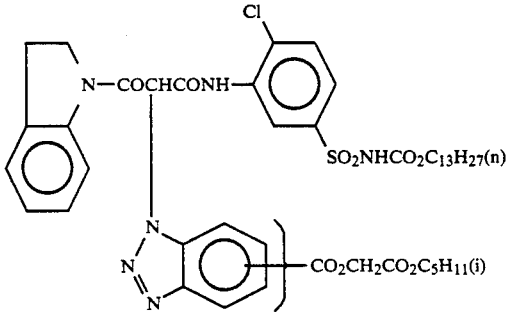
YA-67
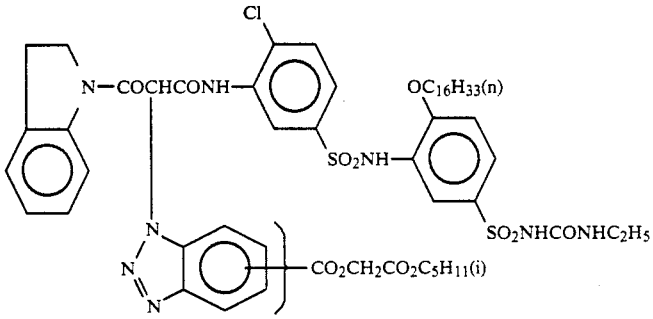
It should be noted that in YA-56, YA-57, YA-58, YA-63, YA-64, YA-65, YA-66, and YA-67, "}" indicates that the fifth or sixth position of the benzotriazolyl group is substituted with the substituent group.
The yellow couplers used in the invention, and represented by formulas (1)-(5), can be synthesized in the following manner:
Synthesis Example 1
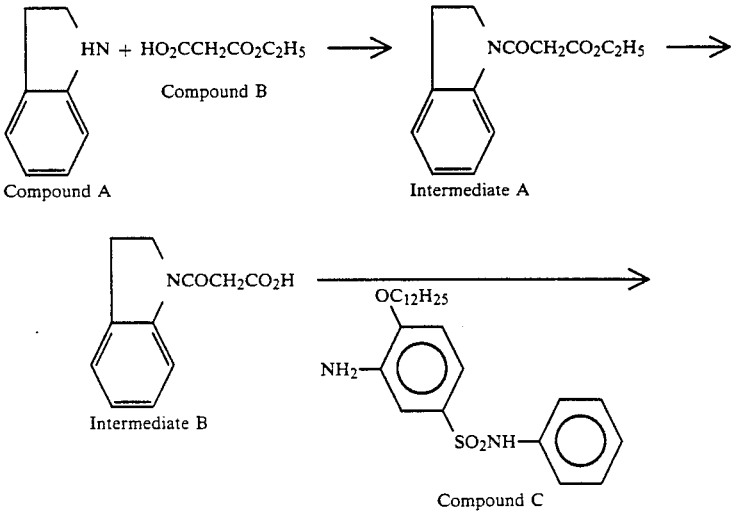

-continued

Synthesis Example 1

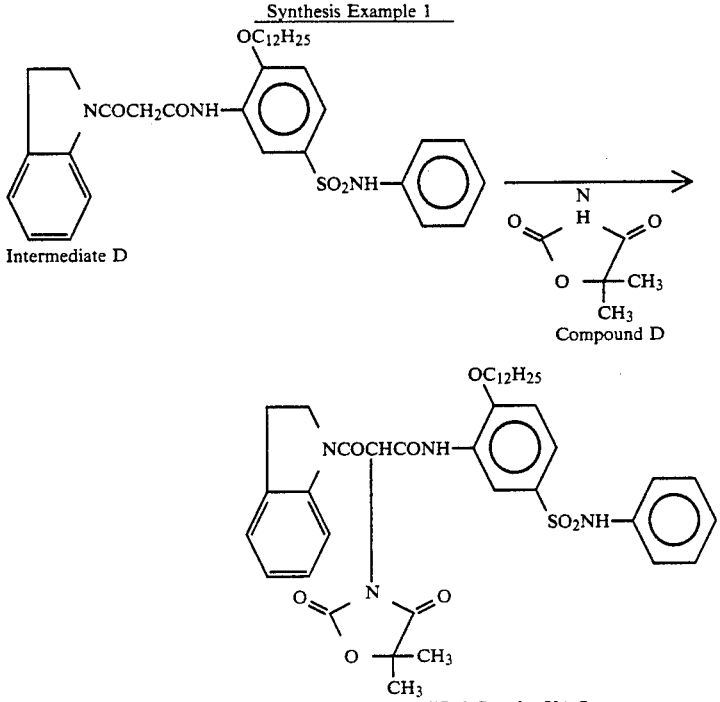

Synthesis of Intermediate B 357.5 g (3.0 mol) of compound A, and 396.3 g (3.0 mol) of compound B were dissolved in 1.2 liters of ethyl acetate and 0.6 liters of dimethylformamide, to make a solution. While stirring the solution, a solution of 631 g (3.06 mol) of dicyclohexylcarbodiimide in 400 ml of acetonitrile was added dropwise at 15° C. to 35° C. The mixture was reacted for 2 hours at 20° C. to 30° C., and then the precipitated dicyclohexylurea was filtered out. To the filtrate, 500 ml of ethyl acetate and 1 liter of water were added, and the aqueous layer was removed. Then, the organic layer was washed with 1 liter of water twice. After the organic layer was dried over anhydrous sodium sulfate, the ethyl acetate was distilled off under a reduced pressure, thereby obtaining 692 g (98.9%) of intermediate A in the form of an oil.

692 g (2.97 mol) of the intermediate A was dissolved in 3 liters of ethyl alcohol to prepare a solution, and while stirring the solution, 430 g of 30% sodium hydroxide was added dropwise at 75° C. to 80° C. Then, the solution was reacted for 30 minutes at that temperature, and the precipitated crystals were collected by filtering. yield: 658 g.

The crystals were suspended in 5 liters of water, and while stirring this suspension, 300 ml of concentrated hydrochloric acid was added dropwise at 40° C. to 50° C. Then, the suspension was further stirred for 1 hour, and the crystals separated were filtered out, thereby obtaining 579 g (95%) of intermediate B (decomposition point of 127° C.).

Synthesis of Intermediate D 45.1 g (0.22 mol) of the intermediate B, and 86.6 g (0.2 mol) of compound C were dissolved in 400 ml of ethyl acetate and 200 ml of dimethylacetamide to make a solution. While stirring the solution, a solution of 66 g (0.32 mol) of dicyclohexylcarbodiimide in 100 ml of acetonitrile was added dropwise at 15° C. to 30° C. The mixture was reacted for 2 hours at 20° C. to 30° C., and the precipitated dicyclohexylurea was filtered off.

To the filtrate, 400 ml of ethyl acetate and 600 ml of water were added, and the aqueous layer was removed. Then, the organic layer was washed with water two times. After the organic layer was dried over anhydrous sodium sulfate, the ethyl acetate was distilled off under a reduced pressure, thereby obtaining 162 g of an oily substance.

The oily substance was crystallized from 100 ml of ethyl acetate and 300 ml of n-hexane, thereby obtaining 108 g (87.1%) of intermediate D (melting point of 132° C. to 134° C.).

TABLE 1

Elemental Analysis of Intermediate D

| | C % | H % | N % |
|---|---|---|---|
| Calculated value | 67.82 | 7.32 | 6.78 |
| Measured value | 67.81 | 7.32 | 6.76 |

Synthesis of Coupler YA-7

49.6 g (0.08 mol) of the intermediate D was dissolved in 300 ml of dichloromethane to make a solution. 11.4 g (0,084 mol) of sulfuryl chloride was added to this solution dropwise at 10° C. to 15° C. while stirring the solution.

After the solution was reacted for 30 minutes at that temperature, 200 g of 5% sodium bicarbonate aqueous solution was added dropwise to the reaction mixture. Then, the organic layer was separated, washed with 200 ml of water and dried over anhydrous sodium sulfate. The dichloromethane was distilled off under a reduced pressure, thereby obtaining 47 g of oily substance.

47 g of the oily substance was dissolved in 200 ml of acetonitrile to prepare a solution, and while stirring this solution, 28.4 g (0.22 mol) of compound D and 22.2 g (0.22 mol) of triethylamine were added thereto. After the mixture was reacted for about 4 hours at 40° C. to 50° C., the reaction mixture was poured into 300 ml of water. The separated oily substance was extracted with 300 ml of ethyl acetate. Then, the organic layer was washed with 200 g of 5% sodium hydroxide aqueous solution, and then with 300 ml of water twice. The organic layer was acidified with diluted hydrochloric acid, and washed with water twice. This organic layer was concentrated under a reduced pressure, thereby obtaining a residue (yield of 70 g).

The obtained oily substance was crystallized from a solvent mixture of 50 ml of ethyl acetate and 100 ml of n-hexane, thereby obtaining 47.8 g (80%) of exemplified coupler YA-7 (melting point of 145° C. to 147° C.).

TABLE 2

| Elemental Analysis of Coupler YA-7 | | | |
|---|---|---|---|
| | C % | H % | N % |
| Calculated value | 64.32 | 6.75 | 7.50 |
| Measured value | 64.31 | 6.73 | 7.50 |

Synthesis Example 2

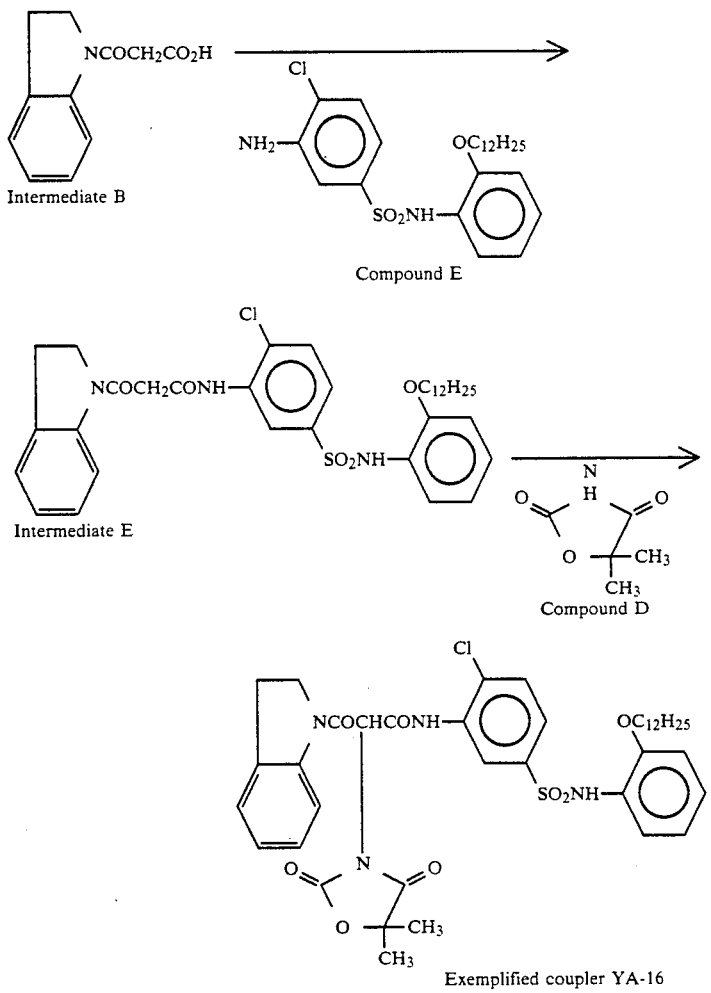

Synthesis of Intermediate E 90.39 (0.44 mol) of intermediate B, and 1879 (0.4 mol) of compound E were dissolved in 500 ml of ethyl acetate and 300 ml of dimethylformamide, to make a solution. While stirring the solution, a solution of 131.9 g (0.64 mol) of dicyclohexylcarbodiimide in 200 ml of acetonitrile was added dropwise at 15° C. to 35° C.

The mixture was reacted for 2 hours at 20° C. to 30° C., and after the reaction, the separated dicyclohexylurea was filtered out. To the filtrate, 500 ml of ethyl acetate and 600 ml of water were supplied, and the aqueous layer was removed. Then, the organic layer was washed with water twice. After the organic layer was dried over anhydrous sodium sulfate, the ethyl acetate was distilled off under a reduced pressure, thereby obtaining 681 g of oily substance.

This oily substance was dissolved in 1.5 liters of n-hexane while heating, and the insoluble matters were removed by filteration. The n-hexane solution was cooled by water, and the separated intermediate E was filtered. The yield was 243.4 g (93%) and the melting point of the intermediate E was 103° C. to 105° C.

TABLE 3

| Elemental Analysis of Intermediate E | | | |
|---|---|---|---|
| | C % | H % | N % |
| Calculated value | 64.25 | 6.78 | 6.42 |
| Measured value | 64.24 | 6.76 | 6.43 |

Synthesis of Coupler YA-16

39.3 g (0.06 mol) of the intermediate E was dissolved in 200 ml of dichloromethane to make a solution. 9.7 g (0,084 mol) of sulfuryl chloride was added to this solution dropwise at 10° C. to 15° C. while stirring the solution.

After the solution was reacted for 30 minutes at that temperature, 200 g of 4% sodium bicarbonate aqueous solution was added dropwise to the reaction mixture. Then, the organic layer was separated, washed with 200 ml of water and dried over anhydrous sodium sulfate. The dichloromethane was distilled off under a reduced pressure, thereby obtaining 41.3 g of oily substance.

47 g of the oily substance was dissolved into 100 ml of acetonitrile and 200 ml of dimethylacetamide to prepare a solution, and while stirring this solution, 20.8 g (0.16 mol) of compound D and 16.2 g of triethylamine were added thereto. After the mixture was reacted for about 3 hours at 30° C. to 40° C., the reaction mixture was poured into 400 ml of water, thus separating an oily substance. This separated oily substance was extracted with 300 ml of ethyl acetate. Then, the organic layer was washed with 300 g of 2% sodium hydroxide solution, and then with water twice. The organic layer was acidified with diluted hydrochloric acid, and washed with water twice. This organic layer was concentrated under a reduced pressure, thereby obtaining 42 g of residue.

The obtained residue was crystallized from 200 ml of methanol, thereby obtaining 39.8 g (85%) of exemplified coupler YA-16 (melting point of 110° C. to 112° C.).

TABLE 4

| Elemental Analysis of Coupler YA-16 | C % | H % | N % |
|---|---|---|---|
| Calculated value | 61.48 | 6.32 | 7.17 |
| Measured value | 61.46 | 6.30 | 7.18 |

Synthesis Example 3

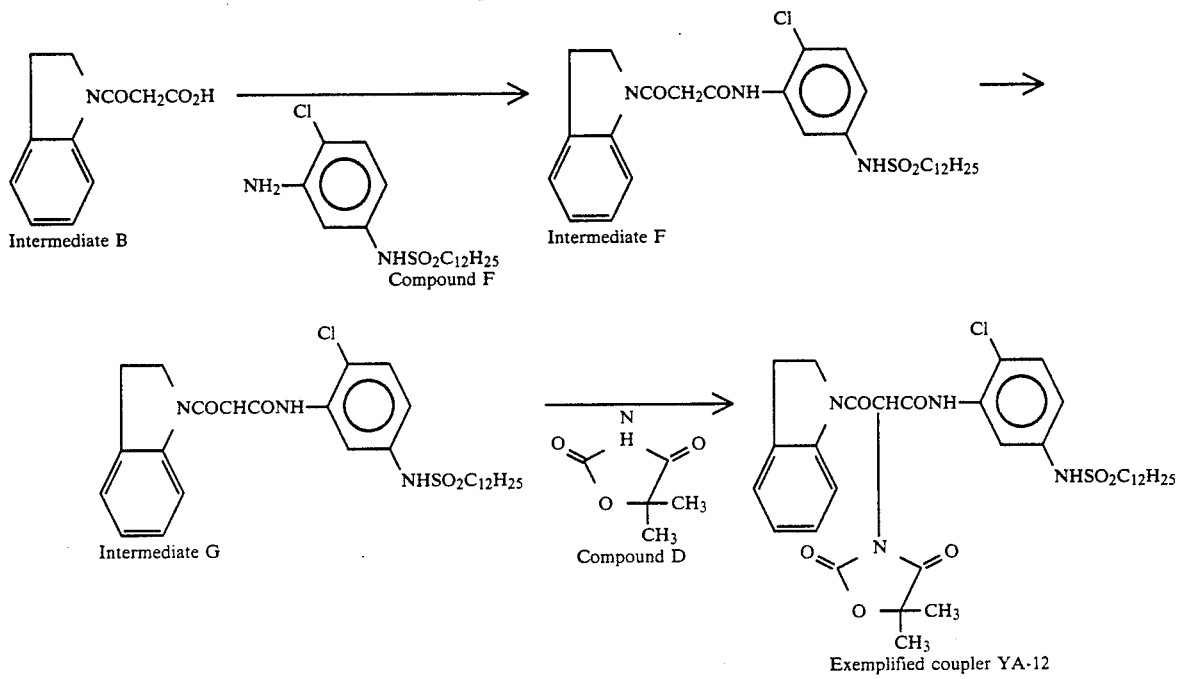

Synthesis of Intermediate F 104.7 g (0.51 mol) of intermediate B, and 187.5 g (0.5 mol) of compound F were dissolved into 1 liter of ethyl acetate and 400 ml of dimethylformamide, to make a solution. While stirring the solution, a solution of 107.3 g (0.525 mol) of dicyclohexylcarbodiimide in 100 ml of dimethylformamide was added dropwise at 15° C. to 30° C. The mixture was reacted for 1 hour at 20° C. to 30° C., and 50 ml of ethyl acetate was added to the reaction mixture. It was further heated up to 50° C. to 60° C., and dicyclohexylurea was filtered out.

To the filtrate, 500 ml of ethyl acetate was added, and the aqueous layer was removed. The residue was further washed with water twice. After the organic layer was dried over anhydrous sodium sulfate, the ethyl acetate was distilled off under a reduced pressure, thereby obtaining 290 g of an oily substance. This oily substance was dissolved into 1 liter of ethyl acetate and 2 liter of methanol while being heated, and the insoluble matters were removed by filteration. Then, the filtrate was cooled by water, and the precipitated crystals of intermediate E were filtered. The yield was 267 g (95%) and the melting point of the intermediate F was 163° C. to 164° C.

TABLE 5

| Elemental Analysis of Intermediate F | C % | H % | N % |
|---|---|---|---|
| Calculated value | 61.95 | 7.17 | 7.48 |
| Measured value | 61.93 | 7.17 | 7.46 |

Synthesis of Intermediate G 114.0 g (0.2 mol) of intermediate F was dissolved into 500 ml of dichloromethane, to make a solution. While stirring the solution, 28.4 g (0.21 mol) of sulfuryl chloride was added dropwise at 15° C. to 35° C.

After the solution was reacted for 30 minutes at that temperature, 500 g of 6% sodium bicarbonate aqueous solution was added dropwise to the reaction mixture. Then, the organic layer was separated, washed with 500 ml of water and dried over anhydrous sodium sulfate. The dichloromethane was distilled off under a reduced pressure, and the precipitated crystals of intermediate G were collected by filtration. The yield was 108.6 g (91%).

Synthesis of Coupler YA-12

29.8 g (0.05 mol) of intermediate G was dissolved into 80 ml of dimethylformamide to prepare a solution, and 12.9 g (0.1 mol) of compound D was added thereto. Then, while stirring the solution, 10.1 g (0.10 mol) of triethylamine was added dropwise at 20° C. to 30° C. After the mixture was reacted for 1 hour at 40° C. to 45° C., 300 ml of ethyl acetate and 200 ml of water were added to the solution. The organic layer was washed with 400 g of 2% sodium hydroxide solution twice, and then with water once. The organic layer was acidified with diluted with hydrochloric acid, and washed with water twice. Then, the organic layer was concentrated, thereby obtaining 34 g of residue. The residue was crystallized from a solvent mixture of 50 ml of ethyl acetate and 150 ml of n-hexane, thus obtaining 19 g of exemplified coupler YA-12.

The obtained crystals were recrystallized from 120 ml of a solvent mixture of ethyl acetate and n-hexane mixed at a volume ratio of ⅓, thereby obtaining 15 g (43.5%) of exemplified coupler YA-12 (melting point: 135° C. to 136° C.).

TABLE 6

| Elemental Analysis of Coupler YA-12 | C % | H % | N % |
|---|---|---|---|
| Calculated value | 59.24 | 6.58 | 8.13 |
| Measured value | 59.27 | 6.56 | 8.12 |

solution, a solution of 29.8 g (0.05 mol) of intermediate G in 30 ml of dimethylformamide was added dropwise.

After the mixture was reacted for 4 hours at 30° C. to 40° C., 400 ml of ethyl acetate and 300 ml of water were added to the reaction mixture. The organic layer was washed with 400 g of 2% sodium hydroxide solution, and then with water twice. The organic layer was acidified with diluted with hydrochloric acid, and washed with water twice. Then, the organic layer was dried over anhydrous sodium sulfate, and ethyl acetate was distilled off under a reduced pressure, thereby obtaining 54 g of residue.

The residue was crystallized from 300 ml of a solvent mixture of ethyl acetate and methanol (mixed at a volume ratio of ½), thereby obtaining (crystals of exemplified) coupler YA-49. The obtained crystals were recrystallized from 200 ml of a solvent mixture of ethyl acetate and methanol mixed at a volume ratio of ½, thereby obtaining 28.8 g (77.8%) of exemplified coupler YA-49 (melting point: 190° C.–191° C.).

TABLE 7

| Elemental Analysis of Coupler YA-49 | C % | H % | N % |
|---|---|---|---|
| Calculated value | 63.26 | 6.81 | 5.68 |
| Measured value | 63.24 | 6.79 | 5.67 |

In the present invention, the yellow coupler represented by formulas (1)–(5) can be used in the range of $2.0\text{–}1.0\times10^{-3}$ mol per mole of silver halide when used as a main coupler. The range should preferably be $5.0\times10^{-1}\text{–}2.0\times10^{-2}$ mol, more preferably be $4.0\times10^{-1}\times5.0\times10^{-2}$ mol, per mole of silver halide. When the coupler releases a photographically useful group, it can be used in the range of $0.5\text{–}1.0\times10^{-6}$ mol per mole of silver halide. The range should preferably be $1\times10^{-1}\text{–}1.0\times10^{-5}$ mol, more preferably be $5.0\times10^{-2}\text{–}5.0\times10^{-4}$ mol, per mole of silver halide.

Further, the yellow coupler represented by formulas (1)–(5) is preferably added to a blue-sensitive silver halide emulsion layer, or a non-light-sensitive layer adjacent thereto, when used as the main coupler. When the coupler is the one which releases a photographically useful group, it is added to a silver halide light-sensitive layer or a non-light-sensitive layer, in accordance with Synthesis Example 4

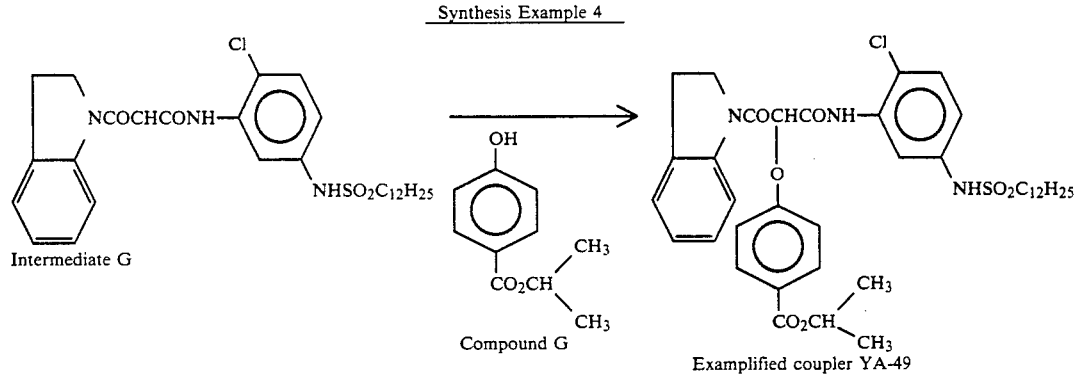

Synthesis of Coupler YA-49

27.0 g (0.15 mol) of compound G, and 15.2 g of triethylamine (0.15 mol) were dissolved into 50 ml of dimethylformamide to prepare a solution. While stirring this purpose.

The yellow couplers of formulas (1)–(5) can be used in combination of two or more of them, or in combination with other known couplers.

The couplers of formulas (1)-(5) can be introduced into a color light-sensitive material by a variety of known dispersion methods.

In the oil-in-water dispersion method, one of the known dispersion methods, an organic solvent having a low boiling point (e.g., ethyl acetate, butyl acetate, methylethyl ketone, or isopropanol) is used to apply a fine dispersion so that the low-boiling point organic solvent is not substantially left in a dry layer. Further, in the case where an organic solvent having a high boiling point is used, any of those having a boiling point of 175° C. or higher at normal pressure can be used singly or in combination of two or more. The ratio between the coupler of formulas (1)-(5) and a high boiling point organic solvent can be set in a wide range; however, when the coupler is used as the main coupler, the amount of the organic solvent used can be set at 5.0 grams or less per gram of coupler. A preferable range is 0-2.0 grams, and more preferably 0.01-1.0 gram per gram of coupler. In the case where the coupler is one releasing a photographically useful group, the weight ratio between the amount of the high boiling point organic solvent and the total amount of the couplers including this particular type falls within the above-mentioned range.

Further, the latex dispersion method, mentioned later, can be applied.

These couplers can be used in a mixture with, or co-present with, a variety of couplers or compounds mentioned later.

Then, the yellow coupler having a group represented by the formula (Y) will be explained.

The acylacetamide-type yellow coupler having a group represented by formula (Y) of the invention is preferably represented by the following formula (Ya):

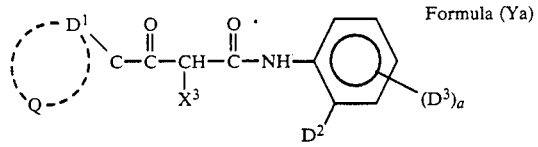

In formula (Ya), $D^1$ represents a monovalent substituent group except for hydrogen; Q represents a non-metallic atomic group required to form, together with the C, either a 3- to 5-membered hydrocarbon ring, or a 3- to 5-membered heretocyclic group containing at least one hetero atom selected from N, S, O, and P; $D^2$ represents a hydrogen atom, a halogen atom (F, Cl, Br, or I; the same applies to the following explanation for the formula (Y)), an alkoxy group, an aryloxy group, an alkyl group, or an amino group; $D^3$ represents a group which can be substituted on the benzene ring; $X^3$ represents a hydrogen atom or a group which can be split off upon coupling reaction with an oxidized form of an aromatic primary amine developing agent (hereinafter referred to as a split-off group); and letter a represents an interger from 0 to 4. It should be noted that when letter a denotes two or more, plural groups $D^3$ may be the same or different.

Examples of $D^3$ are a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, an alkylsulfonyl group, an arylsulfonyl group, a ureido group, a sulfamoylamino group, an alkoxycarbonylamino group, an alkoxysulfonyl group, nitro, a heterocyclic group, cyano, an acyl group, an acyloxy group, an alkylsulfonyloxy group, and arylsulfonyloxy group. Examples of the split-off group $X^3$ are a heterocyclic group bonded to the coupling active position through a nitrogen atom, an aryloxy group, an arylthio group, an acyloxy group, an alkylsulfonyloxy group, an arylsulfonyloxy group, a heterocyclicoxy group, and a halogen atom.

When the substituent group in formula (Ya) is an alkyl group or a group containing an alkyl group, such an alkyl group means, unless otherwise indicated, a straight, branched or cyclic alkyl group which may be substituted or may contain an unsaturated bond (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, or phenoxyethyl).

When the substituent group in formula (Ya) is an aryl group or a group containing an alkyl group, such an aryl group means, unless otherwise indicated, a single ring or fused ring aryl group which may be substituted (e.g., phenyl, 1-naphtyl, p-tolyl, o-tolyl, p-chlorophenyl, 4-methoxyphenyl, 8-quinolyl, 4-hexadecyloxyphenyl, pentafluophenyl, p-hydroxyphenyl, p-cyanophenyl, 3-pentadecylphenyl, 2,4-di-t-pentylphenyl, p-methanesulfonamidophenyl, or 3,4-dichlorophenyl).

When the substituent group in formula (Ya) is a heterocyclic group or a group containing a heterocyclic group, such a heterocyclic group means, unless otherwise indicated, a 3- to 8-membered single ring or fused ring heterocyclic group which contains at least one hetero atom selected from O, N, S, P, Se and Te, and may be substituted (e.g., 2-furyl, 2-pyridyl, 4-pyridyl, 1-pyrazolyl, 1-imidazolyl, 1-benzotriazolyl, 2-benzotriazolyl, succinimido, phthalimido, or 1-benzyl-2,4-imidazolidindione-3-yl).

The substituent groups preferably used in the formula (Ya) will be described.

In formula (Ya), $D^1$ is preferably a halogen atom, cyano, or a monovalent group having a total carbon number (to be abbreviated as C number hereinafter) of 1-30, which can be substituted (e.g., an alkyl group or an alkoxy group), or a monovalent group having a C number of 6-30, which can be substituted (e.g. an aryl group, or an aryloxy group). The substituent group thereof includes a halogen atom, an alkyl group, an alkoxy group, nitro, an amino group, a carbonamido group, a sulfonamido group, and an acyl group.

In formula (Ya), Q preferably represents a non-metallic atomic group required to form, together with the C, either a 3- to 5-membered hydrocarbon ring having a C number of 3-30, which can be substituted, or a heretocyclic group having a C number of 2-30, which contains at least one hetero atom selected from N, S, O, and P and which may be substituted. The ring which Q forms along with the C may contain an unsaturated bond in it. Examples of such a ring are a cyclopropane ring, a cyclobutane ring, a cyclopentane ring, a cyclopropene ring, a cyclotutene ring, a cyclopentene ring, an oxetane ring, an oxolane ring, a 1,3-dioxolane ring, a thietane ring, a thiolane ring, and a pyrrolidine ring. Examples of the substituent group are a halogen atom, a hydroxyl group, an alkyl group, an aryl group, an acyl group, an alkoxy group, an aryloxy group, cyano, an alkoxycarbonyl group, an alkylthio group and an arylthio group.

In formula (Ya), $D^2$ is preferably a halogen atom, or an alkoxy group having a C number of 1-30, an aryloxy group having a C number of 6-30, an alkyl group having a C number of 1-30 or an amino group having a C number of 0-30, all of which may be substituted, and examples of the substituent group thereof are a halogen atom, an alkyl group, an alkoxy group, and an aryloxy group.

In formula (Ya), $D^3$ preferably represents a halogen atom, or an alkyl group having a C number of 1-30, an aryl group having a C number of 6-30, an alkoxy group having a C number of 1-30, an alkoxycarbonyl group having a C number of 2-30, an aryloxycarbonyl group having a C number of 7-30, a carbonamido group having a C number of 1-30, a sulfonamido group having a C number of 1-30, a carbamoyl group having a C number of 1-30, a sulfamoyl group having a C number of 0-30, an alkylsulfonyl group having a C number of 1-30, an arylsulfonyl group having a C number of 6-30, a ureido group having a C number of 1-30, a sulfamoylamino group having a C number of 0-30, an alkoxycarbonylamino group having a C number of 2-30, a heterocyclic group having a C number of 1-30, an acyl group having a C number of 1-30, an alkylsulfonyloxy group having a C number of 1-30 or an arylsulfonyloxy group having a C number of 6-30, all of which may be substituted. Examples of the substituent group thereof are a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulafmoylamino group, a ureido group, cyano, nitro, an acyloxy group, an alkoxycarbonyl group, an aryloxycarbonyl group, an alkylsulfonyloxy group, and an arylsulfonyloxy group.

In formula (Ya), letter a is preferably an integer of 1 or 2, and the substitution position of $D^3$ is preferably meta or para to the following group:

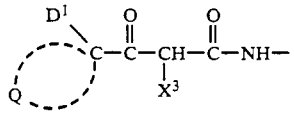

In formula (Ya), $X^3$ is preferably a heterocyclic group which bonds to the coupling active position through a nitrogen atom, or an aryloxy group.

When $X^3$ represents a heterocyclic group, $X^3$ is preferably a 5- to 7-membered single ring or fused ring heterocyclic group, which may be substituted. Examples of the heterocyclic group are succinimido, maleinimido, phthalimido, diglycolimido, pyrrole, pyrazol, imidazol, 1,2,4-triazol, tetrazol, indole, indazol, benzimidazole, benzotriazol, imidazolidin-2,4-dione, oxazolidin-2,4-dione, thiazolidin-2,4-dione, imidazolidin-2-one, oxazolin-2-one, thiazolidin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidin-3,5-dione, 2-pyridone, 4-pyridone, 2-pyrimidone, 6-pyridazone-2-pyrazone, 2-amino-1,3,4-thiazolidine, 2-imino-1,3,4-thiazolidin-4-one, and these heterocyclic rings may be substituted. Examples of the substituting groups of the heterocyclic rings are a halogen atom, hydroxyl group, nitro, cyano, carboxyl, sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group.

When $X^3$ represents an aryloxy group, $X^3$ is preferably an aryloxy group having a C number of 6-30, which may be substituted with the substituting group listed in the case where $X^3$ represents a heterocyclic ring. Preferable examples of the substituent group for the aryloxy group are a halogen atom, cyano, nitro, carboxyl, trifluoromethyl, an alkoxycarbonyl group, a carbonamido group, a sulfonamido group, a carbamoyl group, a sulfamoyl group, an alkylsulfonyl group, an arylsulfonyl group, and cyano.

Substituent groups which are used particularly preferably in formula (Ya) will be described.

$D^1$ is particularly preferably a halogen atom, or an alkyl group, with methyl being most preferred.

Q is particularly preferably a non-metallic atomic group which forms a 3- to 5-membered hydrocarbon ring along with the C, for example, $-[C(R)_2]_2-$, $-[C(R)_2]_3-$, or $-[C(R)_2]_4-$, where R represents a hydrogen atom, a halogen atom, or an alkyl group. It should be noted that what is represented by a plurality of R's or $[C(R)_2]$ may be the same or different.

Q is expecially preferably $-[C(R)_2]_2-$ which forms a 3-membered ring together with the C bonded thereto.

$D_2$ is particularly preferably a chlorine atom, a florine atom, an alkyl group having a C number of 1-6 (e.g., methyl, trifluoromethyl, ethyl, isopropyl, or t-butyl), an alkoxy group having a C number of 1-8 (e.g., methoxy, ethoxy, methoxyethoxy, or butoxy), or an aryloxy group having a C number of 6-24 (e.g., phenoxy, p-tolyloxy, or p-methoxyphenoxy). Most preferable are a chlorine atom, methoxy and trifluoromethyl.

$D^3$ is particularly preferably a halogen atom, an alkoxy group, an alkoxycarbonyl group, an aryloxycarbonyl group, a carbonamido group, a sulfonamido group, a carbamoyl group, or a sulfamoyl group. Most preferable are an alkoxy group, an alkoxycarbonyl group, a carbonamido group and a sulfonamido group.

$X^3$ is particularly preferably a group represented by formulas (Y-1), (Y-2), or (Y-3) below:

Formula (Y-1)

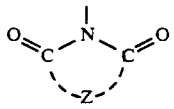

In formula (Y-1), Z represents $-O-CD^4(D^5)-$, $-S-CD^4(D^5)-$, $-ND^6-CD^4(D^5)-$, $-ND^6-ND^7-$, $-ND^6-C(O)-$, $-CD^4(D^5)-CD^8(D^9)-$, or $-CD^{10}=CD^{11}-$.

In these notations, $D^4$, $D^5$, $D^8$, and $D^9$ each represents a hydrogen atom, an alkyl group, an aryl group, an alkoxy group, an aryloxy group, an alkylthio group, an arylthio group, an alkylsulfonyl group, an arylsulfonyl group, or an amino group; $D^6$ and $D^7$ each represents a hydrogen atom, an alkyl group, an aryl group, an alkylsulfonyl group, an arylsulfonyl group, or an alkoxycarbonyl group; and $D^{10}$ and $D^{11}$ each represents a hydrogen atom, an alkyl group, or an aryl group. $D^{10}$ and $D^{11}$ may be combined with each other to form a benzene ring. $D^4$ and $D^5$, $D^5$ and $D^6$, $D^6$ and $D^7$, or $D^4$ and $D^8$ may be combined with each other to form a ring (e.g., cyclobutane, cyclohexane, cycloheptane, cyclohexene, pyrrolidine or pyperidine).

Of the heterocyclic groups represented by formula (Y-1), particularly preferable are those in which Z is —O—$CD^4(D^5)$—, —$ND^6$—$CD^4(D^5)$—, or —$ND^6$—$ND^7$—. The heterocyclic group represented by formula (Y-1) has a C number of 2–30, preferably 4–20, and more preferably 5–16.

Formula (Y-2)

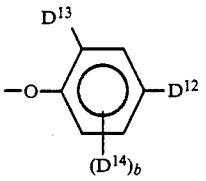

In formula (Y-2), at least one of $D^{12}$ and $D^{13}$ is a group selected from a halogen atom, cyano, nitro, trifluoromethyl, carboxyl, an alkoxycarbonyl group, a carbonamido group, a sulfonamido group, a carbamoyl group, a sulfamoyl group, an alkylsulfonyl group, an arylsulfonyl group, and an acyl group, and the other may be a hydrogen atom, an alkyl group or an alkoxy group. $D^{14}$ has the same meaning as $D^{12}$ or $D^{13}$, and letter b represents an integer of 0–2.

The aryloxy group represented by formula (Y-2) has a C number of 6–30, preferably 6–24, and more preferably 6–15.

Formula (Y-3)

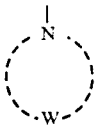

In formula (Y-3), W represents a non-metallic atomic group required to form, together with N, a pyrrole ring, a pyrazole ring, an imidazole ring or a triazole ring. The ring represented by formula (Y-3) may have a substituent group, and preferable examples of the substituent group are a halogen atom, nitro, cyano, an alkoxycarbonyl group, an alkyl group, an aryl group, an amino group, an alkoxy group, an aryloxy group and a carbamoyl group. The heterocyclic group represented by formula (Y-3) has a C number of 2–30, preferably 2–24, and more preferably 2–16.

$X^3$ is most preferably a group represented by formula (Y-1).

Couplers represented by formula (Ya) may bond to each other via a group having a valence of 2 or more at the substituent group $D^1$, Q or $X^3$, or a group represented below, so as to form dimers or polymers. In this case, the carbon number of each substituent group may be out of the range defined before.

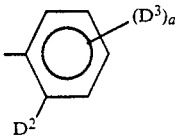

Examples of each of the substituent groups in formula (Ya) will be listed below:

(i) Examples of a group

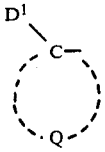

formed by $D^1$, Q and C:

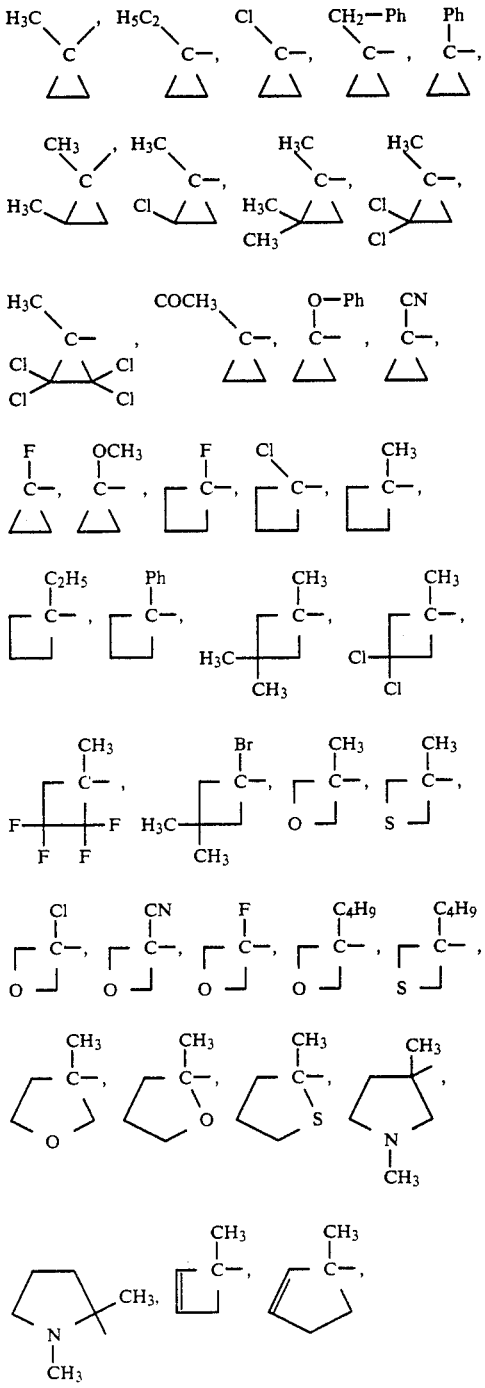

-continued

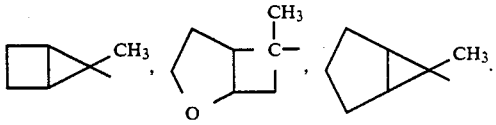

(ii) Examples of $D^2$:

F, Cl, Br, I, $CH_3O$—, Ph—O—, $CH_3$—, $C_2H_5$—, i—$C_3H_7$—, t—$C_4H_9$—, $CH_3OCH_2CH_2O$—, $CF_3$—, $(CH_3)_2N$—, n—$C_4H_9O$—, n—$C_{14}H_{29}O$—, n—$C_{16}H_{33}O$—, Ph—$CH_2O$—, n—$C_{12}H_{25}O$—, and the groups indicated below:

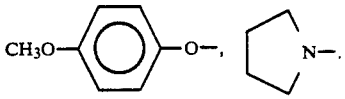

(iii) Examples of $D^3$:

F, Cl, Br, I, $CH_3O$—, $C_2H_5O$—, n—$C_{12}H_{25}O$—, $CH_3$—, t—$C_4H_9$—, —$COOCH_3$, —$COOC_2H_5$, —$COOC_4H_9$—n, —$COOC_{12}H_{25}$—n, —$OCH_2CH(C_6H_{13}$—n)—$C_8H_{17}$—n, —$COOCH(CH_3)$—$COOC_{12}H_{25}$—n, —$COOCH(C_4H_9$—n—)—$COOC_{12}H_{25}$—n, —$SO_2N(CH_3)_2$, —$SO_2NHCOC_2H_5$, —$SO_2NHC_{16}H_{33}$—n, —$NHCOC_{13}H_{27}$—n, —$NHCOC_{15}H_{31}$—n, —$NHCOC_{17}H_{35}$—n, —$NHCOCH(C_6H_{13}$—n)—$C_8H_{17}$—n; —$NHCOCH(CH_3)$—$CH_2SO_2C_{16}H_{33}$—n, —$NHCOCH(C_3H_7$—i)—$SO_2C_{16}H_{33}$—n, —$NHSO_2C_{12}H_{25}$—n, —$NHSO_2C_{16}H_{33}$—n, —$SO_2NHCH_3$, —$SO_2NH$—Ph, —$OCOC_{11}H_{23}$—n, —$OSO_2C_{12}H_{25}$—n, —$NHCOOC_{12}H_{25}$—n, and the groups indicated below:

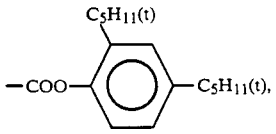

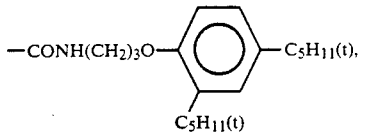

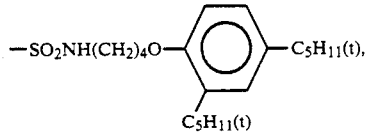

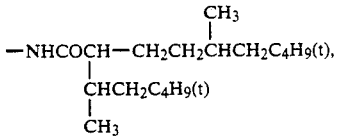

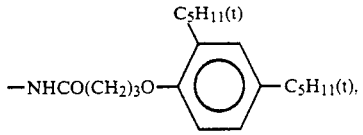

-continued

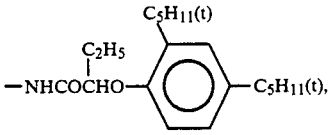

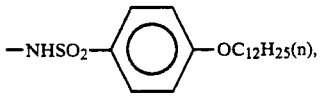

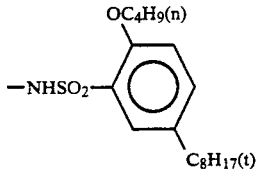

(iv) Examples of $X^3$

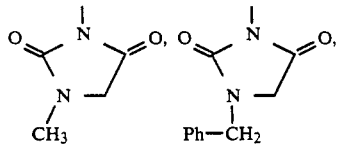

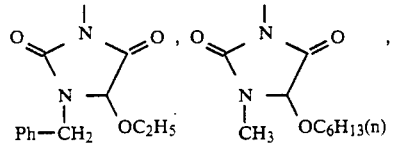

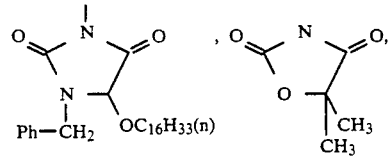

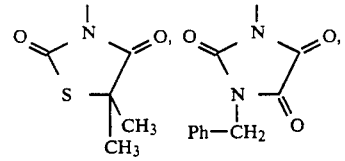

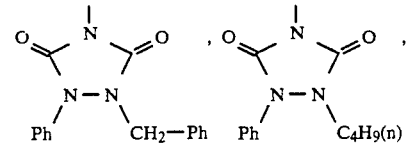

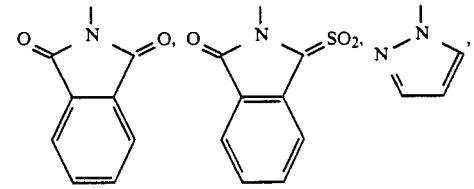

-continued
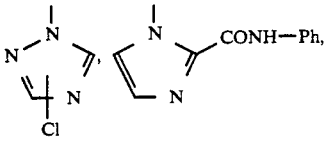
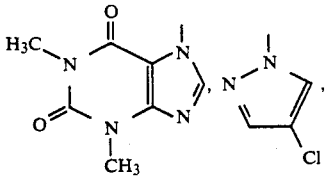
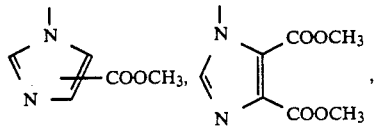
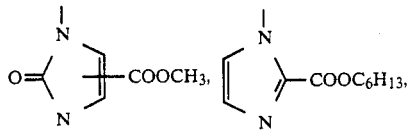
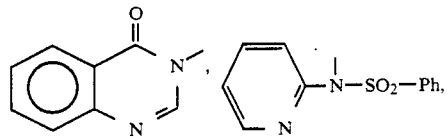
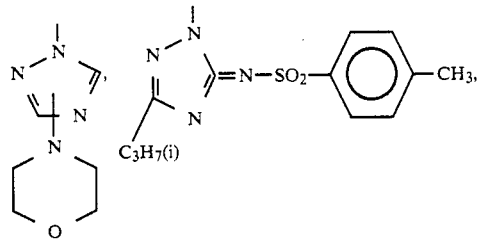
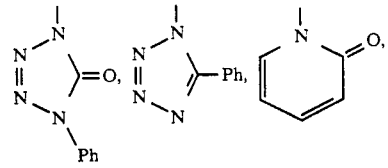
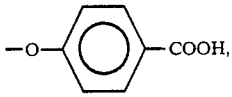
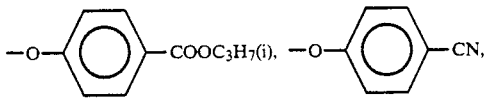
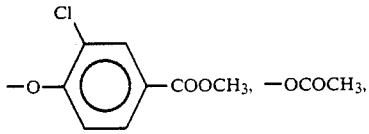
-continued
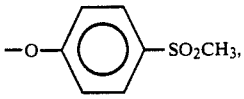
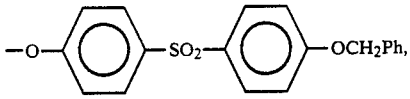
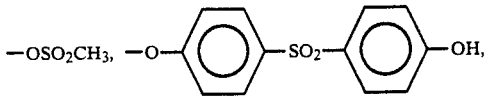
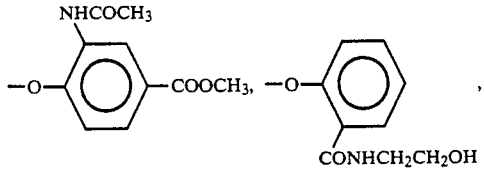
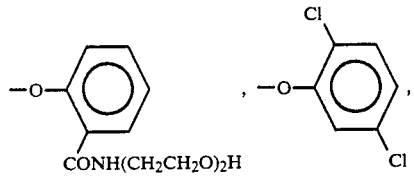
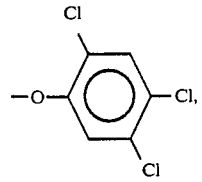
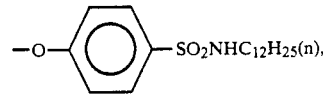
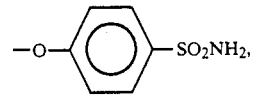
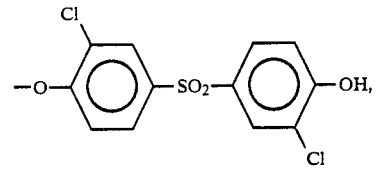
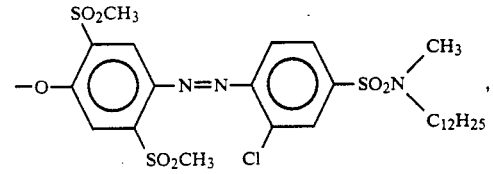
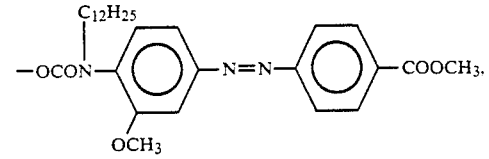

-continued
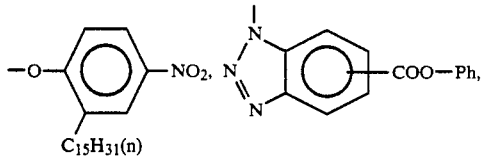
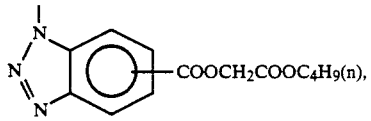
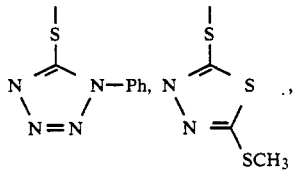
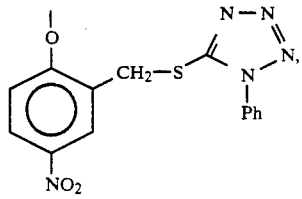
-continued
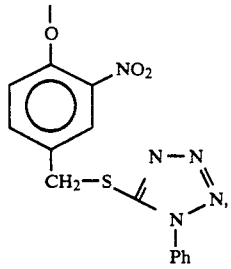
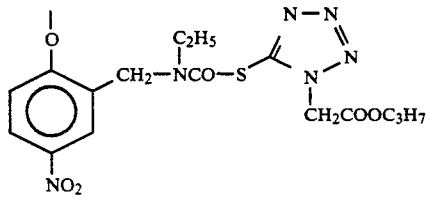
Note: "Ph" is phenyl.
The following are examples (YB-1 to YB-40) of the yellow couplers represented by formula (Ya). It should be noted that the invention is not limited to these compounds.
YB-1
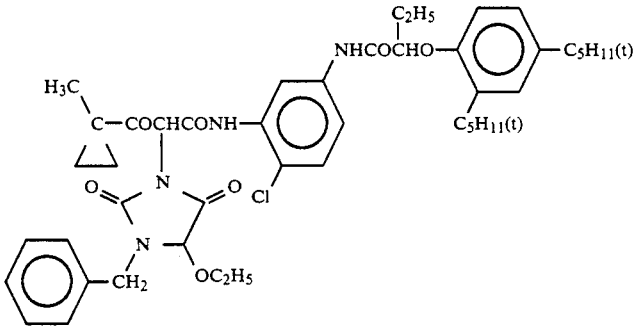
YB-2
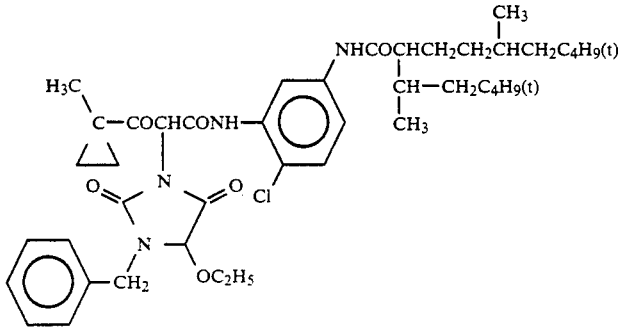

-continued
YB-3
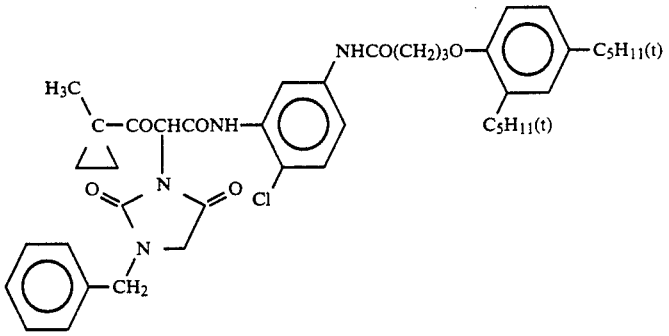
YB-4
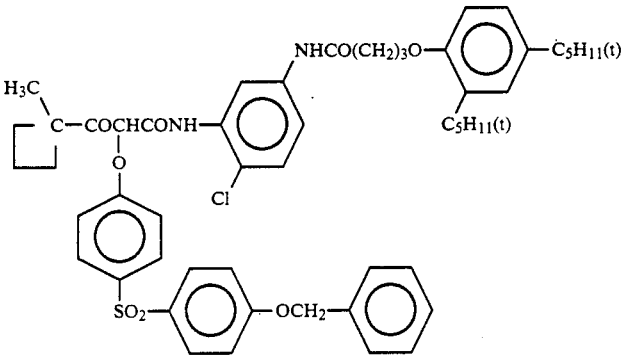
YB-5
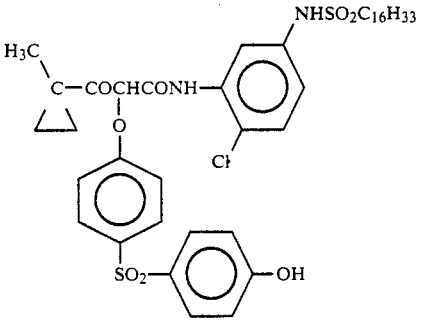
YB-6
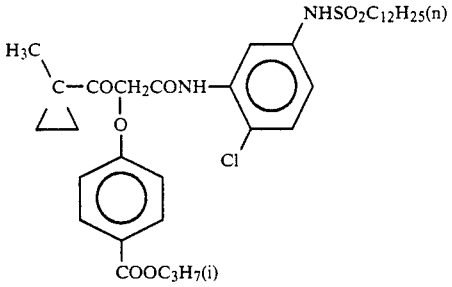
YB-7
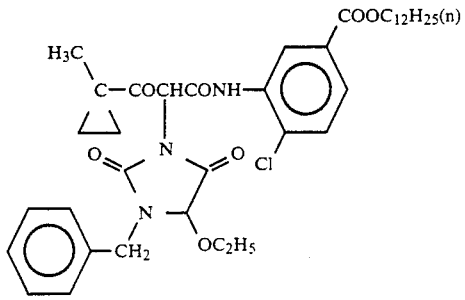

-continued
YB-8
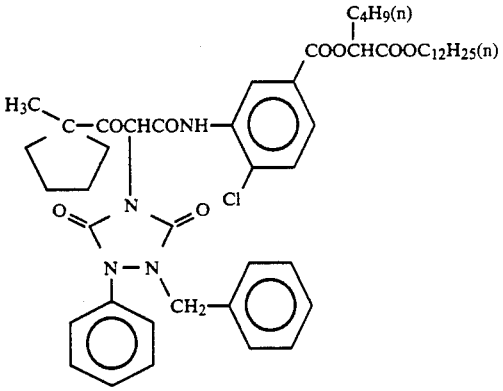
YB-9
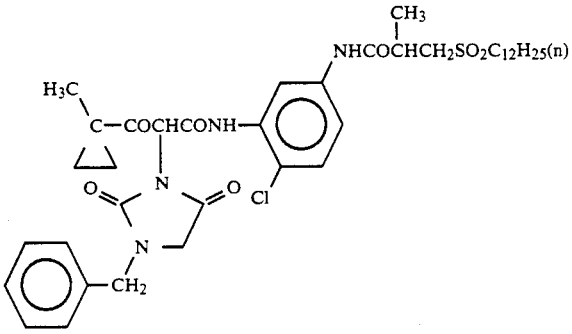
YB-10
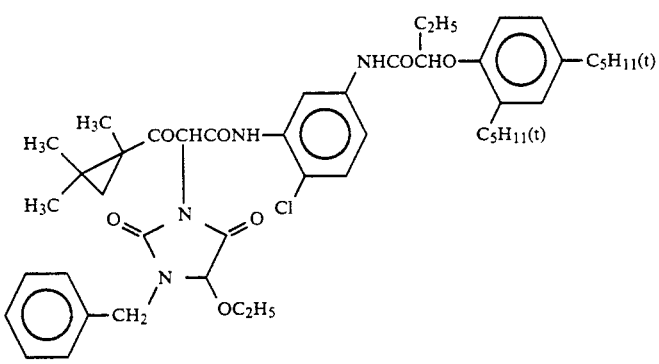
YB-11
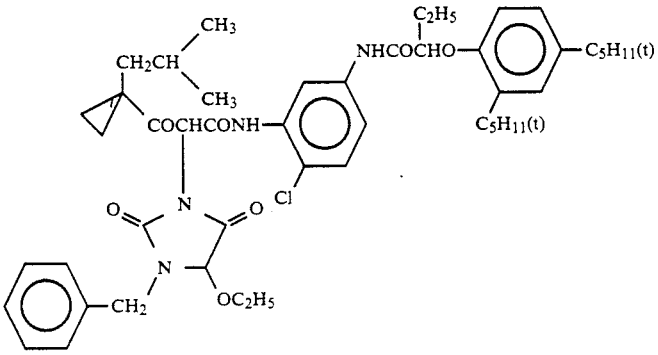

-continued
YB-12
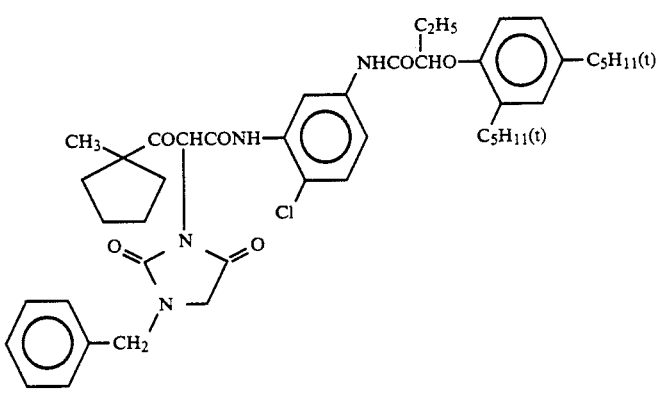
YB-13
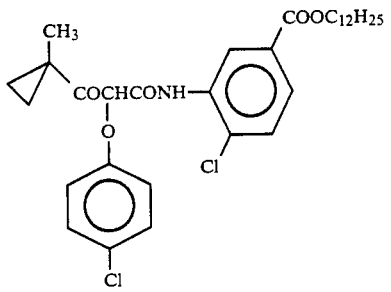
YB-14
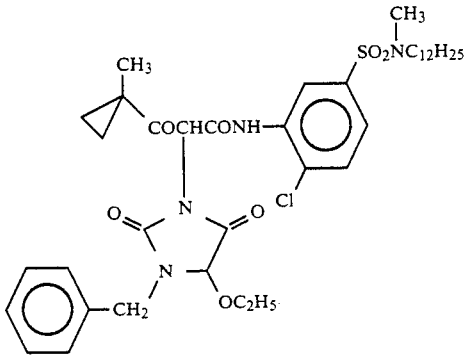
YB-15
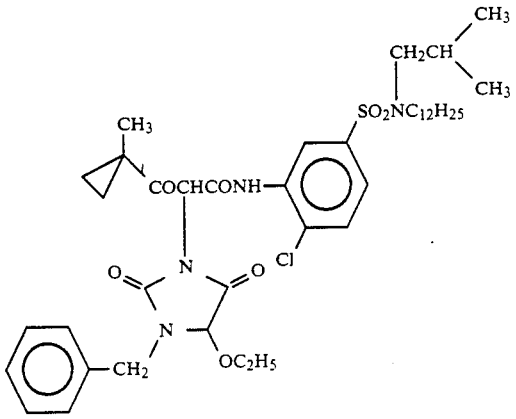

-continued
YB-16
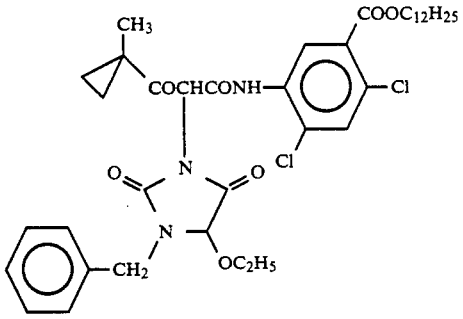
YB-17
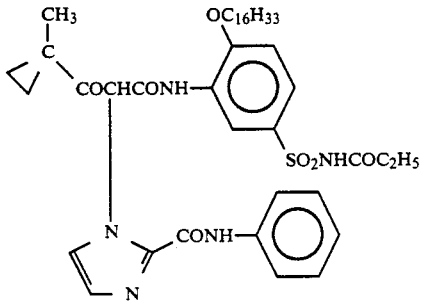
YB-18
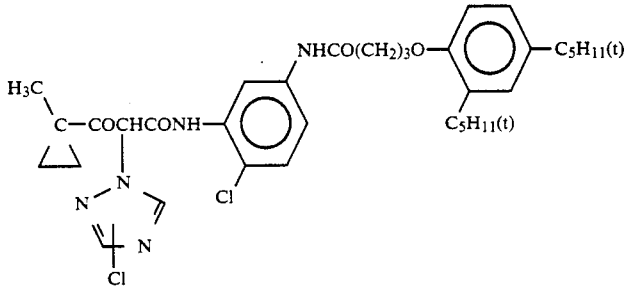
YB-19
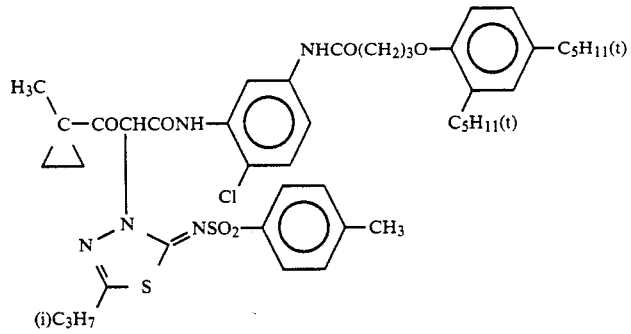
YB-20
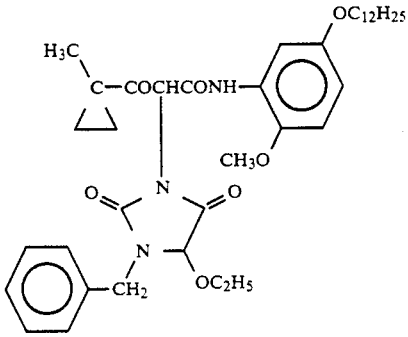

-continued
YB-21
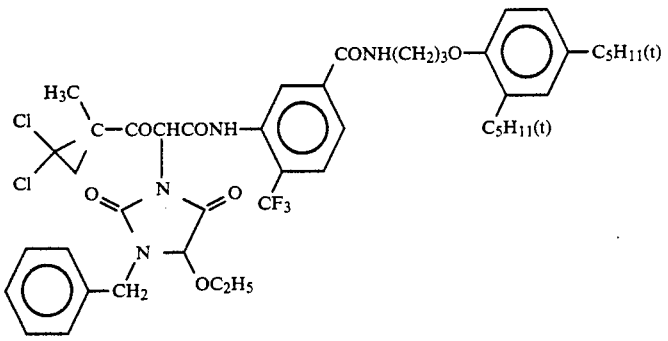
YB-22
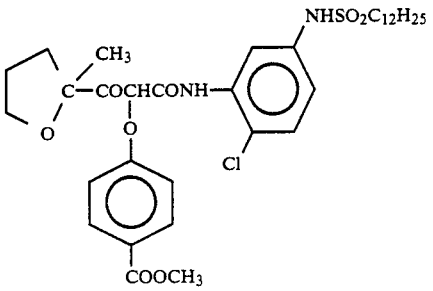
YB-23
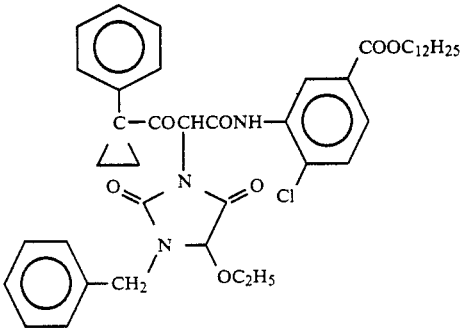
YB-24
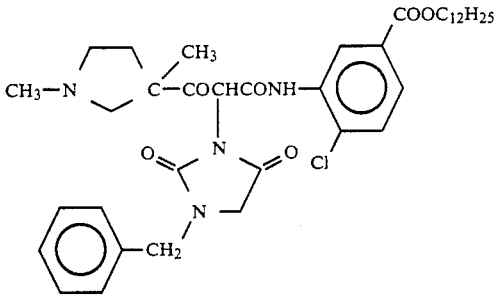
YB-25
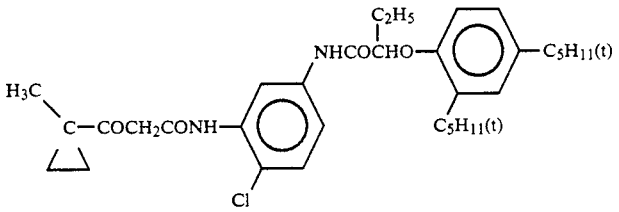
YB-26
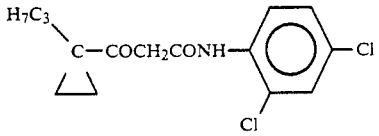

-continued
YB-27
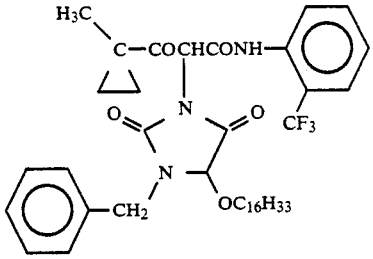
YB-28
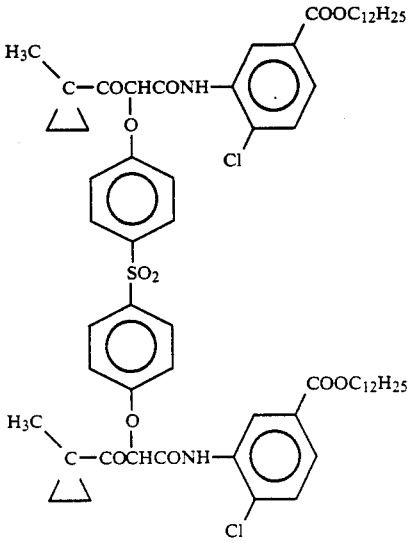
YB-29
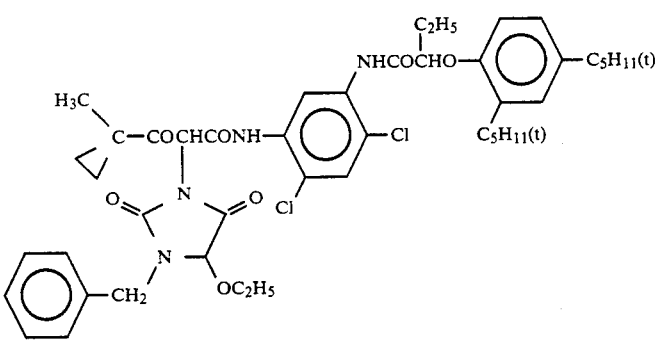
YB-30
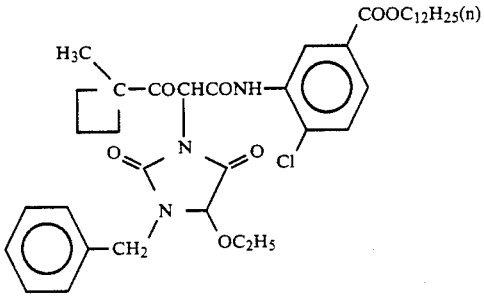

-continued
YB-31
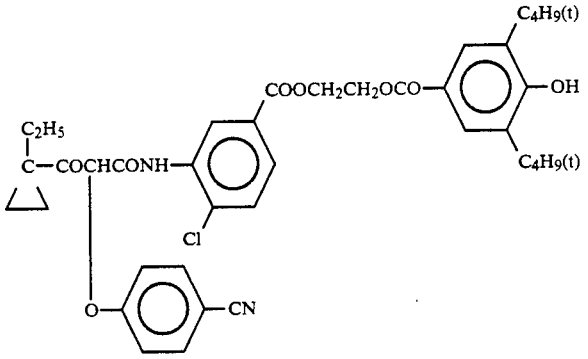
YB-32
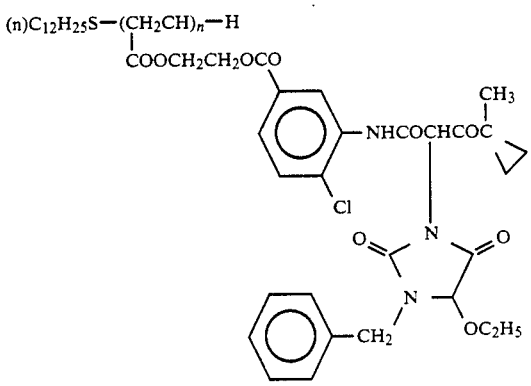
n = 3 (mean value)
YB-33
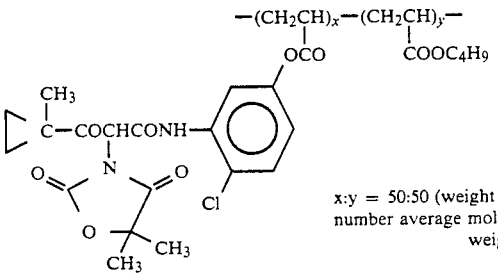
x:y = 50:50 (weight ratio)
number average molecular
weight 50,000
YB-34
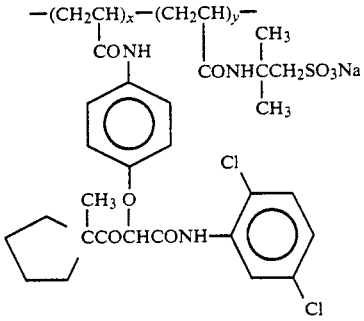
x:y = 80:20 (weight ratio)
number average molecular
weight 70,000

-continued
YB-35
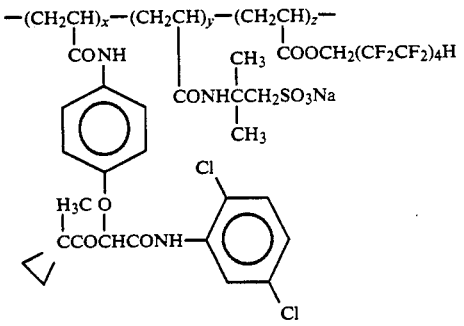
x:y:z = 50:30:20 (weight ratio)
number average molecular weight 70,000
YB-36
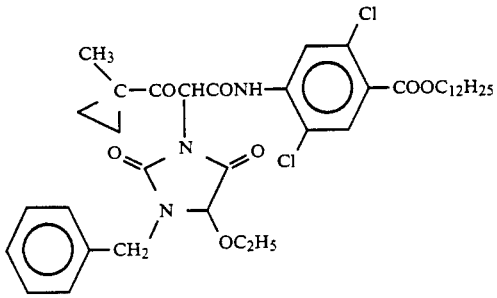
YB-37
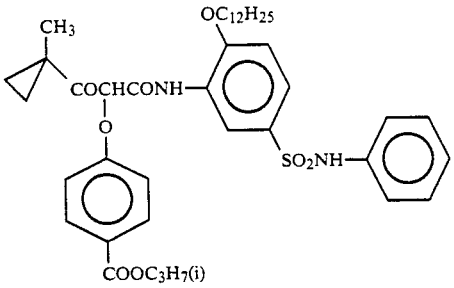
YB-38
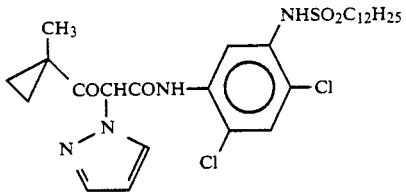
YB-39
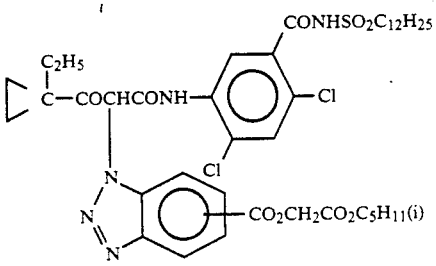

-continued

YB-40

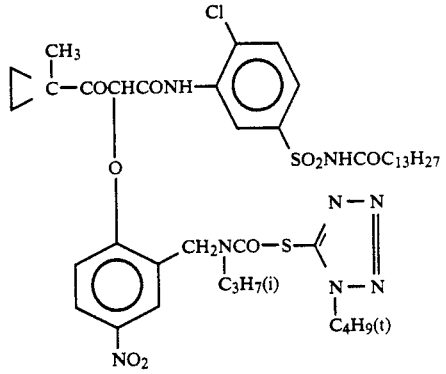

The yellow couplers represented by formula (Ya) of the invention can be synthesized by following synthesizing route described below:

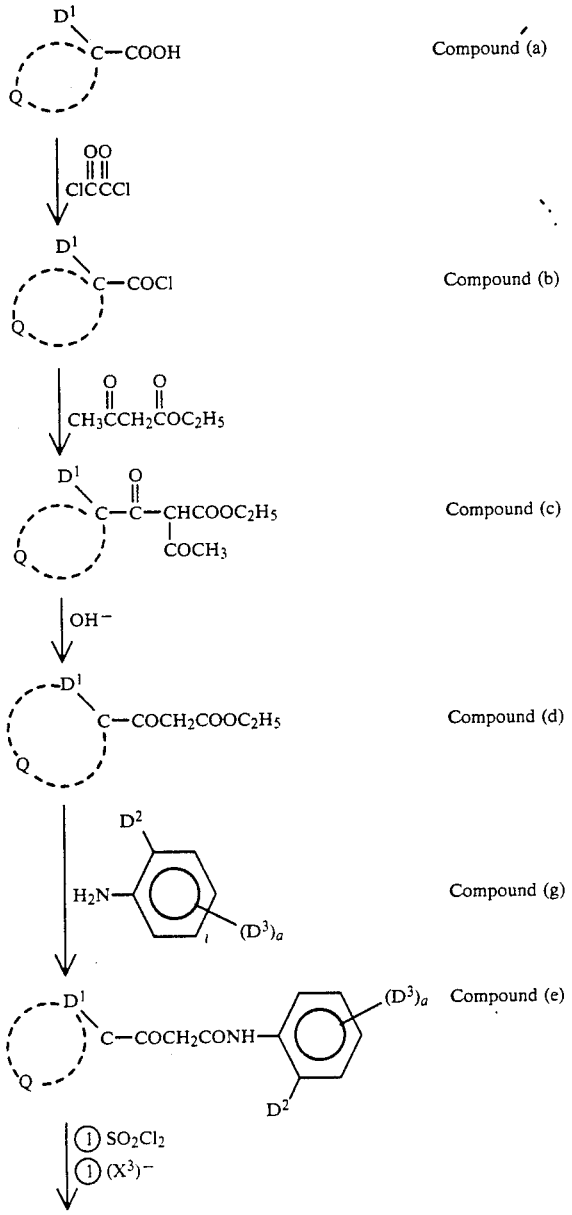

-continued

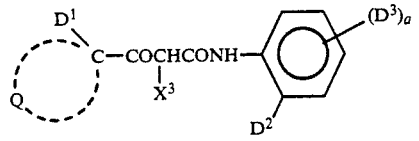

Compound (a) can be synthesized by methods disclosed in, e.g., J. Chem. Soc. (C), 1968, 2548, J. Am. Chem. Soc., 1934, 56, 2710, Synthesis, 1971, 258, J. Org. Chem., 1978, 43, 1729, and CA, 1960, 66, 18533y.

Compound (b) can be synthesized by reacting compound (a) with thionyl chloride or oxalyl chloride in a non-solvent circumstance, or in a solvent such as methylene chloride, chloroform, carbon tetrachloride, dichloroethane, toluene, N,N-dimethylformamide or N,N-dimethylacetoamide at a temperature of, usually, −20° C. to 150° C., preferably, −10° C. to 80° C.

Compound (c) can be synthesized by converting ethyl acetoacetate into an anionic form using, e.g., magnesium methoxide, and by adding compound (b) thereinto. The reaction is carried out without solvent or by use of, e.g., tetrahydrofuran, or ethylether at a temperature of, usually, −20° C. to 60° C., preferably, −10° C. to 30° C.

Compound (d) can be synthesized from compound (c) and a base such as ammonia water, an aqueous $NaHCO_3$ solution or an aqueous sodium hydroxide solution, which are reacted without a solvent or by use of a solvent such as methanol, ethanol, or acetonitrile. The reaction temperature is usually −20° C. to 50° C., preferably −10° C. to 30° C.

Compound (e) can be synthesized from compounds (d) and (g) which are reacted without a solvent. The reaction temperature is usually 10° C. to 150° C., preferably 100° C. to 120° C.

If $X^3$ is not H, compound (f) can be synthesized by introducing split-off group $X^3$ after chlorination or bromination. Here, compound (e) is converted into a chloro-substituted form by use of, e.g., sulfuryl chloride or N-chlorosuccinimide, or into a bromo-substituted form by, e.g., bromine or N-bromosuccinimide, both in a solvent such as dichloroethane, carbon tetrachloride, chloroform, methylene chloride, or tetrahydrofuran. The reaction temperature is usually −20° C. to 70° C., preferably −10° C. to 50° C.

Then, the chloro-substituted form or bromo-substituted form, and a proton-adduct of the split-off group, $H\text{-}X^3$, are reacted in a solvent such as methylene chloride, chloroform, tetrahydrofuran, acetone, acetonitrile, dioxane, N-methylpyrrolidone, N,N'-dimethylimidazolidin-2-one, N,N-dimethylformamide, or N,N-dimethylacetoamide, at a reaction temperature of −20° C. to 150° C., preferably −10° C. to 100° C., thereby obtaining compound (f), a yellow coupler of the present invention. It should be noted that the reaction may be carried out in the presence of a base such as triethylamine, N-ethylmorpholine, tetramethylguanidine, pottasium carbonate, sodium hydroxide, or sodium bicarbonate.

Examples of synthesis of yellow couplers represented by formula (Ya) of the invention will now be described.

SYNTHESIS EXAMPLE I

Compound YB-25

First, 38.1 g of oxalyl chloride was added dropwise to a mixture of 25 g of 1-methylcyclopropane carboxylic acid synthesized by the method disclosed in Cotkis, D. et al., J. Am. Chem. Soc., 1934, 56, 2710, 100 cc of methylene chloride, and 1 cc of N,N-dimethylformamide, at room temperature over 30 minutes. Then, the mixture was reacted for 2 hours at room temperatures, and methylene chloride and excessive oxalyl chloride were removed under a reduced pressure of an aspirator, thus obtaining an oily substance of 1-methylcyclopropanecarbonyl chloride.

Then, 100 cc of methanol was added dropwise to a mixture of 6 g of magnesium and 2 cc of carbon tetrachloride over 30 minutes at room temperature, and then the mixture was refluxed for 2 hours while being heated. Thereafter, 32.6 g of ethyl 3-oxobutanoate was added to the mixture over 30 minutes under refluxing by heating. Further, the mixture was refluxed by heating for another 2 hours, and the methanol was completely removed under a reduced pressure of an aspirator. Then, the reaction mixture was dispersed in 100 cc of tetrahydrofuran, and 1-methylcyclopropanecarbonyl chloride obtained before at room temperature was added dropwise thereto. After 30 minutes of reaction, the reaction liquid was extracted with 30 cc of ethyl acetate and a diluted sulfuric acid solution, and washed with water. The organic layer obtained was dried over anhydrous sodium sulfate, and the solvent was removed, thereby obtaining 55.3 g of an oily substance of ethyl 2-(1-methylcyclopropanecarbonyl)-3-oxobutanoate.

A solution consisting of 55 g of ethyl 2-(1-methylcyclopropanecarbonyl)-3-oxobutanoate and 160 cc of ethanol was stirred at room temperature, and 60 cc of 30% ammonia water was added dropwise to the solution over a period of 10 minutes.

The mixed solution was stirred for another hour, and extracted with a diluted hydrochloric acid solution. Then, the extracted material was neutralized, and washed with water. The organic layer obtained was dried over anhydrous sodium sulfate, and the solvent was removed, thereby obtaining 43 g of an oily substance of ethyl (1-methylcyclopropanecarbonyl)acetate.

Next, 34 g of ethyl (1-methylcyclopropanecarbonyl-)acetate and 44.5 g of N-(3-amino-4-chlorophenyl)-2-(2,4-di-t-pentylphenoxy)butanamide were refluxed while being heated at an inner temperature of 100° C. to 120° C. at a reduced pressure of an aspirator. After 4 hours of reaction, the reaction solution was purified by a column chromatography using a solvent mixture of n-hexane and ethyl acetate, thereby obtaining 49 g of compound YB-25 in the form of a viscous oily substance.

The structure of the obtained compound was confirmed by mass spectrum, NMR spectrum, and elemental analysis.

SYNTHESIS EXAMPLE II

Compound YB-1

22.8 g of compound YB-25 was dissolved into 300 cc of methylene chloride to make a solution, and 5.4 g of sulfuryl chloride was added dropwise over 10 minutes while cooling the solution with ice. After 30 minutes of reaction, the reaction solution was sufficiently washed with water, dried over anhydrous sodium sulfate, and concentrated, thereby obtaining a chloride of compound YB-25.

Meanwhile, the chloride of compound YB-25 thus synthesized was dissolved into 50 cc of N,N-dimethylformaldehyde, which was added dropwise to a solution consisting of 18.7 g of 1-benzyl-5-ethoxyhydantoin, 11.2 cc of triethylamine and 50 cc of N,N-dimethylformamide, over 30 minutes at room temperature. After 4 hours of reaction at 40° C., the reaction mixture was extracted with 300 cc of ethyl acetate, and washed with water. The washed extract was further washed with 300 cc of 2% triethylamine aqueous solution, and neutralized with a diluted hydrochloric acid. The organic layer obtained was dried over anhydrous sodium sulfate, and the solvent was removed, thereby obtaining an oily substance. The oily substance was crystallized from a solvent mixture of n-hexane and ethyl acetate. The obtained crystals were filtered out, and washed with a solvent mixture of n-hexane and ethyl acetate. Then, it was dried to obtain 22.8 g of compound YB-1 in crystal form.

The structure of the compound was confirmed by mass spectrum analysis, NMR spectrum analysis, and elemental analysis. The melting point thereof was 132° C. to 133° C.

The yellow dye-forming coupler having a group represented by formula (Y) of the present invention can be used singly or in mixture of 2 or more types. Further, as long as the advantage of the invention can be obtained, it can be mixed with a known yellow dye-forming coupler.

Further, the yellow dye-forming couplers having a group represented by formula (Y) of the present invention can be used in any layer in the light-sensitive material, but is preferably used in a light-sensitive silver halide emulsion layer or a non-light-sensitive layer adjacent thereto, and most preferably in a light-sensitive silver halide emulsion layer.

The amount of a yellow dye-forming coupler having a group represented by formula (Y) used in the light-sensitive material is $1\times10^{-4}$ to $10^{-2}$ per $m^2$, more preferably, $2\times10^{-4}$ to $10^{-3}$ per $m^2$ of the light-sensitive material.

The light-sensitive material of the present invention need only have at least one blue-sensitive layer, at least one green-sensitive layer, at least one red-sensitive layer, and at least one non-light-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color sensitivity but has different speed. The unit light-sensitive layer is sensitive to blue, green or red. In a multilayered silver halide photographic light-sensitive material, the unit light-sensitive layers are generally arranged such that red-, green-, and blue-sensitive layers are formed from a support side in the order named. However, this order may be reversed or a layer sensitive to different color may be sandwiched between layers each sensitive to the same other color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In most cases, layers are preferably arranged such that the sensitivity is sequentially decreased toward a support, and a non-light-sensitive layer may be formed between the silver halide emulsion layers. In addition, as described in, e.g., JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a unit layer sensitive to the same color, as described in JP-A-59-202464.

In addition, an order of high-sensitivity emulsion layer/low-sensitivity emulsion layer/medium-sensitivity emulsion layer, or low-sensitivity emulsion layer/ medium-sensitivity emulsion layer/high-sensitivity emulsion layer may be adopted. Furthermore, the arrangement can be changed as described above even when four or more layers are formed.

To improve the color reproduction, a donor layer (CL) can be arranged directly adjacent to, or close to, a major light-sensitive layer BL, GL or RL. The donor layer has a spectral sensitivity distribution which is different from that of the major light-sensitive layer. Donor layers of this type are disclosed in U.S. Pat. Nos. 4,663,271, 4,705,744, 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide, each containing about 30 mol % or less of silver iodide. The most preferable silver halide is silver iodobromide or silver iodochlorobromide containing about 2 mol % to about 10 mol % of silver iodide.

Silver halide grains contained in the photographic emulsion may have regular crystal shapes such as cubic, octa-hedral, or tetradecahedral crystals, irregular crystal shapes such as spherical or tabular crystals, crystals having crystal defects such as twined crystal planes, or composite shapes thereof.

The silver halide may consist of fine grains having a grain size of about 0.2 μm or less or large grains having a projected area diameter of up to about 10 μm, and the emulsion may be either a polydisperse or monodisperse emulsion.

The silver halide photographic emulsion which can be used in the present invention can be prepared by methods described in, for example, Research Disclosure (RD) No. 17643 (December, 1978), pp. 22 to 23, "I. Emulsion preparation and types", RD No. 18716 (November, 1979), page 648, and RD No. 307,105 (November, 1989), pp. 863 to 865; P. Glafkides, "Chemie et Phisique Photographique", Paul Montel, 1967; G.F. Duffin, "Photographic Emulsion Chemistry", Focal Press, 1966; and V.L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,439,520, and British Patent 2,112,157.

The crystal structure may be uniform, may have different halogen compositions in the interior and the surface layer thereof, or may be a layered structure. Alternatively, a silver halide having a different composition may be bonded by an epitaxial junction or a compound except for a silver halide, such as silver rhodanide or zinc oxide, may be bonded. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/-shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17643, 18716, and 307105 and they are summarized in Table A (presented later).

In the light-sensitive material of the present invention, two or more types of emulsions different in at least one characteristic of a grain size, a grain size distribution, a halogen composition, a grain shape, and sensitivity can be mixed into one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver bromoiodide, and silver chlorobromoiodide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydisperse emulsion, it is preferably a monodisperse emulsion (in which at least 95% in weight or number of silver halide grains have a grain size falling within the range of ±40% of an average grain size).

In the present invention, a non-light-sensitive fine grain silver halide is preferably used. The "non-light-sensitive fine grain silver halide" means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table A:

TABLE A

| Additives | RD17643 | RD18716 | TD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649, right column | pp. 868–870 |
| 6. Light absorbent, filter dye, ultraviolet absorbents | pp. 25–26 | page 649, right column to page 650, left column | page 873 |
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. B78–879 |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds releasing a fogging agent, a development accelerator, a silver halide solvent, or precursors thereof regardless of a developed silver amount produced by the development, as described in JP-A-1-106052.

The light-sensitive material of the present invention may contain dyes dispersed by methods described in International Disclosure WO 88/04794 and JP-A-1-502912 or dyes described in EP 317,308A, U.S. Pat. No. 4,420,555, and JP-A-1-259358, in addition to those dyes represented by the formulas (I) to (VI) of the present invention.

Various color couplers can be used in the present invention, and specific examples of these couplers are described in patents described in above-mentioned Research Disclosure (RD), No. 17643, VII-C to VII-G and RD No. 307105, VII-C to VII-G.

Preferable examples of a yellow coupler are, besides acylacetoamide type yellow couplers having the groups of the formulas (1), (2) and (Y), those described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A. These yellow couplers can be used in such amounts as not to jeopardize the advantage of the present invention. The amounts in which to use these couplers are, preferably, 50 mol % or less, more preferably 25 mol % or less of the total yellow couplers used.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,565,630, and International Disclosure WO 88/04795.

Examples of a cyan coupler are phenol and naphthol couplers, and preferably, those described in, e.g., U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Disclosure 3,329,729, EP 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole-based couplers disclosed in JP-A-64-553, JP-A-64-554, JP-A-64-555 and JP-A-64-556, and imidazole-based couplers disclosed in U.S. Pat. No. 4,818,672 can be used in the present invention.

Typical examples of a polymerized dye-forming coupler are described in U.S. Pat. Nos. 3,451,820; 4,080,221; 4,367,282; 4,409,320 and 4,576,910, British Patent 2,102,137, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) 3,234,533.

Preferable examples of a colored coupler for correcting additional, undesirable absorption of a colored dye are those described in Research Disclosure No. 17643, VII-G, Research Disclosure No. 307105, VII-G, U.S. Pat. No. 4,163,670, JP-B-57-39413, U.S. Pat. Nos. 4,004,929 and 4,138,258, British Patent 1,146,368, JP-A-1-319744, JP-A-3-177836, JP-A-3-177837, and EP 423,727A. A coupler for correcting unnecessary absorption of a colored dye by a fluorescent dye released upon coupling described in U.S. Pat. No. 4,774,181 or a coupler having, as a split-off group, a dye precursor group which can react with a developing agent to form a dye, described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012, in addition to those represented by formulas (1) and (2) and those having a group of formula (Y) of the invention.

Research Disclosures Nos. 11449 and 24241, JP-A-61-201247, for example, disclose couplers which release breaching accelerator. These couplers effectively serve to shorten the time of any process that involves breaching. They are effective, particularly when added to light-sensitive material containing tabular silver halide grains noted above.

Preferable examples of a coupler which imagewise releases a nucleating agent or a development accelerator upon development are described in British Patents 2,097,140 and 2,131,188, JP-A-59-157638, and JP-A-59-170840. In addition, compounds releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of compounds which can be used in the light-sensitive material of the present invention are competing couplers described in, e.g., U.S. Pat. No. 4,130,427; poly-equivalent couplers described in, e.g., U.S. Pat. Nos. 4,283,472; 4,338,393 and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027. Specific examples of a high-boiling organic solvent to be used in the oil-in-water dispersion method and having a boiling point of 175° C. or more at atmospheric pressure are phthalic acid esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphoric acid esters or phosphonic acid esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoic acid esters (e.g., 2-ethylhexylbenzoate, dodecylbenzoate, and 2-ethylhexyl-p-hydroxybenzoate), amides (e.g., N,N-diethyldodecanamide, N,N-diethyllaurylamide, and N-tetradecylpyrrolidone), alcohols or phenols (e.g., isostearylalcohol and 2,4-di-tert-amylphenol), aliphatic carboxylic acid esters (e.g., bis(2-ethylhexyl) sebacate, dioctylazelate, glyceroltributyrate, isostearyllactate, and trioctylcitrate), aniline derivatives (e.g., N,N-dibutyl-2-butoxy-5-tert-octylaniline), and hydrocarbons (e.g., paraffin, dodecylbenzene, and disopropylnaphthalene). An organic solvent having a boiling point of about 30° C. or more, and preferably, 50° C. to about 160° C. can be used as an auxiliary solvent. Typical examples of the auxiliary solvent are ethyl acetare, butyl acetate, ethyl propionate, methylethylketone, cyclohexanone, 2-ethoxyethylacetate, and dimethylformamide.

Steps and effects of a latex dispersion method and examples of a loading latex are described in, e.g., U.S. Pat. No. 4,199,363 and German Patent Application (OLS) Nos. 2,541,274 and 2,541,230.

Dispersions of the cyan, magenta and yellow couplers for use in the present invention can contain a high-boiling organic solvent having a boiling point of 150° C. or more, in an amount defined by the following formula:

$$0 \leqq \text{solvent (weight)/coupler (weight)} \leqq 1.0$$

The ratio of the solvent to the coupler is preferably 0.7 or less, more preferably 0.5 or less, in order to improve sharpness and film strength.

In the above formula, the high-boiling organic solvent is emulsified and dispersed together with the coupler.

Various types of an antiseptic agent or a mildewproofing agent are preferably added to the color light-sensitive material of the present invention. Examples of the antiseptic agent and the mildewproofing agent are phenethyl alcohol, 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and changing aging conditions after coating. A swell ratio is preferably 150% to 400%. The swell ratio is calculated from the maximum swell film thickness measured under the above conditions in accordance with a relation: (max. swell film thickness−film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 615, and RD. No. 307105, pp. 880 and 881.

A color developer used in development of the light-sensitive material of the present invention is an aqueous alkaline solution containing as a main component, preferably, an aromatic primary amine color developing agent. As the color developing agent, changing aging conditions after coating. A swell ratio is preferably 150% to 400%. The swell ratio is calculated from the maximum swell film thickness measured under the above conditions in accordance with a relation: (max. swell film thickness−film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 615, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl) aniline, 4-amino-3-methyl-N-ethyl-N-(3-hydroxypropyl) aniline, 4-amino-3-methyl-N-ethyl-N-(2-hydroxypropyl) aniline, 4-amino-3-ethyl-N-ethyl-N-(3-hydroxypropyl) aniline, 4-amino-3-methyl-N-propyl-N-(3-hydroxypropyl) aniline, 4-amino-3-propyl-N-methyl-N-(3-hydroxypropyl) aniline, 4-amino-3-methyl-N-methyl-N-(4-hydroxybutyl) aniline, 4-amino-3-methyl-N-ethyl-N-(4-hydroxybutyl) aniline, 4-amino-3-methyl-N-propyl-N-(4-hydroxybutyl) aniline, 4-amino-3-methyl-N-ethyl-N-(3-hydroxy-2-methylpropyl) aniline, 4-amino-3-methyl-N,N-bis(4-hydroxybutyl) aniline, 4-amino-3-methyl-N,N-bis(5-hydroxypentyl) aniline, 4-amino-3-methyl-N-(5-hydroxypentyl)-N-(4-hydroxybutyl) aniline, 4-amino-3-methoxy-N-ethyl-N-(4-hydroxybutyl) aniline, 4-amino-3-ethoxy-N,N-bis(5-hydroxypentyl) aniline, 4-amino-N-propyl-N-(4-hydroxybutyl) aniline, and sulfates, hydrochlorides and p-toluenesulfonates thereof. Of these compounds, 3-methyl-4-amino-N-ethyl-N-β-hydroxyethylaniline, 4-amino-3-methyl-N-ethyl-N-(3-hydroxypropyl) aniline, 4-amino-3-methyl-N-ethyl-N-(4-hydroxypropyl) aniline, and the sulfates, hydrochlorides or p-toluenesulfonates thereof are more preferable. Further, 4-amino-3-methyl-N-ethyl-(3-hydroxybutyl) aniline and its salt are particularly preferred since they impart high coloring property to the light-sensitive material, and provide a certain color-forming density even if the amount of developed silver is relatively small, resulting in shortening of development time and improved desilvering property. These compounds can be used in a combination of two or more thereof in accordance with the application.

In general, the color developer contains a pH buffering agent such as a carbonate, a borate a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine (e.g., N,N-biscarboxymethylhydrazine), a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air.

The solution with air in a processing tank can be represented by an aperture defined below: Aperture = [contact area ($cm^2$) of processing solution with air]/[volume ($cm^3$) of processing solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a replenishing amount can be reduced by using a means of suppressing accumulation of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopoly carboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid or propionic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, EiseigiJutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Suitable as the dye stabilizing agent are: aldehydes such as formalin and glutaraldehyde, n-methylol compounds, hexamethylenetetramine, and aldehyde-sulfite adducts. Various chelating agents and various antifungal agents can be added to this stabilizing bath.

An overflow solution produced upon washing and/or replenishment of the stabilizing solution can be resued in another step such as a desilvering step.

In the processing using an automatic developing machine or the like, if each processing solution described above is condensed by evaporation, water is preferably added to correct concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

EXAMPLE 1

Preparation of Sample 101

A multilayered color light-sensitive material constituted by layers having the following compositions was formed on an undercoated 127 μm thick triacetylcellulose film support, thereby obtaining a sample 101. Numerals indicate an addition amount per $m^2$. Note that the effects of the added compounds are not limited to those described here.

| | |
|---|---|
| Layer 1: Antihalation layer | |
| Black colloidal silver | 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Solid Dispersion of fine crystals of dye E-1 | 0.1 g |
| Layer 2: Interlayer | |
| Gelatin | 0.40 g |
| Compound Cpd-C | 5 mg |
| Compound Cpd-J | 5 mg |
| Compound Cpd-K | 3 mg |
| High boiling organic solvent Oil-3 | 0.1 g |
| Dye D-4 | 0.4 mg |
| Layer 3: Interlayer | |
| Surface-fogged and internally fogged fine grain silver bromoiodide emulsion (average grain size = 0.06 μm, variation coefficient: 18%, AgI content: 1 mol %) | silver 0.05 g |
| Gelatin | 0.4 g |
| Layer 4: Low-speed red-sensitive emulsion layer | |
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-3 | 0.05 g |
| Coupler C-8 | 0.05 g |
| Compound Cpd-C | 10 mg |
| High-boiling organic solvent Oil-2 | 0.1 g |
| Additive P-1 | 0.1 g |
| Layer 5: Medium-speed red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Layer 6: High-speed red-sensitive emulsion layer | |
| Emulsion D | silver 0.4 g |
| Gelatin | 1.1 g |

-continued

| | |
|---|---|
| Coupler C-1 | 0.3 g |
| Coupler C-2 | 0.1 g |
| Coupler C-3 | 0.7 g |
| Additive P-1 | 0.1 g |
| Layer 7: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 mg |
| Ultraviolet absorbent U-2 | 0.002 mg |
| Ultraviolet absorbent U-5 | 0.01 g |
| Dye D-1 | 0.02 mg |
| Compound Cpd-C | 5 mg |
| Compound Cpd-J | 5 mg |
| Compound Cpd-K | 5 mg |
| High-boiling organic solvent Oil-1 | 0.02 g |
| Layer 8: Interlayer | |
| Surface-fogged and internally fogged silver bromoiodide emulsion (average grain size: 0.06 μm, variation coefficient: 16%, AgI content: 0.3 mol %) | silver 0.02 g |
| Gelatin | 1.0 g |
| Additive P-1 | 0.2 g |
| Color-mixing inhibitor Cpd-A | 0.1 g |
| Layer 9: Low-speed green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-4 | 0.1 |
| Coupler C-6 | 0.05 g |
| Coupler C-7 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 |
| High-boiling organic solvent Oil-1 | 0.1 g |
| High-boiling organic solvent Oil-2 | 0.1 g |
| Layer 10: Medium-speed green-sensitive emulsion layer | |
| Emulsion G | silver 0.3 g |
| Emulsion H | silver 0.3 g |
| Gelatin | 0.6 g |
| Coupler C-4 | 0.1 g |
| Coupler C-6 | 0.2 g |
| Coupler C-7 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Layer 11: Low-speed green-sensitive emulsion layer | |
| Emulsion I | silver 0.5 g |
| Gelatin | 1.0 g |
| Coupler C-4 | 0.3 g |
| Coupler C-6 | 0.1 g |
| Coupler C-7 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Layer 12: Interlayer | |
| Gelatin | 0.6 g |
| Layer 13: Yellow filter layer | |
| Yellow colloidal silver | silver 0.09 g |
| Gelatin | 1.1 g |
| Color-mixing inhibitor Cpd-A | 0.01 g |
| High-boiling organic solvent Oil-1 | 0.01 g |
| Layer 14: Interlayer | |
| Gelatin | 0.6 g |
| Layer 15: Low blue-sensitive emulsion layer | |

-continued

| | |
|---|---|
| Emulsion J | silver 0.2 g |
| Emulsion K | silver 0.3 g |
| Emulsion L | silver 0.1 g |
| Gelatin | 0.8 g |
| Coupler C-5 | 0.7 g |
| Layer 16: Medium-speed blue-sensitive emulsion layer | |
| Emulsion L | silver 0.1 g |
| Emulsion M | silver 0.4 g |
| Gelatin | 0.9 g |
| Coupler C-5 | 0.6 g |
| Layer 17: High-speed blue-sensitive emulsion layer | |
| Emulsion N | silver 0.4 g |
| Gelatin | 1.2 g |
| Coupler C-6 | 1.3 g |
| Layer 18: First protective layer | |
| Gelatin | 0.7 g |
| Ultraviolet absorbent U-1 | 0.02 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Layer 19: Second protective layer | |
| Colloidal silver | silver 0.1 mg |
| Fine grain silver bromoiodide emulsion (average grain size: 0.06 μm; AgI content: 1 mol %) | silver 0.1 g |
| Gelatin | 0.4 g |
| Layer 20: Third protective layer | |
| Gelatin | 0.4 g |
| Polymethylmethacrylate (average grain size: 1.5 μm) | 0.1 g |
| Copolymer of methylmethacrylate and acrylic acid in the mole ratio of 4:6 (av. grain size: 1.5 μm) | 0.1 g |
| Silicone oil | 0.03 g |
| Surfactant W-1 | 3.0 mg |

In addition to the above compositions, additives F-1 to F-8 were added to all of the emulsion layers. Furthermore, in addition to the above compositions, a gelatin hardener H-1 and surfactants W-2, W-3 and W-4 for coating and emulsification were added to each layer.

Further, as antiseptic and mildewproofing agents, phenol, 1,2-benzisothiazolin-3-one, 2-phenoxyethanol, phenethyl alcohol, and p-benzoic butylester were added.

The silver bromoiodide emulsions used in Sample 101 were as is specified in the following Table 8:

TABLE 8

| Emulsion | Features of Grains | Average equivalent sphere diameter (μm) | Variation coefficient (%) | AgI Content (mol %) |
|---|---|---|---|---|
| A | Monodispersed teradecabederal grains | 0.28 | 16 | 3.7 |
| B | Monodispersed cubic, internal latent-image grains | 0.30 | 10 | 3.3 |
| C | Monodispersed tabular grains average aspect ratio: 4.0 | 0.38 | 18 | 5.0 |
| D | Tabular grains average aspect ratio: 8.0 | 0.68 | 25 | 2.0 |
| E | Monodispersed cubic grains | 0.20 | 17 | 4.0 |
| F | Monodispersed cubic grains | 0.23 | 16 | 4.0 |
| G | Monodispersed cubic, internal latent-image grains | 0.28 | 11 | 3.5 |
| H | Monodispersed cubic, internal latent-image grains | 0.32 | 9 | 3.5 |
| I | Tabular grains average aspect ratio: 9.0 | 0.80 | 28 | 1.5 |
| J | Monodispersed teradecabederal grains | 0.30 | 18 | 4.0 |
| K | Monodispersed tabular grains average aspect ratio: 7.0 | 0.45 | 17 | 4.0 |
| L | Monodispersed cubic, internal latent-image grains | 0.46 | 14 | 3.5 |
| M | Monodispersed tabular grains average aspect ratio: 10.0 | 0.55 | 13 | 4.0 |
| N | Monodispersed tabular grains average aspect ratio: 12.0 | 1.00 | 33 | 1.3 |

TABLE 9

Spectral Sensitization of Emulsions A-J

| Emulsion | Sensitizing dye added | Amount(g) added per mol of silver halide |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.2 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |

TABLE 10

Spectral Sensitization of Emulsions K-N

| Emulsion | Sensitizing dye added | Amount(g) added per mol of silver halide |
|---|---|---|
| K | S-6 | 0.2 |
| | S-5 | 0.05 |
| L | S-6 | 0.22 |
| | S-5 | 0.06 |
| M | S-6 | 0.15 |

TABLE 10-continued
Spectral Sensitization of Emulsions K–N
| Emulsion | Sensitizing dye added | Amount(g) added per mol of silver halide |
|---|---|---|
| | S-5 | 0.04 |
| N | S-6 | 0.22 |
| | S-5 | 0.06 |
C-1
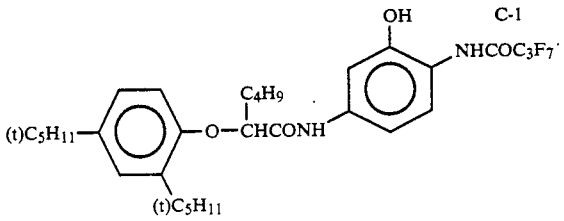
C-2
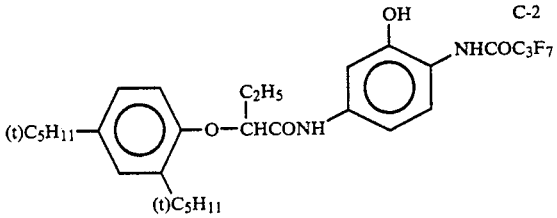
C-3
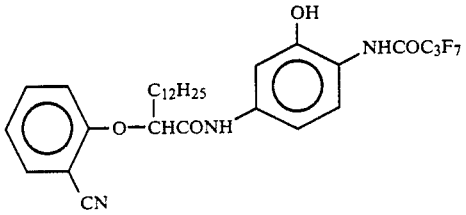
C-4
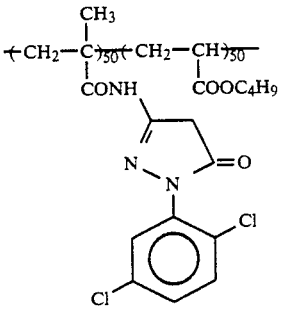
Numbers indicate weight percent
Numbers molecular weight: about 25,000
C-5
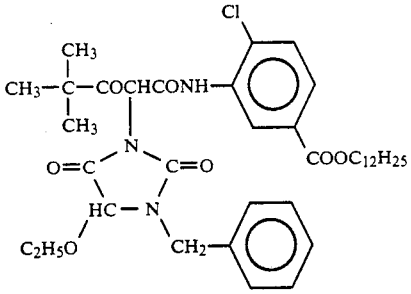
C-6
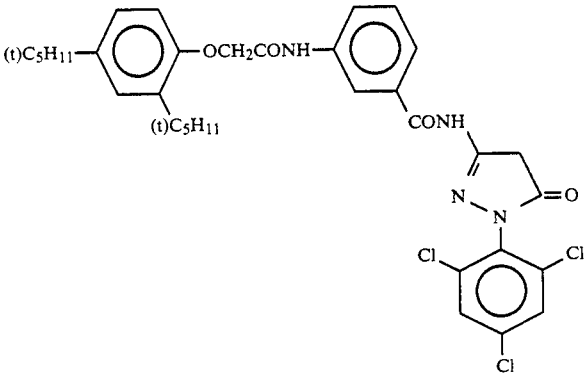

-continued
C-7
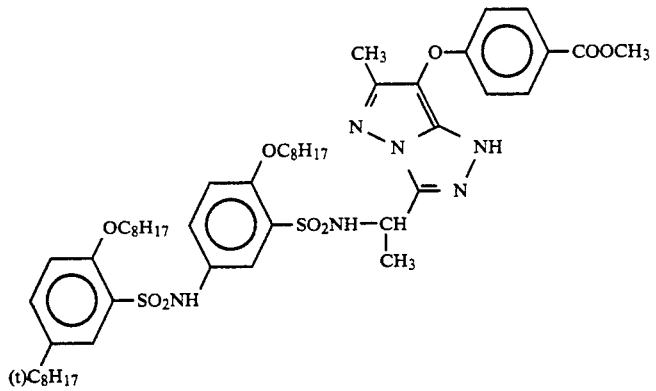
C-8
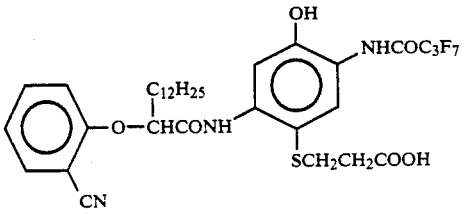
Dibutylphthalate Oil-1
Tricresylphosphate Oil-2
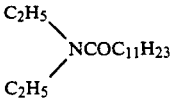
Oil-3
Cpd-A
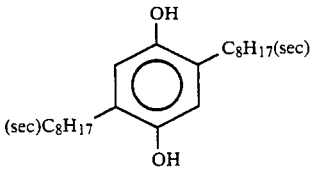
Cpd-B
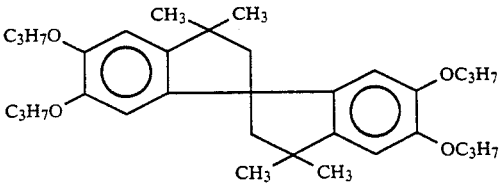
Cpd-C
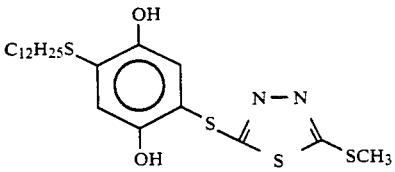
Cpd-D
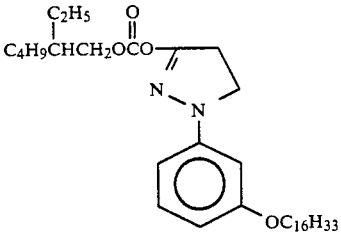
Cpd-E
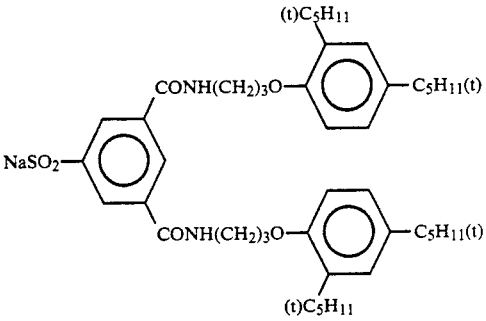
Cpd-F
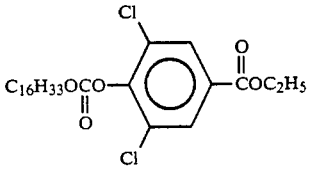
Cpd-G
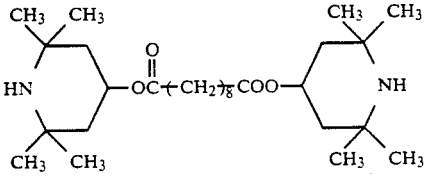
Cpd-H
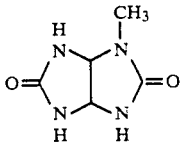

-continued
Cpd-I
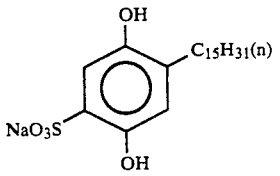
Cpd-J
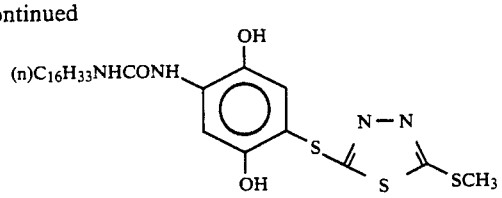
Cpd-K
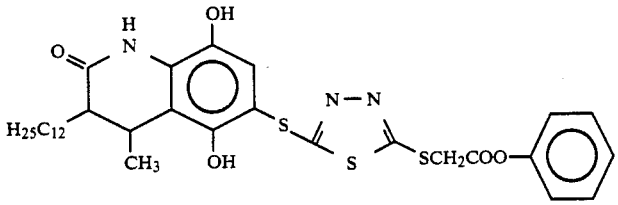
U-1
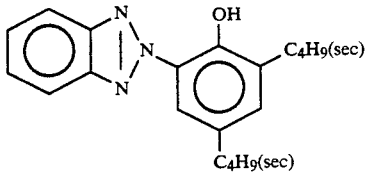
U-2
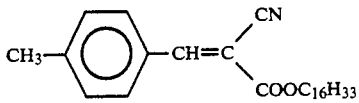
U-3
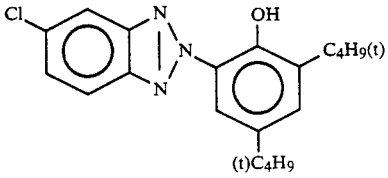
U-4
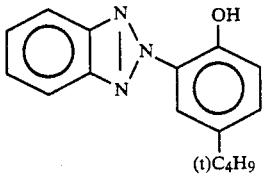
U-5
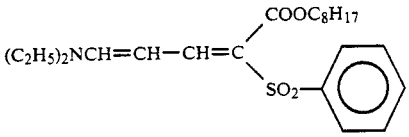
S-1
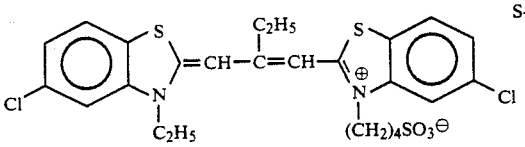
S-2
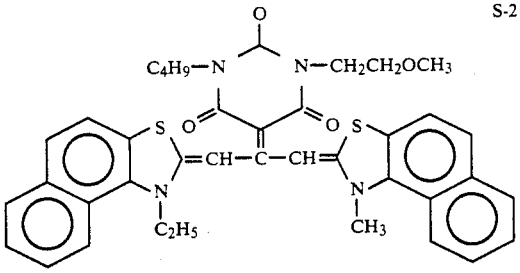
S-3
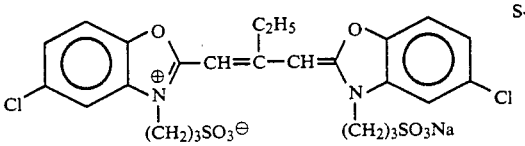
S-4
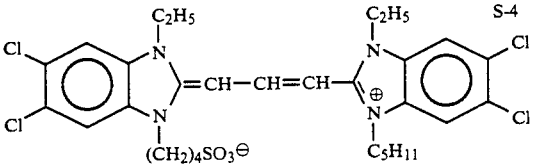
S-5
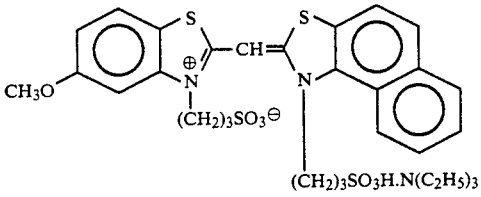
S-6
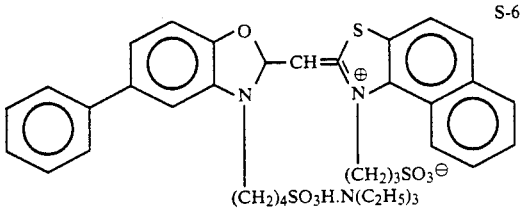
S-7
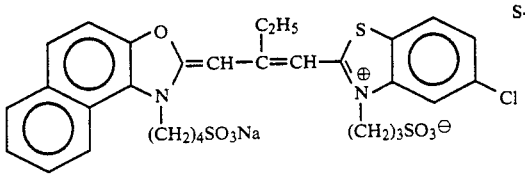

-continued
S-8
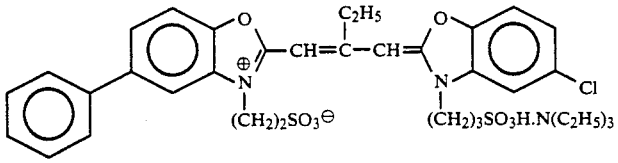
D-1
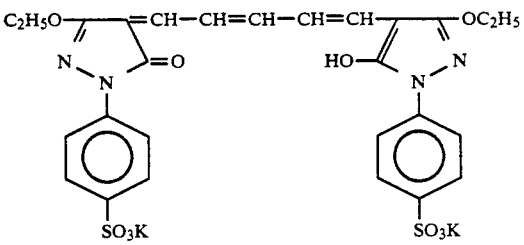
D-2
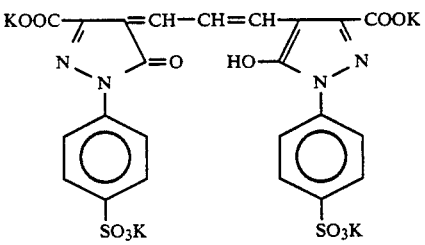
D-3
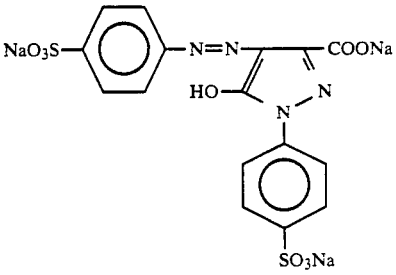
D-4
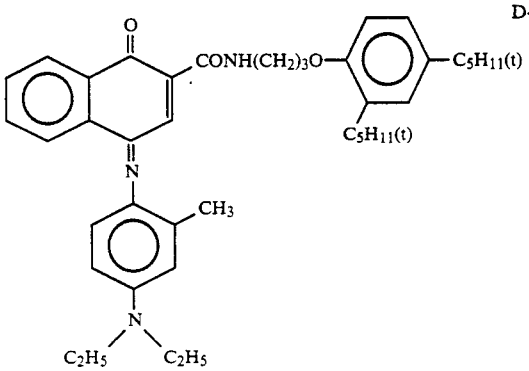
E-1
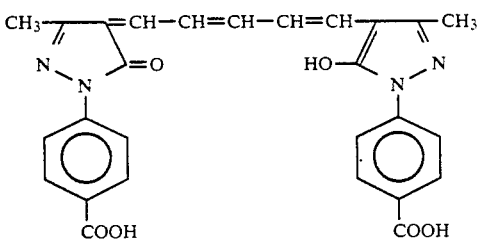
H-1
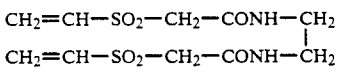
W-1
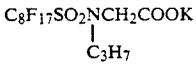
W-2
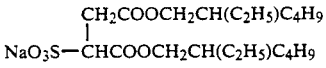
W-3
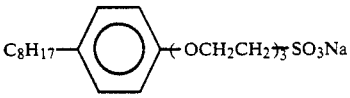
W-4
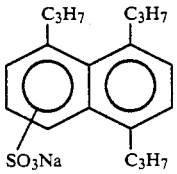
W-5
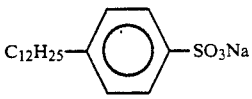
P-1
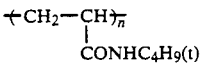
M-1
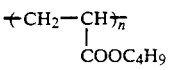
F-1
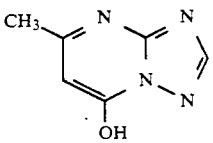

-continued

F-2

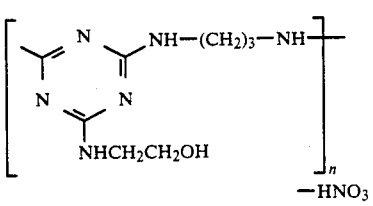

F-3

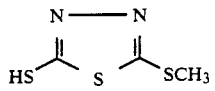

F-4

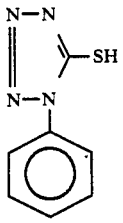

F-5

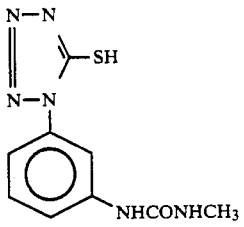

F-6

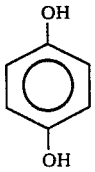

F-7

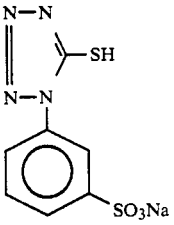

F-8

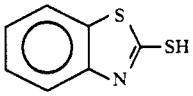

Preparation of Sample 102

Sample 102 was prepared in the same way as Sample 101, except that layer 14 (i.e., the interlayer) was not formed.

Preparation of Sample 103

Sample 103 was formed in the same way as Sample 101, except that layer 14 (i.e., the interlayer) was not formed, and that layer 13 (i.e., the yellow filter layer) contained a dispersion in place of colloidal silver in a coated amount of $2.0\times10^{-4}$ mol/m$^2$. The dispersion had been prepared by dissolving a reference dye (1) represented by the following formula in a mixture of ethyl acetate and tricresylphosphate and by dispersing the dye in a gelatin aqueous solution by means of a colloid mill.

Dye (1) disclosed in JP-A-1-196040:

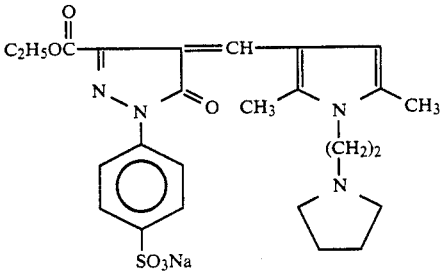

Preparation of Sample 104

Sample 104 was prepared in the same way as Sample 103, except that dye dispersion II-51 according to the invention was added, in equimolar amount, in place of the reference dye (1).

Preparation of Samples 105 to 107

Samples 105 to 107 were prepared in the same way as Sample 104, except that dye dispersion III-10, Iv-3, and VI-2 were added, respectively, in place of dye dispersion II-51.

Preparation of Samples 108 to 114

Samples 108 to 114 were formed in the same way as Samples 101 to 107, respectively, except that layers 15, 16, and 17 contained yellow coupler YA-28 of the invention, instead of yellow coupler C-5, in equimolar amount, and that the coated amount of yellow coupler YA-28 was 0.8 times that of yellow coupler C-5, in order to obtain the same yellow image density.

Preparation of Samples 115 to 121

Samples 115 to 121 were prepared in the same way as Samples 108 to 114, respectively, except that layers 15, 16, and 17 contained yellow coupler YA-6 of the invention, instead of yellow coupler YA-28, in equimolar amount.

Preparation of Sample 122

Sample 122 was prepared in the same way as Sample 110, except that each of layers 15, 16, and 17 contained yellow couplers YA-28 and YB-6 of this invention, each used in an amount of ½ mol.

The details of Samples 101 to 122, thus prepared, were as is shown in the following Table 11:

TABLE 11

| Sample | Additive in layer 13 | Layer 14 | Coupler in layers 15–17 |
|---|---|---|---|
| 101 (Comparative) | Yellow colloidal silver | Formed | C-5 |
| 102 (") | " | Not formed | " |
| 103 (") | Reference dye (1) | " | " |
| 104 (") | II-51 | " | " |
| 105 (") | III-10 | " | " |
| 106 (") | IV-3 | " | " |
| 107 (") | VI-2 | " | " |
| 108 (") | Yellow colloidal silver | Formed | YA-28 |
| 109 (") | " | Not formed | " |
| 110 (") | Reference dye (1) | " | " |
| 111 (Invention) | II-51 | " | " |
| 112 (") | III-10 | " | " |
| 113 (") | IV-3 | " | " |
| 114 (") | VI-2 | " | " |
| 115 (Comparative) | Yellow colloidal silver | Formed | YB-6 |
| 116 (") | " | Not formed | " |
| 117 (") | Reference dye (1) | " | " |
| 118 (Invention) | II-51 | " | " |
| 119 (") | III-10 | " | " |
| 120 (") | IV-3 | " | " |
| 121 (") | VI-2 | " | " |
| 122 (") | II-51 | " | YA-28/YB-6 = 1/1 (mol ratio) |

Samples 101 to 122 were cut and then stored at 35° C. and at a relative humidity of 80% for one month. Thereafter, they were wedge-exposed by the ordinary method and then processed in the way specified later, together with samples which had been stored at room temperature and similarly wedge-exposed. They were examined for their dye color-remaining, changes in sensitivity, and changes in maximum color-forming density. Also, the MTF values of the green-sensitive layers of each sample were measured, thereby evaluating the sharpness of the sample.

The results obtained were as is shown in Table 12 presented below. As is evident from Table 12, any sample using a combination of the dye and coupler of this invention had a small change in sensitivity and a small decrease in maximum density (caused by, probably, the fog increased in the first development) during a long term storage, and large decrease in dye color-remaining, even if it had no layer corresponding to layer 14. Also, as can be understood from Table 12, any sample according to the invention had high sharpness.

Other samples were prepared, using couplers YA-4 and YA-36 instead of coupler YA-28 in equimolar amount, and using couplers YB-24 and YB-31 instead of coupler YB-6 in equimolar amount. These samples were evaluated in the same method as Samples 101 to 122. The results were similar to those represented in Table 12.

TABLE 12

| | Long-term stability[2)] | | | |
|---|---|---|---|---|
| Sample | Residual dye color[1)] | Sensitivity | Maximum density | MTF of green-sensitive layer[3)] |
| 101 (Comparative) | Control (±0) | +0.06 | −0.14 | 0.55 |
| 102 (") | ±0 | +0.11 | −0.22 | 0.61 |
| 103 (") | ±0.06 | +0.01 | −0.09 | 0.62 |
| 104 (") | ±0 | +0.02 | −0.05 | 0.61 |
| 105 (") | ±0 | +0.01 | −0.08 | 0.62 |
| 106 (") | ±0 | +0.03 | −0.07 | 0.61 |
| 107 (") | ±0.01 | +0.02 | −0.07 | 0.62 |
| 108 (") | ±0 | +0.01 | −0.15 | 0.60 |
| 109 (") | ±0 | +0.17 | −0.28 | 0.65 |
| 110 (") | ±0.06 | +0.02 | −0.07 | 0.67 |
| 111 (Invention) | ±0 | +0.01 | −0.05 | 0.67 |
| 112 (") | ±0 | +0.02 | −0.06 | 0.68 |

TABLE 12-continued

| | Long-term stability[2)] | | | |
|---|---|---|---|---|
| Sample | Residual dye color[1)] | Sensitivity | Maximum density | MTF of green-sensitive layer[3)] |
| 113 (") | ±0.01 | +0.03 | −0.07 | 0.67 |
| 114 (") | ±0.01 | +0.02 | −0.08 | 0.67 |
| 115 (Comparative) | ±0 | +0.02 | −0.16 | 0.59 |
| 116 (") | ±0.01 | +0.16 | −0.29 | 0.65 |
| 117 (") | ±0.07 | +0.02 | −0.07 | 0.66 |
| 118 (Invention) | ±0 | +0.01 | −0.07 | 0.67 |
| 119 (") | ±0.01 | +0.02 | −0.08 | 0.66 |
| 120 (") | ±0 | +0.02 | −0.08 | 0.67 |
| 121 (") | ±0 | +0.01 | −0.07 | 0.66 |
| 122 (") | ±0 | +0.00 | −0.06 | 0.68 |

[1)]The minimum density measured after the processing, using that of Sample 101 as reference

[2)]Changes in the sensitivity (i.e., absolute exposure amount imparting density of 0.5) and maximum density, both measured after one-month storage at 35° C. and RH of 80% The less the values, the better.

[3)]Value for spatial frequency of 20/mm. The greater the value, the higher the sharpness.

| | Processing Steps | |
|---|---|---|
| Steps | Time | Temperature |
| First development | 6 min. | 38° C. |
| Water washing | 2 min. | 38° C. |
| Reversing | 2 min. | 38° C. |
| Color Development | 6 min. | 38° C. |
| Control | 2 min. | 38° C. |
| Bleaching | 6 min. | 38° C. |
| Fixing | 4 min. | 38° C. |
| Water washing | 4 min. | 38° C. |
| Stabilization | 1 min. | 25° C. |

The compositions of the respective processing solutions were as follows.

| [First development solution] | |
|---|---|
| Pentasodium nitrilo-N,N,N-trimethylene phosphonate | 1.5 g |
| Pentasodium diethylenetriaminepentaacetate | 2.0 g |
| Sodium sulfite | 30 g |

-continued

| [First development solution] | |
|---|---|
| Hydroquinone potassium monosulfonate | 20 g |
| Sodium carbonate | 15 g |
| Sodium biscarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water to make | 1000 ml |
| pH | 9.60 |

The pH was adjusted by hydrochloric acid or potassium hydroxide.

| [Reversing solution] | |
|---|---|
| Pentasodium nitrilo-N,N,N-trimethylene phosphonate | 3.0 g |
| Stannous chloride dihydrate | 1.0 g |
| p-aminophenol | 0.1 g |
| Sodium hydroxide | 8 g |
| Glacial acetic acid | 15.0 ml |
| Water to make | 1000 ml |
| pH | 6.00 |

The pH was adjusted by hydrochloric acid or potassium hydroxide.

| [Color developing solution] | |
|---|---|
| Pentasodium nitrilo-N,N,N-trimethylene phosphonate | 2.0 g |
| Sodium sulfite | 7.0 g |
| Tripotassium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-(β-methanesulfonamidoethyl)-3-methyl-4-aminoaniline 3/2 sulfate monohydrate | 11 g |
| 3,6-dithiaoctane-1,8-diol | 1 g |
| Water to make | 1000 ml |
| pH | 11.80 |

The pH was adjusted by hydrochloric acid or potassium hydroxide.

| [Control solution] | |
|---|---|
| Disodium ethylenediamine-tetraacetate dihydrate | 8.0 g |
| Sodium sulfite | 12 g |
| 1-thioglycerol | 0.4 g |
| Formaldehyde-sodium bisulfite adduct | 30 g |
| Water to make | 1000 ml |

The pH was adjusted by hydrochloric acid or potassium hydroxide.

| [Bleaching solution] | |
|---|---|
| Disodium ethylenediamine tetraacetate dihydrate | 2.0 g |
| Ammonium Fe (III) ethylenediamine tetraacetate dihydrate | 120 g |
| Potassium bromide | 100 g |
| Ammonium nitrate | 10 g |
| Water to make | 1000 ml |
| pH | 3.40 |

The pH was adjusted by hydrochloric acid or potassium hydroxide.

| [Fixing solution] | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by hydrochloric acid or ammonia water.

| [Stabilizing Solution] | |
|---|---|
| Benzoisothiazolin-3-one | 0.02 g |
| Polyoxyethylene-p-mono-nonylphenyl ether (av. polymerization degree: 10) | 0.3 g |
| Water to make | 1000 ml |
| pH | 7.0 |

EXAMPLE 2

A multilayered color light-sensitive material constituted by layers having the following compositions was formed on an undercoated triacetylcellulose film support, thereby obtaining a sample 201.

Compositions of Light-Sensitive Layers

The components used in each layer are classified as follows:

ExC: Cyan coupler
UV: Ultraviolet absorbent
ExM: Magenta coupler
HBS: High-boiling organic solvent
ExY: Yellow coupler
H: Gelatin hardener
ExS: Sensitizing dye Numerals indicate amounts coated in $g/m^2$ of silver for silver halide and colloidal silver, in $g/m^2$ for couplers, additives and gelatin, and in mol per mol of silver contained in the same layer, for sensitizing dyes.

| | |
|---|---|
| Layer 1: Antihalation layer | |
| Black colloidal silver | silver 0.15 |
| Gelatin | 1.90 |
| ExM-1 | $2.0 \times 10^{-2}$ |
| HBS-1 | $3.0 \times 10^{-2}$ |
| Layer 2: Interlayer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| HBS-2 | $7.0 \times 10^{-2}$ |
| Layer 3: Low-speed red-sensitive emulsion layer | |
| Emulsion AA | silver 0.15 |

-continued

| | |
|---|---|
| Emulsion BB | silver 0.25 |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| HBS-1 | $7.0 \times 10^{-3}$ |
| Layer 4: Medium-speed red-sensitive emulsion layer | |
| Emulsion CC. | silver 0.25 |
| Emulsion DD | silver 0.45 |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| Comparative coupler (a) | $3.0 \times 10^{-2}$ |
| Cpd-10 | $1.0 \times 10^{-4}$ |
| HBS-1 | 0.10 |
| Layer 5: High-speed red-sensitive emulsion layer | |
| Emulsion EE | silver 0.60 |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-4 | $1.0 \times 10^{-2}$ |
| ExC-5 | $7.0 \times 10^{-2}$ |
| ExS-6 | $8.0 \times 10^{-2}$ |
| ExC-7 | $1.5 \times 10^{-2}$ |
| HBS-1 | 0.15 |
| HBS-2 | $8.0 \times 10^{-2}$ |
| Layer 6: Interlayer | |
| Gelatin | 1.10 |
| P-2 | 0.17 |
| Cpd-1 | 0.10 |
| Cpd-4 | 0.17 |
| HBS-1 | $5.0 \times 10^{-2}$ |
| Layer 7: Low-speed green-sensitive emulsion layer | |
| Emulsion FF | silver 0.10 |
| Emulsion GG | silver 0.15 |
| Gelatin | 0.50 |
| ExS-4 | $3.0 \times 10^{-4}$ |
| ExS-5 | $1.2 \times 10^{-4}$ |
| ExS-6 | $0.2 \times 10^{-4}$ |
| ExS-7 | $3.0 \times 10^{-4}$ |
| ExM-1 | $3.0 \times 10^{-2}$ |
| ExM-2 | 0.20 |
| Comparative coupler (a) | $3.0 \times 10^{-2}$ |
| Cpd-11 | $7.0 \times 10^{-3}$ |
| HBS-1 | 0.15 |
| HBS-3 | 0.10 |
| Layer 8: Medium-speed green-sensitive emulsion layer | |
| Emulsion HH | silver 0.55 |
| Gelatin | 1.00 |
| ExS-4 | $3.0 \times 10^{-4}$ |
| ExS-5 | $1.2 \times 10^{-4}$ |
| ExS-6 | $2.0 \times 10^{-5}$ |
| ExS-7 | $3.0 \times 10^{-4}$ |
| ExM-1 | $3.0 \times 10^{-2}$ |
| ExM-2 | 0.25 |
| ExM-3 | $1.5 \times 10^{-2}$ |
| Comparative coupler (a) | $4.0 \times 10^{-2}$ |
| Cpd-11 | $9.0 \times 10^{-3}$ |
| HBS-1 | 0.2 |
| Layer 9: High-speed green-sensitive emulsion layer | |
| Emulsion II | silver 0.45 |

-continued

| | |
|---|---|
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExS-9 | $2.0 \times 10^{-5}$ |
| ExM-1 | $1.0 \times 10^{-2}$ |
| ExM-4 | $3.0 \times 10^{-2}$ |
| ExM-5 | $2.6 \times 10^{-2}$ |
| Comparative coupler (a) | $0.8 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| HBS-1 | 0.10 |
| HBS-2 | $5.0 \times 10^{-2}$ |
| HBS-3 | 0.10 |
| Layer 10: Yellow filter layer | |
| Gelatin | 0.90 |
| Yellow colloid | $5.0 \times 10^{-2}$ |
| Cpd-1 | 0.20 |
| HBS-1 | 0.15 |
| Layer 11: Low-speed blue-sensitive emulsion layer | |
| Emulsion JJ | silver 0.10 |
| Emulsion KK | silver 0.20 |
| Gelatin | 1.00 |
| ExS-8 | $2.0 \times 10^{-4}$ |
| Comparative coupler (a) | $9.0 \times 10^{-2}$ |
| Comparative coupler (A) | 0.90 |
| Cpd-2 | $1.0 \times 10^{-2}$ |
| HBS-1 | 0.15 |
| HBS-4 | 0.15 |
| Layer 12: High-speed blue-sensitive emulsion layer | |
| Emulsion LL | silver 0.40 |
| Gelatin | 0.60 |
| ExS-8 | $1.0 \times 10^{-4}$ |
| Comparative coupler (a) | $2.0 \times 10^{-2}$ |
| Comparative coupler (A) | 0.12 |
| Cpd-2 | $1.0 \times 10^{-3}$ |
| HBS-1 | $4.0 \times 10^{-2}$ |
| Layer 13: First protective layer | |
| Fine-grain silver bromoiodide (av. grain size: 0.07 μm AgI: 1 mol %) | |
| Gelatin | 0.20 |
| UV-2 | 0.80 |
| UV-3 | 0.10 |
| UV-4 | 0.20 |
| HBS-1 | $4.0 \times 10^{-2}$ |
| P-3 | $9.0 \times 10^{-2}$ |
| Layer 14: Second protective layer | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-11 | 0.40 |

Further, Cpd-3, Cpd-5 to Cpd-8, P-11, P-12, W-11 to W-13 were added to improve stability during storage, processibility, resistance to pressure, antifungal property, antibacterial property, antistatic property, and coatability of the sample.

Moreover, each of the layers contained B-4, F-11 to F-21, iron salt, lead salt, gold salt, platinum salt, iridium salt and rhodium salt, as was needed.

The emulsions used in the present invention will be specified in the following Tables 13 and 14, and the structures or names of the compounds used in the invention will be specified below.

TABLE 13

| | Average AgI content (%) | Average equivalent-sphere diameter (μm) | Variation coefficient in terms of grain-size distribution (%) | Diameter/thickness ratio | Average projected area equivalent circle diameter (μm) | Average thickness (μm) |
|---|---|---|---|---|---|---|
| Emulsion AA | 2.0 | 0.2 | 12 | 1 | — | — |

TABLE 13-continued

| | Average AgI content (%) | Average equivalent-sphere diameter (μm) | Variation coefficient in terms of grain-size distribution (%) | Diameter/thickness ratio | Average projected area equivalent circle diameter (μm) | Average thickness (μm) |
|---|---|---|---|---|---|---|
| Emulsion BB | 2.0 | 0.3 | 14 | 1 | — | — |
| Emulsion CC | 4.7 | 0.3 | 12 | 1 | — | — |
| Emulsion DD | 4.7 | 0.5 | 8 | 1 | — | — |
| Emulsion EE | 8.8 | 0.65 | 20 | 6.5 | 1.06 | 1.06 |
| Emulsion FF | 2.9 | 0.15 | 16 | 1 | — | — |
| Emulsion GG | 2.9 | 0.25 | 18 | 1 | — | — |
| Emulsion HH | 4.7 | 0.45 | 10 | 1 | — | — |
| Emulsion II | 8.8 | 0.60 | 22 | 7.2 | 1.01 | 0.14 |
| Emulsion JJ | 3.0 | 0.2 | 30 | 4.5 | 0.29 | 0.064 |
| Emulsion KK | 3.0 | 0.5 | 26 | 7.0 | 0.84 | 0.12 |
| Emulsion LL | 9.0 | 0.85 | 23 | 6.5 | 1.39 | 0.21 |

TABLE 14

| | Grain structure (iodine structure = silver ratio (AgI content, %) |
|---|---|
| Emulsion AA | Uniform, cubic grains |
| BB | Uniform, cubic grains |
| CC | Triple structure = 4/1/5 (1/38/1), cubic grains |
| DD | Triple structure = 4/1/5 (1/38/1), cubic grains |
| EE | Triple structure = 12/59/29 (0/11/8), tabular grains |
| FF | Triple structure = 45/5/50 (1/38/1), octahedral grains |
| GG | Triple structure = 45/5/50 (1/38/1), octahedral grains |
| HH | Triple structure = 4/1/5 (1/38/1), octahedral grains |
| II | Triple structure = 12/59/29 (0/11/8), tabular grains |
| JJ | Uniform, tabular grains |
| KK | Uniform, tabular grains |
| LL | Triple structure = 8/59/33 (0/11/8), tabular grains |

In Tables 13 and 14:

(1) Each emulsion was subjected to reduction sensitization using thiourea dioxide and thiosufonic acid at the time of forming grains, by the method disclosed in JP-A-2-191938.

(2) Each emulsion was gold-, sulfur-, and selenium-sensitized in the presence of the spectral sensitizing dyes indicated in the compositions of the light-sensitive layers and of sodium thiocyanates, by the method described in JP-A-3-237450.

(3) The tabular grains were formed by using low-molecular gelatin, as is described in JP-A-l-158426.

(4) Dislocation lines of the type disclosed in JP-A-3-237450 were observed in the tabular grains and in the regular grains having a structure, by means of a high-voltage electron microscope.

(5) Each of the emulsions was silver bromoiodide emulsion.

UV-1

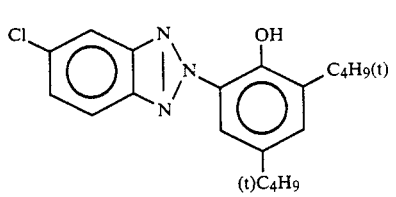

UV-2

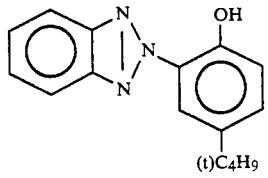

UV-3

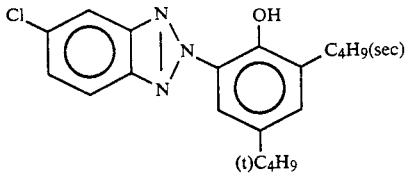

UV-4

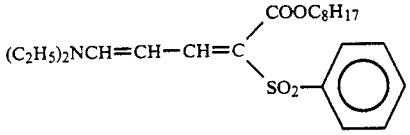

Tricresylphosphate HBS-1

Dibutylphthalate HBS-2

Tri(2-ethylhexyl)phosphate HBS-3

Dioctylphthalate HBS-4

ExF-1

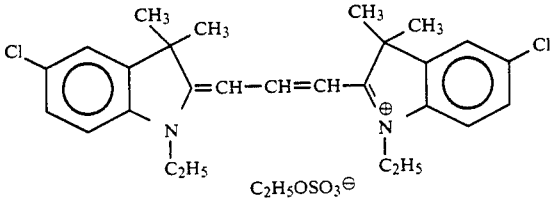

-continued
ExC-1
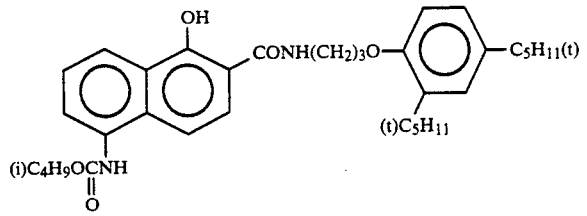
ExC-2
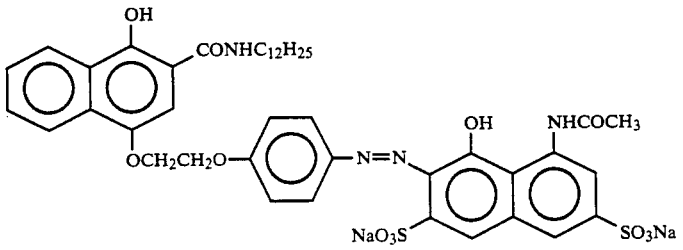
ExC-3
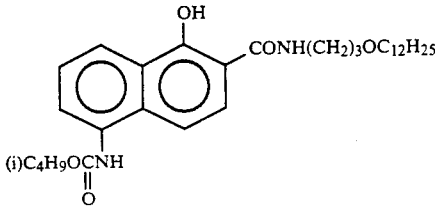
ExC-4
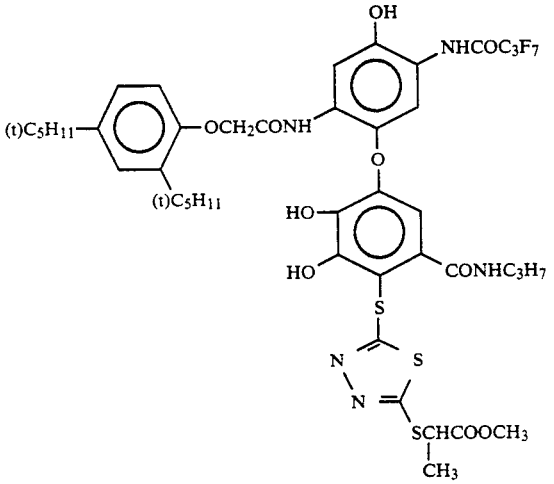
ExC-5
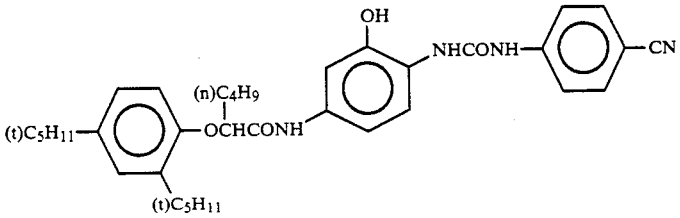
ExC-6
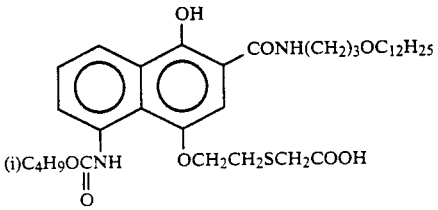

-continued
ExC-7
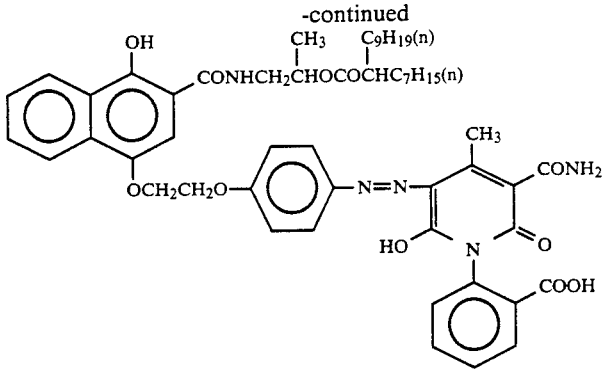
ExM-1
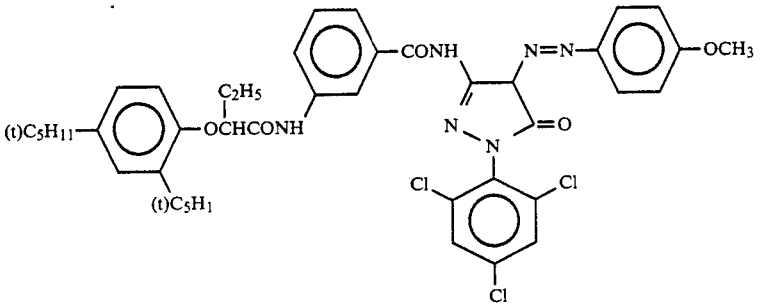
ExM-2
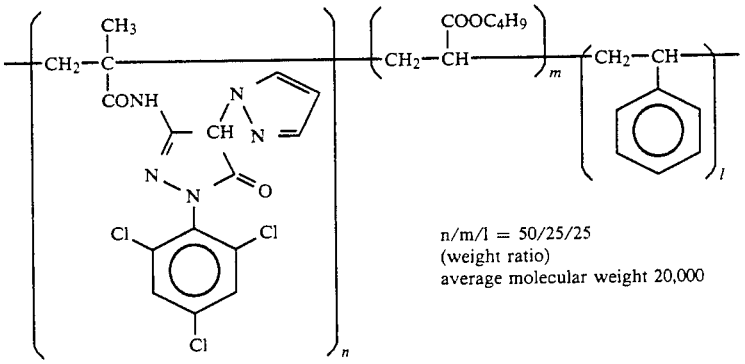
n/m/l = 50/25/25
(weight ratio)
average molecular weight 20,000
ExM-3
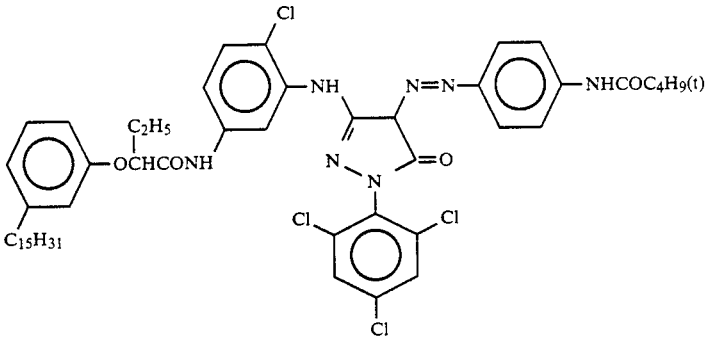
ExM-4
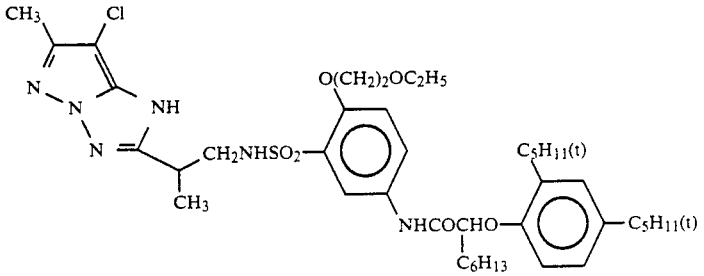

-continued
ExM-5
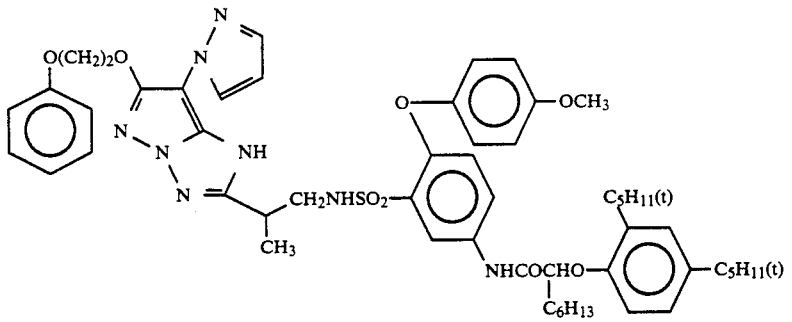
Cpd-1
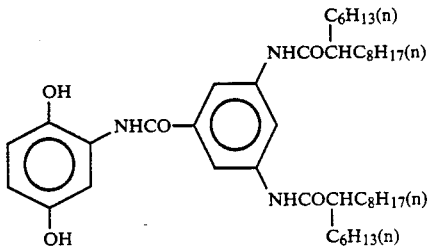
Cpd-2
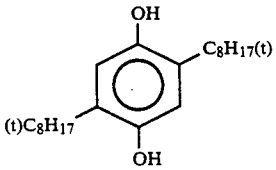
Cpd-3
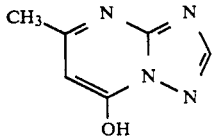
Cpd-4
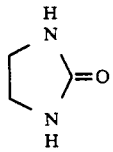
Cpd-5
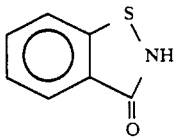
Cpd-6
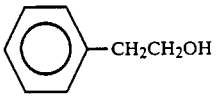
Cpd-7
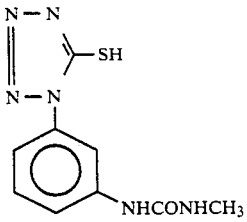
Cpd-8
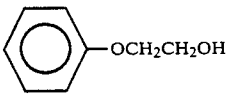
Cpd-9
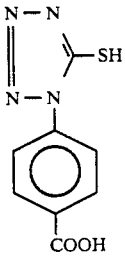
Cpd-10
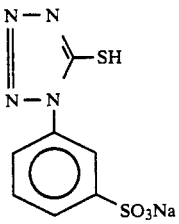
Cpd-11
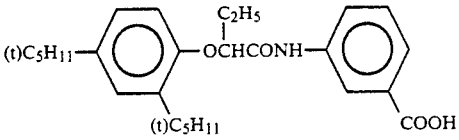
ExS-1
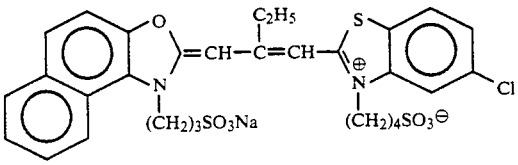

-continued
ExS-2
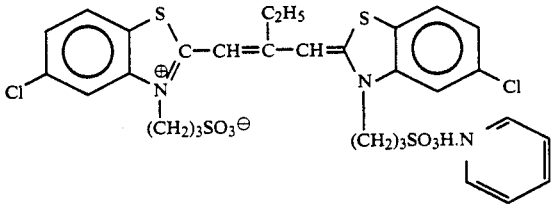
ExS-3
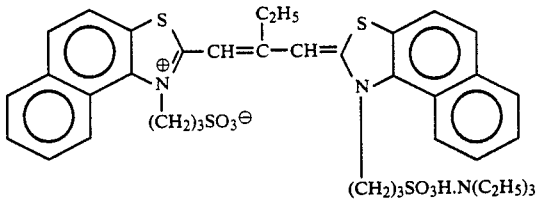
ExS-4
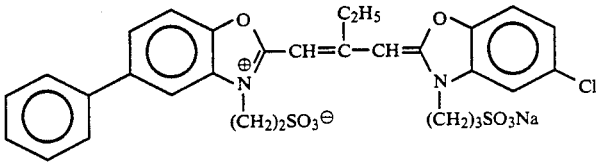
ExS-5
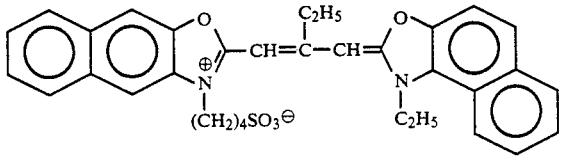
ExS-6
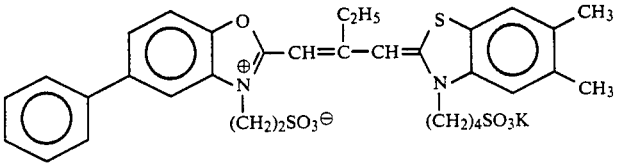
ExS-7
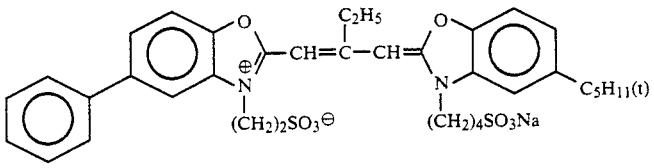
ExS-8
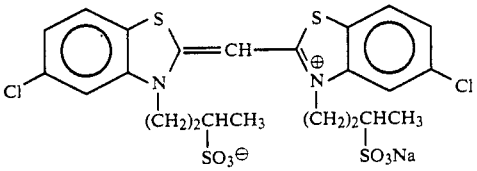
ExS-9
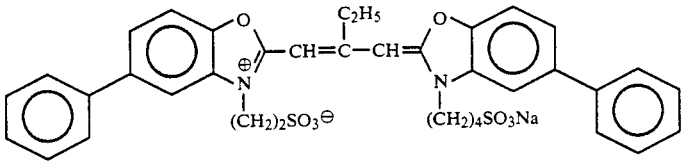
B-1
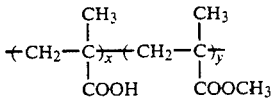
x/y/ = 10/90
B-2
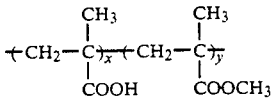
x/y = 40/60
B-3
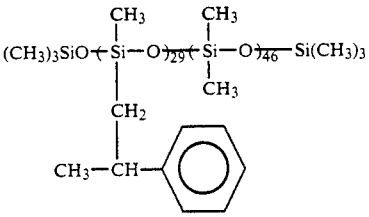
B-4
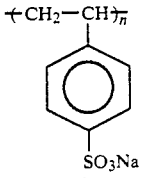

-continued

H-11 mixture [mixing ratio: 4:1) of:

$CH_2{=}CH{-}SO_2{-}CH_2{-}CONH{-}CH_2$ and $CH_2{=}CH{-}SO_2{-}CH_2{-}CONH{-}CH_2$

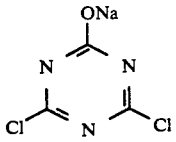

W-11

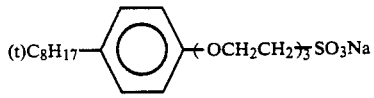

W-12

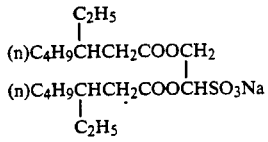

W-13

$C_8F_{17}SO_2N(C_3H_7)CH_2COOK$

P-11

Copolymer of vinylpyrrolidone and vinyl alcohol (copolymerization ratio = 70:30 [weight ratio])

P-12

Polyvinylpyrolidone (average molicular weight: about 10,000)

P-13

Polyethylacrylate

F-11

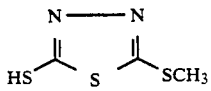

F-12

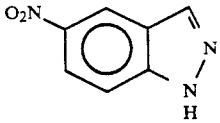

F-13

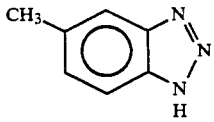

F-14

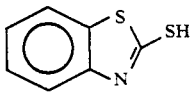

F-15

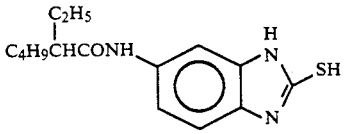

F-16

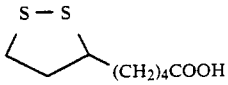

F-17

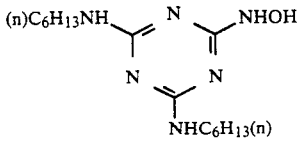

F-18

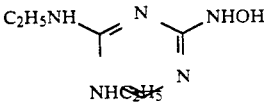

F-19

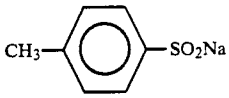

F-20

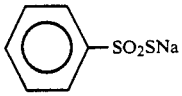

F-21

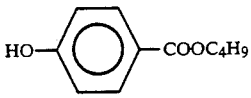

Further, the following samples were prepared, as will be detailed below.

Preparation of Samples 202 to 204

Samples 202 to 204 were prepared in the same way as Sample 201, except that blue-sensitive layers 11 and 12 contained, instead of comparative coupler (A), the yellow coupler, used in Sample 201, comparative couplers (B), comparative coupler (C), and yellow coupler YA-20, each used in equimolar amount, as is shown in Table 15.

Preparation of Samples 205 to 208

Samples 205 to 208 were prepared by the same method as Sample 202 to 204, respectively, except that layer 10 contained dye II-49 of the invention, in place of the yellow colloidal silver used in Samples 202 to 204. Dye II-49 was coated as a dispersion prepared using HBS-1 (HBS-1/II-49=2/1 in weight ratio), in an amount of $3.0\times10^{-4}$ mol/m$^2$.

Preparation of Samples 209 to 211

Samples 209 to 211 were prepared by the same method as Sample 208, except that layers 4 (i.e., a red-sensitive layer), layers 7–9 (i.e., green-sensitive layers), and layers 11 and 12 (i.e., blue-sensitive layers) contained comparative coupler (b), reference coupler (c), and coupler YA-64 of the invention, respectively, in place of comparative DIR coupler (a), in equimolar amounts, as is specified in Table 15.

Preparation of Samples 212 to 229

Samples 212 to 229 were prepared by the same way as Sample 201, except that layer 4 (i.e., a red-sensitive layer), layers 7 to 9 (i.e., green-sensitive layers), and layers 11 and 12 (i.e., blue-sensitive layers) contained the couplers of the formulas (1) and (2) of the invention, and the dyes of the invention or reference dyes, as is specified in Tables 16 and 17, in equimolar amounts in place of the DIR couplers used in the layers 4, 7–9, and 11 and 12 of Sample 201, and the yellow colloidal silver used in the layer 10 (i.e. yellow filter layer) of Sample 201.

TABLE 15

| Sample No. | Layer 4 (red-sensitive layer) | Green-sensitive layers | | | Blue-sensitive layers | | Layer 10 (yellow-filter layer) |
|---|---|---|---|---|---|---|---|
| | | Layer 7 | Layer 8 | Layer 9 | Layer 11 | Layer 12 | |
| 201 (Comparative) | Comparative coupler (a) | Comparative coupler (a) | The same as the left | The same as the left | Comparative coupler (A)/ Comparative coupler (a) | The same as the left | Yellow Colloidal silver |
| 202 (Comparative) | Comparative coupler (a) | Comparative coupler (a) | The same as the left | The same as the left | Comparative coupler (B)/ Comparative coupler (a) | The same as the left | Yellow Colloidal silver |
| 203 (Comparative) | Comparative coupler (a) | Comparative coupler (a) | The same as the left | The same as the left | Comparative coupler (C)/ Comparative coupler (a) | The same as the left | Yellow Colloidal silver |
| 204 (Comparative) | Comparative coupler (a) | Comparative coupler (a) | The same as the left | The same as the left | YA-20/Comparative coupler (a) | The same as the left | Yellow Colloidal silver |
| 205 (Comparative) | Comparative coupler (a) | Comparative coupler (a) | The same as the left | The same as the left | Comparative coupler (A)/ Comparative coupler (a) | The same as the left | II-49 |
| 206 (Comparative) | Comparative coupler (a) | Comparative coupler (a) | The same as the left | The same as the left | Comparative coupler (B)/ Comparative coupler (a) | The same as the left | II-49 |
| 207 (Comparative) | Comparative coupler (a) | Comparative coupler (a) | The same as the left | The same as the left | Comparative coupler (C)/ Comparative coupler (a) | The same as the left | II-49 |
| 208 (Invention) | Comparative coupler (a) | Comparative coupler (a) | The same as the left | The same as the left | YA-20/Comparative coupler (a) | The same as the left | II-49 |
| 209 (Invention) | Comparative coupler (b) | Comparative coupler (b) | The same as the left | The same as the left | YA-20/comparative coupler (b) | The same as the left | II-49 |
| 210 (Invention) | Reference coupler (c) | Reference coupler (c) | The same as the left | The same as the left | YA-20/reference coupler (c) | The same as the left | II-49 |
| 211 (Invention) | YA-64 | YA-64 | The same as the left | The same as the left | YA-20/YA-64 | The same as the left | II-49 |

TABLE 16

| Sample No. | Layer 4 (red-sensitive layer) | Green-sensitive layers | | | Blue-sensitive layers | | Layer 10 (yellow-filter layer) |
|---|---|---|---|---|---|---|---|
| | | Layer 7 | Layer 8 | Layer 9 | Layer 11 | Layer 12 | |
| 212 (Invention) | YA-64 | YA-64 | The same as the left | The same as the left | YA-5/YA-64 | The same as the left | II-49 |
| 213 (Invention) | YA-64 | YA-64 | The same as the left | The same as the left | YA-12/YA-64 | The same as the left | II-49 |
| 214 (Invention) | YA-64 | YA-64 | The same as the left | The same as the left | YA-49/YA-64 | The same as the left | II-49 |
| 215 (Invention) | YA-64 | YA-64 | The same as the left | The same as the left | YA-4/YA-64 | The same as the left | II-49 |
| 216 (Invention) | YA-64 | YA-64 | The same as the left | The same as the left | YA-14/YA-64 | The same as the left | II-49 |
| 217 (Invention) | YA-64 | YA-64 | The same as the left | The same as the left | YA-7/YA-64 | The same as the left | II-49 |

TABLE 16-continued

| Sample No. | Layer 4 (red-sensitive layer) | Green-sensitive layers | | | Blue-sensitive layers | | Layer 10 (yellow-filter layer) |
|---|---|---|---|---|---|---|---|
| | | Layer 7 | Layer 8 | Layer 9 | Layer 11 | Layer 12 | |
| 218 (Invention) | YA-64 | YA-64 | The same as the left | The same as the left | YA-16/YA-64 | The same as the left | II-49 |
| 219 (Invention) | YA-64 | YA-64 | The same as the left | The same as the left | YA-27/YA-64 | The same as the left | II-49 |
| 220 (Invention) | YA-64 | YA-64 | The same as the left | The same as the left | YA-43/YA-64 | The same as the left | II-49 |
| 221 (Invention) | YA-63 | YA-63 | The same as the left | The same as the left | YA-20/YA-63 | The same as the left | II-49 |
| 222 (Invention) | YA-59 | YA-60 | YA-62 | YA-56 | [YA-22/YB-9 = 1/1 (mol ratio)]/ YA-61 | YA-20/ YA-67 | II-49 |

TABLE 17

| Sample No. | Layer 4 (red-sensitive layer) | Green-sensitive layers | | | Blue-sensitive layers | | Layer 10 (yellow-filter layer) |
|---|---|---|---|---|---|---|---|
| | | Layer 7 | Layer 8 | Layer 9 | Layer 11 | Layer 12 | |
| 223 (Invention) | YA-65/ YB-39 = 1/1 (mol ratio) | YB-40 | YA-56/ YA-66 = 1/1 (mol ratio) | YA-64 | [YA-10/YB-9 = 1/1 (mol ratio)]/ [YA-66/YB-39 = 1/1 (mol ratio)] | [YA-27/YB-16 = 1/1 (mol ratio)]/ YA-65 | II-49 |
| 224 (Invention) | YA-64 | YB-40 | YA-64 | YA-64 | YA-20/YA-64 | The same as the left | III-15 |
| 225 (Invention) | YA-64 | YB-40 | YA-64 | YA-64 | YA-20/YA-64 | The same as the left | II-43 |
| 226 (Invention) | YA-64 | YB-40 | YA-64 | YA-64 | YA-20/YA-64 | The same as the left | D-1 |
| 227 (Invention) | YA-64 | YB-40 | YA-64 | YA-64 | YA-20/YA-64 | The same as the left | IV-3/II-41 1/1 (mol ratio) |
| 228 (Invention) | YA-64 | YB-40 | YA-64 | YA-64 | Comparative coupler (A)/ YA-64 | The same as the left | II-29 |
| 229 (Comparative) | YA-64 | YB-40 | YA-64 | YA-64 | YA-20/YA-64 | The same as the left | Reference dye (1) |

The mark "" used in Table 15 means "the same as above."

The comparative couplers and the reference dye will be specified as follows:

Comparative coupler (A) corresponding to one disclosed in Research Disclosure No. 18053 (1979)

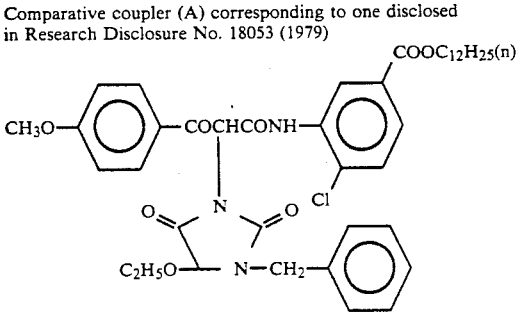

Comparative coupler (B), i.e., coupler (47) disclosed in French Patent 1,558,452

-continued

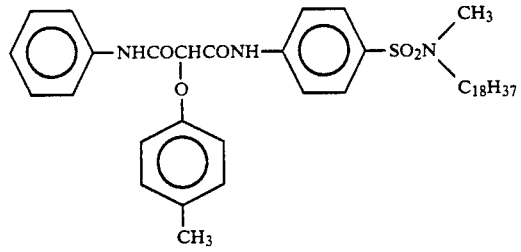

Comparative coupler (C), i.e., coupler Cp-(12) disclosed in JP-A-1-250950

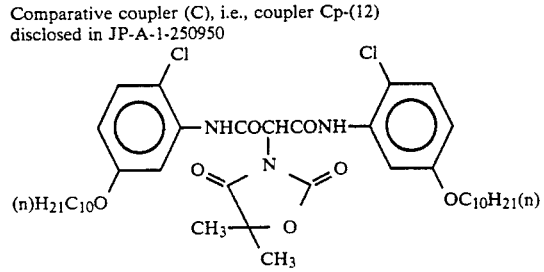

Comparative coupler (a), i.e., a coupler disclosed in U.S. Pat. No. 4,477,562

-continued

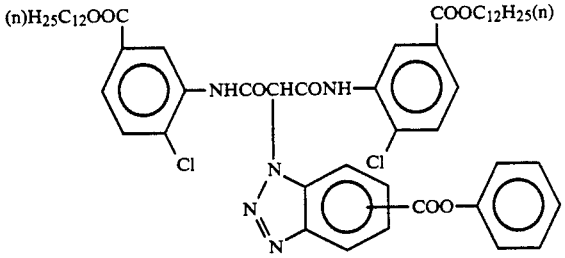

Comparative coupler (b), i.e., a coupler disclosed in JP-A-2-250053

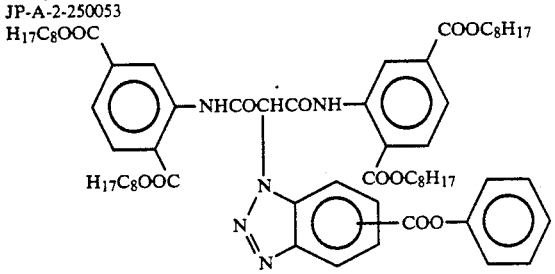

Comparative coupler (c), i.e., a coupler disclosed in JP-A-52-69624

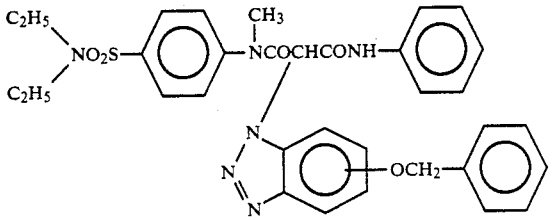

Reference dye (1), i.e., a dye disclosed in U.S. Pat. No. 4,477,562

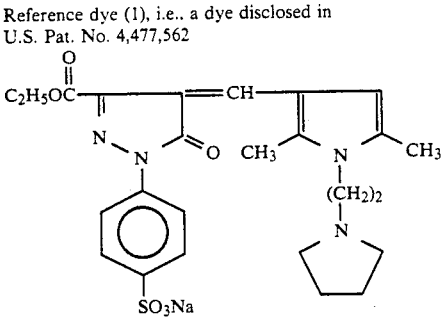

Samples 201 to 229, thus prepared, were color-developed and processed by the method specified below, by using the processing solutions of the compositions specified below, and were examined for their various properties.

They were processed by an automatic developing machine. More specifically, each sample was exposed imagewise until the color developing solutions replenished amounted three times the tank volume and then processed, and its properties were examined.

The steps of the process, and the compositions of the solutions were as follows:

| | Processing Steps | | | |
|---|---|---|---|---|
| Steps | Time | Temp. | Replenish Amout* | Tank volume |
| Color development | 3 min. 5 sec. | 38.0° C. | 600 ml | 10 l |
| Bleaching | 50 sec. | 38.0° C. | 140 ml | 5 l |
| Bleach-fixing | 50 sec. | 38.0° C. | — | 5 l |
| Fixing | 50 sec. | 38.0° C. | 420 ml | 5 l |
| Water washing | 30 sec. | 38.0° C. | 980 ml | 3.5 l |
| Stabilization (1) | 20 sec. | 38.0° C. | — | 3 l |
| Stabilization (2) | 20 sec. | 38.0° C. | 560 ml | 3 l |
| Drying | 1 min. 30 sec. | 60° C. | | |

*Amount per $m^2$ of the light-sensitive material.

The stabilizing solution was supplied in counter flow, from the step (2) to the step (1). All overflowing solution was introduced into the stabilizing bath. The replenishing into the bleach-fixing bath was achieved by causing all solution, which overflowed due to the replenishing into the bleaching tank and the fixing tank, to flow through the notches cut in the rims of the bleaching tank and fixing tank of the automatic developing machine. The amount of developing solution carried over into the bleaching step, the amount of bleaching solution carried over into the bleach-fixing step, the amount of bleach-fixing solution carried over into the fixing step, and the amount of fixing solution carried over into the washing step were 65 ml, 50 ml, 50 ml, and 50 ml per $m^2$ of the light-sensitive material, respectively. The cross-over time for each solution was 6 seconds, which was included in the time of the preceding step.

The compositions of the solutions used in the process were as follows:

| | Tank Solution (g) | Replenishment Solution (g) |
|---|---|---|
| (Color Developing Solution) | | |
| Diethylenetriamine-pentaacetic acid | 2.0 | 2.0 |
| 1-hydorxyethylidene-1, 1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-methyl-4-[N-ethyl-N-(β-hydroxylethyl) amino]aniline sulfate | 4.5 | 6.0 |
| Water to make | 1.0 l | 1.0 l |
| pH | 10.05 | 10.15 |
| (Bleaching Solution) | | |
| Ammonium Ferric 1,3-diaminepropane tetraacetate monohydate | 130 | 195 |
| Ammonium bromide | 70 | 105 |
| Ammonium nitrate | 14 | 21 |
| Hydroxyacetic acid | 50 | 75 |
| Acetic acid | 40 | 60 |
| Water to make | 1.0 l | 1.0 l |
| pH (adjusted with ammonia water) | 4.4 | 4.4 |

Bleach-Fixing Solution

A mixture of the bleaching solution described above and the fixing tank solution specified below, the mixing ration (in volume): 15:85, pH 7.0

| | Tank Solution (g) | Replenishment Solution (g) |
|---|---|---|
| (Fixing Solution) | | |
| Ammonium sulfite | 19 | 57 |
| Ammonium thiosulfate aqueous solution (700 g/l) | 280 ml | 840 ml |
| Imidazole | 15 | 45 |
| Ethylenediamine tetraacetic acid | 15 | 45 |
| Water to make | 1.0 l | 1.0 l |
| pH [adjusted with ammonia water and acetic acid] | 7.4 | 7.45 |

Water-Washing Solution

This was a solution prepared as follows. First, tap water was passed through a mixed-bed column filled with OH-type strong-base anion exchange resin (Amberlite IRA-400 available from Rohm & Haas, Co.) and H-type strong-acid cation exchange resin (Amberlite IR-120B), both resins made by manufactured by Rome and Harse, Inc., whereby the calcium and magnesium ion concentration of the water was reduced to 3 mg/l or less. Next, 20 mg/l of sodium isocyanuric acid dichloride and 150 mg/l of sodium sulfate were added to the water thus processed, thereby obtaining the washing solution. The washing solution had pH value ranging from 5.6 to 7.5.

| (Stabilizing Solution): The tank solution and the replenisher were identical in composition | (g) |
|---|---|
| Sodium p-toluenesulfonate | 0.03 |
| Polyoxyethylene-p-monononylphenylether (average polymerization degree: 10) | 0.2 |
| Disodium ethylenediamine tetraacetate | 0.05 |
| 1,2,4-triazole | 1.3 |
| 1,4-bis(1,2,4-triazol-1-ylmethyl)piperazine | 0.75 |
| Water to make | 1.0 liter |
| pH | 8.5 |

The samples, thus color-developed, were tested as follows, whereby their properties were evaluated.

(1) Photographic Properties

Each sample was subjected to white-light gradiation exposure (using a light source having a color temperature of 4800° K.), then processed as described above, and examined for its color densities. The absolute values of the reciprocals of the exposure amounts which imparted a density of the minimum cyan density+0.2, a density of the minimum magenta density+0.2, and a density of the minimum yellow density+0.2 were calculated from the characteristic curves of the cyan (R), magenta (G) and yellow (B) densities. The difference ($\Delta S_R$, $\Delta S_G$, or $\Delta S_B$) between each of these values and the corresponding value of Sample 201, used as reference, was used as the sensitivity of the sample, whereby the samples were compared in terms of sensitivity.

As for yellow images, the density achieved by an exposure amount of logE=1.0, which is greater than the exposure amount imparting a density of the minimum density+0.2, was measured in percentage ($D_B$%), using the color density of Sample 201 as reference.

(2) Storage Stability of the Light-Sensitive Material

Samples 201 to 229 of a first set were stored in a refrigerator for 5 days at 5° C. Meanwhile, Samples 201 to 229 of a second set were stored for 5 days at 50° C. and a relative humidity of 80%. Then, the samples of both sets were subjected to white-light gradation exposure, and were processed simultaneously. The samples were tested for their densities in the same way as described in the preceding paragraph (1). Each sample of the second set was compared with the corresponding one of the first set, in terms of magenta density and yellow density, using the densities of the latter as reference. The results were as will be shown later. Further, to evaluate the storage stability of each sample, the unexposed sample was bent for a predetermined time by a predetermined angle, and then developed, thereby examining density changes caused by the pressure applied to the sample.

(3) Color-Image Fastness

Samples 201 to 229 were subjected to white-light graduation exposure and the processing described above, and were tested for their densities in the same way as described in the preceding paragraph (1). Thereafter, they were stored for 30 days at 60° C. and a relative humidity of 70%, and evaluated for their densities again. The density of each sample, achieved by the exposure amount which had imparted a density of the minimum density+1.5 before the test, was determined from the characteristic curve of the sample. The fastness of the sample was evaluated in terms of color residue rate (%), i.e., the ratio of the density measured after the test to the density measured before the test. The results concerning yellow and magenta images were as will be specified later.

(4) Image Quality

Color Turbidity

Each of Samples 201 to 229 was subjected to uniform green-light exposure (0.5 Lux.sec), and then to blue-light gradation exposure. The yellow and magenta densities of the color image obtained by processing the sample were measured. The magenta density of the minimum density portion measured at a yellow density was subtracted from the magenta density read at that point on the characteristic curve which showed the exposure amount imparting a density of the minimum yellow density+2.0. The difference, thus obtained, was used as a yardstick for evaluating the color reproduction of the sample. The less the difference, the greater the color saturation of the yellow image.

Sharpness

Other samples were formed which were identical to Samples 201 to 229, except that couplers or sensitizing dyes were used in such amounts that the samples had yellow-image sensitivities and gradations almost equal to those of Sample 201.

These samples were subjected to exposure, in which white light was applied to the samples through MTF patterns. Then, the samples were processed as described above, and their yellow-image MTF values (25 cycles/mm) were measured by the method commonly used in the art. Their sharpnesses were compared in terms of yellow-image MTF values.

The results of the various tests described in the paragraphs (1) to (4) will be shown in the following Tables 18 and 19:

TABLE 18

| Sample No. | Photographic properties: Sensitivity: Cyan | Magenta | Yellow | Color density ($D_B$%) | Storage stability: Magenta | Yellow | Color-image fastness: Magenta | Yellow | Image quality: Color turbidity | Sharpness (25 cycles/mm) |
|---|---|---|---|---|---|---|---|---|---|---|
| 201 (Comparative) | 0.00 (Reference) | 0.00 (Reference) | 0.00 (Reference) | 100 (Reference) | −0.07 | −0.06 | 97 | 85 | 0.13 | 0.88 |
| 202 (Comparative) | 0.00 | 0.00 | −0.06 | 75 | −0.07 | −0.08 | 97 | 82 | 0.17 | 0.87 |
| 203 (Comparative) | 0.00 | 0.00 | +0.02 | 88 | −0.07 | −0.06 | 97 | 87 | 0.16 | 0.86 |
| 204 (Comparative) | 0.00 | 0.00 | +0.06 | 112 | −0.07 | −0.05 | 97 | 89 | 0.08 | 0.89 |
| 205 (Comparative) | +0.05 | +0.15 | 0.00 | 99 | −0.05 | −0.05 | 97 | 85 | 0.13 | 0.88 |
| 206 (Comparative) | +0.05 | +0.15 | −0.06 | 75 | −0.05 | −0.07 | 97 | 82 | 0.17 | 0.87 |
| 207 (Comparative) | +0.05 | +0.15 | +0.02 | 88 | −0.05 | −0.05 | 97 | 87 | 0.16 | 0.87 |
| 208 (Invention) | +0.06 | +0.16 | +0.07 | 112 | −0.04 | −0.03 | 97 | 90 | 0.04 | 0.91 |
| 209 (Invention) | +0.06 | +0.16 | +0.07 | 112 | −0.04 | −0.03 | 98 | 91 | 0.04 | 0.91 |
| 210 (Invention) | +0.05 | +0.14 | +0.06 | 110 | −0.08 | −0.06 | 97 | 89 | 0.05 | 0.89 |
| 211 (Invention) | +0.06 | +0.17 | +0.08 | 114 | −0.03 | −0.02 | 99 | 93 | 0.03 | 0.93 |
| 212 (Invention) | +0.06 | +0.17 | +0.06 | 103 | −0.03 | −0.04 | 99 | 89 | 0.04 | 0.91 |
| 213 (Invention) | +0.06 | +0.17 | +0.08 | 114 | −0.03 | −0.02 | 99 | 94 | 0.03 | 0.93 |
| 214 (Invention) | +0.06 | +0.17 | +0.07 | 112 | −0.03 | −0.03 | 99 | 91 | 0.03 | 0.92 |
| 215 (Invention) | +0.06 | +0.17 | +0.06 | 106 | −0.03 | −0.04 | 99 | 90 | 0.04 | 0.91 |

TABLE 19

| Sample No. | Photographic properties: Sensitivity: Cyan | Magenta | Yellow | Color density ($D_B$%) | Storage stability: Magenta | Yellow | Color-image fastness: Magenta | Yellow | Image quality: Color turbidity | Sharpness (25 cycles/mm) |
|---|---|---|---|---|---|---|---|---|---|---|
| 216 (Invention) | +0.06 | +0.17 | +0.09 | 116 | −0.03 | −0.02 | 99 | 93 | 0.04 | 0.93 |
| 217 (Invention) | +0.06 | +0.17 | +0.08 | 114 | −0.03 | −0.02 | 99 | 92 | 0.03 | 0.94 |
| 218 (Invention) | +0.06 | +0.17 | +0.09 | 116 | −0.03 | −0.02 | 99 | 93 | 0.04 | 0.93 |
| 219 (Invention) | +0.06 | +0.17 | +0.09 | 113 | −0.03 | −0.02 | 99 | 92 | 0.04 | 0.93 |
| 220 (Invention) | +0.06 | +0.17 | +0.08 | 112 | −0.03 | −0.02 | 99 | 92 | 0.03 | 0.94 |
| 221 (Invention) | +0.06 | +0.17 | +0.08 | 114 | −0.03 | −0.02 | 99 | 93 | 0.03 | 0.93 |
| 222 (Invention) | +0.06 | +0.17 | +0.08 | 115 | −0.03 | −0.02 | 99 | 93 | 0.03 | 0.93 |
| 223 (Invention) | +0.06 | +0.17 | +0.08 | 112 | −0.03 | −0.02 | 99 | 94 | 0.03 | 0.93 |
| 224 (Invention) | +0.06 | +0.17 | +0.08 | 114 | −0.03 | −0.02 | 99 | 93 | 0.03 | 0.93 |
| 225 (Invention) | +0.06 | +0.17 | +0.08 | 114 | −0.03 | −0.02 | 99 | 93 | 0.03 | 0.93 |
| 226 (Invention) | +0.06 | +0.17 | +0.08 | 114 | −0.03 | −0.02 | 99 | 93 | 0.03 | 0.93 |
| 227 (Invention) | +0.06 | +0.17 | +0.08 | 113 | −0.03 | −0.02 | 99 | 93 | 0.03 | 0.93 |
| 228 (Invention) | +0.06 | +0.16 | +0.02 | 103 | −0.03 | −0.04 | 99 | 88 | 0.11 | 0.90 |
| 229 (Comparative) | −0.03 | −0.07 | −0.06 | 105 | −0.11 | −0.10 | 96 | 82 | 0.12 | 0.89 |

As is evident from Tables 18 and 19, the use of the couplers of this invention more improved the photographic properties (i.e., yellow-image sensitivity and color density), storage stability, color-image fastness and color turbidity of the light-sensitive material, than the use of the comparative couplers and similar malondiamide-series couplers. This is obvious from the comparison of Sample 204 with Samples 201 to 203.

The use of the coupler and dyes of this invention in the same light-sensitive material, which is a feature of the present invention, resulted in improvement in the properties, though slightly, as can be understood from sample 208, while no noticeable changes were recognized in comparative Samples 205 to 207. Further, the use of the dyes of this invention greatly enhanced the sensitivities of the green- and red-sensitive layers, i.e., the light-sensitive layers located closer to the support than the layers containing the dyes, as is clearly seen from the comparison of Samples 201 to 204 with Samples 205 to 208.

The dyes of this invention are superior to the cited dyes in view of their contribution to improvement of photographic properties, storage stability, color fastness and image quality of the light-sensitive material, as is evidenced by the comparison of Samples 211 and 224 to 227 with Sample 229. This is probably because the dyes of the invention did not diffuse into any other layer in the dried film, and were decolored or flowed out during the color development. By contrast, the comparative dyes seem to have diffused into any other layer even in the dried film, inevitably affecting the photographic properties, or to have been little decolored or flowed out during the color development, thus degrading the properties of the light-sensitive material.

Of the couplers of this invention, those represented by the formula (2) are superior to those represented by the formula (1), as can be understood from the comparison of Samples 212 to 214 among themselves and from the comparison of Sample 215 with Sample 216. Also, any so-called DIR coupler of the invention, in which a group capable of splitting off upon coupling reaction with the oxidized form of the color developing agent is a development inhibiting compound, improves the photographic properties, storage stability, color fastness and image quality (i.e., color turbidity and sharpness) of the light-sensitive material, more greatly than any other coupler of the present invention, as is evident from the comparison of Samples 208 to 210 with Samples 211,221 and 222 and from the comparison of Sample 205 with Sample 228.

Samples 210 to 229 of another set, all unexposed, were bent by a predetermined angle, and then were developed. The change in the density of each sample was detected in order to evaluate the storage stability of the sample. This experiment revealed that Samples 208 to 228, particularly Samples 221 to 227, exhibited a small density change, whereas Samples 205 to 207 had a greater density change, Sample 229 exhibited a still greater density change, and Samples 201 to 204 had the greatest density change. The results show that the use of the couplers represented by the formula (1) or (2) and the use of the dyes of the invention improve the pressure resistance of the light-sensitive material.

Example 3

Six film units, each having a lens, were made by the method described in JU-B-2-32615 and JU-B-3-39784, using Samples 201, 208, 211, 223, 227, and 228, respectively. ("JU-B" means Published Examined Japanese Utility Model Application.)

Various objects were photographed on the film units of the six types, under the same conditions. The film units were color-developed by EP-560BAL (manufactured by Fuji Photo Film Co., Ltd.), an automatic developing machine. Then, they were printed on Fuji color paper, Super FA, Type II by means of Fuji Minilabo Champion, Printer Processor FA-140 (manufactured by Fuji Photo Film Co., Ltd.) (CP-43FA was used in this color developing process.)

The prints of six types, thus obtained, were compared in terms of image quality. Samples 208, 211, 223, 227, and 228, all using the couplers and dyes of this invention, produced images better in color saturation and clearness, than the images produced by Sample 201 which contained the comparative dyes. Of Samples of the present invention, Samples 211, 223, and 227 were excellent in comparison with Samples 208 and 228.

EXAMPLE 4

Samples 201 to 229, formed in Example 2, were color-developed and processed by the method specified below, by using the processing solutions of the compositions specified below, and were examined for their various properties in the same method as in Example 2.

| | Processing Steps | | | |
|---|---|---|---|---|
| | | | Replenish Tank | |
| Steps | Time | Temp. | Amount* | volume |
| Pre-bath | 10 sec | 27° C. | 13 ml | 10 l |
| Rinsing (1) | 10 sec. | 38° C. | — | — |
| Color development | 3 min. 00 sec. | 41° C. | 30 ml | 20 l |
| Development suspended | 30 sec. | 38° C. | 20 ml | 10 l |
| Acceleration | 30 sec. | 27° C. | 6.5 ml | 10 l |
| Bleaching | 3 min. 00 sec. | 27° C. | 6.5 ml | 10 l |
| Water washing (1) | 30 sec. | 38° C. | — | 10 l |
| Water washing (2) | 30 sec. | 38° C. | 45 ml | 10 l |
| Fixing | 2 min. 00 sec. | 38° C. | 20 ml | 10 l |
| Water washing (3) | 40 sec. | 38° C. | — | 10 l |
| Water washing (4) | 40 sec. | 38° C. | — | 10 l |
| Water washing (5) | 40 sec. | 38° C. | 9 ml | 10 l |
| Rinsing (2) | 10 sec. | 38° C. | 13 ml | 10 l |

*Amount per meter of the 35 mm wide light-sensitive material.

Rinsing (1) was carried out by spraying water directly onto both sides of each sample, in an amount of 30 ml per meter of the 35 mm wide material.

Each washing was performed in counter flow, from the step (2) to the step (1), and from the step (5) to the step (4) and further to the step (3).

The compositions of the processing solutions were as follows:

| | Mother Solution (g) | Replenishment Solution (g) |
|---|---|---|
| (Pre-Bath Solution) | | |
| Borax (decahydrate) | 20.0 | 20.0 |
| Sodium sulfate | 100 | 100 |
| Sodium hydroxide | 1.0 | 1.0 |
| Water to make | 1 l | 1 l |
| pH | 9.25 | 9.35 |
| (Color Developing Solution) | | |
| Amino tri(methylene phosphonic acid) 5 sodium salt | 1.5 | 2.0 |
| Sodium sulfite | 2.0 | 2.5 |
| Sodium Bromide | 1.0 | 0.8 |
| Sodium carbonate (anhydrate) | 25.6 | 25.0 |
| Sodium bicarbonate | 2.7 | 0.6 |
| N-ethyl-N- -methanesulfonamideethyl-3-methyl-4-aminoaniline sesquisulfate monohydrate | 4.0 | 5.5 |
| Water to make | 1 l | 1 l |
| pH | 10.20 | 10.27 |
| (Development-suspending solution) | | |
| 7.0N sulfuric acid | 50 ml | |
| Water to make | 1 l | (the same as the mother solution) |
| pH | 0.8 to 1.5 | |
| (Development-accelerating solution) | | |
| Sodium methabisulfite | 10.0 | 12.0 |
| Glacial acetic acid | 25 l | 30 ml |
| Sodium acetate | 10.0 | 12.0 |
| Tetrasodium ethylenediaminetetraacetate | 1.0 | 1.0 |
| 2-(2-N,N-dimethylaminoethyl)isothiourea dihydrochloride | 3.0 | 3.6 |
| Water to make | 1 l | 1 l |
| pH | 2.3 | 3.8 |
| (Bleaching Solution) | | |
| Gelatin | 0.5 | 0.5 |
| Sodium persulfate | 35.0 | 55.0 |
| Sodium chloride | 15.0 | 20.0 |
| Sodium primary phosphate | 9.0 | 12.9 |
| Phosphoric acid (85%) | 2.5 ml | 2.5 ml |
| Water to make | 1 l | 1 l |
| pH | 2.3 | 2.4 |
| (Fixing Solution) | | |
| Amino tri(methylene phosphonic acid) 5 sodium salt | 1.5 | 2.1 |
| Aqueous solution of ammonium thiosulfate (58 wt %) | 185 ml | 200 ml |
| Sodium sulfite | 10.0 | 22.0 |
| Sodium bisulfite | 8.4 | 4.0 |
| Water to make | 1 l | 1 l |
| pH | 6.5 | 7.2 |
| (Rinse Solution (2)) | | |
| Formaldehyde (37%) | 1.0 ml | 1.5 ml |
| Drywell (manufactured by Fuji Photo Film Co., Ltd.) | 2.0 m | 2.4 ml |
| Water to make | 1 l | 1 l |

There was the tendency that the samples processed as specified above exhibited properties similar to those shown in Tables 18 and 19. The light-sensitive materials using the couplers represented by the formula (1) or (2) and the dyes of this invention proved to excel in photographic properties, storage stability, color-image fastness and image quality.

A comparison of the results of Example 4 with those of Example 2 shows that the alkaline pre-bath processing, if performed as in Example 4, does not alter at all the properties of light-sensitive materials.

EXAMPLE 5

Preparation of Sample 501

Layers 1 to 11, specified below, were coated one upon another, all on a paper support polyethylene-laminated on both sides and having a thickness of 200 μm, thereby forming a color photographic material. The polyethylene on that side of the support on which layers 1 to 11 were coated contained 15 wt% of anatase-type titanium dioxide white used as white pigment and a small amount of ultramarine blue used as blue dye. The surface of the support had chromaticities of 89.0, −0.18 and −0.73 in terms of L*, a* and *c color systems, respectively.

Compositions of the Layers

The composition of each layer and the amount ($g/m^2$) of each component coated were as follows. The amount of any silver halide used is represented in the amount of silver.

| | |
|---|---|
| Layer 1: Antihalation layer | |
| Black colloidal silver | 0.07 |
| Gelatin | 0.50 |
| Layer 2: Low-speed red-sensitive layer | |
| Silver chlorobromoiodide spectrally sensitized with red sensitizing dyes 1, 2 and 3 (used in equimolar amounts) (silver chloride: 1 mol %, silver iodide: 4 mol %, average grain size: 0.3 μm, variation coefficient: 10%, cubic, iodine-rich core/shell structure) | 0.05 |
| Silver chlorobromoiodide spectrally sensitized with red sensitizing dyes 1, 2 and 3 (used in equimolar amounts) (silver chloride: 1 mol %, silver iodide: 4 mol %, average grain size: 0.5 μm, variation coefficient: 12%, cubic grains) | 0.08 |
| Gelatin | 1.00 |
| Cyan coupler 1 | 0.14 |
| Cyan coupler 2 | 0.07 |
| Decoloring inhibitor 1 | 0.03 |
| Decoloring inhibitor 2 | 0.03 |
| Decoloring inhibitor 2 | 0.03 |
| Dispersion medium (for couplers) | 0.03 |
| Di(2-ethylhexyl)phthalate (solvent for couplers) | 0.02 |
| Trinonylphosphate (solvent for couplers) | 0.02 |
| Di(3-methylhexyl)phthalate (solvent for couplers) | 0.02 |
| Development accelerator | 0.05 |
| Layer 3: High-speed red-sensitive layer | |
| Silver bromoiodide spectrally sensitized with red sensitizing dyes 1, 2 and 3 (used in equimolar amounts) (silver iodide: 6 mol %, average grain size: 0.8 μm, variation coefficient: 18%, tabular (aspect ratio = 8), iodine-rich core/shell structure) | 0.15 |

-continued

| | |
|---|---|
| Gelatin | 1.00 |
| Cyan coupler 1 | 0.20 |
| Cyan coupler 2 | 0.10 |
| Decoloring inhibitor 1 | 0.05 |
| Decoloring inhibitor 2 | 0.05 |
| Decoloring inhibitor 3 | 0.05 |
| Dispersion medium (for couplers) | 0.03 |
| Di(2-ethylhexyl)phthalate (solvent for couplers) | 0.033 |
| Trinonylphosphate (solvent for couplers | 0.033 |
| Di(3-methylhexyl)phthalate (solvent for couplers) | 0.033 |
| Development accelerator | 0.05 |
| Layer 4: Interlayer | |
| Black colloidal silver | 0.02 |
| Gelatin | 1.00 |
| Color-mixing inhibitor 1 | 0.04 |
| Color-mixing inhibitor 2 | 0.04 |
| Tricresylphosphate (solvent for color-mixing inhibitors) | 0.08 |
| Dibutylphthalate (solvent for color-mixing inhibitors) | 0.08 |
| Polyethylacrylate latex (molecular weight: 10,000–100,000) | 0.10 |
| Layer 5: Low-speed green-sensitive layer | |
| Silver chlorobromoiodide spectrally sensitized with green sensitizing dye 1 (silver chloride: 1 mol %, silver iodide: 2.5 mol %, average grain size: 0.28 μm, variation coefficient: 6%, cubic, iodine-rich core/shell structure) | 0.03 |
| Silver chlorobromoiodide spectrally sensitized with green sensitizing dye 1 (silver chloride: 1 mol %, silver iodide: 2.5 mol %, average grain size: 0.45 μm, variation coefficient: 10%, cubic grains) | 0.05 |
| Gelatin | 0.80 |
| Magenta coupler 1 | 0.05 |
| Magenta coupler 2 | 0.05 |
| Color-mixing inhibitor 4 | 0.10 |
| Stain preventing agent 1 | 0.05 |
| Stain preventing agent 2 | 0.05 |
| Stain preventing agent 3 | 0.001 |
| Stain preventing agent 4 | 0.01 |
| Dispersion medium (for couplers) | 0.05 |
| Tricresylphosphate (solvent for couplers) | 0.075 |
| Trioctylphosphate (solvent for couplers) | 0.075 |
| Layer 6: High-speed green-sensitive layer | |
| Silver bromoiodide spectrally sensitized with green sensitizing dye 1 (silver iodide: 3.5 mol %, average grain size: 1.0 μm, variation coefficient: 18%, tabular grains (aspect ratio = 9), uniform iodine-content type) | 0.10 |
| Gelatin | 0.80 |
| Magenta coupler 1 | 0.05 |
| Magenta coupler 2 | 0.05 |
| Color-mixing inhibitor 4 | 0.10 |
| Stein preventing agent 3 | 0.001 |
| Stein preventing agent 4 | 0.01 |
| Dispersion medium (for couplers) | 0.05 |
| Tricresylphosphate (solvent for couplers) | 0.075 |
| Trioctylphosphate (solvent for couplers) | 0.075 |
| Layer 7: Yellow filter layer | |
| Yellow colloidal silver | 0.14 |
| Gelatin | 1.00 |
| Color-mixing inhibitor 1 | 0.06 |
| Tricresylphosphate (solvent for color-mixing inhibitor) | 0.075 |
| Dibutylphthalate (solvent | 0.075 |

-continued

| | |
|---|---|
| for color-mixing inhibitor) | |
| Polyethylacrylate latex (molecular weight: 10,000–100,000) | 0.10 |
| Layer 8: Low-speed blue-sensitive layer | |
| Silver chlorobromoiodide spectrally sensitized with blue sensitizing dyes 1 and 2 (used in equimolar amount) (silver chloride: 2 mol %, silver iodide: 2.0 mol %, average grain size: 0.38 μm, variation coefficient: 8%, cubic, iodine-rich core/shell structure) | 0.07 |
| Silver chlorobromoiodide spectrally sensitized with blue sensitizing dyes 1 and 2 (used in equimolar amount) (silver chloride: 2 mol %, silver iodide: 2.0 mol %, average grain size: 0.55 μm, variation coefficient: 10%, cubic, iodine-rich core/shell structure) | 0.10 |
| Gelatin | 0.50 |
| Yellow coupler 1 | 0.10 |
| Yellow coupler 2 | 0.10 |
| Color-mixing inhibitor 5 | 0.10 |
| Stain preventing agent 3 | 0.001 |
| Dispersion medium (for coupler) | 0.05 |
| Trinonylphosphate (solvent for couplers) | 0.05 |
| Layer 9: High-speed blue-sensitive layer | |
| Silver bromoiodide spectrally sensitized with blue sensitizing dyes 1 and 2 (used in equimolar amount) (silver iodide: 2.0 mol %, average grain size: 1.4 μm, variation coefficient: 18%, tabular (aspect ratio = 12), iodine-rich core/shell structure) | 0.25 |
| Gelatin | 1.00 |
| Yellow coupler 1 | 0.20 |
| Yellow coupler 2 | 0.20 |
| Color-mixing inhibitor 5 | 0.10 |
| Stain preventing agent 3 | 0.002 |
| Dispersion medium | 0.15 |

-continued

| | |
|---|---|
| (for coupler) | |
| Trinonylphosphate (solvent for coupler) | 0.10 |
| Layer 10: Ultraviolet absorbing layer | |
| Gelatin | 1.50 |
| Ultraviolet absorbent 1 | 0.50 |
| Ultraviolet absorbent 2 | 0.50 |
| Dispersion medium (for ultraviolet absorbents) | 0.15 |
| Di(2-ethylhexyl)phthalate (solvent for ultraviolet absorbents) | 0.075 |
| Trinonylphosphate (solvent for ultraviolet absorbents) | 0.075 |
| Dye 1 (for preventing irradiation) | 0.01 |
| Dye 2 (for preventing irradiation) | 0.01 |
| Dye 3 (for preventing irradiation) | 0.005 |
| Dye 4 (for preventing irradiation) | 0.005 |
| Layer 11: Protective layer | |
| Gelatin | 0.90 |
| 1,2-bis(vinylsulfonylacetoamide) ethane (gelatin hardener) | 0.085 |
| 4,5-dichloro-2-hydroxy-1,3,5-triazine sodium salt (gelatin hardener) | 0.085 |
| Non-light-sensitive silver halide (silver chlorobromide, silver iodide: 3 mol %, average grain size: 0.2 μm) | 0.02 |
| Modified poval | 0.05 |

Further, each of the layers specified above contained Alkanol XC (manufactured by Du Pont) and sodium alkylbenzensulfonate, both used as emulsifying-dispersing agents, and succinate ester and Magfac F-120 (manufactured by Dai-Nippon Ink Co., Ltd.) both used as coating aids. Any layer containing silver halide or colloidal silver contained the stabilizing agents which will be specified below.

The photographic material, thus prepared, shall be referred to as "Sample 501."

The compounds used in forming this photographic materials are as follows:

(Red sensitizing dye 1)

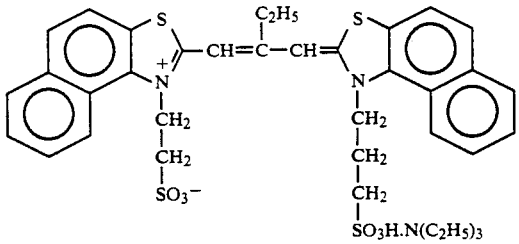

(Red sensitizing dye 2)

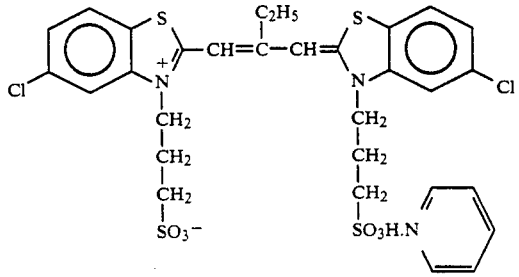

(Red sensitizing dye 3)

-continued
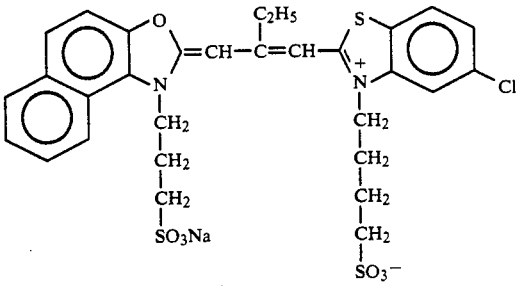
(Green sensitizing dye)
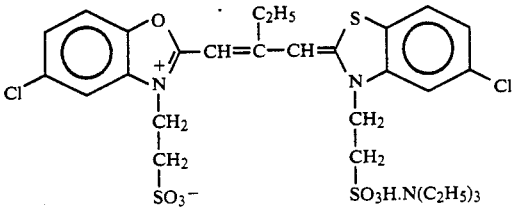
(Blue sensitizing dye 1)
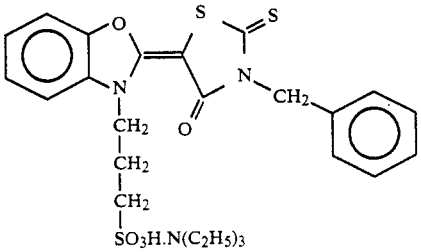
(Blue sensitizing dye 2)
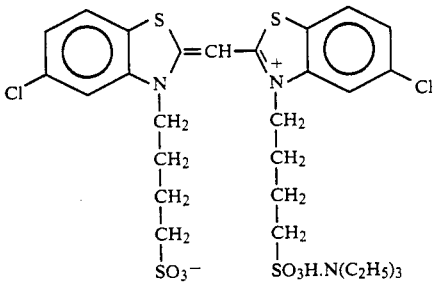
(Cyan coupler 1)
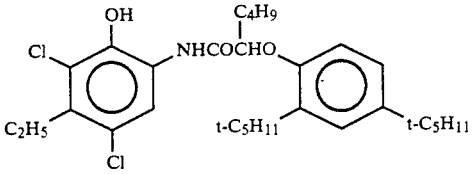
(Cyan coupler 2)
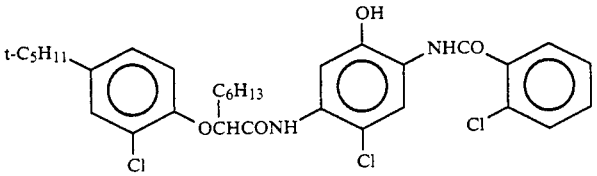
(Magenta coupler 1)

-continued
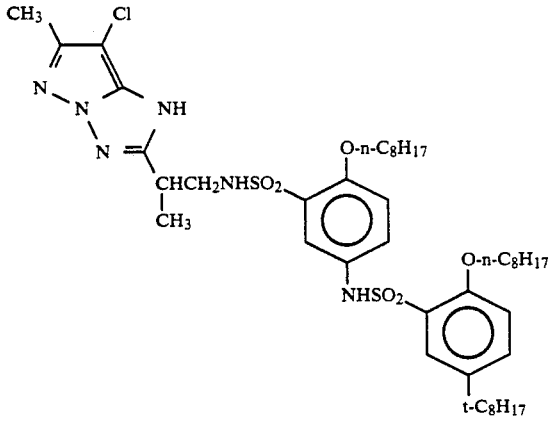
(Magenta coupler 2)
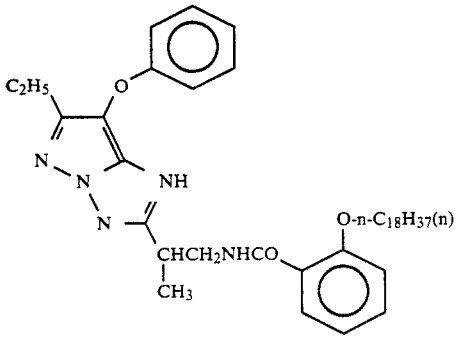
(Yellow coupler 1)
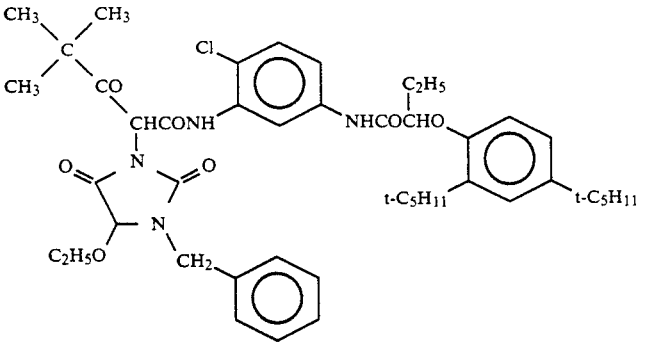
(Yellow coupler 2)
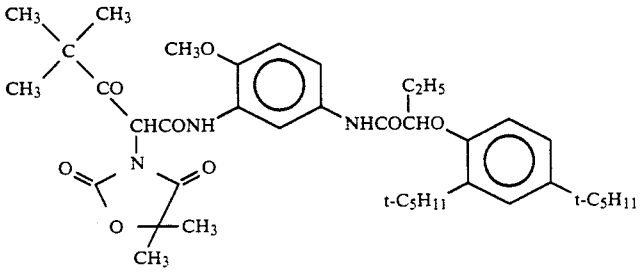
(Decoloring inhibitor 1)

-continued
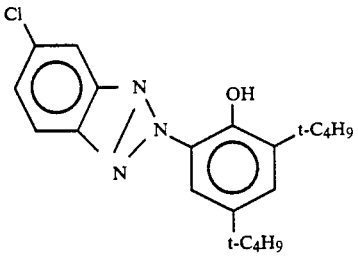
(Decoloring inhibitor 2)
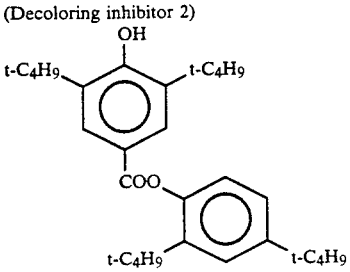
(Decoloring inhibitor 3)
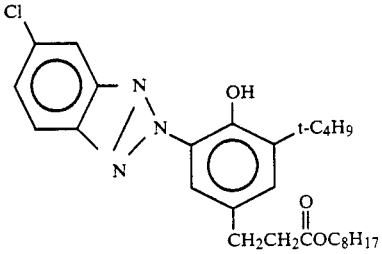
(Decoloring inhibitor 4)
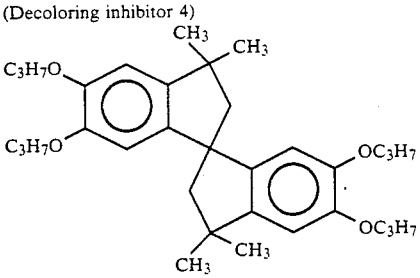
(Decoloring inhibitor 5)
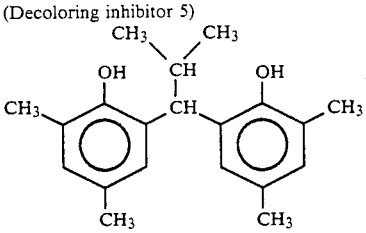
(Dispersion medium)
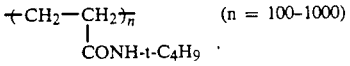
(n = 100–1000)
(Development accelerator)
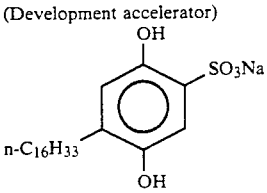
(Color-mixing inhibitor 1)

-continued
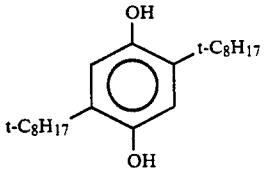
(Color-mixing inhibitor 2)
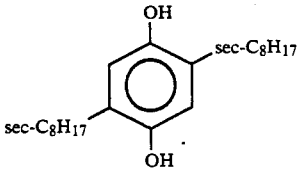
(Stain preventing agent 1)
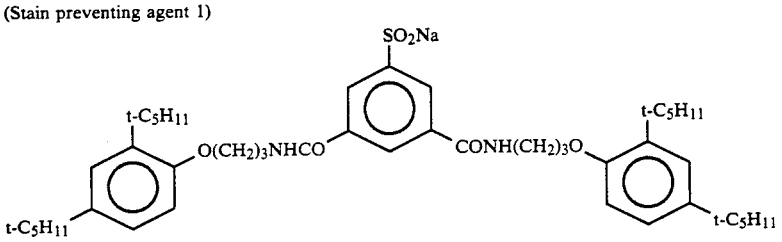
(Stain preventing agent 2)
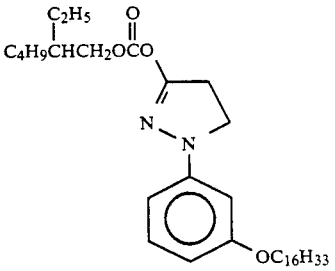
(Stain preventing agent 3)
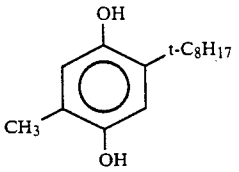
(Stain preventing agent 4)
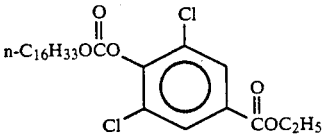
(Ultraviolet absorbent 1)
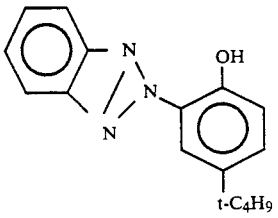
(Ultraviolet absorbent 2)

-continued
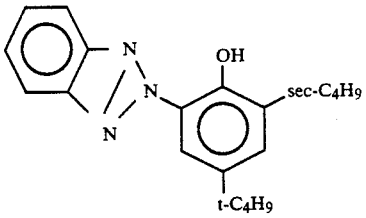
(Dye 1)
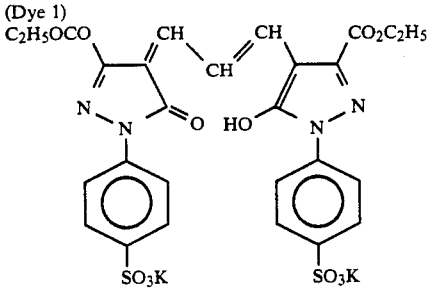
(Dye 2)
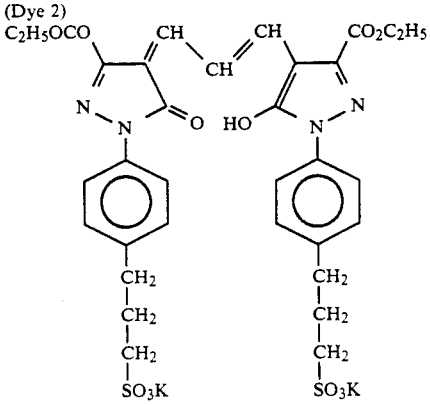
(Dye 3)
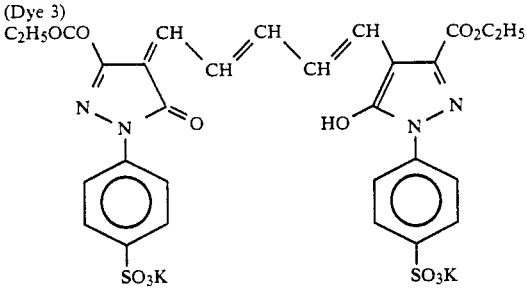
(Dye 4)
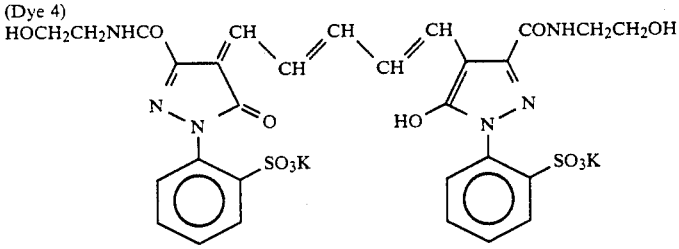
(Stabilizing agent 1)
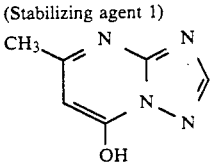

-continued (Stabilizing agent 2)

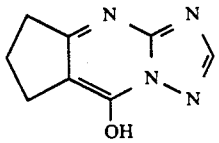

(Stabilizing agent 3)

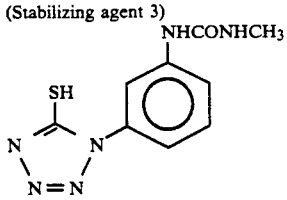

Samples other than Sample 501 were prepared as will be described below.

Preparation of Sample 502

Sample 502 was formed in the same way as Sample 501, except that colloidal silver was not used in layer 7, and a dye dispersion was used instead in layer 7. The dye dispersion had been prepared by dissolving the reference dye (1) used in Example 1 in a mixture of ethyl acetate and tricresylphosphate and by dispersing the dye in a gelatin aqueous solution by means of a colloid mill, and was added in an amount of the dye of $3.0\times10^{-4}$ mol/m$^2$.

Preparation of Samples 503 to 505

Samples 503 to 505 were formed in the same way as Sample 302, except that dye dispersions II-44, III-5, and IV-2, all according to the invention were used instead of the reference dye (1) in the equimolar amount. Preparation of Samples 506 to 510.

Samples 506 to 510 were formed in the same way as Samples 501 to 505, respectively, except that yellow couplers 1 and 2 were not used in layers 8 and 9, respectively, and yellow coupler YA-15 of the invention was used instead in these layers in equimolar amount. Preparation of Samples 511 to 515.

Samples 511 to 515 were formed in the same way as Samples 501 to 505, respectively, except that yellow couplers 1 and 2 were not used in layers 8 and 9, respectively, and yellow coupler YB-1 of the invention was used instead in these layers in equimolar amount.

Preparation of Sample 516

Sample 516 was formed in the same way as Sample 508, except that yellow coupler YA-15 was not used in layers 8 and 9, and yellow couplers YA-17 and YB-3 were used instead in both layers, in molar ratio of 1:1.

The details of Samples 501 to 516, thus formed, were as is shown in the following Table 20:

TABLE 20

| Sample No. | Additive in layer 7 | Couplers in layers 8 and 9 |
|---|---|---|
| 501 (Comparative) | Yellow colloidal silver | Yellow couplers 1 and 2 |
| 502 (Comparative) | Reference dye (1) | Yellow couplers 1 and 2 |
| 503 (Comparative) | II-44 | Yellow couplers 1 and 2 |
| 504 (Comparative) | III-5 | Yellow couplers 1 and 2 |
| 505 (Comparative) | IV-2 | Yellow couplers 1 and 2 |
| 506 (Comparative) | Yellow colloidal silver | Yellow coupler YA-15 |
| 507 (Comparative) | Reference dye (1) | Yellow coupler YA-15 |
| 508 (Invention) | II-44 | Yellow coupler YA-15 |
| 509 (Invention) | III-5 | Yellow coupler YA-15 |
| 510 (Invention) | IV-2 | Yellow coupler YA-15 |
| 511 (Comparative) | Yellow colloidal silver | Yellow coupler YB-1 |
| 512 (Comparative) | Reference dye (1) | Yellow coupler YB-1 |
| 513 (Invention) | II-44 | Yellow coupler YB-1 |
| 514 (Invention) | III-5 | Yellow coupler YB-1 |
| 515 (Invention) | IV-2 | Yellow coupler YB-1 |
| 516 (Invention) | II-44 | Yellow couplers YA-17 and YB-3 |

Samples 501 to 516 were stored, in the form of rolls, at 25° C. for 2 weeks, and were then cut and subjected to various experiments. Each sample was exposed to the light emitted by a 3200° K. light source and applied through a sensitometry wedge, subjected to color reversal development, and processed, as will be described below, using various process solutions which will be specified later. The density of each sample was measured, thereby obtaining a characteristic curve of the sample, and various properties of the sample were determined from this characteristic curve.

| Processing Steps | | | | |
|---|---|---|---|---|
| Steps | Time | Temp. | Tank volume | Replenish amount |
| Black-white development | 75 sec. | 38° C. | 8 liters | 330 ml/m$^2$ |
| 1st washing (1st bath) | 45 sec. | 33° C. | 5 liters | none |
| 1st washing (2nd bath) | 45 sec. | 33° C. | 5 liters | 5000 ml/m$^2$ |
| Reversal exposure | 15 sec. | (100 lux) | | |
| Color development | 135 sec. | 38° C. | 15 liters | 500 ml/m$^2$ |

-continued

| Processing Steps | | | | |
|---|---|---|---|---|
| Steps | Time | Temp. | Tank volume | Replenish amount |
| 2nd washing | 45 sec. | 33° C. | 5 liters | 1000 ml/m$^2$ |
| Bleach-fixing (1st bath) | 60 sec. | 38° C. | 7 liters | none |
| Bleach-fixing (2nd bath) | 60 sec. | 38° C. | 7 liters | 220 ml/m$^2$ |
| 3rd washing (1st bath) | 45 sec. | 33° C. | 5 liters | none |
| 3rd washing (2nd bath) | 45 sec. | 33° C. | 5 liters | none |
| 3rd washing (3rd bath) | 45 sec. | 33° C. | 5 liters | 5000 ml/m$^2$ |
| Drying | 45 sec. | 75° C. | | |

The first washing and the third washing were performed in counter flow. In other words, in the first washing, the water for the second washing was made to flow, the overflowing part of which was supplied into the first bath. In the third washing, water was supplied into the third bath, the water overflowing the third bath was supplied into the second bath, and the water overflowing the second bath was supplied into the first bath.

The compositions of the solutions used in the process were as follows:

| | Mother Solution (g) | Replenishment Solution (g) |
|---|---|---|
| **Black-White Developing Solution** | | |
| Pentasodium nitrilo-N,N,N-trimethylene phosphonate | 1.0 | 1.0 |
| Pentasodium diethylene triaminepentaacetate | 3.0 | 3.0 |
| Potassium sulfite | 30.0 | 30.0 |
| Potassium thiocyanate | 1.2 | 1.2 |
| Potassium carbonate | 35.0 | 35.0 |
| Potassium hydroquinone monosulfonate | 25.0 | 25.0 |
| 1-phenyl-4-hydroxy-methyl-4-methyl-4-methyl-3-pyralidone | 2.0 | 2.0 |
| Potassium bromide | 0.5 | none |
| Potassium iodide | 5.0 mg | none |
| Water to make | 1000 ml | 1000 ml |
| pH (adjusted with hydrochloric acid or potassium hydroxide) | 9.60 | 9.60 |
| **Color Developing Solution** | | |
| Benzyl alcohol | 15.0 ml | 18.0 ml |
| Diethylene glycol | 12.0 ml | 14.0 ml |
| 3,6-dithia-1,8-octane-diol | 0.20 | 0.25 |
| Pentasodium nitrilo-N,N,N-trimethylene phosphonate | 0.5 | 0.5 |
| Pentasodium diethylenetriamine tetraacetate | 2.0 | 2.0 |
| Sodium sulfite | 2.0 | 2.5 |
| Hydroxyamine sulfate | 3.0 | 3.6 |
| N-ethyl-N-(β methane-sulfonamideethyl)-3-methyl-aminoanyline sulfate | 5.0 | 8.0 |
| Fluorescent brightening agent (diamino-stilbene-series) | 1.0 | 1.2 |
| Potassium bromide | 0.5 | none |
| Potassium iodide | 1.0 mg | none |
| Water to make | 1,000 ml | 1,000 ml |
| pH (adjusted with hydrochloric acid or potassium hydroxide) | 10.25 | 10.40 |
| **Bleach-Fixing Solution** | | |
| Disodium ethylenediamine tetraacetate dihydrate | 5.0 | 5.0 |
| Ammonium Fe (III) ethylenediaminetetraacetate monohydrate | 80.0 | 80.0 |
| Sodium sulfite | 1.50 | 15.0 |
| Aqueous solution of ammonium thiosulfate (700 ml/l) | 160 ml | 160 ml |
| 20-mercapto-1,3,5-triazole | 0.5 | 0.5 |
| Water to make | 1,000 ml | 1,000 ml |
| pH (adjusted with acetic acid or ammonia water) | 6.50 | 6.50 |

Samples 501 to 516, after subjected to the above color reversal development, were tested for their properties.

(1) Color-Forming Property

The exposure amount which imparted a density of the minimum density + 1.6 to the yellow image formed on Sample 501 was measured, and the density at this exposure was detected. The density $D_B$ (in percentage) of any other sample was calculated, using as reference the density detected of Sample 501.

(2) Storage Stability

Two sets of Samples 501 to 116 were prepared. Those of the first set were stored at 25° C. at a relative humidity of 60% for seven days, whereas those of the second set were stored at 45° C. at a relative humidity of 80% for seven days. Thereafter, the samples of both set were processed simultaneously. The maximum densities $BD_{max}$ and $GD_{max}$ of the yellow image and magenta image on each sample, respectively, were measured. The densities $BD_{max}$ and $GD_{max}$ of any sample of the second set were compared with those of the corresponding sample of the first set. Also, the density of each sample was measured by calculating the logarithm of the reciprocal of the exposure amount which imparted a density of 0.6.

(3) Residual Color

Using the minimum density $BD_{min}$ of Sample 501 as reference, the color residue of any other sample was evaluated.

(4) Color-Image Fastness

Each of the samples, the characteristic curve of which had been obtained by measuring the density of the sample, was stored at 60° C. and a relative humidity of 70% for 30 days, and its density was again measured. Then, the value D' and minimum density $D_{min}'$ of the yellow image formed on the sample were detected at that point on the characteristic curve where a density of the minimum density $D_{min}+0.6$ had been obtained before the storage test. The percentage X (%) of the density difference detected after the test to the density difference measured before the test, defined by the following equation was calculated in accordance with the following equation, and was used as color residue rate, thereby determining the color-image fastness of the sample.

$$X=(D'-D_{min}')/0.6\times 100$$

The properties (1) to (4) of each sample, thus determined, were as is shown in the following Table 21:

TABLE 21

| Sample No. | Color-forming property $D_B$ | Long-period storage stability $BD_{max}$ | $BS_{0.6}$ | $GD_{max}$ | Residual color $BD_{min}$ | Fastness X |
|---|---|---|---|---|---|---|
| 501 (Comparative) | 100 | −0.10 | +0.09 | −0.14 | 0.00 | 82 |
| 502 (Comparative) | 104 | −0.15 | +0.12 | −0.20 | +0.04 | 78 |
| 503 (Comparative) | 105 | −0.07 | +0.03 | −0.10 | 0.00 | 80 |
| 504 (Comparative) | 104 | −0.07 | +0.04 | −0.10 | −0.01 | 82 |
| 505 (Comparative) | 105 | −0.08 | +0.03 | −0.11 | 0.00 | 80 |
| 506 (Comparative) | 112 | −0.17 | +0.07 | −0.14 | 0.00 | 89 |
| 507 (Comparative) | 117 | −0.15 | +0.12 | −0.19 | +0.05 | 87 |
| 508 (Invention) | 116 | −0.08 | +0.03 | −0.10 | 0.00 | 91 |
| 509 (Invention) | 116 | −0.07 | +0.03 | −0.11 | +0.01 | 89 |
| 510 (Invention) | 117 | −0.07 | +0.04 | −0.11 | −0.01 | 91 |
| 511 (Comparative) | 111 | −0.19 | +0.07 | −0.15 | 0.00 | 91 |
| 512 (Comparative) | 116 | −0.16 | +0.11 | −0.21 | +0.04 | 89 |
| 513 (Invention) | 117 | −0.07 | +0.05 | −0.11 | 0.00 | 91 |
| 514 (Invention) | 117 | −0.08 | +0.03 | −0.11 | −0.01 | 93 |
| 515 (Invention) | 117 | −0.07 | +0.04 | −0.12 | −0.01 | 91 |
| 516 (Invention) | 116 | −0.07 | +0.04 | −0.10 | 0.00 | 91 |

As is evident from Table 21, the light-sensitive materials using the dyes and couplers of the present invention exhibited good color-forming property, improved color-image storage stability, and small changes in sensitivity and maximum density. Also, as can be understood from Table 21, they had no problematical color residue.

EXAMPLE 6

Layers 1 to 14 specified below, were coated on the first side of a paper support polyethylene-laminated on both sides and having a thickness of 100 μm, and layers 15 to 16, also specified below, were formed on the second side of the paper support, thereby forming a color photographic material. The polyethylene on the first side on which the layer 1 was coated contained titanium dioxide (4 g/m²) used as white pigment and a small amount of ultramarine blue (0.003 g/m²) used as blue dye. (The surface of the support had chromaticities of 88.0, −0.20 and −0.75 in terms of L*, a* and *c color systems, respectively.)

Compositions of the Layers

The composition of each layer and the amount (g/m²) of each component coated were as follows. The amount of any silver halide used is represented in the amount of silver. The emulsions used in the layers had been prepared by methods similar to the method of preparing Emulsion EM-1, which will be described later. However, the emulsion used in layer 14 was Lippmann mulsion containing grains which are not subjected to surface chemical sensitization.

| | |
|---|---|
| Layer 1: Antihalation layer | |
| Black colloidal silver | 0.10 |
| Color-mixing inhibitor (Cpd-27) | 0.05 |
| Gelatin | 0.07 |
| Layer 2: Interlayer | |
| Gelatin | 0.07 |
| Layer 3: Low-speed red-sensitive layer | |
| Silver bromide spectrally sensitized with red sensitizing dyes (ExS-11, -12 and 13 used in equimolar amounts) (average grain size: 0.25 μm, grain size distribution [variation coefficient]: 8%, octahedral) | 0.40 |
| Silver chlorobromide spectrally sensitized with red sensitizing dyes (ExS-11, -12 and 13 used in equimolar amounts) (silver chloride: 5 mol %, average grain size: 0.40 μm, grain size distribution: 10%, octahedral) | 0.08 |
| Gelatin | 1.00 |
| Cyan coupler (ExC-11, -12, and -13 used in the ratio of 1:1:0.2) | 0.30 |
| Decoloring inhibitor (Cpd-21, -22, -23, -24, and -50 used in equimolar amount) | 0.18 |
| Stain preventing agent (Cpd-25) | 0.003 |
| Coupler dispersing medium (Cpd-26) | 0.03 |
| Coupler solvent (Solv-1, -2 and -3 used in equimolar amount) | 0.12 |
| Layer 4: High-speed red-sensitive layer | |
| Silver bromide spectrally sensitized with red sensitizing dyes (ExS-11, -12 and 13 used in equimolar amounts) (average grain size: 0.60 μm, grain size distribution: 15%, octahedral) | 0.14 |
| Gelatin | 1.00 |
| Cyan coupler (ExC-11, -12, and -13 used in the ratio of 1:1:0.2) | 0.30 |
| Decoloring inhibitor (Cpd-21, -22, -23, -24, and -50 used in equimolar amount) | 0.18 |
| Coupler dispersing medium (Cpd-26) | 0.03 |
| Coupler solvent (Solv-1, -2 and -3 used in equimolar amount) | 0.12 |
| Layer 5: Interlayer | |
| Gelatin | 1.00 |
| Color-mixing inhibitor (Cpd-27) | 0.08 |
| Color-mixing inhibitor (Solv-4 and -5 used in equimolar amount) | 0.16 |
| Polymer latex (Cpd-28) | 0.10 |
| Layer 6: Low-speed green-sensitive layer | |
| Silver bromide spectrally sensitized with green sensitizing dye (ExS-14) (average grain size: 0.25 μm, grain size distribution: 8%, octahedral) | 0.04 |
| Silver chlorobromide spectrally sensitized with green sensitizing dye (ExS-14) (silver chloride: 5 mol %, average grain size: 0.40 μm, grain size | 0.06 |

-continued

| | |
|---|---|
| distribution: 10%, octahedral) | |
| Gelatin | 0.80 |
| Magenta coupler (ExM-11, -12 and -13 used in equimolar amount) | 0.11 |
| Color-mixing inhibitor (Cpd-29, -46 and -50 used in equimolar amount) | 0.15 |
| Stain preventing agent (Cpd-30, -31, -32, and -33 used in the ratio of 10:7:7:1) | 0.025 |
| Coupler dispersing medium (Cpd-26) | 0.05 |
| Coupler solvent (Solv-4 and -6 used in equimolar amount) | 0.15 |
| Layer 7: High-speed green-sensitive layer | |
| Silver bromide spectrally sensitized with green sensitizing dyes (ExS-14) (average grain size: 0.65 μm, grain size distribution: 16%, octahedral) | 0.10 |
| Gelatin | 0.80 |
| Magenta coupler (ExM-11, -12 and -13 used in equimolar amount) | 0.11 |
| Color-mixing inhibitor (Cpd-29, -46 and -50 used in equimolar amount) | 0.15 |
| Stain preventing agent (Cpd-30, -31, -32, and -33 used in the ratio of 10:7:7:1) | 0.025 |
| Coupler dispersing medium (Cpd-26) | 0.05 |
| Coupler solvent (Solv-4 and -6 used in equimolar amount) | 0.15 |
| Layer 8: Interlayer | |
| Identical to layer 5 | |
| Layer 9: Yellow filter layer | |
| Yellow colloidal silver (grain size: 1000A) | 0.12 |
| Gelatin | 0.70 |
| Color-mixing inhibitor (Cpd-27) | 0.03 |
| Color-mixing inhibitor (Solv-4 and -5 used in equimolar amount) | 0.10 |
| Polymer latex (Cpd-28) | 0.07 |
| Layer 10: Interlayer | |
| Identical to layer 5 | |
| Layer 11: Low-speed blue-sensitive layer | |
| Silver bromide spectrally sensitized with green sensitizing dyes (ExS-14 and -16 used in equimolar amount) (average grain size: 0.40 μm, grain size distribution: 8%, octahedral) | 0.07 |
| Silver chlorobromide spectrally sensitized with green sensitizing dyes (ExS-15 and -26 used in equimolar amount) (silver chloride: 8 mol %, average grain size: 0.60 μm, grain size distribution: 11%, octahedral) | 0.14 |
| Gelatin | 0.80 |
| Yellow coupler (ExY-1, -2 and -3 used in equimolar amount) | 0.35 |
| Decoloring inhibitor (Cpd-34) | 0.10 |
| Decoloring inhibitor (Cpd-50) | 0.05 |
| Stain preventing agent (Cpd-25 and -35 used in the ratio of 1:5) | 0.007 |
| Coupler dispersion medium (Cpd-26) | 0.05 |
| Coupler solvent (Solv-2) | 0.10 |
| Layer 12: High-speed blue-sensitive layer | |
| Silver bromide spectrally sensitized with green sensitizing dyes (ExS-14 and -16 used in equimolar amount) (average grain size: 0.85 μm, grain size distribution: 18%, octahedral) | 0.15 |
| Gelatin | 0.60 |
| Yellow coupler (ExY-1, -2 and -3 used in equimolar amount) | 0.30 |

-continued

| | |
|---|---|
| Decoloring inhibitor (Cpd-34) | 0.10 |
| Decoloring inhibitor (Cpd-50) | 0.05 |
| Stain preventing agent (Cpd-25 and -35 used in the ratio of 1:5) | 0.007 |
| Coupler dispersion medium (Cpd-26) | 0.05 |
| Coupler solvent (Solv-2) | 0.10 |
| Layer 13: Ultraviolet absorbing layer | |
| Gelatin | 1.00 |
| Ultraviolet absorbent (Cpd-22, -24 and -36 used in equimolar amount) | 0.50 |
| Color-mixing inhibitor (Cpd-27 and -37 used in equimolar amount) | 0.03 |
| Dispersion medium (Cpd-26) | 0.02 |
| Ultraviolet absorbent solvent (Solv-2 and -7 used in equimolar amount) | 0.08 |
| Irradiation preventing dye (Cpd-(38, -39, -40, -41 and -47 used in the ratio of 10:10:13:15:20) | 0.05 |
| Layer 14: Protective layer | |
| Fine-grain silver chlorobromide (silver chloride: 97 mol %, average size: 0.1μ) | 0.03 |
| Denatured acryl copolymer of polyvinyl alcohol (molecular weight: 50,000) | 0.01 |
| Polymethylmethacrylate grains (average grain size: 2.4μ) and silicon oxide (average grain size: 5μ) used in equimolar amount | 0.05 |
| Gelatin | 1.80 |
| Gelatin hardener (H-21 and H-22 used in equimolar amount) | 0.18 |
| Layer 15: Back layer | |
| Gelatin | 2.50 |
| Ultraviolet absorbent (Cpd-22, -24, and -36 used in equimolar amount) | 0.50 |
| Dyes (Cpd-38, -39, -40, -41 and -47 used in equimolar amount) | 0.06 |
| Layer 16: Protective layer for the back layer | |
| Polymethylmethacrylate grains (average size: 2.4μ) and silicon oxide (average grain size: 5μ) used in equimolar amount | 0.05 |
| Gelatin | 2.00 |
| Gelatin hardener (H-21 and H-22 used in equimolar amount) | 0.14 |

Method of Preparing Emulsion EM-1

An aqueous solution of potassium bromide and an aqueous solution of silver nitrate were added together to a gelatin solution over 15 minutes at 75° C., while vigrously stirring the gelatin solution, thereby obtaining octahedral silver bromide grains having an average diameter of 0.35 μm. During this addition, 3,4-dimethyl-1,3-thiazoline-2-thion was added in an amount of 0.3 g per mol of silver. Sodium thiosulfate was added to the emulsion in an amount of 6 mg per mol of silver, and then chloroauric acid (tetrahydrate) was added to the emulsion in an amount of 7 mg per mol of silver. Then, the emulsion was heated at 75° C. for 80 minutes, thereby performing chemical sensitization. The grains, thus obtained and used as cores, were further grown in the same precipitating condition as in the first growth. A silver bromide emulsion was thereby prepared which contained monodispersed octahedral core/shell type grains having an average diameter of 0.7 μm and a size variation coefficient of about 10%. Next, sodium thiosulfate was added to this emulsion in an amount of 1.5 mg per mol of silver, and then chloroauric acid (tetrahydrate) was added to the emulsion in an amount of 1.5 mg per mol of silver. The emulsion was then heated at 60° C. for 60 minutes, thereby achieving chemical sensitization. As a result, an internally latent-image type silver halide emulsion was obtained.

In each light-sensitive layers, ExZK-1 and ExZK-2 were used as nucleus-forming agents in amounts of $10^{-3}$ wt % and $10^{-2}$ wt %, respectively, based on the silver halide, and Cpd-42, -48, and -49 were used as nuleus-forming aids, each in amount of $10^{-2}$ wt % based on the silver halide. Further, in each light-sensitive layer, Aalkanol XC (manufacture by Du Pont) and sodium alkylbenzenesulfonate were used as emulsifying-dispersing agents, and succinate ester and Magfac F-120 (manufactured by Dai-Nippon Ink Co., Ltd.) were used as coating aids. In each layer containing silver halide and colloidal silver, compounds Cpd-43, -44 and -45 were used as stabilizing agents. The photographic material, thus prepared, shall be referred to as "Sample 601". The compounds used in forming Sample 601 are as follows:

ExS-11

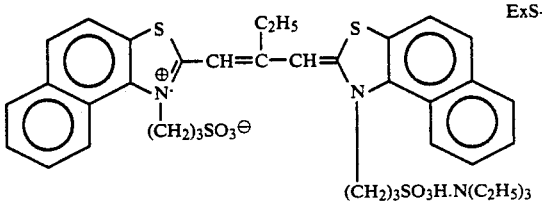

ExS-12

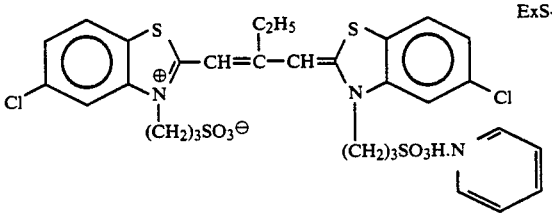

ExS-13

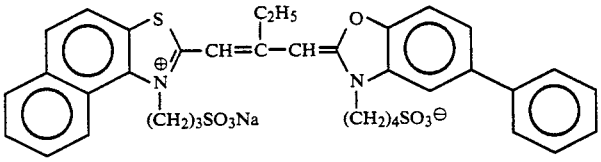

ExS-14

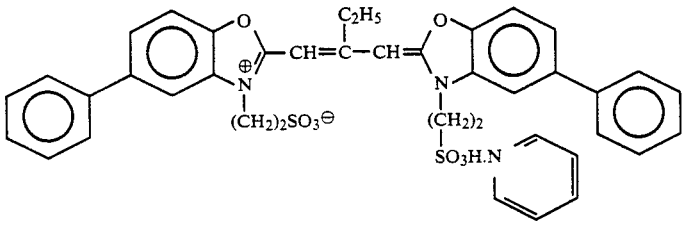

ExS-15

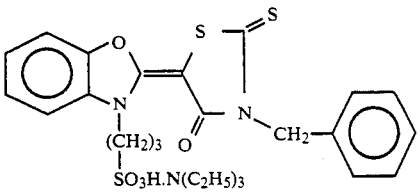

ExS-16

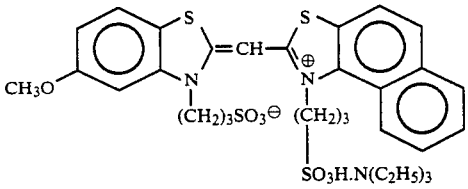

Cpd-21

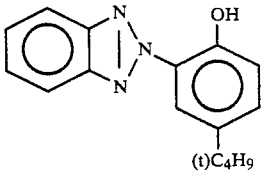

Cpd-22

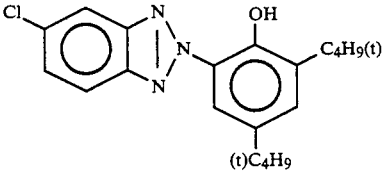

Cpd-23

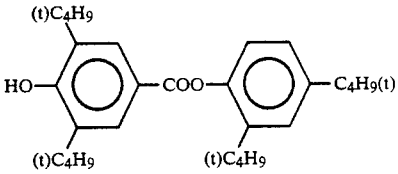

Cpd-24

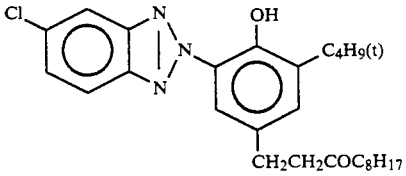

Cpd-25

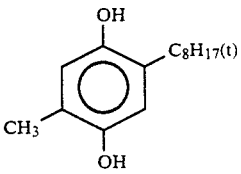

Cpd-26

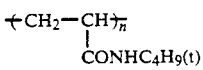

(n = 100 to 1000)

-continued
Cpd-27
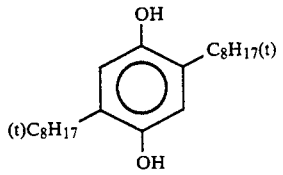
Cpd-28
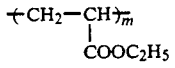
Cpd-29
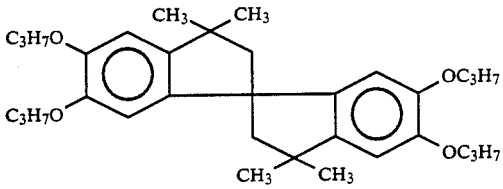
Cpd-30
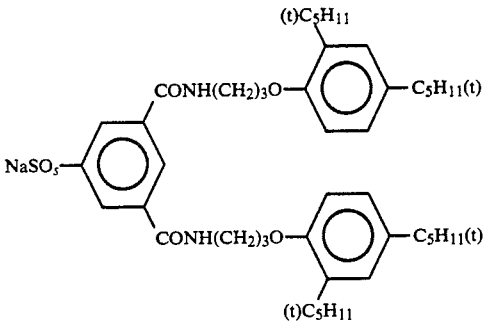
Cpd-31
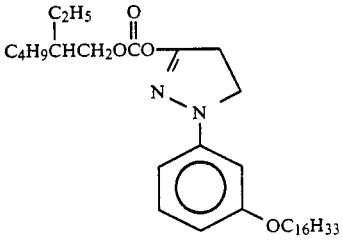
Cpd-32
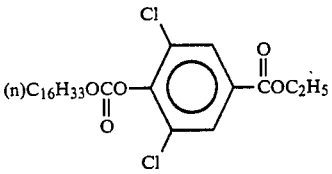
Cpd-33
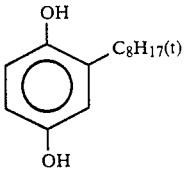
Cpd-34
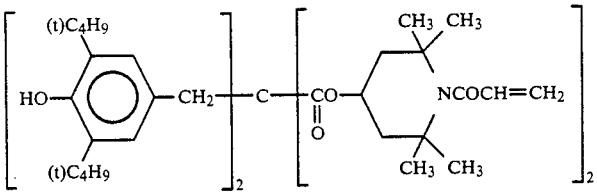
Cpd-35
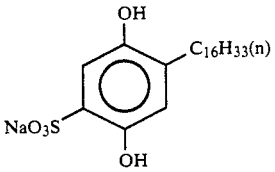
Cpd-36
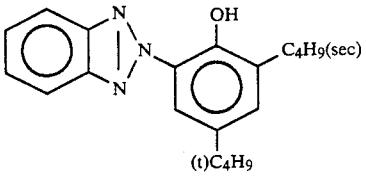
Cpd-37
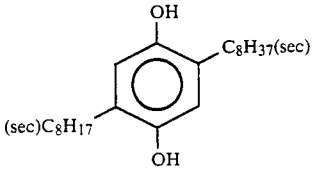
Cpd-38
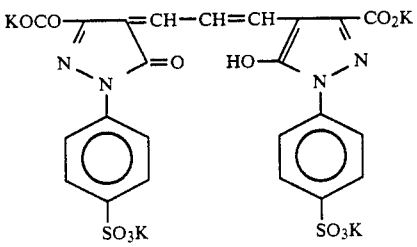

-continued
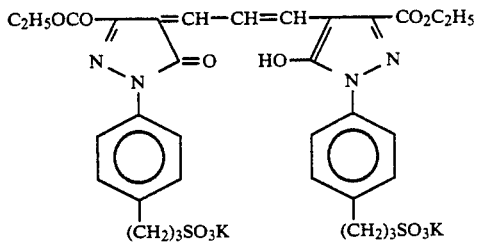
Cpd-39
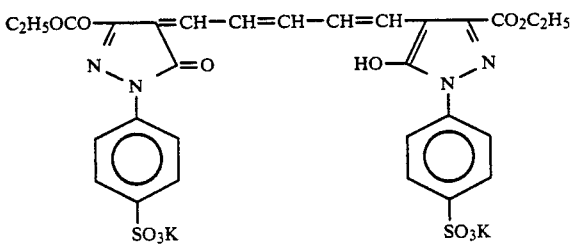
Cpd-40
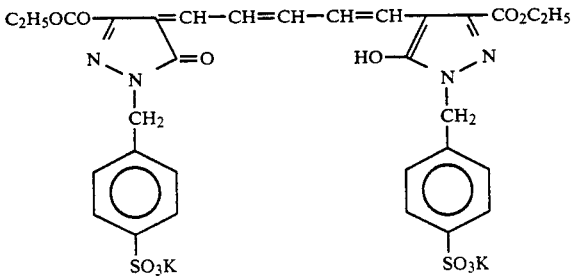
Cpd-41
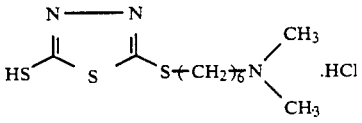
Cpd-42
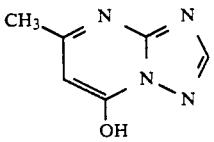
Cpd-43
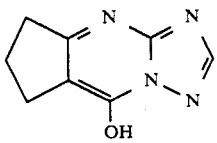
Cpd-44
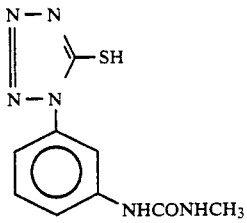
Cpd-45
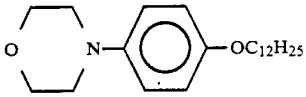
Cpd-46
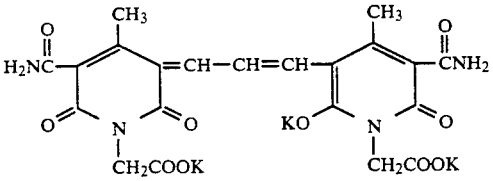
Cpd-47
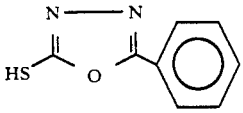
Cpd-48
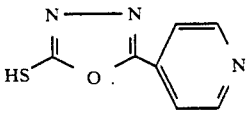
Cpd-49

-continued
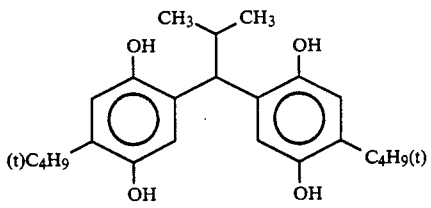
Cpd-50
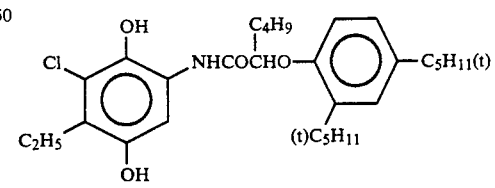
ExC-11
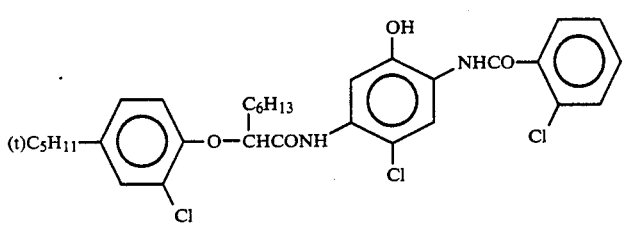
ExC-12
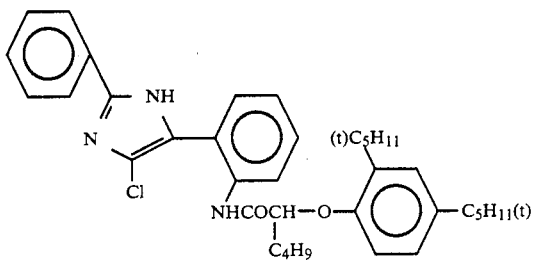
ExC-13
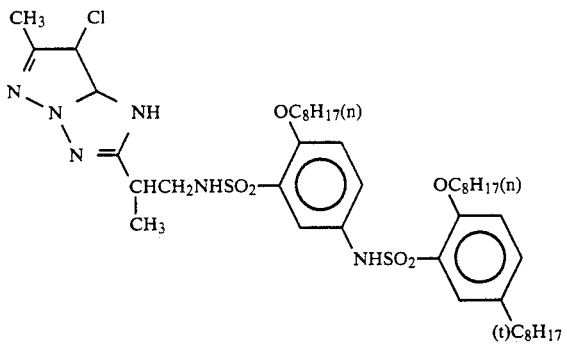
ExM-11
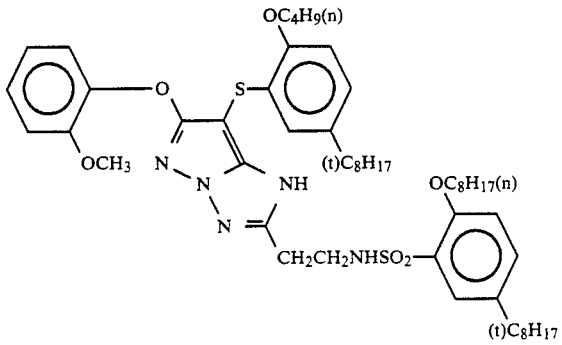
ExM-12

-continued

ExM-13

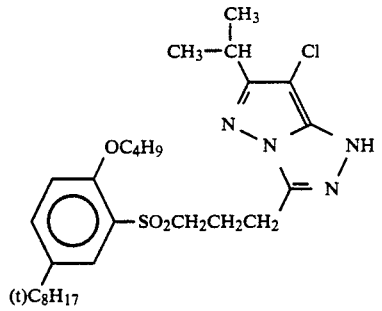

ExY-1

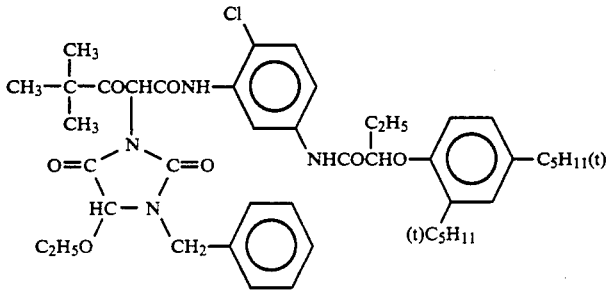

ExY-2

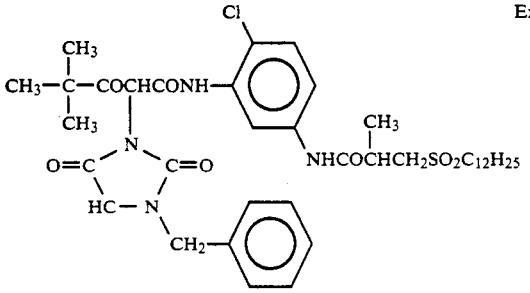

ExY-3

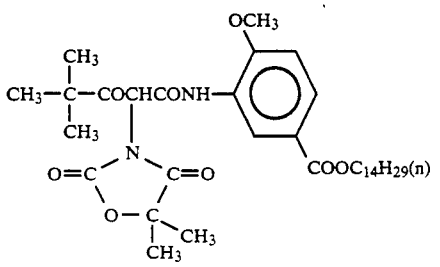

Solv-1
Di(2-ethylhexyl)sebacate
Solv-2
Trinonylphosphate
Solv-3
Di(3-methylhexyl)phthalate
Solv-4
Tricresylphosphate
Solv-5
Dibutylphthalate
Solv-6
Trioctylphosphate
Solv-7
Di(2-ethylhexyl)phthalate
H-21
1,2-bis(vinylsulfonylacetamide)ethane
H-22
4,6-dichloro-2-hydroxy-1,3,5-triazine Na salt
ExZK-1
7-(3-ethoxythiocarbonylaminobenzamido)-9-methyl-10-propagyl-1,2,3-4-tetrahydroacrydinium trifluoromethanesulfonate
ExZK-2
2-[4-{3-[3-{3-[5-{3-[2-chloro-5-(1-dodecyloxycarbonylethoxycarbonyl)phenylcarbamoyl]-4-hydroxy-1-naphthylthio}tetrazol-1-yl]phenyl-}ureido]benzenesulfonamido}phenyl-1-formylhydrazine Preparation of Sample 602

Sample 602 was prepared in the same way as Sample 601, except that layer 10, i.e., an interlayer, was not formed.

Preparation of Sample 603

Sample 603 was prepared in the same way as Sample 502, except that colloidal silver was not used in layer 9, and a dye dispersion was used instead in layer 9 in an amount of the dye of $2.8\times10^{-4}$ mol/m$^2$. The dispersoid had been prepared by dissolving the reference dye (1) used in Example 1 in a mixture of ethyl acetate and tricresylphosphate and by dispersing the dye in a gelatin aqueous solution by means of a colloid mill.

Preparation of Sample 604

Samples 504 was prepared in the same way as Sample 03, except that dye dispersions II-1 according to the invention was used instead of reference dye (1), in equimolar amount.

Preparation of Samples 605 to 607

Samples 605 to 607 were prepared in the same way as Sample 604, except that dye dispersions II-16, Iv-3, and V-5, all according to the invention, were used instead of dye dispersion II-1, in the equimolar amount.

Preparation of Samples 608 to 614

Samples 608 to 614 were prepared in the same way as Samples 601 to 607, respectively, except that yellow couplers ExY-1, -2, and -3 were not used in layers 11 and 12, respectively, and yellow coupler YA-28 of the invention was used instead in these layers in equimolar amount.

Preparation of Samples 615 to 621

Samples 615 to 621 were prepared in the same way as Samples 608 to 614, respectively, except that yellow couplers in layers 11 and 12 were replaced by yellow coupler YA-6 of the invention, in equimolar amount.

The details of Samples 601 to 621, thus formed, were as is shown in the following Table 22:

TABLE 22

| Sample No. | Additive in layer 7 | Layer 10 | Coupler in layers 11 and 12 |
|---|---|---|---|
| 601 (Comparative) | Yellow colloidal silver | Formed | ExY-1, 2, 3 |
| 602 (Comparative) | Yellow colloidal silver | Not formed | " |
| 603 (Comparative) | Reference dye (1) | " | " |
| 604 (Comparative) | II-1 | " | " |
| 605 (Comparative) | III-16 | " | " |
| 606 (Comparative) | IV-3 | " | " |
| 607 (Comparative) | V-5 | " | " |
| 608 (Comparative) | Yellow colloidal silver | Formed | YA-28 |
| 609 (Comparative) | Yellow colloidal silver | Not formed | " |
| 610 (Comparative) | Reference dye (1) | " | " |
| 611 (Invention) | II-1 | " | " |
| 612 (Invention) | III-16 | " | " |
| 613 (Invention) | IV-3 | " | " |
| 614 (Invention) | V-5 | " | " |
| 615 (Comparative) | Yellow colloidal silver | Formed | YB-6 |
| 616 (Comparative) | Yellow colloidal silver | Not formed | |
| 617 (Comparative | Reference dye (1) | " | " |
| 618 (Invention) | II-1 | " | " |
| 619 (Invention) | III-16 | " | " |
| 620 (Invention) | IV-3 | " | " |
| 621 (Invention) | V-5 | " | " |

Samples 601 to 621, color printing paper sheets, were stored at 40° C. and a relative humidity of 80% for three days. Thereafter, they were subjected to wedge exposure (1/10 sec, for 10 cms), and were then processed, as will be described below, using various processing solutions which will be specified later. The maximum and minimum yellow-image densities of each sample were measured, thereby obtaining the results shown in the following Table 23:

TABLE 23

| | Stability in Forced-Aging Storage | | | |
|---|---|---|---|---|
| | Forced aging not performed | | At 40° C., 80% RH for 3 days | |
| Sample No. | Max. image density | Min. image density | Max. image density | Min. image density |
| 601 (Comparative) | 2.2 | 0.10 | 1.7 | 0.17 |
| 602 (Comparative) | 2.2 | 0.12 | 1.5 | 0.21 |
| 603 (Comparative) | 2.2 | 0.10 | 1.8 | 0.14 |
| 604 (Comparative) | 2.2 | 0.10 | 1.8 | 0.14 |
| 605 (Comparative) | 2.2 | 0.10 | 1.7 | 0.15 |
| 606 (Comparative) | 2.2 | 0.10 | 1.7 | 0.14 |
| 607 (Comparative) | 2.2 | 0.10 | 1.7 | 0.14 |
| 608 (Comparative) | 2.2 | 0.10 | 1.7 | 0.16 |
| 609 (Comparative) | 2.2 | 0.12 | 1.6 | 0.20 |

TABLE 23-continued

| | Stability in Forced-Aging Storage | | | |
|---|---|---|---|---|
| | Forced aging not performed | | At 40° C., 80% RH for 3 days | |
| Sample No. | Max. image density | Min. image density | Max. image density | Min. image density |
| 610 (Comparative) | 2.2 | 0.10 | 1.8 | 0.15 |
| 611 (Invention) | 2.2 | 0.10 | 2.1 | 0.11 |
| 612 (Invention) | 2.2 | 0.10 | 2.0 | 0.11 |
| 613 (Invention) | 2.2 | 0.10 | 2.0 | 0.12 |
| 614 (Invention) | 2.2 | 0.10 | 2.0 | 0.11 |
| 615 (Comparative) | 2.2 | 0.11 | 1.7 | 0.17 |
| 616 (Comparative) | 2.2 | 0.12 | 1.5 | 0.12 |
| 617 (Comparative) | 2.2 | 0.10 | 1.8 | 0.15 |
| 618 (Invention) | 2.2 | 0.10 | 2.1 | 0.11 |
| 619 (Invention) | 2.2 | 0.10 | 2.0 | 0.12 |
| 620 (Invention) | 2.2 | 0.10 | 2.1 | 0.12 |
| 621 (Invention) | 2.2 | 0.10 | 2.1 | 0.11 |

Samples 601 to 621 of another set were exposed in the same way, and subjected to forced aging at 30° C. and a relative humidity of 80% for seven days. The decrease in the maximum yellow-mage density of each sample was measured. Also, Samples 601 to 621 of still another set were exposed in the same way, and subjected to forced aging at 60° C. and a relative humidity of 40% for three days. The decrease in the maximum yellow-mage density of each sample of this set was measured. The results were as is shown in the following Table 24:

TABLE 24

| | Change in max. image density | |
|---|---|---|
| Sample No. | At 30° C., 80% RH for 7 days | At 60° C., 40% RH for 3 days |
| 601 (Comparative) | 0.28 | 0.38 |
| 602 (Comparative) | 0.35 | 0.51 |
| 603 (Comparative) | 0.29 | 0.39 |
| 604 (Comparative) | 0.28 | 0.36 |
| 605 (Comparative) | 0.29 | 0.40 |
| 606 (Comparative) | 0.30 | 0.42 |
| 607 (Comparative) | 0.29 | 0.40 |
| 608 (Comparative) | 0.28 | 0.39 |
| 609 (Comparative) | 0.34 | 0.50 |
| 610 (Comparative) | 0.30 | 0.40 |
| 611 (Invention) | 0.09 | 0.13 |
| 612 (Invention) | 0.10 | 0.17 |
| 613 (Invention) | 0.10 | 0.19 |
| 614 (Invention) | 0.09 | 0.16 |
| 615 (Comparative) | 0.29 | 0.40 |
| 616 (Comparative) | 0.35 | 0.52 |
| 617 (Comparative) | 0.31 | 0.42 |
| 618 (Invention) | 0.08 | 0.14 |
| 619 (Invention) | 0.09 | 0.16 |
| 620 (Invention) | 0.11 | 0.18 |
| 621 (Invention) | 0.10 | 0.19 |

As can be clearly seen from Tables 23 and 24, any sample using dyes and couplers of the present invention experienced but small changes in the maximum and minimum color-image density after storage of a long period, even if layer 10, i.e., an interlayer, was not formed at all. Further, as is evident from Tables 23 and 24, the sample exhibited good color-image fastness.

The steps of the processing carried out in Example 6 were as is specified below:

| | Processing Steps | | | |
|---|---|---|---|---|
| Steps | Time | Temp. | Tank volume | Replenish amount |
| Color development | 135 sec. | 38° C. | 11 liters | 350 ml/m$^2$ |

-continued

| Processing Steps | | | | |
|---|---|---|---|---|
| Steps | Time | Temp. | Tank volume | Replenish amount |
| Bleach-fixing | 40 sec. | 34° C. | 3 liters | 300 ml/m$^2$ |
| Washing (1) (lst bath) | 40 sec. | 32° C. | 3 liters | — |
| Washing (2) (2nd bath) | 40 sec. | 32° C. | 3 liters | 350 ml/m$^2$ |
| Drying | 30 sec. | 80° C. | | |

The washing water was replenished in so-called counter flow. In other words, water was supplied into the washing bath (2), and the water overflowing the washing bath (2) is guided into the washing bath (1). The amount in which each solution was carried over by the light-sensitive material was 35 milliliters/m$^2$.

The compositions of the solutions used in the process were as follows:

| | Tank Solution (g) | Replenishment Solution (g) |
|---|---|---|
| [Color Developing Solution] | | |
| D-sorbitol | 0.15 | 0.20 |
| Condensate of sodium naphthalenesulfonate and formalin | 0.15 | 0.20 |
| Pentasodium nitrilotris (methylenephosphonate) | 1.8 | 1.8 |
| Diethylenetriamine pentaacetatic acid | 0.5 | 0.5 |
| 1-hydroxyethylidine-1,1-diphosphonic acid | 0.15 | 0.15 |
| Diethylene glycol | 12.0 ml | 6.0 ml |
| Benzyl alcohol | 13.5 ml | 18.0 ml |
| Potassium bromide | 0.70 | — |
| Benzotriazole | 0.003 | 0.004 |
| Sodium sulfite | 2.4 | 3.2 |
| Disodium-N,N-bis(sulfonateethyl)hydroxyamine | 8.0 | 10.6 |
| Triethanolamine | 6.0 | 8.0 |
| N-ethyl-N-(β-methanesulfoneamidoethyl)-3-methyl-4-aminoaniline 3/2 sulfate monohydrate | 6.0 | 8.0 |
| Potassium carbonate | 30.0 | 25.0 |
| Fluorescent brightening agent (diaminostilbene-series) | 1.3 | 1.7 |
| Water to make | 1,000 ml | 1,000 ml |
| pH (25° C.) (adjusted with KOH or sulfric acid) | 10.30 | 10.79 |
| [Bleach-Fixing Solution] | | |
| Disodium ethylenediaminetetraacetate dihydrate | 4.0 | Same as the tank solution |
| Ammonium Fe (III) ethylenediaminetetraacetate dihydrate | 55.0 | |
| Ammonium thiosulfate (750 g/litter) | 168 ml | |
| Sodium p-toluenesulfonate | 30.0 ml | |
| Ammonium sulfite | 35.0 | |
| 5-mercapto-1,3,4-triazole | 0.5 | |
| Ammonium nitrate | 10.0 | |
| Water to make | 1,000 ml | |
| pH (25° C.) (adjusted with ammonia water or acetic acid) | 6.5 | |
| [Washing Solution] | | |
| [Tank and replenishment solutions are used in the same amount] | | |
| Sodium chlorinated isocyanurate | | 0.02 g |
| Deionized water (connductance: 5 μs/cm or less) | | 1,000 ml |
| pH | | 6.5 |

As has been described, the use of the dyes of this invention in combination with the couplers of this invention can greatly reduce fog or change in sensitivity, occurring during storage due to the use of colloidal silver, and serves to increase sharpness without forming a layer adjacent to the colloidal silver layer. In addition, the use of the dyes and couplers of the present invention can provide a silver halide color photographic light-sensitive material which excels in photographic properties, particularly sensitivity, color image fastness, color reproduction, and also in image quality.

What is claimed is:

1. A silver halide color photographic light-sensitive material comprising at least one red-sensitive silver halide emulsion layer, at least one green-sensitive silver halide emulsion layer, at least one blue-sensitive silver halide emulsion layer, and at least one non-light-sensitive layer, formed on a support, wherein the photographic light-sensitive material contains a dispersion of a dye represented by formula (I), wherein said dispersion is prepared by an oil-in-water dispersion method using a water-insoluble, high-boiling organic solvent and said dye, and wherein a color-sensitive silver halide emulsion layer or a non-light-sensitive layer contains at least one yellow coupler represented by formula (1) or formula (2) and/or at least one acylacetamide yellow coupler having an acyl group represented by formula (Y):

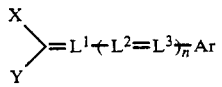

Formula (I)

where X and Y each represents an electron attractive group, or when coupled with each other, XY represents an acidic nucleus, Ar represents a phenyl group or a heterocyclic group, $L^1$, $L^2$, and $L^3$ each represents a methine group, and n represents 0, 1, or 2,

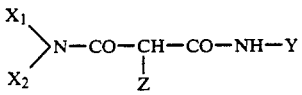

Formula (1)

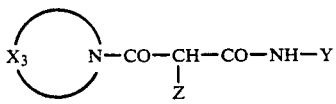

Formula (2)

where $X_1$ and $X_2$ each represents an alkyl group, an aryl group, or a heterocyclic group, $X_3$ represents an organic group which forms a nitrogen-containing heterocyclic group together with >N—, Y represents an aryl group or a heterocyclic group, and Z represents a group which is split off when a coupler represented by formula (1) or (2) reacts with an oxidized form of a developing agent, Formula (Y)

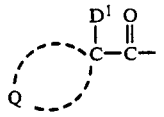

where $D^1$ represents a monovalent group, and Q represents a non-metallic atomic group required to form, together with the C, a 3- to 5-membered hydrocarbon ring or a 3- to 5-membered heterocyclic ring containing at least one heteroatom selected from the group consisting of N, S, O and P in its ring, provided that $D^1$ does not represent a hydrogen atom, and further provided that $D^1$ does not couple with Q to form a ring.

2. The light-sensitive material according to claim 1, wherein said dye of formula (I) is used in a yellow filter layer in the light-sensitive material.

3. The light-sensitive material according to claim 1, wherein said dye of formula (I) is represented by the following formula (II), (III), (IV), (V) or (VI):

Formula (II)

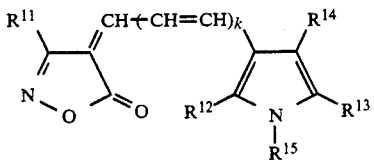

where $R^{11}$ represents a hydrogen atom, an alkyl group, an aryl group, —$COOR^{16}$, or —$CONR^{16}R^{17}$; each of $R^{12}$, $R^{13}$ and $R^{14}$ represents a hydrogen atom, an alkyl group, or an aryl group; $R^{15}$ represents a hydrogen atom, an alkyl group, an aryl group or an amino group; $R^{13}$ and $R^{14}$ can combine with each other to form a 6-membered ring; $R^{16}$ and $R^{17}$ each represents a hydrogen atom, an alkyl group, or an aryl group; and k is either 0 or 1;

Formula (III)

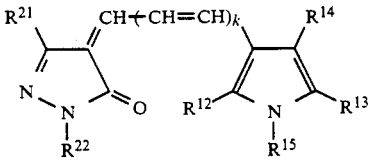

where $R^{21}$ represents a hydrogen atom, an alkyl group, an aryl group, —$COOR^{23}$, —$COR^{23}$, —$CONR^{23}R^{24}$, —CN, —$OR^{23}$, —$NR^{23}R^{24}$, or —$N(R^{23})COR^{24}$; $R^{22}$ represents a hydrogen atom, an alkyl group, or an aryl group; or a heterocyclic group, each of $R^{12}$, $R^{13}$, $R^{14}$ and $R^{15}$ has the same meaning as in formula (II); each of $R^{23}$ and $R^{24}$ represents a hydrogen atom, an alkyl group, an aryl group; and k is either 0 or 1;

Formula (IV)

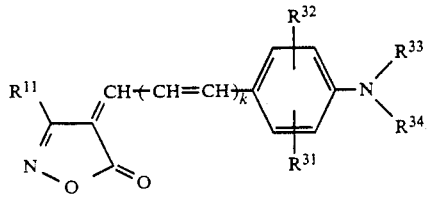

where $R^{11}$ has the same meaning as in formula (II); each of $R^{31}$ and $R^{32}$ represents a hydrogen atom, a halogen atom, an alkyl group, —$OR^{35}$, or —$COOR^{35}$; each of $R^{33}$ and $R^{34}$ represents a hydrogen atom, an alkyl group, or an aryl group; $R^{33}$ and $R^{34}$ may form a 5- or 6-membered ring; $R^{32}$ and $R^{33}$, and $R^{31}$ and $R^{34}$ respectively can combine with each other to form a 5- or 6-membered ring; $R^{35}$ represents a hydrogen atom, an alkyl group, or an aryl group; and k is either 0 or 1;

Formula (V)

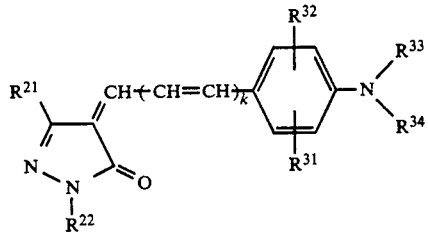

where $R^{21}$ and $R^{22}$ have the same meanings as in formula (III), respectively; $R^{31}$, $R^{32}$, $R^{33}$ and $R^{34}$ have the same meanings as in formula (IV), respectively; and k is either 0 or 1;

Formula (VI)

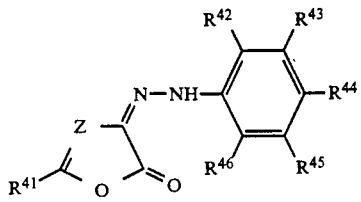

where Z represents a nitrogen atom or a methine group; $R^{41}$ represents a hydrogen atom, an alkyl group, an aryl group or a heterocyclic group; $R^{42}$, $R^{43}$, $R^{44}$, $R^{45}$, and $R^{46}$ each represents a hydrogen atom, a halogen atom, an alkyl group, an aryl group, —$OR^{47}$, —$COOR^{47}$, —$COR^{47}$, —$CONR^{47}R^{48}$, —$SO_2NR^{47}R^{48}$, —$NR^{47}R^{48}$, —$SO_2NHCOR^{47}$, —$SO_2NHSO_2R^{47}$, —$CONHCOR^{47}$, —$CONHSO_2R^{47}$, —$N(R^{47})SO_2R^{48}$, or —$N(R^{47})COR^{48}$; $R^{47}$ and $R^{48}$ each represents a hydrogen atom, an alkyl group, an aryl group or a heterocyclic group.

4. The light-sensitive material according to claim 3, wherein said dye of the formula (I) is represented by the formula (II).

5. The light-sensitive material according to claim 1, wherein said coupler of the formula (1) or (2) is represented by the following formula (3), (4) or (5):

Formula (3)

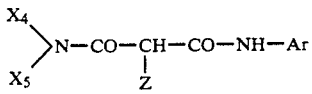

Formula (4)

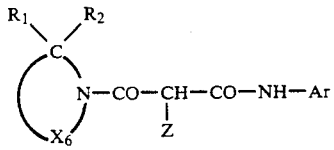

Formula (5)

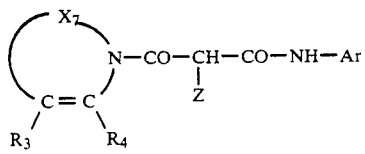

where Z has the same meaning as in the formula (1); $X_4$ represents an alkyl group; $X_5$ represents an alkyl group, or an aromatic group; Ar represents a phenyl group having at least one substituent group at the ortho position; $X_6$ represents an organic group which forms a nitrogen-containing heterocyclic group together with $—C(R_1R_2)—N<$; $X_7$ represents an organic group which forms a nitrogen-containing heterocyclic group together with $—C(R_3)=C(R_4)—N<$; and $R_1$, $R_2$, $R_3$ and $R_4$ each represents a hydrogen atom or a substituent group.

6. The light-sensitive material according to claim 6, wherein said coupler of the formula (1) or (2) is represented by the formula (4) or (5).

7. The light-sensitive material according to claim 5, wherein said coupler of the formula (1) or (2) has a photographically non-useful group as the split-off group represented by Z, and is used in the blue-sensitive silver halide emulsion layer or a non-light-sensitive layer adjacent thereto, in an amount of $2–1.0\times10^{-3}$ mol per mol of silver halide in the blue-sensitive silver halide emulsion layer.

8. The light-sensitive material according to claim 5, wherein said coupler of the formula (1) or (2) releases or splits off a photographically useful group, and is used in a light-sensitive silver halide emulsion layer or a layer adjacent thereto, in an amount of $0.5–1\times10^{-6}$ mol per mol of silver halide in a light-sensitive silver halide emulsion layer.

9. The light-sensitive material according to claim 5, wherein said coupler of the formula (1) or (2) releases or splits off a photographically useful group which is a group having a development-inhibiting property or a precursor thereof.

10. The light-sensitive material according to claim 1, wherein said acylacetamide type coupler having an acyl group represented by the formula (Y) is represented by the following formula (Ya):

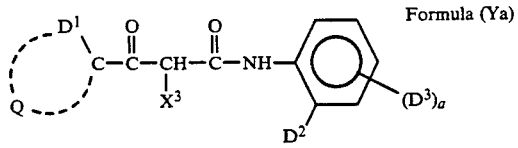

where $D^1$ represents a monovalent substituent group except for hydrogen; Q represents a non-metallic atomic group required to form, together with the C, either a 3- to 5-membered hydrocarbon ring, or a 3- to 5-membered heterocyclic group containing at least one hetero atom selected from N, S, O, and P; $D^2$ represents a hydrogen atom, a halogen atom, an alkoxy group, an aryloxy group, an alkyl group, or an amino group; $D^3$ represents a group which can be substituted on the benzene ring; $X^3$ represents a hydrogen atom or a group which can be split off upon coupling reaction with an oxidized form of an aromatic primary amine developing agent; and R represents an integer from 0 to 4.

11. The light-sensitive material according to claim 1 wherein said acylacetamide type coupler having an acyl group represented by the formula (Y) is represented by the following formula (Ya):

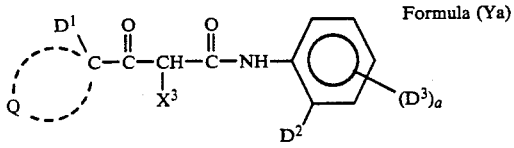

where $D^1$ represents a monovalent substituent group except for hydrogen; Q represents a non-metallic atomic group required to form, together with the C, either a 3- to 5-membered hydrocarbon ring, or a 3- to 5-membered heterocyclic group containing at least one hetero atom selected from N, S, O, and P; $D^2$ represents a hydrogen atom, a halogen atom, an alkoxy group, an aryloxy group, an alkyl group, or an amino group; $D^3$ represents a group which can be substituted on the benzene ring; $X^3$ represents a hydrogen atom or a group which can be split off upon coupling reaction with an oxidized form of an aromatic primary amine developing agent; and a represents an integer from 0 to 4.

* * * * *